US012392557B2

(12) United States Patent
Seidel

(10) Patent No.: US 12,392,557 B2
(45) Date of Patent: Aug. 19, 2025

(54) PLATE OF PLATE HEAT EXCHANGERS

(71) Applicant: Pessach Seidel, Ilit (IL)

(72) Inventor: Pessach Seidel, Ilit (IL)

( * ) Notice: Subject to any disclaimer, the term of this patent is extended or adjusted under 35 U.S.C. 154(b) by 462 days.

(21) Appl. No.: 16/972,810

(22) PCT Filed: Jun. 7, 2019

(86) PCT No.: PCT/IL2019/050659
§ 371 (c)(1),
(2) Date: Dec. 7, 2020

(87) PCT Pub. No.: WO2019/234756
PCT Pub. Date: Dec. 12, 2019

(65) Prior Publication Data

US 2021/0247143 A1 Aug. 12, 2021

Related U.S. Application Data

(60) Provisional application No. 62/838,332, filed on Apr. 25, 2019.

(30) Foreign Application Priority Data

Jun. 7, 2018 (IL) ..... 259897
Jul. 25, 2018 (IL) ..... 260785
(Continued)

(51) Int. Cl.
*F28D 9/00* (2006.01)
*F28F 3/04* (2006.01)
*F28F 3/06* (2006.01)

(52) U.S. Cl.
CPC ..... *F28D 9/005* (2013.01); *F28D 9/0056* (2013.01); *F28F 3/046* (2013.01); *F28F 3/06* (2013.01); *F28F 2275/00* (2013.01)

(58) Field of Classification Search
CPC ..... F28D 9/005; F28D 9/0031; F28D 9/0037; F28D 9/0043; F28F 2215/04; F28F 3/025; F28F 3/083
See application file for complete search history.

(56) References Cited

U.S. PATENT DOCUMENTS 3,262,495 A * 7/1966 Baird ..... F28D 1/0316 165/DIG. 447
3,661,203 A * 5/1972 Mesher ..... F28F 3/083 165/DIG. 362
(Continued)

FOREIGN PATENT DOCUMENTS

EP 0477346 A1 4/1992
EP 1933105 A1 6/2008
(Continued)

OTHER PUBLICATIONS

Extended European Search Report for European U.S. Appl. No. 22/176,249, dated Apr. 19, 2023, 16pp.
(Continued)

*Primary Examiner* — Jianying C Atkisson
*Assistant Examiner* — For K Ling
(74) *Attorney, Agent, or Firm* — The Roy Gross Law Firm, LLC; Roy Gross

(57) ABSTRACT

The present invention discloses an improve plate for plate heat exchangers (PHE) which its parameters are tailor-made to be utilized in industrial operation comprising various set of at least one first fluid and at least one second fluid having different physical and chemical characteristics and hence requires different two or more sets of PHE-related parameters. The invention also discloses method of using and manufacturing the same.

13 Claims, 89 Drawing Sheets

(30) Foreign Application Priority Data

Sep. 9, 2018 (IL) ..... 261690
Oct. 11, 2018 (IL) ..... 262330

(56) References Cited

U.S. PATENT DOCUMENTS 3,847,211 A * 11/1974 Fischel ..... B01D 53/22 165/70
4,470,453 A * 9/1984 Laughlin ..... F28D 9/0012 165/DIG. 384
4,781,248 A * 11/1988 Pfeiffer ..... F28F 3/083 165/166
4,915,165 A * 4/1990 Dahlgren ..... F28F 3/046 165/166
5,462,113 A 10/1995 Wand
6,016,865 A 1/2000 Blomgren
6,190,624 B1 * 2/2001 Romatier ..... F28D 9/0037 422/219
7,044,206 B2 * 5/2006 Sabin ..... F28F 3/046 165/166
2003/0024697 A1 * 2/2003 Matsuzaki ..... F28D 9/0037 29/890.03
2004/0069473 A1 * 4/2004 Blomgren ..... F28F 3/04 165/167
2005/0274501 A1 * 12/2005 Agee ..... F02M 26/22 165/146
2006/0115393 A1 * 6/2006 Reinke ..... C01B 3/382 422/198
2007/0000654 A1 * 1/2007 Matsuzaki ..... F28F 3/04 165/167
2008/0210414 A1 * 9/2008 Blomgren ..... F28D 9/005 165/166
2015/0224850 A1 * 8/2015 Bank ..... B60H 1/00507 392/340
2016/0202004 A1 * 7/2016 Cooper ..... F28F 13/08 165/10
2017/0102193 A1 * 4/2017 Atkinson ..... F28F 3/046
2017/0131041 A1 * 5/2017 Blomgren ..... F28F 3/08

FOREIGN PATENT DOCUMENTS

JP 2009174841 A 8/2009
WO 2017167598 A1 10/2017

OTHER PUBLICATIONS

PCT International Search Report for International Application No. PCT/IL2019/050659, mailed Sep. 25, 2019, 6pp.
PCT Written Opinion for International Application No. PCT/IL2019/050659, mailed Sep. 25, 2019, 9pp.

* cited by examiner

Non-Phase shifted assembly

Zig Zag Non Phase Shifted

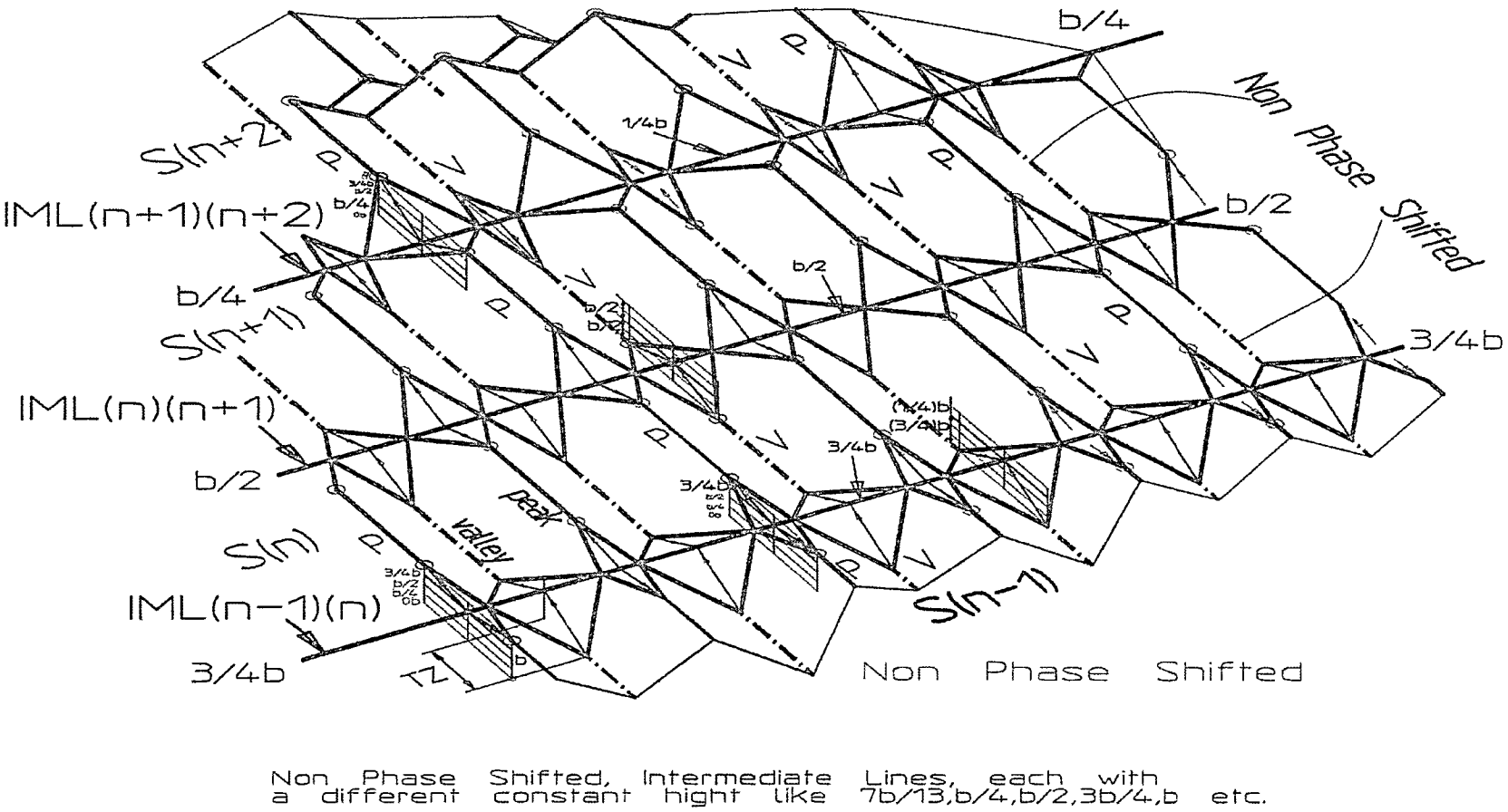
Non Phase Shifted
b/4
b/2
3/4b
SL(n+2)
IML(n+1)(n+2)
b/4
SL(n+1)
IML(n)(n+1)
b/2
SL(n)
IML(n-1)(n)
3/4b
peak
valley
a
7
1/4b
b/2
3/4b
(b/4)b
(3/4)b
b/4
b/2
3/4b
b/2
b/4
3/4b
b/2
b/4
3/4b
b/2
b/4

Seperating and Middle Plates
Channels with 2 Plates and MORE

Phase Shifted Assembly Cuts A-A and D-D

Non Standard Segment Geometry – a Surface between two IML Intermedite Lines

Two Standard Segments Assembly (sample of one of many ways)
For Shifted and non Shifted Assemblies see Drawings 316B +316C Three Segments Assembly (sample of one of many ways)
For Shifted and non Shifted Assemblies see Drawings 316B +316C A Way to Posses Independently the Window Height or/and the IML Height for Each Fluid and for each Segment and for each place in a particular Segment (a sample: h(Win)1=h(Win)2=b/4)

Possible possition of the IML is at any height between 0 and b

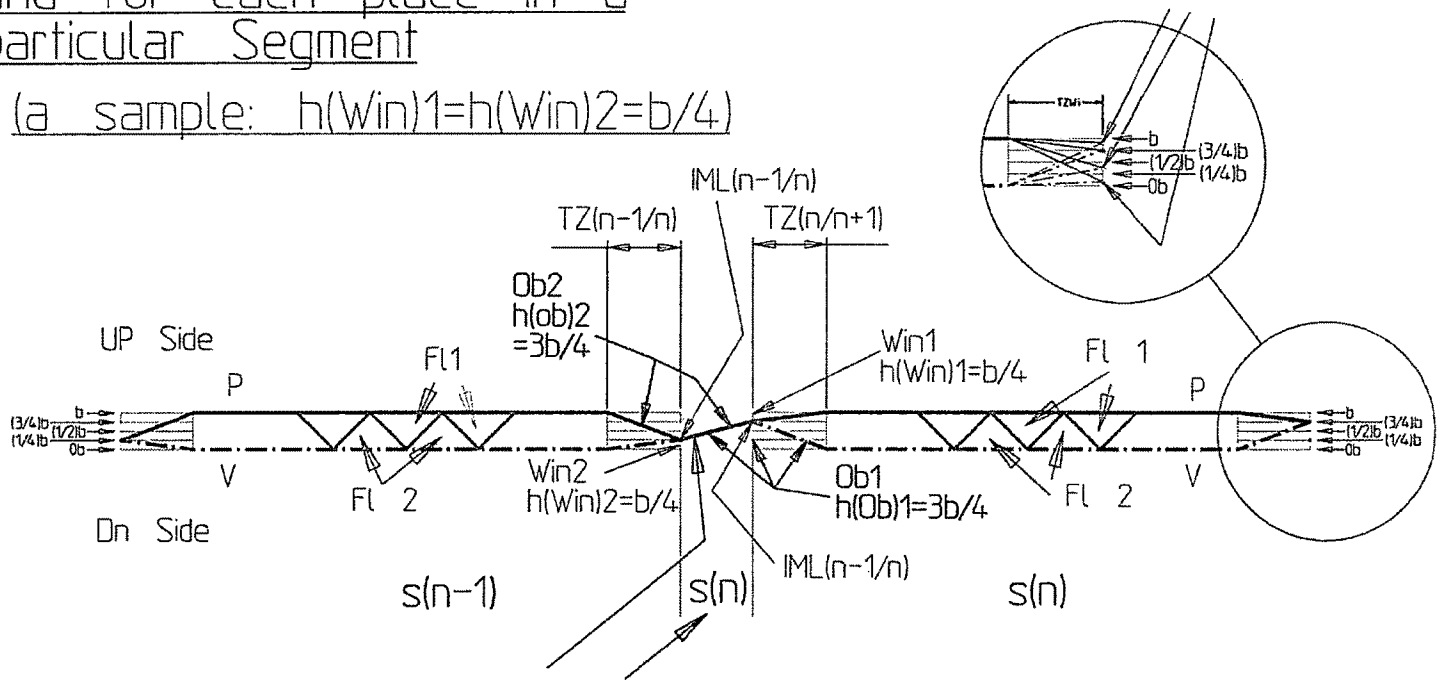

a Surface non standard segment

Fig. 26E

Three Segments Assembly (sample of one of many ways)
For Shifted and non Shifted Assemblies see Drawings 316B +316C Low Wavy Area Segment Assembly Not Phase Shifted and Phase Shifted, Intermediate Lines, each with at least one hight outof all different hights, like b/4,b/2,3b/4,etc.

STEAM TO STEAM Heat Exchanger
With Conic Paths

Fluid 1 in channel 1 with lower pressure drop and heat transfer coefficients
Fluid 2 in channel 2 with higher pressure drop and heat transfer coefficients

FLUID 1 FLOWS AT THE BEGINNGE OF THE NEXT SEGMENT

FLUID 1 AT THE END OF THE SEGMENT MEETS THE BARRIER AND WINDOWS

FLUID 1 FLOWS IN THE MODLE OF THE SEGMENT

FLUID1 AND FLUID 2 FLOW IN SEGMENT CHANNELS

FLUID 1 IN CHANNEL 1 WITH LOWER PRESSURE DROP AND HEAT TRANSFER COFFICIENTS

FLUID 2 IN CHANNEL 2 WITH HIGHER PRESSURE DROP AND HEAT TRANSFER COFFICIENTS

Some Possible Boundry Geometry number 6
to High and Low Cross Sectional Area Channels The two plates can be different from each other in drawing thickness, Geometric shape, wave width, cross sectional area, Peripery, sheet thicness and more Some Possible Boundry Geometry to High and Low Cross Sectional Area Channels The two plates can be different from each other in drawing thickness b, Geometric shape, wave width, cross sectional area, Peripery, sheet thicness and more Two plates with differet cross sectional area and with Phase Shifted Sections High and Low Cross Sectional Area Channels Geometry 3

High and Low Cross Sectional Area Channels Geometry 4

Gas/Liquid or Evaporator Or Condenser PHE

PLATE OF PLATE HEAT EXCHANGERS

CROSS-REFERENCE TO RELATED APPLICATIONS

This application is claiming priority from IL 259897 dated Jul. 6, 2018; IL 260785 dated 25 Jul. 2018; IL 261690 dated Sep. 9, 2018; IL 262330 dated Nov. 10, 2018 and U.S. 62/838,322 dated 25 Apr. 2019; the disclosures of which are all hereby incorporated herein by reference.

FIELD OF THE INVENTION

The present invention relates to the field of a plate of plate heat exchangers.

BACKGROUND OF THE INVENTION

Heat exchangers are used to facilitate the transfer of thermal energy between fluids without direct contact. A plate heat exchanger (PHE) is a heat exchanger which is comprised of a series of corrugated plates which are stacked together in such a way that facilitate heat transfer between a first fluid flowing through a first pair of plates and a second fluid flowing through a second pair of plates, such that one of the plates is common to both the first and second pairs. Many plate heat exchangers have plates that are each patterned with alternating protrusions and trenches in such a way that protrusions of a first plate abut corresponding protrusions of a second plate to define an interspace therebetween through which a heat transfer facilitating fluid flows, see e.g., U.S. Pat. No. 4,915,165; US 2016/0341484; US 2014076527. IL patent application No. IL259897 is incorporated herein as a reference. The first and second fluids flow along a path which is either co-current or counter-current in relation to each other.

Some of the heat exchanger corrugated plates have wave-like corrugation patterns, such as a herringbone pattern, which improve their heat transfer capability at the expense of pressure drop. These patterns are symmetrical in nature in terms of plate length, width and depth dimensions. When plates of this nature are stacked together, the flow channels formed are identical in shape, so that all resulting flow paths are equal between the two flowing fluids.

PHE is designed to maximize heat transfer coefficient and minimize flow resistance. A high heat transfer rate allows a reduced heat exchange surface area to be used, leading to a lower cost of the heat exchanger as a result of its smaller size. A low flow resistance results in a reduction in the required size of the pumps delivering the heat exchanging fluids and a reduction in the required pumping power, leading to reduced equipment and operational costs.

It is a long felt need to have such an improve PHE which its parameters are tailor-made to be utilized in industrial operation comprising various set of at least one first fluid and at least one second fluid having different physical and chemical characteristics and hence requires different two or more sets of PHE-related parameters.

SUMMARY OF THE INVENTION

The present invention hence discloses a plate for a PHE. The plate is characterized by length X (hereinafter "main longitudinal axis", directed North), width y (transverse axis) and height Z; upwards surface (UP) and opposite surface (DOWN). The plate is corrugated with an array of protruding peaks and depressed valleys. Upper peaks & valleys and Down peaks & valleys are denoted hereto after as P', V', P" and V", respectively. P' substantially lies on a single plane denoted as (upper-) peak plane. V" substantially lies on a single plane denoted as (down-) valley plane, Heights are measured from the valley plane. Distances between P' and V' and between P" and V" are denoted as drawing depth b' and b", respectively. Metal sheet thicknesses between P' plane P" or between V' and V" are all denoted as t. Plate thickness equals t+b'=b=t+b". Lower peaks, namely LP' are equal to or lower along Z axis than peaks P'. Lower peaks, namely LP" are equal to or lower along Z axis than peaks P". High valleys, namely HV', are equal to or higher along Z axis than valleys V'. High valleys, namely HV", are equal to or higher along Z axis than valleys V". Plate n is stackable along Z axis with adjacent plates (n−1, lower plate) and (n+1, upper plate), n is an integer number.

When stacked, peaks P' of plate (n−1) abut (support) valleys V" of plate (n) and peaks P' of plate (n) abut valleys V" of plate (n+1). Again, when stacked and between two adjacent plates, an interspace (channel) is provided for fluid flow, channel maximal height equals to or lower than b'+b". Channels are sealed by a gasket or by welding, brazing, 3D printing or any other sealing technique. Each channel comprises at least one inlet and at least one outlet port, provided by holes in the plate or through spaces without sealing in between two adjacent plates. Further again, when stacked, fluid 1 flows above and fluid 2 flows below plate n, respectively. Fluid 2 flows above plate (n−1) and fluid 1 flows below plate (n+1) and (n−1); heat transfer zone or heat transfer area comprises all plate area through which fluid 1 is in indirect contact with fluid 2. Heat transfer area of a plate comprises segments S(n−1), S(n), S(n+1), n being an integer number. Adjacent segments defined above share a common Intermediate Line (IML, Border Line, Obstacle Line, ObL).

The projection of border lines onto the XY Valleys plane are denoted as Segmentation Lines. Segmentation lines take any shape, including straight lines, zigzags, curved lines, continuous or discontinuous in the Valleys plane, allowing for any shape, size or orientation to North for the segments. Shapes of the segments are selected, e.g., from a group consisting of rectangular segments substantially parallel to the East-West axis, array of triangular segments substantially oriented to the South West-North East axis, array of curved segments or zigzagged segments, all in any shapes, size and orientation to the North.

A Segmentation Surface between two adjacent segments is the surface perpendicular to the XY plate plane and contains all the points above the segmentation line, between the valleys plane and the peaks plane. An IML between the adjacent segments is contained in the segmentation surface.

Standard Segments are denoted below for a segment consisting of the following members: (i) a High Wavy Zone (HWZ); (ii) one or more border lines (IML) with adjacent segments or adjacent non-heat-transfer members including gaskets, inlets and outlets; and (iii) one or more Transfer Zones or Transition Zones (TZ) interconnecting the HWZ to the IMLs.

Nonstandard Segments are denoted below for segments consisting two or less of the members. Nonstandard segments may comprise a Low Wavy Zone (LWZ). HWZ comprises high waves of alternating peak lines and valley lines in which each adjacent peak-valley-peak (P'-V'-P') forms a flow path for the fluid flowing in the interspace above the plate and in which each adjacent valley-peak-valley (V"-P"-V") forms a flow path for the fluid flowing in the interspace under the plate. Peak lines and valley lines are directed to any predefined orientation, including e.g., being substantially parallel, substantially perpendicular and in at least one portion oriented to different directions from at least one other portion. Peak lines can take any shape, including shapes selected from a group consisting of straight line, zigzag, curved line, polygonal shapes, at least partially curved shapes.

Adjacent peak and valley lines are, e.g., evenly spaced with a predefined peak-to-peak Wavelength (a) and/or arbitrarily spaced. Waves are oriented in any predefined orientation to the North and/or to the IML. HWZs are provided both as support between adjacent plates and for guiding the fluids along a segment at a predefined angle towards an IML. HWZ length is varied, e.g., from short length, providing for high pressure drop and high heat transfer coefficient, and respectively longer length, providing for low pressure drop and lower heat transfer coefficient.

An IML together with the two transition zones adjacent to it form an obstacle at least partially blocking the flow above and/or below the plate. Area of the IML together with the two transition zones is denoted as the Obstacle Zone (ObZ). Unblocked cross-section of a flow path in the IML is denoted below as Window. Obstacle height plus the window height equals the drawing depth b'=b". In a flow path above the plate (P'-V'-P'), obstacle starts at lower height V' and rises to IML, 0<=h(IML)<=b. In a flow path below the plate (V"-P"-V"), obstacle starts at higher height P" and falls to IML, 0<=h(IML)<=b. IMLs is of shape in the segmentation surface, selected e.g., from a group consisting of a straight line at constant height, zigzag, curved line. At least one portion of the IMLs is potentially oriented differently as compared to a second portion, including vertical inclination, homogenously tilted inclination and heterogenous inclination. The term "about" refers to a value being greater or smaller than 25% of the defined measure.

The plate is further characterized by a configuration selected from the following: For the transition zones (TZ), interconnecting HWZ and IML, the portion connecting a peak or valley to the IML rises in an angle ranging from a steep, substantially up to about 90 degrees, medium inclination including about 45 degrees to a gradually inclining angle including about 30 degrees and about 15 degrees. In case of substantially up to about 90 degrees, the transition zone length substantially equals to t+rounding radius measuring about t=1.5t=b/2. Thereby in the case two adjacent transition zones have total length of about b. In case of a gradually inclining angle, e.g. 15 degrees, length(TZ)>=2b. Segment S(n) is interconnectable with S(n−1) and/or S(n+1) and the adjacent segment share a mutual IML; IML(n/n+1) and IML(n/n−1) are either identical or different. For each of IML(n/n+1) and IML(n/n−1), at least one first TZ is either identical or different from at least one second TZ. As each of the segments comprises the three members (HWZ, IMLs, TZs), if all the three members are identical two segments are equal and otherwise, if at least one of the members is different, the segments are different. Along a sequence of three or more segments, either at least one first portion of the sequence is identical to at least one second portion and otherwise all portions of the sequence are different; the difference can form a pattern where at least one portion of the sequence of the segments repeats in other portions, either periodically or a-periodically. The HWZ of segment S(n) comprises waves which are at any angle relative to IML(n/n+1), including substantially parallel to the North, and the angle for the waves of the HWZ of adjacent segment S(n+1) is either identical or different from the angle of segment S(n).

Segments either have identical or different wavelengths (a, $a_i$) Two adjacent segments S(n) and S(n+1) are interconnected in such a way that both terminations of valley lines in the HWZs of S(n) and S(n+1) lie on the same horizontal perpendicular line to IML(n/n+1), facing each other. Additionally, or alternatively, both terminations of peak lines in the HWZs of S(n) and S(n+1) lie on a same horizontal perpendicular line to IML(n/n+1), facing each other. In such a case the fluid flowing from a flow path in one HWZ towards the IML passes an obstacle and continues into the facing flow path in the HWZ on the other side of the IML, either with or without a change in flow direction. A phase shift is provided between adjacent segments by shifting one of the adjacent segments with respect to the second the segment by a phase shift offset (PH), which is positive or negative, leftward or rightward with respect to the flow direction, at an absolute value greater than or equal to 0 (no shift), lower than or equal to the wavelength a, or any other predefined value. Phase shift offset between adjacent segments are either identical or different. For a phase shift of PH~a/2 between segment S(n) and segment S(n+1), a flow path for fluid flowing above the plate (P'V'P') in segment S(n) faces a maximal obstacle (V'P'V') in segment S(n+1), where the valley line V' of segment S(n) faces peak line P' of segment S(n+1). Obstacle V'P'V' provides two triangular windows of height b/2, with a left Saddle Point (M) and a right saddle point (M) lying on IML(n/n+1) with left window tracing the line P'(n)MP'(n+1) from left to right and a right window tracing the line P'(n+1)MP'(n) from left to right. Fluid flowing above the plate in flow path P'(n)V'(n)P'(n) splits into two flow paths in S(n+1), one to the left and one to the right, providing, e.g., by means of micro-channels, increased mixing as well as a left vortex and a right vortex respectively. Cross-section area of each the window is about a quarter of the cross-section of the flow path's original cross-section P'(n)V'(n)P'(n); transfer zones between S(n) and S(n+1) interconnect their respective HWZs to IML(n/n+1). HWZ of segment S(n) comprises waves which are at any angle relative to IML(n/n+1), including substantially parallel to the North, and the angle for the waves of the HWZ of adjacent segment S(n+1) is either identical or different from the angle of segment S(n).

HWZs comprise a geometry of high waves of alternating peak lines and valley lines, providing a plurality of separated flow paths for a fluid flowing above the plate and a plurality of separate flow paths for a fluid flowing below the plate. Flow direction is guided by the HWZ geometry along a predefined angle or angles relative to the North. Flow is guided towards an obstacle line (IML) between adjacent segments, with flow direction of the arriving fluid meeting the IML at any angle. Flow paths in HWZs of two adjacent segments either guide the flow in an identical direction or in a different direction, in which case additional vorticity is provided due to the change in flow direction upon passing the IML. HWZs also provide support along lines of abutment providing for increased support resulting in an increased ability of the plate stack to withstand pressure and thus a thinner metal sheet thickness. The geometry provide an uninterrupted continuous helical flow in which the fluid does not need to accelerate from zero along the path, so pressure drop is due mainly to friction losses of the fluid and the walls, which results in an increased heat transfer coefficient and a reduced pressure drop.

In some embodiments of the invention, IML in each flow path is parallel to the plate xy plane. In a flow path above the plate, the transfer zone begins at a point V' and rises to a height 0<=h(IML)<=b/2 and in a flow path below the plate, the transfer zone begins at a point P" and falls to a height b/2<=h(IML)<=b. Two portions of the IML belonging to two adjacent flow paths sharing a common wall (P'-V' for flow above the wall and P"-V" for flow below the wall) are interconnected by another portion of the IML lying on the wall. Since portions of the IML lie on the wall of a flow path of one segment, the portions must also approximately lie on a wall of a flow path of the adjacent segment and hence the walls of the flow paths from both sides of the IML are approximately continuous.

In another set of embodiments of the invention, IML is substantially parallel to the plate XY plane at a constant height; h(Ob1)+h(Ob2)=b'=b" and h(win1)+h(win2)=b'=b" where h(Ob1) is the height of an obstacle blocking the flow above the plate, h(Ob2) is the height of an obstacle blocking the flow above the plate, h(win1) is the height of a window for flow above the plate and h(win2) is the height of a window for flow below the plate;

In another set of embodiments of the invention, IML is drawn as much as possible beyond the mid-plate height b/2 so as to block as much cross-section as possible for both flow paths above and below the plate; the IML thereby arcs in the segmentation surface above and below mid-plate height b/2 with points lying on flow path walls at height approximately b/2.

In another set of embodiments of the invention, HWZ structure wavelength (a) is lower than 5 mm.

In another set of embodiments of the invention, an independent window height 0<=h(win1)<=b for the fluid flowing above the plate and 0<=h(win2)<=b for the fluid flowing below the plate is provided. The solution is optimal for heights b/2<=h(win1)<=b and b/2<=h(win2)<=b. Such as at least one of the following is being held through:

Firstly, three segments S(n−1), S(n), S(n+1) in between which both IMLs are straight lines of constant height h(IML(n−1/n))=Q and h(IML(n/n+1))=R; IML(n−1/n) provides a window of height h(win1(n−1/n))=b−Q for fluid flowing above the plate and a window of height h(win2(n−1/n))=Q for fluid flowing below the plate; IML(n/n+1) provides a window of height h(win1(n/n+1))=b−R for fluid flowing above the plate and a window of height h(win1(n/n+1))=R for fluid flowing below the plate; both fluids flowing above and below the plate are mainly affected by the smaller window of the two, being min{b−Q, b−R} for fluid flowing above the plate and min{Q, R} for fluid flowing below the plate.

Secondly, the amount of turbulence and pressure drop is selected independently for the fluid below and the fluid above by setting the values of Q and R.

In another set of embodiments of the invention, a method for providing an independent window height between two standard segments S(n−1) and S(n+1) is provided. This method is provided useful to enable an insert a nonstandard segment S(n) which does not comprise a HWZ between them. IML(n−1/n) and IML(n/n+1) are straight lines of constant height h(IML(n−1/n))=Q and h(IML(n/n+1))=R. Nonstandard segment S(n) interconnects the IMLs. IML(n−1/n) provides a window of height h(win1(n−1/n))=b−Q for fluid flowing above the plate and a window of height h(win2(n−1/n))=Q for fluid flowing below the plate. IML (n/n+1) provides a window of height h(win1(n/n+1))=b−R for fluid flowing above the plate and a window of height h(win1(n/n+1))=R for fluid flowing below the plate. Both fluids flowing above and below the plate are mainly affected by the smaller window of the two, being min{b−Q, b−R} for fluid flowing above the plate and min{Q, R} for fluid flowing below the plate. In other words, for the fluid flowing above the plate in segment S(n−1), an obstacle is provided starting at V', rising to height h(IML(n−1/n)))=Q, then descends through height h(IML(n/n+1))=R back to height 0 at a valley V' of segment S(n+1). For the fluid flowing below the plate in segment S(n+2), an obstacle is provided starting at P", falling to height h(IML(n/n+1)))=R, then rising through height h(IML(n−1/n))=Q back to height b at a peak P" of segment S(n−1).

In another set of embodiments of the invention, distance between HWZs of two adjacent segments is as short as about the plate thickness b. in other words, the obstacle zone width between the segments, equaling the sum of lengths of the two TZs which it comprises, is as short as about the plate thickness b; since support between plates is not needed in such small distances, an Extra Low Wavy Zone (ELWZ) or Extra Low Wavy Area (ELWA) is provided useful for being inserted in between the two TZs. ELWZ is in a nonstandard segment S(n), now lying between standard segments S(n−1) and S(n+1). ELWZ is characterized by waves with taking any shape, wavelength, direction and amplitude while lying between the peak plane and valley plane. ELWA waves are either evenly spaced or irregularly spaced, leaving any vertical space, also denoted by window, between the ELWZ low peaks and the peak plane, or between the ELWZ high valleys and valley plane; waves in the ELWZ are either identical in direction and/or amplitude or different from one another in direction and/or amplitude; an x-y center plane around which the waves oscillate is either constant in height or varying in any direction. ELWZ comprises protrusions rising to peak plane height b and depressions falling to valley plane height 0 taking any shape. The protrusions and depressions in the ELWZ provide extra support. When ELWZ waves have LP lines and HV lines taking a zigzag form, such points of support are found where the lines zigzag. The plate of the invention, wherein the distance between HWZs of two adjacent segments is as short as about the plate thickness b; in other words, the obstacle zone width between said segments, equaling the sum of lengths of the two TZs which it comprises, is as short as about the plate thickness b; since support between plates is not needed in such small distances, an Extra Low Wavy Zone (ELWZ) or Extra Low Wavy Area (ELWA) can be inserted in between said two TZs; said ELWZ is in a nonstandard segment S(n), now lying between standard segments S(n−1) and S(n+1); said ELWZ is characterized by waves with taking any shape, wavelength, direction and amplitude while lying between the peak plane and valley plane; ELWA waves are either evenly spaced or irregularly spaced, leaving any vertical space, also denoted by window, between said ELWZ low peaks and the peak plane, or between said ELWZ high valleys and valley plane; waves in said ELWZ are either identical in direction and/or amplitude or different from one another in direction and/or amplitude; an x-y center plane around which said waves oscillate is either constant in height or varying in any direction; when said center of oscillation decreases or increases along said segment, a change in cross-section is provided along said segment; in areas where said center of oscillation is higher along z axis, fluid flowing above said plate has a larger cross-section and fluid flowing below said plate has a smaller cross-section in areas where said center of oscillation is lower along z axis, fluid flowing above said plate has a higher cross-section and fluid flowing below said plate has a larger cross-section; in areas where said center of oscillation is lower along z axis, fluid flowing above said plate has a higher cross-section and fluid flowing below said plate has a larger cross-section; ELWZ comprises protrusions rising to peak plane height b and depressions falling to valley plane height 0 taking any shape; said protrusions and depressions in said ELWZ provide extra support; when ELWZ waves have LP lines and HV lines taking a zigzag form, such points of support are found on said lines in every second change of angle; peak points in one peak line and valley points in an adjacent valley line lie on the same line when projected onto the valley plane, and approximately straight lines connecting said peak point of support and an adjacent valley point of support proved extra support for said ELWZ; ELWZ amplitude is either identical along the segment S(n) or changing along said segment In another set of embodiments of the invention, waves in said HWZ are asymmetric in shape with respect to an x-y plane of height b/2; cross-section area A1 for flow paths of a fluid flowing above the plate is different in shape and/or size from cross-section area A2 for flow paths of a fluid flowing below said plate; said cross-section areas A1 and A2 can be identical in shape and or/size or different for different flow paths along the segment. when three such plates p1, p2 and p3 are stacked together, p2 rotated by 180 degrees about z axis with respect to p1 and p3, flow paths between plates p2 and p3 will be equal in cross-section shape to flow paths between plates p1 and p2 since each such flow path comprises one said A1 shape and one said A2 shape; when three such plates q1, q2 and q3 are stacked together where q1 is the lowest of the three and q3 the highest, where q2 is rotated by 180 degrees about y axis with respect to q1 and q3, and said three plates are aligned horizontally so that support is provided, each flow path for fluid flowing between plates q1 and q2 will comprise of two A1 shapes and each flow path for fluid flowing between plates q2 and q3 will comprise of two A2 shapes;

In another set of embodiments of the invention, distance waves in said HWZ are asymmetric in shape with respect to an x-y plane of height b/2; cross-section area for a first flow path of a fluid flowing above the plate (P'V'P') is different in shape and/or size from the cross-section area of a second flow path of a fluid flowing below said plate (V"P"V") sharing a common wall with said first flow path; said cross-section areas can be identical in shape and or/size or different for different flow paths along the segment; when three such plates q1, q2 and q3 are stacked together where q1 is the lowest of the three and q3 the highest, where q2 is rotated by 180 degrees about y axis with respect to q1 and q3, and said three plates are aligned horizontally so that support is provided, a first flow path for fluid flowing above plate q1 meets a second flow path of q2 where said first and said second flow path cross-sections are mirror images of each other and a third flow path for fluid flowing below plate q3 meets a fourth flow path of q2 where said third and said forth flow path cross-sections are mirror images of each other; adjacent segments are phase-shifted by an offset of absolute value greater than or equal to 0 (no shift), lower than or equal to the wavelength a, or any other predefined value; when said offset between segments S(n) and S(n+1) is equal to about a/2, and the channel q1 and q2 has larger cross section than the channel between plates q2 and q3, flow along a flow path of segment S(n) with larger cross section between plates q1 and q2 is partly blocked by the shifted smaller cross-section shape in the next segment S(n+1), providing a left window and a right window characterized by a large window height and a high obstacle in both the upper plate q2 and lower plate q1; flow along a flow path of segment S(n+1) with smaller cross section between q2 and q3 is partly blocked by the shifted smaller cross-section shape in segment S(n), providing a left window and a right window characterized by a small window height and a high obstacle in both the upper plate q3 and lower plate q2; by inserting a nonstandard segment with straight-line IMLs parallel to x-y plane on both sides between two said segments where each IML is of a different height, for the channel with larger cross section between plates q1 and q2 results in increased heat transfer for the larger cross-section channel.

BRIEF DESCRIPTION OF THE FIGURES

In order to better understand the invention and its implementation in practice, a plurality of embodiments will now be described, by way of non-limiting example only, with reference to the accompanying drawings, wherein FIG. 1 schematically illustrates a perspective view of a PHE plate according to several embodiments of the invention;

FIGS. 16A-D schematically illustrates a segment in which the high wavy zone comprises a single low peak and a single high valley according to several embodiments of the invention;

DETAILED DESCRIPTION OF THE INVENTION

Figure 1:
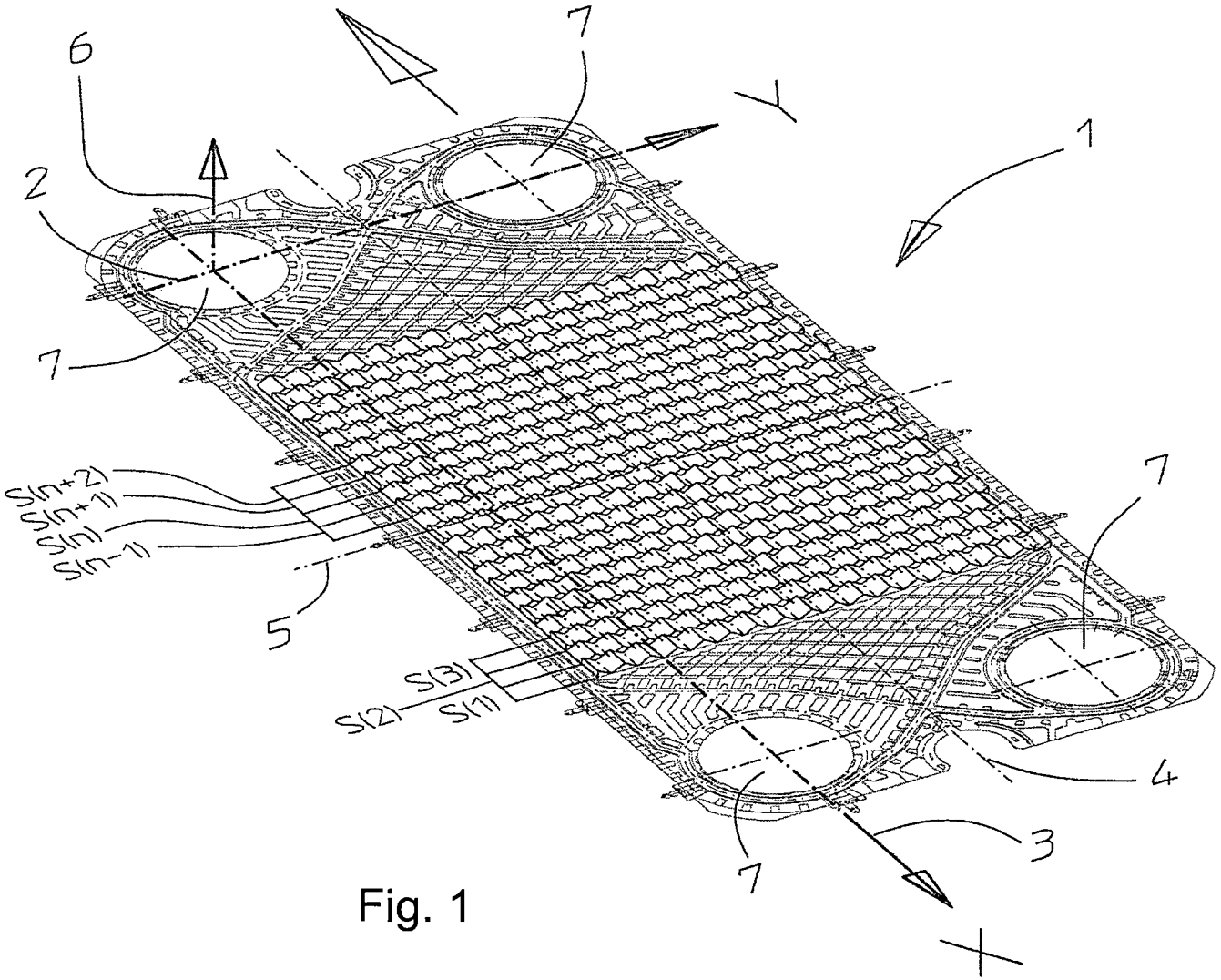

The following description is provided, alongside all chapters of the present invention, so as to enable any person skilled in the art to make use of the invention and sets forth the best modes contemplated by the inventor of carrying out this invention. Various modifications, however, will remain apparent to those skilled in the art, since the generic principles of the present invention have been defined specifically to provide a means and method for generating tailorable PHEs of improved heat exchange capacity and rate, as shown and disclosed in this invention below.

The term 'plate thickness' or 'plate depth' hereinafter refers to the vertical distance between the upper surface of the highest peak plane in a pressed plate and the lower surface of the lowest valley planes in a pressed plate.

The term 'plate main plane' hereinafter refers to the plane of the plate approximately in the center of the plate; the peaks rise from the plate main plane, while the valleys descend from the plate main plane.

The plate coordinate system as used herein comprises an x axis in the plate main plane, parallel to the main longitudinal axis of the plate, a y axis in the plate main plane, perpendicular to the main longitudinal axis of the plate (parallel to the transverse axis of the plate) and a z axis perpendicular to the plate main plane.

The term 'metal thickness' hereinafter refers to the thickness of the plate metal.

The term 'peak' hereinafter refers to an excursion of the plate extending upward (+z direction) when the plate is in its original orientation. A peak remains a peak (although now being a downward excursion) if the plate is rotated by 180° about its main longitudinal axis.

The term 'valley' hereinafter refers to an excursion of the plate extending downward (−z direction) when the plate is in its original orientation. A valley remains a valley (although now being an upward excursion) if the plate is rotated by 180° about its main longitudinal axis.

The term 'protrusion' hereinafter refers to an upward (+z direction) excursion of a plate, independent of plate orientation. A peak is a protrusion if the plate is in its original orientation; a valley forms a protrusion if the plate is rotated by 180° about its main longitudinal axis.

The term 'depression' hereinafter refers to a downward (−z direction) excursion of a plate, independent of plate orientation. A peak is a depression is rotated by 180° about its main longitudinal axis, while a valley is a depression if the plate is in its original orientation.

The term 'high wavy support zone' hereinafter refers to a zone comprising peaks and valleys with a depth equal to the plate thickness.

The term 'low wavy zone' hereinafter refers to a zone comprising peaks and valleys with a depth smaller than the plate thickness.

The term 'plate heat transition zone' hereinafter refers to the portion of the plate in which one fluid, flowing above the plate, is in indirect thermal contact through the plate with a second fluid flowing below the plate and in which the majority of the heat transfer between the plates occurs.

The term 'peak plane' hereinafter refers to the plane of the highest peaks, parallel to the plate main plane and above (at a positive z distance from) the plate main plane, The term 'valley plane' hereinafter refers to the plane of the lowest valleys, parallel to the plate main plane and below (at a negative z distance from) the plate main plane, The term 'channel' hereinafter refers to the entire space between two plates through which fluid can flow.

The term 'flow path' hereinafter refers to the volume between two plates within a segment which is bounded by two peaks and two valleys. Each segment will typically comprise a plurality of flow channels above a plate through which a fluid will flow and a second plurality of flow paths below a plate through which a second fluid will flow, the two fluids being completely unable to mix.

The term 'segment' hereinafter refers to a portion of a plate comprising a substantially constant pattern of peaks and valleys.

The term 'transition zone' hereinafter refers to an end of a segment comprising at least part of a pattern transitioning between the peaks and valleys of one segment and the peaks and valleys of an adjacent segment. A segment can comprise no, one or two transition zones.

The terms 'border line', 'intermediate line' and 'obstacle line' hereinafter refer to the line forming the boundary between two segments. The intermediate line passes through the material of the plate. A projection of the border line onto the valley plane forms the 'segmentation line'. The border line need not be a straight line.

The term 'segmentation surface' hereinafter refers to the surface comprised of the area of the metal in the vertical (z) direction above and below the IML, between the high peak plane and the low valley plane.

The term 'obstacle zone' hereinafter refers to a zone comprising two adjacent transition zones which meet at a common border line.

A plate heat exchanger comprises corrugated flow plates in which a depthwise wave is used for the plate corrugation. The waves can vary in depth, fundamental wave shape (sinusoidal, V-shape, square or other), curvature shape, inclination angle, wavelength, shape irregularity or added hybrid features within the wave shape. In addition, the corrugated plates can be stacked in such a way that every second plate within the stack is flipped, i.e. of an opposite orientation than the orientation of the other plates such that the second side of the second plate is adjacent to the second side of a first plate.

The plate heat transfer zone is the portion of the plate in which one fluid, flowing above the plate, is in indirect thermal contact through the plate with a second fluid flowing below the plate. The surface area of either side of the plate within the heat transition zone is the plate heat transfer surface area. The plate heat transfer zone is split into segments. These segments can be of one uniform repetitive form, or can comprise a plurality of forms. All of the plurality of forms can be the same, or at least two can differ from each other. Forms can be aligned at any angle with respect to the longitudinal axis of the plate. The plurality of forms are combined to create the plate corrugation pattern. The segments may either be of standard or nonstandard types. Unless otherwise mentioned, a segment will be of a standard type.

It is thus an object of the invention to disclose a plate of a plate heat exchanger. As an example and in none limiting manner, various possible embodiments are hereto described below. Sor sack of clarity, definition held in the SUMMARY OF THE INVENTION above are pertains to the general technology of the present invention and objects listed below are example of such a general technology. Hence, as hereto the, the plate comprises a heat transition zone (HTZ). The HTZ is configured with a plurality of segments. Each of the segments having a continuous wave pattern characterized by at least one peak and at least one valley, all of the at least one peaks being a protrusion from the plate and all of the at least one valley being a depression from the plate. A heat transfer fluid flowable above the plurality of segments through a valley and a second heat transfer fluid flowable below the plurality of segments below each peak. Each of the segments terminating at one end at a first terminal end and terminating at an opposite end at a second terminal end. The plurality of segments comprising at least one first segment and at least one second segment, the second terminal end of the at least one first segment conterminous with the first terminal end of the second segment. At least one transition zone, each of the at least one transitional zone located at a position selected from the second terminal end, the first terminal end and any combination thereof. Each of the at least one transition zone further comprising at least one obstruction. Characteristics of heat transfer between the first fluid and the second fluid are customizable upon selection of a member of a group consisting of configuration of each segment in the plurality of segments, alignment of each of the at least one first segment with each of the at least one second segment, and any combination thereof.

It is another object of the invention to disclose another embodiment of the plate defined above, wherein the plate has a main longitudinal axis and a main transverse axis, the main longitudinal axis being an x axis, the main transverse axis being a y axis; a z axis being perpendicular to both the x axis and the y axis, the x axis and the y axis lying in a central plane of the plate; and a plane parallel to the central plane and extending through a lowest point on a lowest valley of the plate is a base plane.

It is another object of the invention to disclose another embodiment of the plate defined in any of the above, wherein, for each the at least one first plate and each the at least one second plate, in an area where the second terminal end of the at least one first segment is conterminous with the first terminal end of the second segment, a line passing through a center of material of the plate is an intermediate line (IML) of the plate.

It is another object of the invention to disclose another embodiment of the plate defined in any of the above, wherein the IML can have a shape selected from a group consisting of: a straight line, a curved line, a zigzag and any combination thereof.

It is another object of the invention to disclose another embodiment of the plate defined in any of the above, wherein orientation of the IML is selected from a group consisting of parallel to the x axis, parallel to the y axis, parallel to the z axis and any combination thereof.

It is another object of the invention to disclose another embodiment of the plate defined in any of the above, wherein a shape of a first the IML relative to a second the IML is either the same or different.

It is another object of the invention to disclose another embodiment of the plate defined in any of the above, wherein an orientation of a first the IML relative to a second the IML is either the same or different.

It is another object of the invention to disclose another embodiment of the plate defined in any of the above, wherein the IML is characterized by a set of vertical distances $b_i$, where each $b_i$ is a vertical distance between the base plane and the IML It is another object of the invention to disclose another embodiment of the plate defined in any of the above, wherein, for and the first IML and any the second IML, the set of vertical distances $b_i$ are the same or different.

It is another object of the invention to disclose another embodiment of the plate defined in any of the above, wherein fluid 1 flowing from a valley of the first segment flows into either a single valley of the second segment or a plurality of valleys of the second segment.

It is another object of the invention to disclose another embodiment of the plate defined in any of the above, wherein fluid 2 flowing under a peak of the first segment under either a single peak of the second segment or a plurality of peaks of the second segment.

It is another object of the invention to disclose another embodiment of the plate defined in any of the above, wherein a set of wavedistances $\{a_i\}$ is either a set of distances between one of the at least one peak and an adjacent one of the at least one peak or a set of distances between one of the at least one valley and an adjacent one of the at least one valley; for the set of wavedistances $\{a_i\}$, either all the wavedistances $a_i$ are the same or at least one of the wavedistances $a_i$ is different from at least one other of the wavedistances $a_j$.

It is another object of the invention to disclose another embodiment of the plate defined in any of the above, wherein a set of areas $\{A_i\}$ is either a set of areas under one of the at least one peaks or a set of areas above one of the at least one valleys; for the set of areas $\{A_i\}$, either all the areas $A_i$ are the same or at least one of the areas $A_i$ is different from at least one other of the areas $A_j$.

It is another object of the invention to disclose another embodiment of the plate defined in any of the above, wherein, for at least one set of areas $\{A_i\}$ in at least one of the plurality of segments, the area $A_i$ either increases with distance along the at least one of the plurality of segments or decreases with distance along the at least one of the plurality of segments.

It is another object of the invention to disclose another embodiment of the plate defined in any of the above, wherein, for at least one of the plurality of segments, a set of peak areas $\{Ap_i\}$ is different from a set of valley areas $\{Av_i\}$.

It is another object of the invention to disclose another embodiment of the plate defined in any of the above, wherein, for at least one of the plurality of segments, for at least one of the at least one peak and an adjoining at least one valley, a relationship between the area $Ap_i$ and the area $Av_i$ is selected from a group consisting of: as the area $Ap_i$ increases, the area $Av_i$ decreases; as the area $Ap_i$ decreases, the area $Av_i$ increases; as the area $Ap_i$ increases, the area $Av_i$ increases; as the area $Ap_i$ decreases, the area $Av_i$ decreases; and any combination thereof.

It is another object of the invention to disclose another embodiment of the plate defined in any of the above, wherein, for at least one of the plurality of segments, for the at least one of the at least one peak and the adjacent peak, the wavedistance $a_i$ between adjacent peaks remains constant.

It is another object of the invention to disclose another embodiment of the plate defined in any of the above, wherein, for at least one of fluid 1 and fluid 2, at least one of the obstructions changes a member of a group consisting of a direction of flow, turbulence in the flow, vorticity of the flow, velocity of the flow, and any combination thereof.

It is another object of the invention to disclose another embodiment of the plate defined in any of the above, wherein the plate comprises at least one low wave selected from a group consisting of a low peak, a high valley, and any combination thereof.

It is another object of the invention to disclose another embodiment of the plate defined in any of the above, wherein a height of the low peak, as measured from the central plane, is no greater than the greatest height of the at least one peak.

It is another object of the invention to disclose another embodiment of the plate defined in any of the above, wherein a height of the high valley, as measured from the central plane, is no greater than the greatest height of the at least one valley.

It is another object of the invention to disclose another embodiment of the plate defined in any of the above, wherein a height of at least one of the high valley changes with position on the of at least one of the high valleys.

It is another object of the invention to disclose another embodiment of the plate defined in any of the above, wherein a height of at least one of the low peak changes with position on the of at least one of the low peaks.

It is another object of the invention to disclose another embodiment of the plate defined in any of the above, wherein a plate stack comprises n plates, n being an integer greater than or equal to 2.

It is another object of the invention to disclose another embodiment of the plate defined in any of the above, wherein there is at least one point of contact between at least one pth plate of the n plates and a qth plate of the n plates, the qth plate being adjacent to the pth plate.

It is another object of the invention to disclose another embodiment of the plate defined in any of the above, wherein fluid 1 is flowable between the pth plate and the qth plate.

As an example, if n is greater than or equal to 3, fluid 2 is flowable between an rth plate and an sth plate, at least one of the following being true: $r \neq p$ and $s \neq q$.

It is another object of the invention to disclose another embodiment of the plate defined in any of the above, wherein, via a contactor, at least one of the low wave on a first plate of the plate stack is positionable in contact with at least one member of a group consisting of the low wave, the at least one peak and the at least one valley on an adjacent plate.

It is another object of the invention to disclose another embodiment of the plate defined in any of the above, wherein the contactor comprises a portion of a height group consisting of a peak, a valley and an obstruction that has a greater height than an adjacent part of the member of the height group. A contactor comprises material separate from any of the plates.

It is another object of the invention to disclose another embodiment of the plate defined in any of the above, wherein the contactor comprises at least a portion of a mesh.

It is another object of the invention to disclose another embodiment of the plate defined in any of the above, wherein, for an upper plate abutting a lower plates along lines of abutment, the cross-sectional area below the upper plate between two of the lines of abutment has a different cross-sectional shape than the cross-sectional area above the lower plate between the two lines of abutment; the area is asymmetrical about a plane formed by the two lines of abutment.

It is another object of the invention to disclose another embodiment of the plate defined in any of the above, wherein fluid is flowable across an area between adjacent obstructions.

It is another object of the invention to disclose another embodiment of the plate defined in any of the above, wherein the area changes size along the length of the adjacent obstructions.

It is another object of the invention to disclose another embodiment of the plate defined in any of the above, a smallest area bounded by the adjacent obstructions comprises a window.

It is another object of the invention to disclose another embodiment of the plate defined in any of the above, wherein fluid 1 is flowable through type 1 windows and fluid 2 is flowable through type 2 windows.

It is another object of the invention to disclose another embodiment of the plate defined in any of the above, wherein, in a segment, at least one of the following is true: the type 1 windows all have the same shape and the type 2 windows all have the same shape.

It is another object of the invention to disclose another embodiment of the plate defined in any of the above, wherein, in a segment, at least one of the following is true: the type 1 windows all have the same size and the type 2 windows all have the same size.

It is another object of the invention to disclose another embodiment of the plate defined in any of the above, wherein type 1 windows have a different shape from type 2 windows.

It is another object of the invention to disclose another embodiment of the plate defined in any of the above, wherein at least one of a group consisting of the type 1 windows and the type 2 windows change size with distance down the plate.

It is another object of the invention to disclose another embodiment of the plate defined in any of the above, wherein at least one the following is true: the type 1 windows increase in size and the type 2 windows decrease in size with distance down the plate, the type 1 windows decrease in size and the type 2 windows increase in size with distance down the plate, the type 1 windows increase in size and the type 2 windows increase in size with distance down the plate, the type 1 windows decrease in size and the type 2 windows decrease in size with distance down the plate, and any combination thereof.

It is another object of the invention to disclose another embodiment of the plate defined in any of the above, wherein at least one of a group consisting of the type 1 windows and the type 2 windows change shape with distance down the plate.

It is another object of the invention to disclose a use of PHEs as defined in any of the above in heat exchangers. Additionally, it is another object of the invention to disclose a heat exchanger comprising the plate as defined in any of the above.

It is another object of the invention to disclose another embodiment, namely a method of heat exchanging by means of a plate heat exchanger which is comprises a heat transition zone. This method comprises steps as follows: providing the a plurality of segments; further providing each of the segments with a continuous wave pattern characterized by at least one peak and at least one valley, all of the at least one peaks being a protrusion from the plate and all of the at least one valleys being a depression from the plate; a heat transfer fluid flowable above the plurality of segments through a valley and a second heat transfer fluid flowable below the plurality of segments below each peak; configuring each of the segments terminating at one end at a first terminal end and terminating at an opposite end at a second terminal end; further configuring the plurality of segments to comprise at least one first segment and at least one second segment, the second terminal end of the at least one first segment conterminous with the first terminal end of the second segment. Providing at least one transition zone, each of the at least one transitional zone located at a position selected from the second terminal end, the first terminal end and any combination thereof. Providing each of the at least one transition zone further comprising at least one obstruction. The heat transfer between the first fluid and the second fluid is customizable upon selecting a member of a group consisting of configuring each segment in the plurality of segments, aligning of each of the at least one first segment with each of the at least one second segment, and any combination thereof.

It is another object of the invention to disclose another embodiment of the method as defined above, wherein the method further comprising step of providing the plate with a main longitudinal axis and a main transverse axis, the main longitudinal axis being an x axis, the main transverse axis being a y axis; a z axis being perpendicular to both the x axis and the y axis, the x axis and the y axis lying in a central plane of the plate; and a plane parallel to the central plane and extending through a lowest point on a lowest valley of the plate is a base plane.

It is another object of the invention to disclose another embodiment of the method as defined in any of the above, wherein the method further comprising step of providing, for each the at least one first plate and each the at least one second plate, in an area where the second terminal end of the at least one first segment is conterminous with the first terminal end of the second segment, a line passing through a center of material of the plate is an intermediate line (IML) of the plate.

It is another object of the invention to disclose another embodiment of the method as defined in any of the above, wherein the IML have a shape selected from a group consisting of: a straight line, a curved line, a zigzag and any combination thereof.

It is another object of the invention to disclose another embodiment of the method as defined in any of the above, wherein orientation of the IML is selected from a group consisting of parallel to the x axis, parallel to the y axis, parallel to the z axis and any combination thereof.

It is another object of the invention to disclose another embodiment of the method as defined in any of the above, wherein a shape of a first the IML relative to a second the IML is either the same or different.

It is another object of the invention to disclose another embodiment of the method as defined in any of the above, wherein an orientation of a first the IML relative to a second the IML is either the same or different.

It is another object of the invention to disclose another embodiment of the method as defined in any of the above, wherein the IML is characterized by a set of vertical distances $b_i$, where each $b_i$ is a vertical distance between the base plane and the IML It is another object of the invention to disclose another embodiment of the method as defined in any of the above, wherein, for and the first IML and any the second IML, the set of vertical distances $b_i$ are the same or different.

It is another object of the invention to disclose another embodiment of the method as defined in any of the above, wherein fluid 1 flowing from a valley of the first segment flows into either a single valley of the second segment or a plurality of valleys of the second segment.

It is another object of the invention to disclose another embodiment of the method as defined in any of the above, wherein fluid 2 flowing under a peak of the first segment under either a single peak of the second segment or a plurality of peaks of the second segment.

It is another object of the invention to disclose another embodiment of the method as defined in any of the above, wherein a set of wavedistances $\{a_i\}$ is either a set of distances between one of the at least one peak and an adjacent one of the at least one peak or a set of distances between one of the at least one valley and an adjacent one of the at least one valley; for the set of wavedistances $\{a_i\}$, either all the wavedistances $a_i$ are the same or at least one of the wavedistances $a_i$ is different from at least one other of the wavedistances $a_j$.

It is another object of the invention to disclose another embodiment of the method as defined in any of the above, wherein a set of areas $\{A_i\}$ is either a set of areas under one of the at least one peaks or a set of areas above one of the at least one valleys; for the set of areas $\{A_i\}$, either all the areas $A_i$ are the same or at least one of the areas $A_i$ is different from at least one other of the areas $A_j$.

v wherein, for at least one set of areas $\{A_i\}$ in at least one of the plurality of segments, the area $A_i$ either increases with distance along the at least one of the plurality of segments or decreases with distance along the at least one of the plurality of segments. For at least one of the plurality of segments, a set of peak areas $\{Ap_i\}$ is different from a set of valley areas $\{Av_i\}$.

It is another object of the invention to disclose another embodiment of the method as defined in any of the above, wherein, for at least one of the plurality of segments, for at least one of the at least one peak and an adjoining at least one valley, a relationship between the area $Ap_i$ and the area $Av_i$ is selected from a group consisting of: as the area $Ap_i$ increases, the area $Av_i$ decreases; as the area $Ap_i$ decreases, the area $Av_i$ increases; as the area $Ap_i$ increases, the area $Av_i$ increases; as the area $Ap_i$ decreases, the area $Av_i$ decreases; and any combination thereof.

It is another object of the invention to disclose another embodiment of the method as defined in any of the above, wherein, for at least one of the plurality of segments, for the at least one of the at least one peak and the adjacent peak, the wavedistance $a_i$ between adjacent peaks remains constant.

It is another object of the invention to disclose another embodiment of the method as defined in any of the above, wherein, for at least one of fluid 1 and fluid 2, at least one of the obstructions changes a member of a group consisting of a direction of flow, turbulence in the flow, vorticity of the flow, velocity of the flow, and any combination thereof.

It is another object of the invention to disclose another embodiment of the method as defined in any of the above, wherein the plate comprises at least one low wave selected from a group consisting of a low peak, a high valley, and any combination thereof.

It is another object of the invention to disclose another embodiment of the method as defined in any of the above, wherein a height of the low peak, as measured from the central plane, is no greater than the greatest height of the at least one peak.

It is another object of the invention to disclose another embodiment of the method as defined in any of the above, wherein a height of the high valley, as measured from the central plane, is no greater than the greatest height of the at least one valley.

It is another object of the invention to disclose another embodiment of the method as defined in any of the above, wherein a height of at least one of the high valley changes with position on the of at least one of the high valley.

It is another object of the invention to disclose another embodiment of the method as defined in any of the above, wherein a height of at least one of the low peak changes with position on the of at least one of the low peak.

It is another object of the invention to disclose another embodiment of the method as defined in any of the above, wherein a plate stack comprises n plates, n being an integer greater than or equal to 2.

It is another object of the invention to disclose another embodiment of the method as defined in any of the above, wherein there is at least one point of contact between at least one pth plate of the n plates and a qth plate of the n plates, the qth plate being adjacent to the pth plate.

It is another object of the invention to disclose another embodiment of the method as defined in any of the above, wherein fluid 1 is flowable between the pth plate and the qth plate.

It is another object of the invention to disclose another embodiment of the method as defined in any of the above, wherein, if n is greater than or equal to 3, fluid 2 is flowable between an rth plate and an sth plate, at least one of the following being true: $r \neq p$ and $s \neq q$.

It is another object of the invention to disclose another embodiment of the method as defined in any of the above, wherein via a contactor, at least one of the low wave on a first plate of the plate stack is positionable in contact with at least one member of a group consisting of the low wave, the at least one peak and the at least one valley on an adjacent plate.

It is another object of the invention to disclose another embodiment of the method as defined in any of the above, wherein the contactor comprises a portion of a height group consisting of a peak, a valley and an obstruction that has a greater height than an adjacent part of the member of the height group.

It is another object of the invention to disclose another embodiment of the method as defined in any of the above, wherein the contactor comprises material separate from any of the plates.

It is another object of the invention to disclose another embodiment of the method as defined in any of the above, wherein the contactor comprises at least a portion of a mesh.

It is another object of the invention to disclose another embodiment of the method as defined in any of the above, wherein, for an upper plate abutting a lower plates along lines of abutment, the cross-sectional area below the upper plate between two of the lines of abutment has a different cross-sectional shape than the cross-sectional area above the lower plate between the two lines of abutment; the area is asymmetrical about a plane formed by the two lines of abutment.

It is another object of the invention to disclose another embodiment of the method as defined in any of the above, wherein fluid is flowable across an area between adjacent obstructions.

It is another object of the invention to disclose the method as defined in any of the above, wherein the area changes size along the length of the adjacent obstructions.

It is another object of the invention to disclose another embodiment of the method as defined in any of the above, herein a smallest area bounded by the adjacent obstructions comprises a window.

It is another object of the invention to disclose another embodiment of the method as defined in any of the above, wherein fluid 1 is flowable through type 1 windows and fluid 2 is flowable through type 2 windows.

It is another object of the invention to disclose another embodiment of the method as defined in any of the above, wherein, in a segment, at least one of the following is true: the type 1 windows all have the same shape and the type 2 windows all have the same shape.

It is another object of the invention to disclose another embodiment of the method as defined in any of the above, wherein, in a segment, at least one of the following is true: the type 1 windows all have the same size and the type 2 windows all have the same size.

It is another object of the invention to disclose another embodiment of the method as defined in any of the above, wherein, wherein type 1 windows have a different shape from type 2 windows.

It is another object of the invention to disclose another embodiment of the method as defined in any of the above, wherein at least one of a group consisting of the type 1 windows and the type 2 windows change size with distance down the plate.

It is another object of the invention to disclose another embodiment of the method as defined in any of the above, wherein at least one the following is true: the type 1 windows increase in size and the type 2 windows decrease in size with distance down the plate, the type 1 windows decrease in size and the type 2 windows increase in size with distance down the plate, the type 1 windows increase in size and the type 2 windows increase in size with distance down the plate, the type 1 windows decrease in size and the type 2 windows decrease in size with distance down the plate, and any combination thereof.

It is another object of the invention to disclose another embodiment of the method as defined in any of the above, wherein at least one of a group consisting of the type 1 windows and the type 2 windows change shape with distance down the plate.

Still as an example and within the role of the SUMMARY OF THE INVENTION above, it is still is in the scope of the invention wherein a plate of a PHE is characterized by a corrugation geometry. A trench of a first segment is transversally offset with respect to a corresponding trench of the second segment. A plurality of segments is arranged in a staggered formation that induces flow of the exiting the first segment to follow a path characterized by longitudinal swirl flow. Additionally or alternatively, an obstruction is configured to cause the exiting fluid to be deflected into two paths that are directed to two different discontinuous trenches, respectively, included within the second segment and to mix with fluid exiting a different trench of the first segment. Trench of the first segment is transversally aligned with a corresponding trench of the second segment. Additionally or alternatively, an obstruction is configured with two or more surfaces of different angular dispositions, to cause the exiting fluid to change its angular disposition at the intermediate region prior to flowing to the transversally aligned trench of the second segment. Additionally or alternatively, a transitional zone additionally includes a corridor formed between two transversally adjacent obstructions, along a restricted path associated with the corridor at least a portion of the exiting fluid is forced to flow to a desired trench. Additionally, or alternatively, a corridor is spaced from the valley plane of the corresponding trench. Additionally, or alternatively, an one or more segments of the heat transition zone is configured with an asymmetrical wave pattern. Additionally, or alternatively, an asymmetrical wave pattern includes a first set of transversally adjacent discontinuous trenches that are accessible at a first face of the plate, and a second set of transversally adjacent discontinuous trenches that are accessible at a second face of the plate and that have a different shape than each trench of the first set. Additionally, or alternatively, at least one trench of the first segment is angularly spaced from at least one trench of the second segment. Additionally, or alternatively, a heat transition zone is configured in a zig-zag pattern. Additionally, or alternatively, the plates are arranged in a stack. Additionally, or alternatively, a different plate groups including a plurality of separated individualized-flow groups which are configured to facilitate flow of a different heat transfer fluid through each channel of the group and one or more separated common-flow groups which are each configured to facilitate flow of air through a plurality of consecutive channels of the common-flow group. Additionally, or alternatively, a configuration of the heat exchanger is customized with respect to a first fluid flowing across a first channel defined between the first and second plates and with respect to a second fluid flowing across a second channel defined between the second and third plates so as to be in heat exchanger relation with the first fluid. Additionally or alternatively, two transversally adjacent peaks of each trench of the at least first, second and third plates is positionable in abutting relation with corresponding peaks of an adjacent plate of the plate heat exchanger to provide, at each set of inter-trench abutment regions, an interspace delimited by four banks including two banks of the adjacent plate through which the first or second fluid is flowable across one of the channels. Additionally, or alternatively, second plate is of an opposite orientation than the orientation of the first and third plates such that the second face of the second plate is adjacent to the second face of the first plate, and the first face of the second plate is adjacent to the first face of the third plate. Additionally, or alternatively, each of a plurality of first interspaces delimited by a trench of the first plate and a trench of the second plate has a different hydraulic diameter than each of a plurality of second interspaces delimited by a trench of the second plate and a trench of the third plate by virtue of the opposite orientation of the second plate than the orientation of the first and third plates. Additionally or alternatively, each obstruction of the at least first, second and third plates is in abutting relation with one of the obstructions of the adjacent plate at an inter-obstruction abutment region and is projected into a corresponding interspace to define a window along which the exiting fluid is flowable by a space projected into the corresponding interspace that is unoccupied by a projected obstruction between the projected inter-obstruction abutment region and an adjacent inter-trench abutment region, Additionally or alternatively, the size or shape of the window defined by the corresponding interspace of the first channel is different than the size or shape of the window defined by the corresponding interspace of the second channel, and is customized in accordance with characteristics of the first fluid. Additionally, or alternatively, the ratio of window area to projected area of the corresponding interspace is different with respect to the first channel than with respect to the second channel.

FIG. 1 schematically illustrates a corrugated plate (1). In the plate (1), presented in this figure in a top perspective view, there is a single corrugation pattern comprising a number of segments (S(n−1), S(n), S(n+1), S(n+2). Segments are numbered from one end of the heat transition zone (S(1), S(2), S(3) at the south end of the plate in FIG. 1). The wave peak lines are represented by thick solid lines, while the valleys are represented by thick dashed lines. The plate has four inlet/outlet ports: one in each of the four corners.

The plate longitudinal (4) and transverse (5) centerlines are shown, which bisect its lengthwise and widthwise dimensions. The intersection of the longitudinal and transverse centerlines is the plate center point. The plate main plane is substantially parallel to the peak and valley planes, as well as the plane formed by the plate lengthwise (x, 3) and widthwise (y, 2) axes, whose origin may be placed on any point on the plate. The z axis (6) is perpendicular to the x-y plane and depicts the depth of the various features on the corrugated plate.

FIG. 1 schematically illustrates an additional reference to the plate orientation: The longitudinal centerline defines the north/south direction. In the embodiment shown, the ports (7) for the flow circuit flowing above the plate are situated at the plate NE & SE corners, and the ports allocated for the flow circuit flowing below the plate is situated at the plate NW & SW corners. This allocation of directions is chosen arbitrarily, with the sole purpose of simplifying the upcoming descriptions.

Figure 2A:
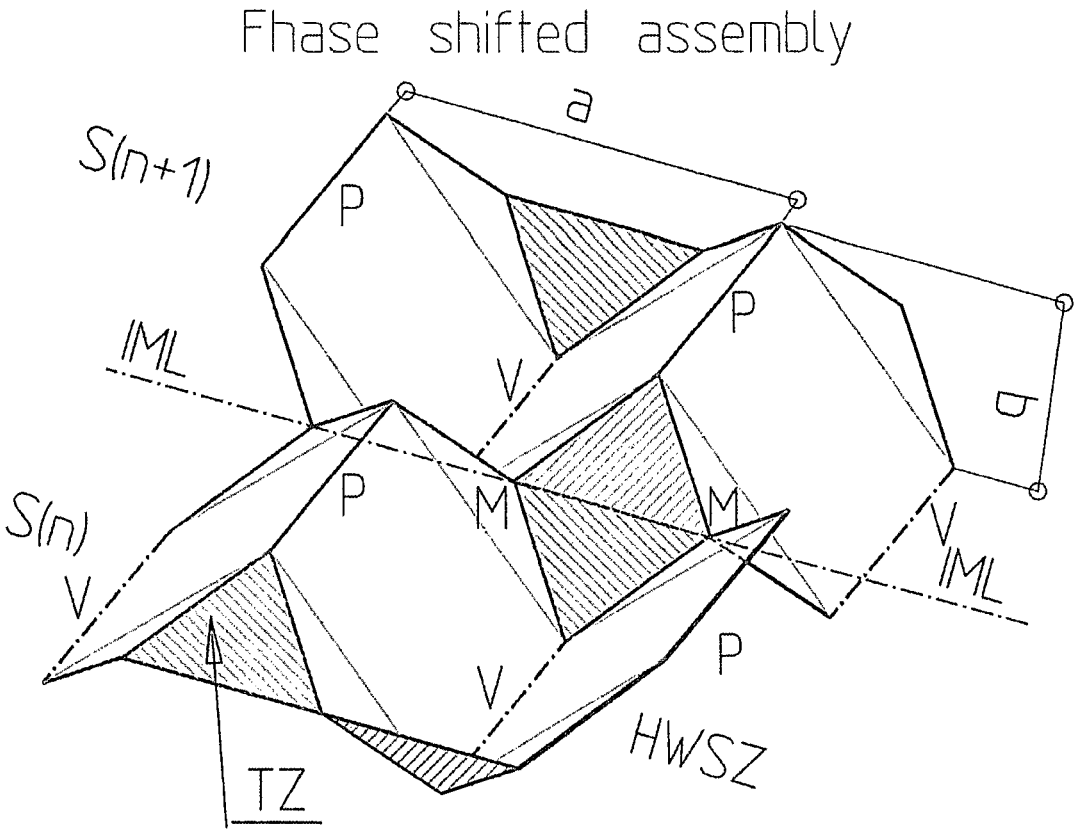
FIG. 2A schematically illustrates a perspective view of two adjacent segments of a PHE plate according to several embodiments of the invention.
Figure 2B:
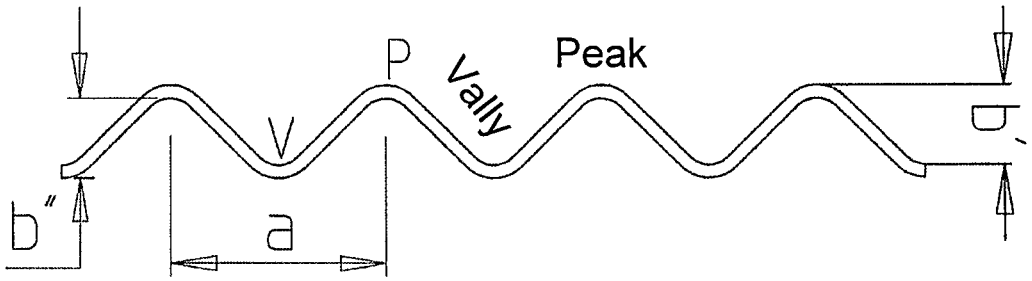
FIG. 2B schematically illustrates a side view of a segment, illustrating peaks and valleys according to several embodiments of the invention.
Figure 2C:
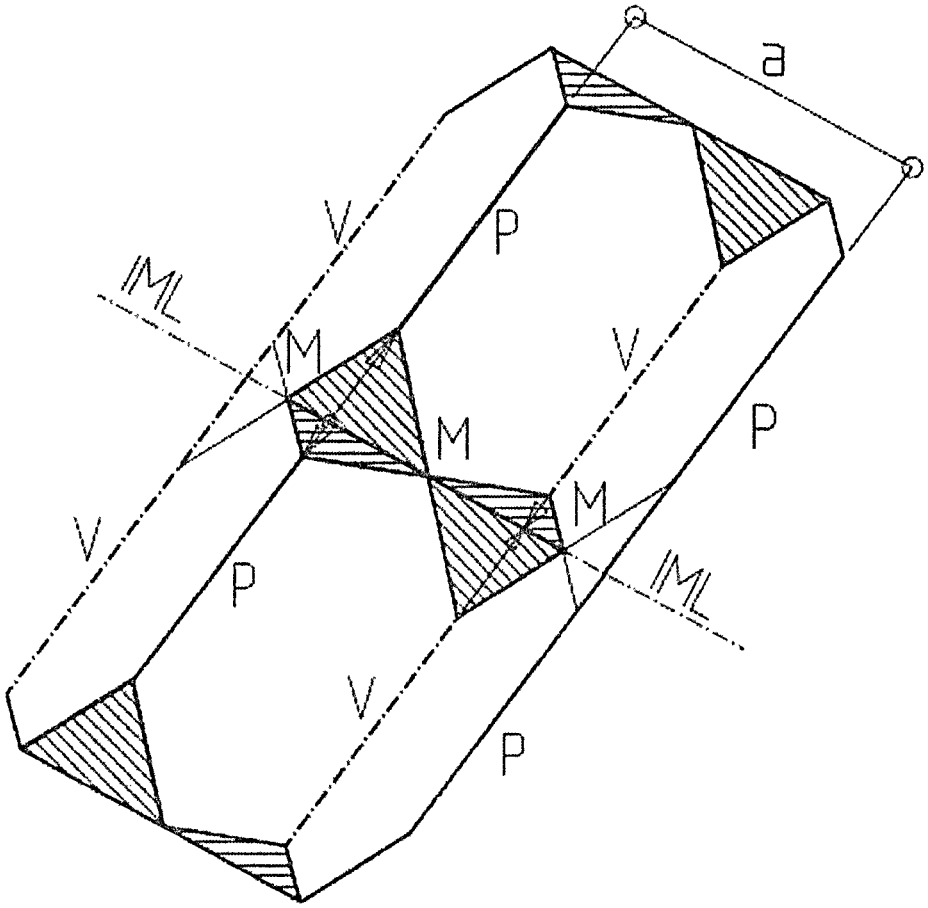
FIG. 2C schematically illustrates an upper view of the segment.

FIG. 2A-B schematically illustrates two segments of an embodiment of a heat exchanger plate. FIG. 2A schematically illustrates a perspective view of the segments while FIG. 2B schematically illustrates a cross-sectional view of a high wavy zone of a segment.

The corrugation geometry of each standard segment in this invention is comprised of a central high wavy zone, described below, together with two regions, referred to as transition zones, located on the parts of the segment adjacent to the neighboring segments. The structure of nonstandard segments is similar to that of standard segments, except that either one or more of the regions mentioned above does not exist or the waves in the central wavy zone are not high waves.

Wavelike patterns, whether high wavy zone patterns (comprising high waves) or other wavy zone patterns (e.g., low waves), are induced onto plate heat exchanger (PHE) plates, e.g., by drawing; the drawing (or other manufacturing process) results in corrugated plates. The drawn wavelike patterns can be, for example, in the form of a sine wave, a V shape, a square wave, or other pattern forms, can be symmetric or asymmetric, with a single constant basic shape and wavelength (denoted as a, see FIG. 2B, below) which is repeated throughout the plate or with a basic shape and wavelength which changes throughout the plate and any combination thereof. The wavelike patterns can be of uniform or variable height/depth, in one or in varying directions. The wavelike patterns can be either straight, curved, zig-zagged or with any other progression, symmetrical or asymmetrical.

In general, as shown in the exemplary embodiment of FIG. 2A, the wavelike structures within the plate corrugation pattern are characterized by having lower-most portions denoted as 'valleys' (V), which can have a shape comprising a circle, line, polygon, dot, or any other geometrical form, as well as higher-most portions denoted as 'peaks' (P), which can have a shape comprising a circle, line, triangle, dot, or any other geometrical form, and mid-height intermediate portions, which can include local peaks (denoted as 'low peaks', LP) that are lower than the higher-most peaks of the pattern and local valleys (denoted as 'high valleys', HV) that are higher than the lower-most valleys of the pattern. These local peaks and valleys can have a shape comprising a circle, line, triangle, dot, or any other geometrical form. The peaks, low peaks, valleys and high valleys refer to an initial orientation of the plate. The plate's upper side, above the plate material, is denoted in this application by (') or (U), while the plate's lower side, below the plate material, is denoted in this application by (") or (D). The plate's lower side is typically hidden from view in a perspective or a top view. If the plate is inverted, a peak, etc., remains a peak. For clarity, for any orientation of the plate, an excursion pointing upward (+Z direction) will be called a "protrusion" and an excursion facing downward (−Z direction) will be called a "depression".

The ensemble of high peak lines and points of a plate lie on a single plane denoted as the 'high peak plane'. The high peak plane will be at the uppermost portion of the plate, at a positive z distance from the plate main plane, the lower plane of the plate.

Similarly, the low valley lines and points of a plate lie on a single plane denoted as the 'low valley plane'. The low valley plane will be at the lowermost portion of the plate, at a negative z distance from the plate main plane. Typically, when the plates are stacked together with alternate plates rotated 180° about the z axis with respect to each other, the high peak plane of one plate becomes the same plane as the low valley plane of the plate directly above it. Consequently, peaks of the lower plate will abut valleys of the upper plate along specific abutment lines and points, thus providing support between adjacent plates. Two plates support each other (a support occurs) when a protrusion on a lower plate abuts a depression on an upper plate. In embodiments where alternate plates are rotated 180° about the x or y axis with respect to each other, peaks will abut peaks and valleys will abut valleys along specific abutment lines and points, thus providing support between adjacent plates.

Reference is again made to FIG. 2A illustrating two adjacent segments S(n) and S(n+1) which meet at an intermediate line (IML). The intermediate line can be parallel to the plate main plane, at an angle to the plate main plane different from 0, at any angle to the to the plate longitudinal axis including perpendicular to the plate longitudinal axis; it can be a straight line, zigzagged, curved etc. A high wavy support zone (HVSZ), peaks (P), valleys (V), length (distance) between two adjacent peaks (wavelength a) are schematically illustrated. Between the peaks and valleys of segment Sn and segment S(n+1), there are two transition zones, the first transition zone (TZ) being the zone between the IML and terminations of the peaks and valleys in segment Sn at the end of segment Sn closest to the IML; similarly there is a second TZ between the IML and the terminations at the end of segment S(n+1) closest to the IML. If a peak or valley in a segment is parallel to the IML, then the TZ would be in the zone between the parallel peak or valley and the IML. In the standard segment shown, there are two adjacent transition zones between the peaks and valleys of segment S(n) and the peaks and valleys of segment S(n+1). Each segment in the figure comprises two transition zones, one at the S(n−1) end of segment S(n) and one at the S(n+1) end. A segment can have 2 transition zones, one transition zone or no transition zones.

Points marked as M are saddle points, which are defined below. A window (P-M-P) through which fluid can flow is also shown. Obstacles (P-M-V-M) block part of the flow path; the smallest free cross-sectional area (through which the fluid will pass) in the obstacle zone is the "window".

Supports occur when there is contact between HWSZs on adjacent plates, or extended protrusions, extended depressions or both ensure contact between LWSZs and/or HWSZs on adjacent plates. It is also possible, although less desirable, to provide additional material between plates to provide contact, for non-limiting example, by means of a mesh.

For the sake of simplicity and without the loss of generality, in the figures below, the wavelike patterns will be shown as symmetrical with a V-shaped cross section. FIG. 2B schematically illustrates a cross section of this V-shape. The plate thickness b is defined as the vertical distance between its peak and valley planes. The PHE plates are usually manufactured from a thin sheet metal with sheet metal thickness denoted by t. The plate thickness is thus equal to the sum of the drawing depth on the plate upper side b' and the sheet metal thickness t.

For simplicity, in most of the figures, the metal sheet thickness has been ignored so that the metal is shown as a line and b=b'=b". Furthermore, radiusing has been neglected; unless otherwise indicated, lines are shown as meeting at a point although, in practice, the meeting would be radiused.

Figure 3:
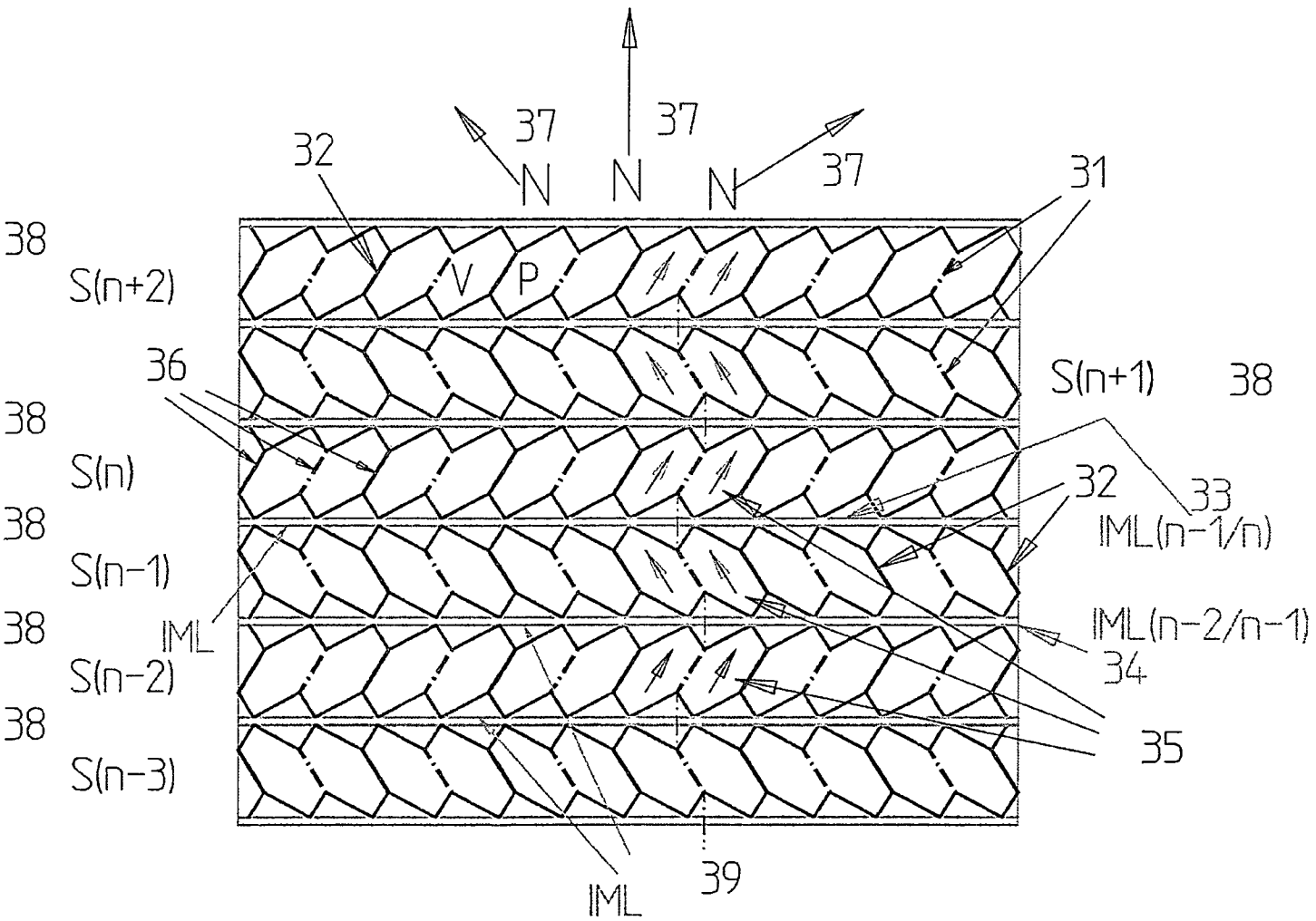
FIG. 3 schematically illustrates a top view of a section of a plate where the angle between the longitudinal axes of peaks/valleys in one segment and the longitudinal axes of peaks/valleys in an adjacent segment is not zero so that fluid(s) must follow a zigzag path in flowing through the segments according to several embodiments of the invention.

FIG. 3 schematically illustrates an embodiment of segments (38) S(n−3), S(n−2), S(n−1), S(n), S(n+1) and S(n+2) arranged in a zigzag formation so that the longitudinal axes of the peaks (32) and valleys (31) in one segment will be aligned at an angle to the longitudinal axis of the plate, while the longitudinal axes of the peaks and valleys in a next segment will be aligned at a different angle to the longitudinal axis of the plate. The peaks and valleys form a flow guide (36) for the fluid flow (35); for a HWSZ, flow will be predominantly along the peaks and valleys; the valleys will be flow paths for fluid above the plate and the peaks will be flow paths for the fluid below the plate. In the example shown, the first, third and fifth segments (S(n−3), S(n−1), S(n+1)) are aligned northwest/southeast, while the second, fourth and sixth segments (S(n−2), S(n), S(n+2)) are aligned northeast/southwest. Flow of the fluids will be alternately northwest and northeast. Portions of two flow paths for one fluid are indicated by the alternately northwest and northeast arrows.

The peaks contact the plate above and provide support for the plate above (32); the plate below, via the valleys provides a similar support for the plate (1).

The IMLs are shown as a double line (e.g., IML(n−2/n−1) (34) and IML(n−1/n)) (33), conceptually illustrating that further obstacles, in addition to the transition zones (not shown), such as, but not limited to, low wavy zones, can be inserted between the segments.

The orientation of the exemplary zig-zag pattern can be at any angle with respect to the plate, as schematically indicated by the 3 exemplary plate Norths (37) shown.

For all of the exemplary segment patterns shown, the segment pattern can be aligned at any angle to the plate north. It is understood that the angular disposition of segment patterns can be fixed for a plate pattern intended for a particular use.

Figures 4A, 4B, 4C:
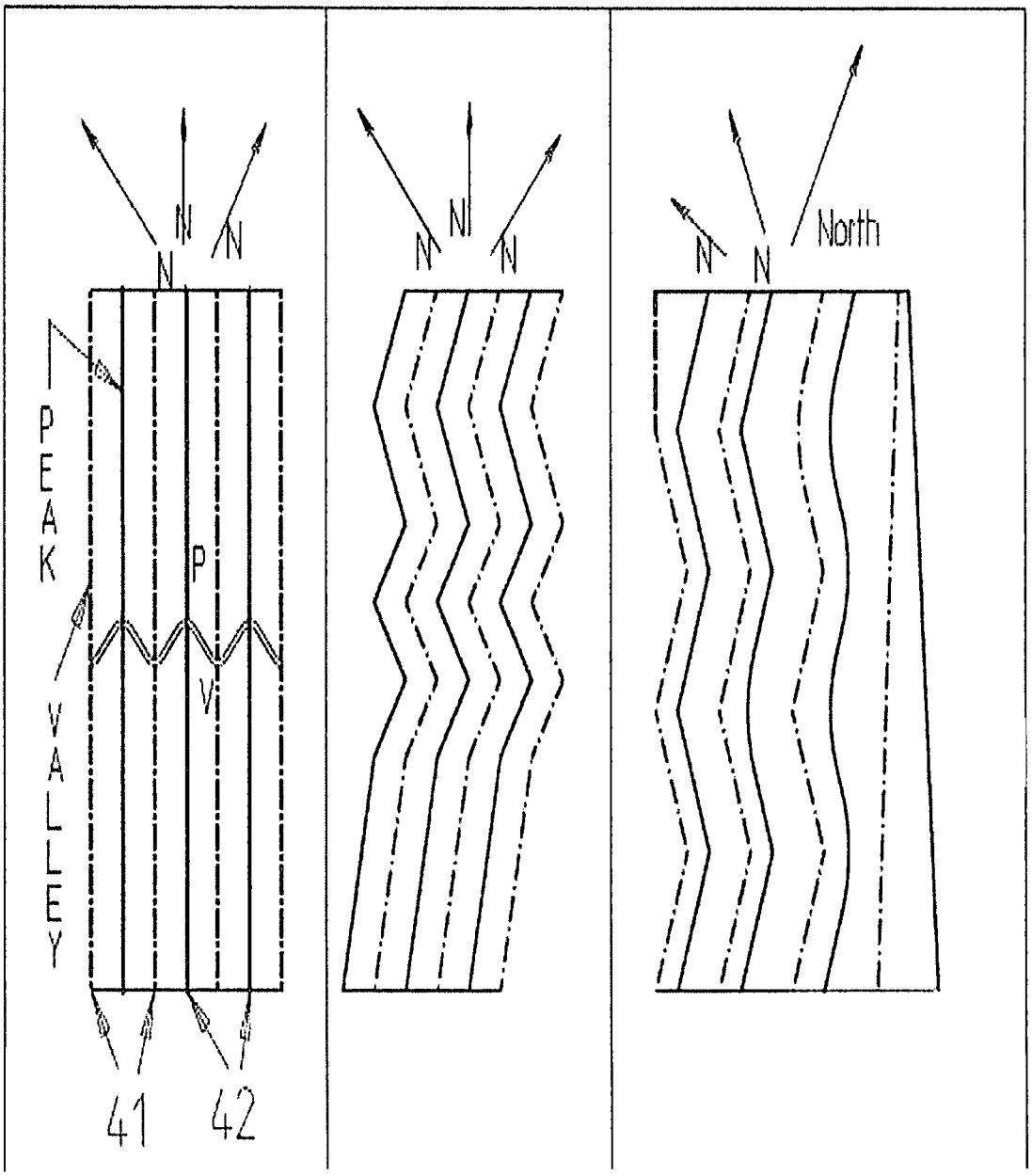
FIGS. 4A-C schematically illustrates a top view of configurations of peak and valley shapes and sizes in a segment according to several embodiments of the invention.

FIGS. 4A-C show different examples of wave pattern geometries. In each of the figures, all shown from a top view, the wave pattern can be situated at any angle with reference to the plate lengthwise axis, as shown by the north direction. This is illustrated by the arrows which are pointed at various directions.

FIG. 4A schematically illustrates straight waves with a V-shaped cross section. Peaks (42) alternate with valleys (41). FIG. 4A also schematically illustrates the wave pattern's cross section (double line at the center of the figure), in which the sheet metal thickness and the radiusing of the peaks and valleys is shown. In the figures below, unless otherwise indicated, the plate will be indicated by a single line without detailing its metal sheet thickness or the shape of the peaks or valleys.

FIG. 4B schematically illustrates a wave pattern with peak and valley lines forming an irregular zig-zag. In this wave pattern, the different peak and valley lines have a common shape and are evenly spaced and parallel to each other.

FIG. 4C schematically illustrates a wave pattern in which peak and valley lines have different shapes and are irregularly spaced.

Referring again to FIGS. 1 and 3, each pair of adjacent segments shares a common line forming the boundary between them for example, S(n−1), S(n), S(n+1). This line, the "border line", 'intermediate line' (IML) or 'obstacle line', which may or not be a straight line, is in a surface, the segmentation surface, perpendicular to the plane of the plate. A border line can be straight or curved, a continuous zig-zag or of arbitrary shape. Border lines can be mutually parallel or not, in any direction including a transverse east-west direction, a longitudinal north-south direction, a diagonal direction, or any other direction with reference to the corrugated plate.

A projection of the border line onto the valley plane forms the 'segmentation line'.

In terms of indexing, the border line or the IML between segments S(n) and S(n+1) will be defined as: IML(n/n+1).

In each segment, the area between the central high-wave zone and the border line is referred to as a 'transition zone'. Transition zones can comprise flow obstacles, such as low peaks and high valleys, which help in augmenting the flow characteristics and in improving heat transfer. The transition zones can also comprise 'saddle points' or 'saddle lines', from which the plate corrugation rises in one direction to peaks or low peaks which are located on opposite sides of the saddle point and which descend into valleys or high valleys in on opposite sides of the saddle in a different direction.

Figure 5:
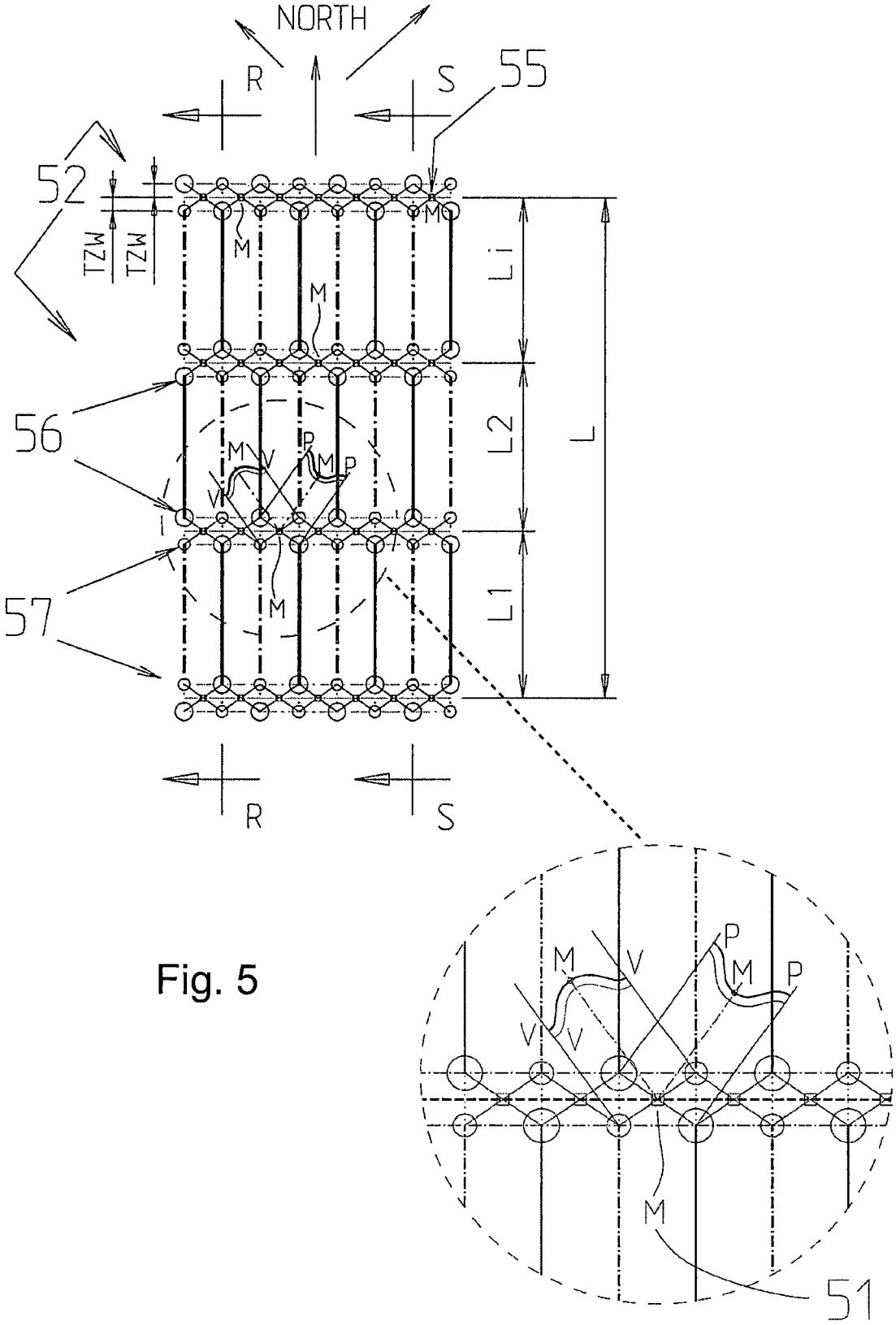
FIG. 5 schematically illustrates segments with transition zones at each end of each segment and a phase shift between peaks/valleys in a segment and peaks/valleys in an adjacent segment according to several embodiments of the invention.

FIG. 5 illustrates exemplary saddle points. An enlargement of the area within the dotted circle is shown in the lower right corner. For simplicity, three segments of length L1, L2 and Li are shown. Again, for simplicity, flow is presumed to be generally along a north-south line, although other flow directions can be implemented (diagonal arrows at top, 55). Each segment comprises two transition zones (52), one at the upstream termination and one at the downstream termination of the segment. In other embodiments, any segment can comprise no, one or two transition zones. Peaks are indicated by solid lines, valleys, by dot-dashed lines. There is a phase shift of a/2 where a is the wavelength between each segment and the next, so that peaks of one segment are aligned with valleys in the previous and next segment. The end (56) of each peak, the point where it starts to descend to the IML (56), is indicated by a large circle, while the end (57) of each valley, the point where it starts to rise to the IML (56), is indicated by a small circle. In the obstacle zone, which comprises two adjacent transition zones which meet at a common border line, starting from an end of a valley and passing through the IML (55) to the end of the next laterally adjacent valley, for simplicity to the valley to the right, the plate will rise and then fall again. Similarly, starting from an end of a peak and passing through the IML (55) to the end of the next laterally adjacent peak, for simplicity the peak to the left, the plate will fall and rise again. The points on the IML (55) where a valley-valley line and a peak-peak line meet, and where the valley-valley line is highest and the peak-peak line is lowest (M, 51) is a saddle point.

Figure 6A:
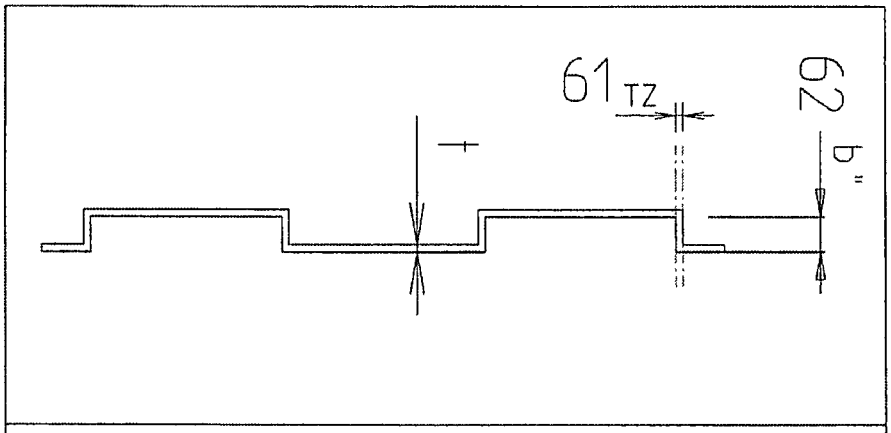
FIGS. 6A-C schematically illustrates shapes of chamfers in transition zones according to several embodiments of the invention.
Figure 6B:
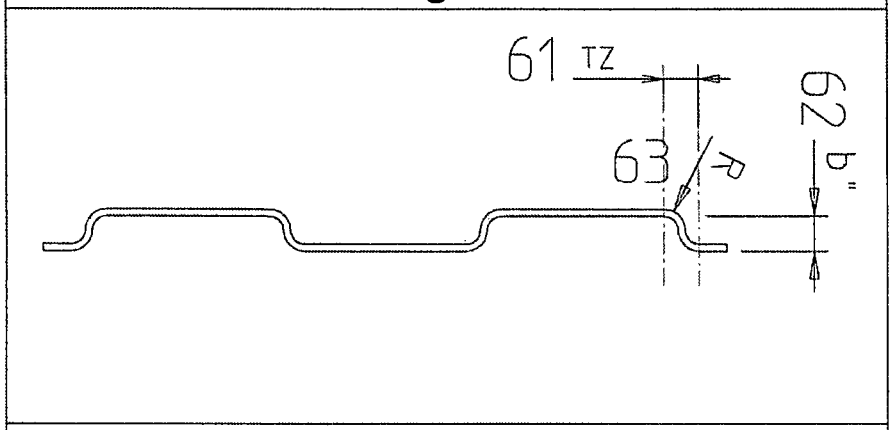
Figure 6C:
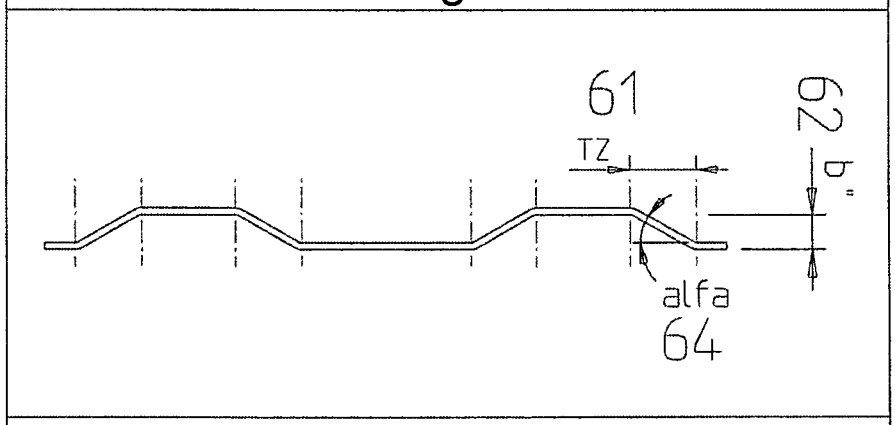

FIG. 6A-C illustrates, in a not-to-sale manner, non-limiting embodiments of chamfers in the transition zones between the peaks and valleys. In all examples, the plate thickness (62) is b. FIG. 6A schematically illustrates a corner transition zone, wherein a peak and a valley meet at the IML; the thickness of the metal is the TZ (61) width; the link between the peak and the valley lies in the tz (61). FIG. 6B illustrates radiused TZs (61), wherein the peak ends before the IML, the transition zone is radiused down to the IML, with radius R (63). The plate then passes along the IML and the valley transition zone, which ends after the IML is radiused into the valley with radius R (63). The transition zone (61) width is TZW. FIG. 6C schematically illustrates chamfer TZs. The peak ends before the IML and the transition zone (61) lowers linearly to the IML, forming an angle α (64) with a perpendicular to the plate. The plate then passes along the IML and the valley transition zone lowers linearly to the valley, which ends after the IML. The transition zone (61) width is TZW.

Figures 7A, 7B:
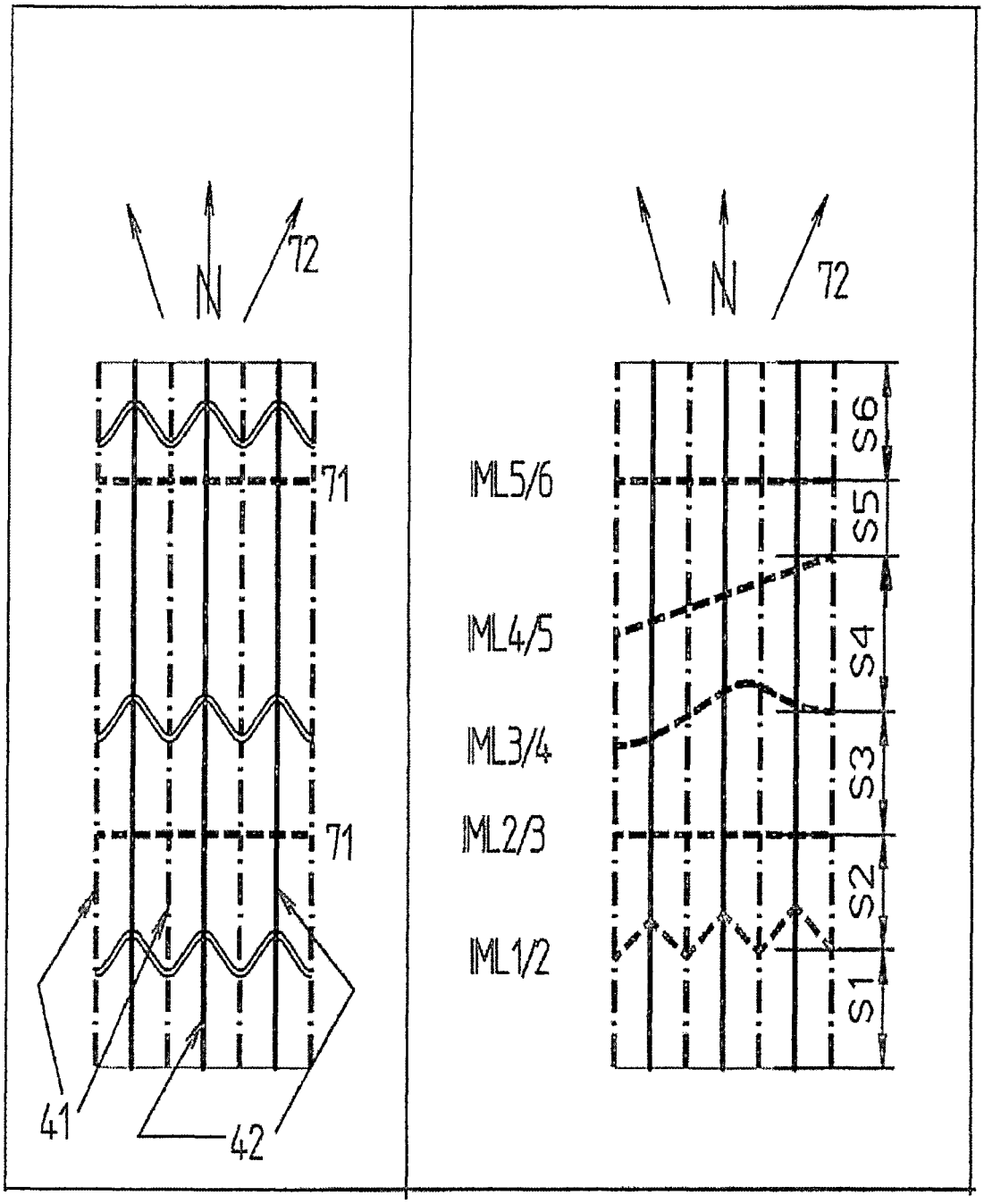
FIGS. 7A-C and 8 schematically illustrate a top view of configurations of segmentation lines between segments according to several embodiments of the invention.
Figure 7C:
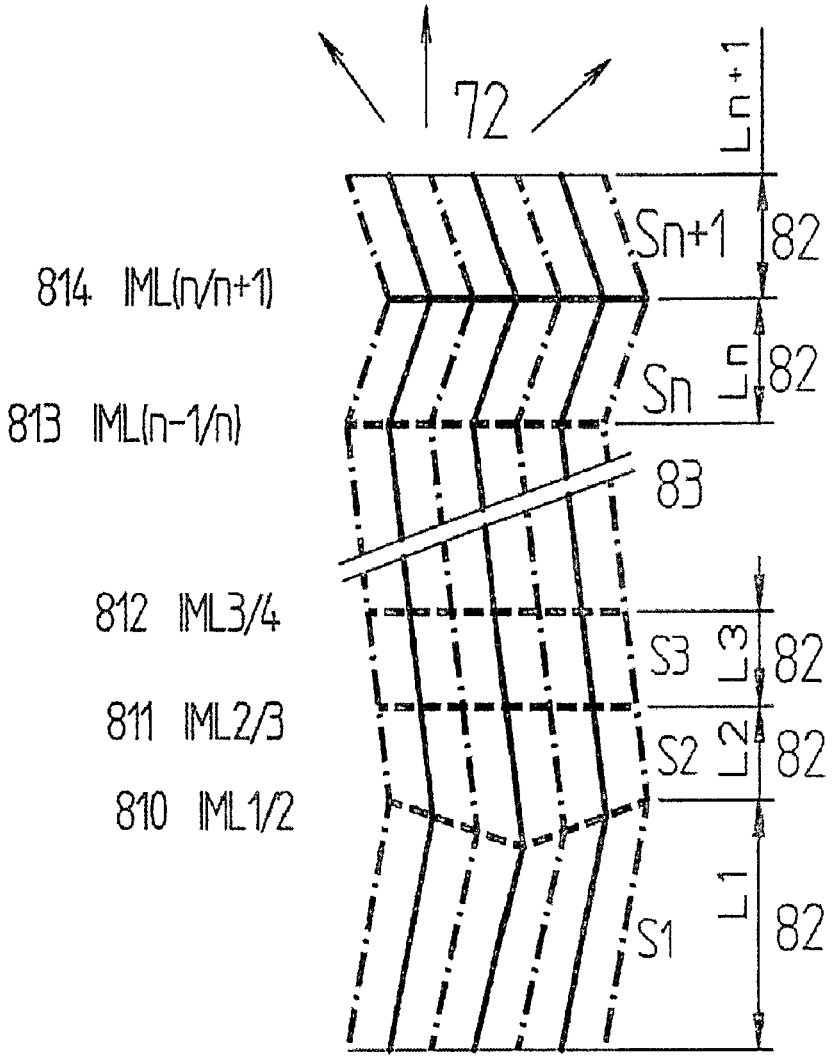

FIGS. 7A-C show various examples of the segmentation, all shown from a top view. For the sake of simplicity, the obstacle zone is omitted; the obstacle zones can be thought of as contained within the border line. Segments may be situated at any angle with reference to the plate lengthwise axis, the north (72) direction. This is shown by the arrows which are pointed at various directions.

FIG. 7A schematically illustrates a basic partition into identical rectangular segments and the segmentation lines (IML, 71)) separating each pair of adjacent segments are straight lines. The peaks (42) are indicated by solid lines, the valleys (41) by dot-dashed lines.

FIG. 7B schematically illustrates examples of differently shaped segmentation lines—straight lines perpendicular to the wave pattern (IML2/3 and IML5/6), a straight line meeting the wave pattern at an angle (IML4/5), a curved line (IML3/4) as well as zigzag IML (IML1/2). A closed line (not shown) indicates one segment surrounded by another segment.

FIG. 7C gives examples of different segment lengths and different segment angles. Segment widths can also differ transversely. In FIG. 7C, the peaks are indicated by solid lines, the valleys by dot-dashed lines. The diagonal double line (83), where shown, as in FIG. 7C, indicates that, for clarity, some segments have been omitted. Although all the segments (84) (S(1), S(2), S(3), . . . S(n), S(n+1)) share a common wave pattern, for example, with a V-shaped cross-section, and a similar width, they are different lengths (82) (L(1), L(2), L(3), . . . L(n), L(n+1)), and can be differently angled with respect to the north direction. Intermediate line IML1/2 (810) is not straight; individual waves across the segment are of different lengths. Intermediate lines (811, 812, 813, 814) IML2/3, IML3/4, IMLn−1/n and IMLn/n+1 are straight and are parallel to the base of the plate. IML2/3 (811) and IML3/4 (812) link segments with collinear peaks and troughs, but the segments are of different length. IMLn−1/n (813) and IMLn/n+1 (814) link segments that are angled with respect to each other, the angles different both in magnitude and in direction, with the segment of length L4 angled to the left, segment S5 angled to the right, and segment S6 angled left.

Figure 8:
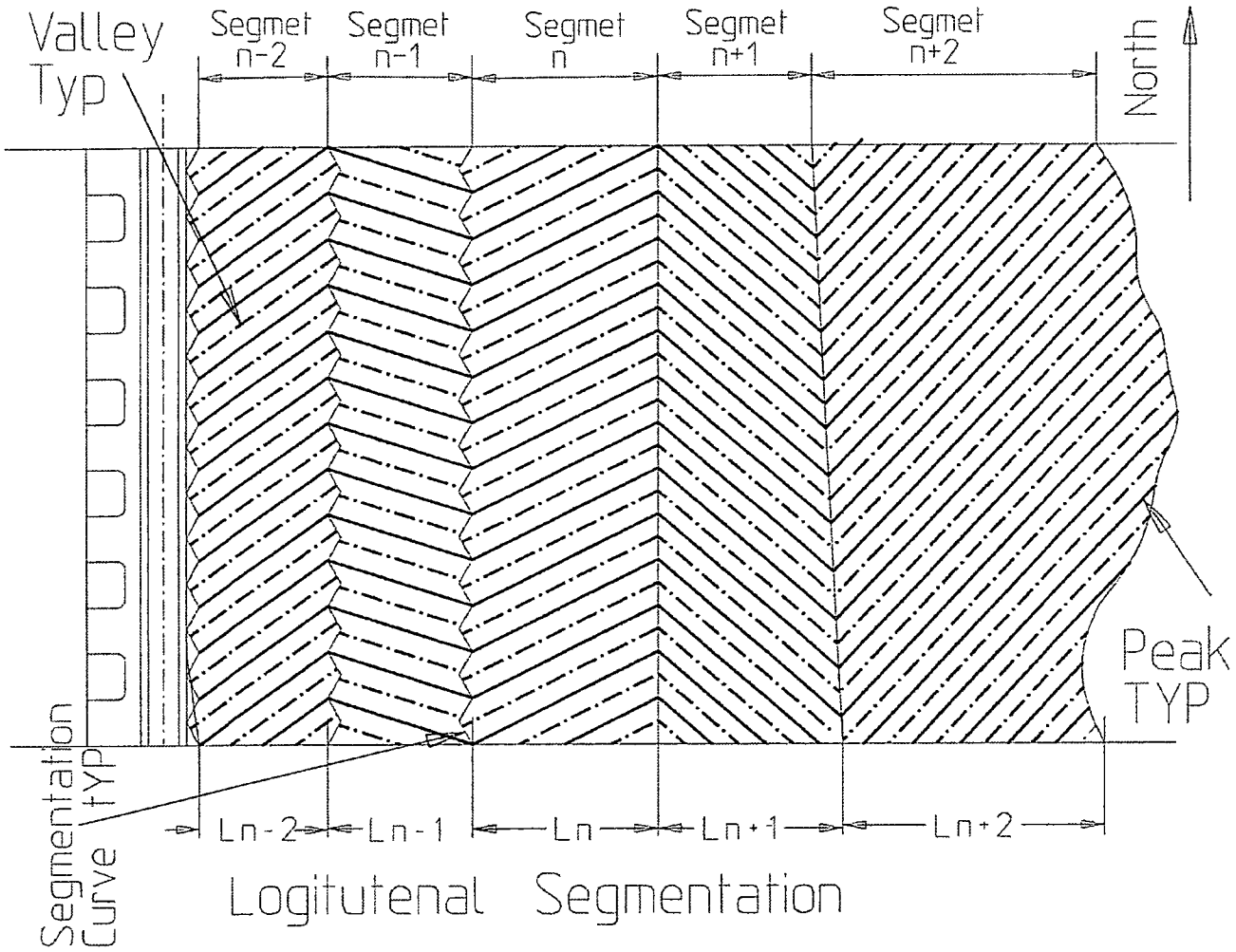

FIG. 8, shown from a top view, schematically illustrates another example of segmentation, lateral segmentation. Peaks (1710) are indicated by a solid line, valleys (1720) by a dot-dashed line. The segments have lengths Ln−2, Ln−1, Ln, Ln+1 and Ln+2, which differ from each other. The gasket lengthwise notches (1760) on the plate are parallel to the north-south direction. This example schematically illustrates curved (1730), zig-zag (1750) and straight (1740) segmentation lines. This example emphasizes the possibility of the segmentation lines being aligned in any desired direction and having any desired shape.

The high wavy zone is characterized by a relatively low flow resistance as well as a low heat transfer coefficient. This result, at least partly, from the relatively large flow path cross-section, and, in most embodiments, also from a lack of mixing between adjacent flow paths within the same segment. In order to increase the heat transfer coefficient with a minimal increase in flow resistance, typically, obstacles are inserted into the obstacle zone between two consecutive high-wavy zones. The obstacles block part of the flow path; the smallest free cross-sectional area (through which the fluid will pass) in the obstacle zone is the "window". The window can be at any angle to the longitudinal axis of the plate (and to the flow paths) depending on the obstacle pattern geometry. The 'window height' in an obstacle zone is the height of the window, the smallest vertical height (z-axis) through which the fluid can pass within the obstacle zone. The window shape can vary dramatically depending on the wave pattern geometry and obstacle pattern geometry. Windows can be continuous (linking two or more flow paths) or discontinuous; an obstacle zone can allow fluid from one flow path to flow into a single downstream flow path or can allow fluid from one flow path to flow into two or more downstream flow paths.

The reduced cross section, as well as the specific window geometry, increases the flow velocity. The obstacles may result in a change of flow direction, a velocity change and added vorticity, all inducing added flow turbulence. All of the above tend to improve the heat transfer coefficient at the cost of an increased pressure drop. In addition, certain designs of the obstacle zone (see FIG. 2A, above), comprising two adjacent transition zones, allow flow from one flow path of the previous segment's high-wave region to be split into several flow paths of the next segment's high-wave region. This also results in better flow mixing, leading to a better heat transfer coefficient and improves transverse spreading of fluid throughout the plate, which improves the PHE plate overall utilization.

For embodiments using any particular manufacturing process, the final pattern can take into account sheet metal and manufacturing considerations, due to which, for instance, the variations in structure have to be gradual enough so that manufacturing will be possible with specific sheet metal materials. For most embodiments, the resulting PHE corrugated plate has complete unperforated surfaces which facilitates heat transfer between two fluids, which flow on either side of the plate, without any direct contact between the two fluids. In some embodiments, additional perforated plates can be inserted into the PHE stack.

An important embodiment of the general segmentation design scheme described above is the geometrical concept of phase shifting between adjacent segments. The phase shifting technique causes a shift in a selected segment with relation to the segments before and/or after it. The phase shifting transverse offset between adjacent segments, denoted by PHi, can be positive or negative, leftward or rightward with respect to the flow direction, at an absolute value between 0 (no shift) and the plate heat transition zone width, and any combination thereof. A geometrical pattern in which adjacent segments are situated at a phase shift with relation to each other is denoted as a 'staggered formation'.

In FIG. 7A the pattern as shown includes no phase shift, so that PH=0.

Figure 9A:
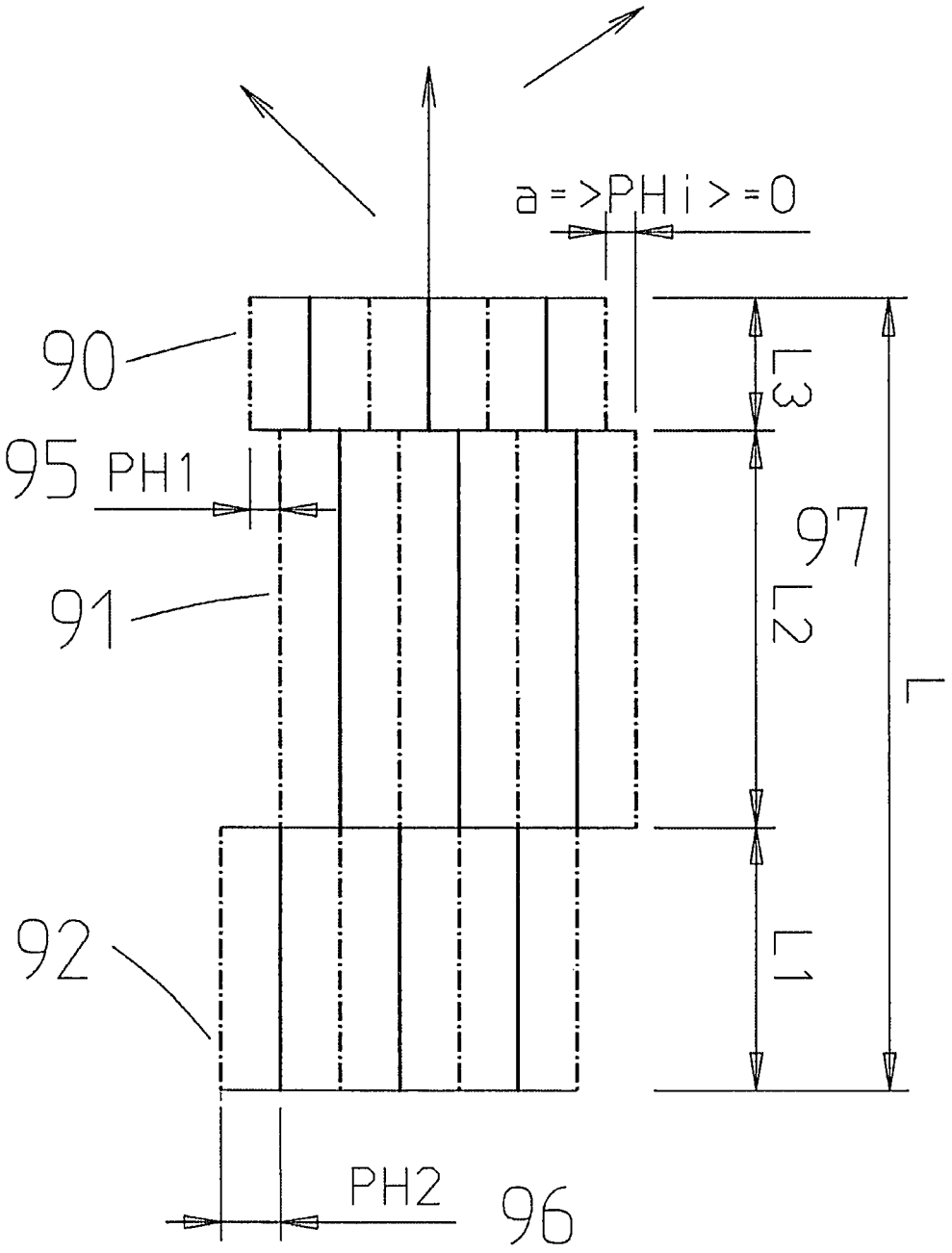
FIGS. 9A-B schematically illustrates phase shifts between segments according to several embodiments of the invention.
Figure 9B:
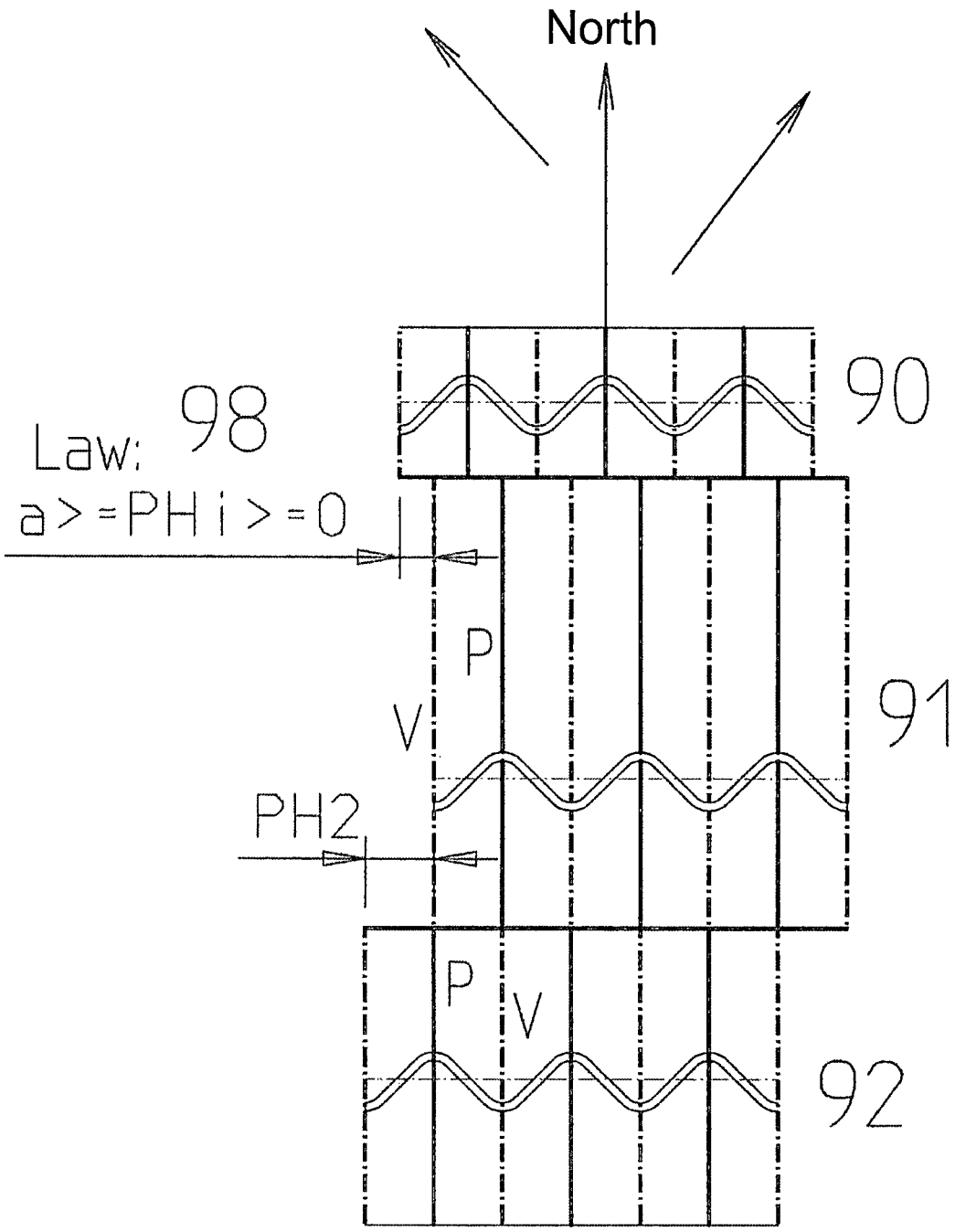

In FIG. 9A-B, a plate is shown with V-shaped waves which can be positioned at any angle with respect to the plate north direction, as indicated by the arrows. FIG. 9A shows a top view of the plate, while FIG. 9B shows side views though the three segments (90, 91, 92). Three segments (90, 91, 92) are schematically indicated in the figure, with phase shifting offsets PH1 and PH2, PH1 being between the segment of length L2 and the segment of length L3 and PH2 being between the segment of length L1 and the segment of length L2. An offset can vary from 0 to any selected value. In this example, $a/2>PH_1>0$ and $PH_2=a/2$ (where a is the wavelength as defined in FIG. 2B). It should be noted that, typically, the phase of a segment rather than an entire segment is shifted; there would be a partial peak or valley at the edge of the segment so that the edge of the heat transfer zone remains substantially straight, rather than as shown in FIG. 9.

The offset PHi can vary transversely between flow paths, longitudinally between segments and any combination thereof.

Within a staggered formation geometrical pattern, the offset between adjacent flow paths, along with flow obstructions and flow deflecting transitional zone windows in between the HWZs, cause a transverse deflection of the direction of fluid flow at the transition between adjacent segments, which adds to flow vorticity and turbulence, and in turn improves the heat transfer rate throughout the plate.

When the plates are stacked on one another during heat exchanger assembly, at least some of the upward protrusions of one plate will abut depressions of the adjacent plate above and, similarly, at least some of the depressions of one plate will abut upward protrusions of the plate below, creating points, lines or surfaces with specific geometrical shapes of support (support regions) between the adjacent plates. Typically, in the HWZ, only lines of support are found.

These points and lines of support transfer the pressure and the forces acting on the plates to the frame plates and the tie rods, so that the PHE plates will not undergo buckling and deformation due to operational stresses. In a scenario where the pressure within the heat exchanger is sub-atmospheric, the abutment lines and points on the PHE plate corrugation pattern will counter the inward directed stresses, so that the PHE plates will not undergo inward deformation or buckling.

The horizontal distance between the support regions, along with other parameters, such as the plate thickness b and the sheet metal thickness t, determine the ability of the plate to withstand high pressure and sub-pressure conditions. As the distance between support regions decreases, the ability of a thin plate to withstand high pressure and sub-atmospheric pressure conditions increase. In prior art herringbone pattern heat exchanger plates, the distance between support regions is normally in the range of 8-12 mm or more, whereas in prior art "micro-channel" pattern type heat exchanger plates, such as WO2017/133618, the distance between the support points is smaller, at a range of 7-9 mm, which enables this plate type to withstand pressures higher than that of the herringbone pattern for the same plate sheet thickness (t).

The structures described in this application enable a distance as small as approximately 5 mm between the support lines or points, which allows the PHE to withstand high operating pressure conditions of 50 atm or more with a 0.5 mm plate sheet thickness or 16 atm pressures with only 0.2 mm plate sheet thickness.

The reduction of the plate sheet thickness bears many advantages, apart from lowering the heat exchanger weight and price: The thin plate sheet improves the heat transfer through it (the thinner the sheet, the better the heat conduction through it).

The inter-plate support lines and points and the metal thickness determine the maximum depth of the flow paths; the maximum depth of a flow path being the distance between the underside of the protrusions on the higher plate and the upper side of the depressions on the adjacent lower plate.

Figure 10:
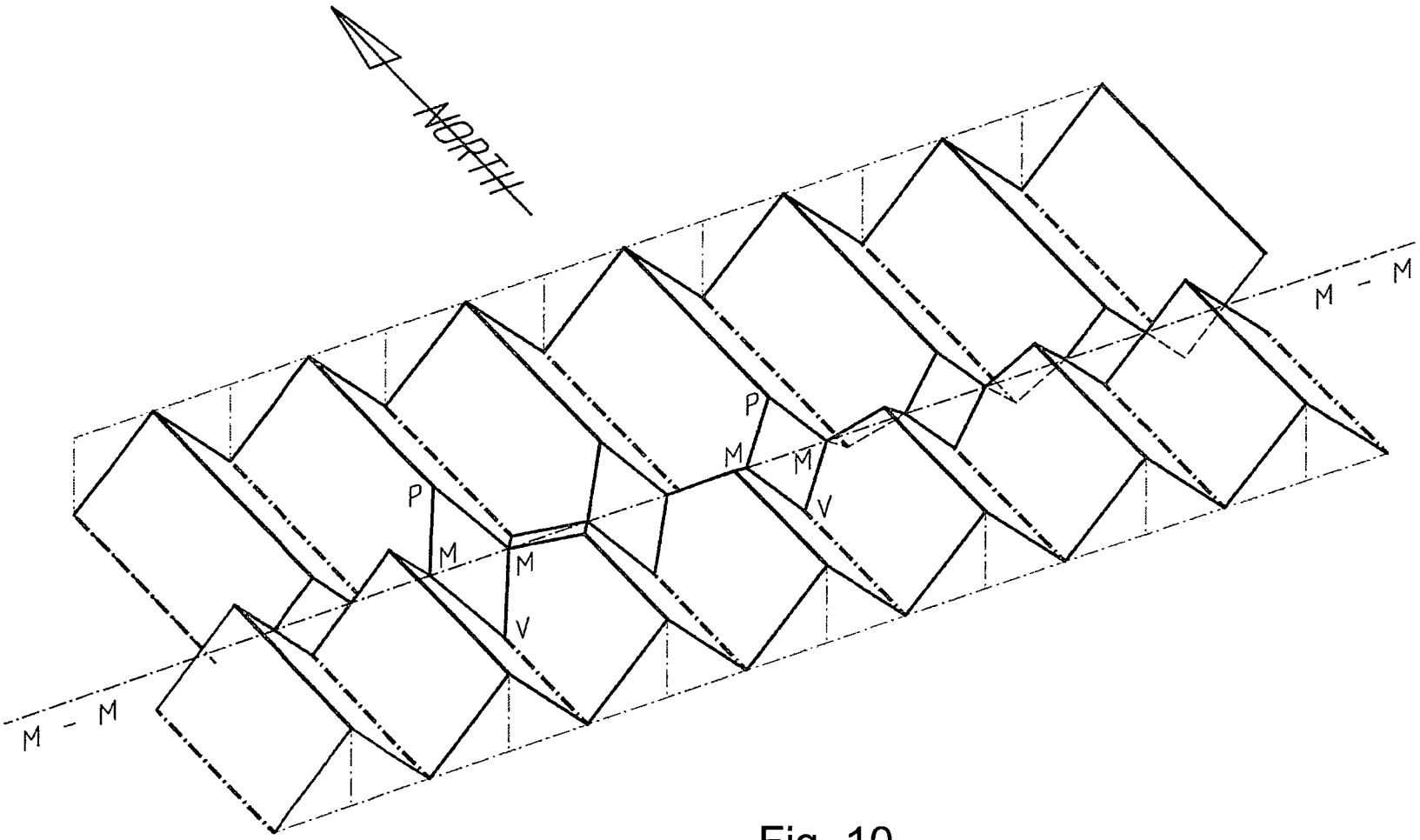
FIGS. 10 and 11 schematically illustrate segments meeting at intermediate lines, showing windows and obstructions according to several embodiments of the invention.

The intermediate line (center line M-M) is noted in FIG. 10, including triangles which appear above the line (Pi–Pi+1–Mi) which appear across the center line for the open flow paths above the horizontal plane and diamonds which appear across the IML and are marked as half-diamond triangles Mi–M(i+1)–Vi for the obstruction below the horizontal plane, (where M signifies a mid-height saddle point and V signifies a valley point) and half-diamond triangles Mi–M(i+1)–P(i+1) for the obstruction above the horizontal plane, (where P signifies a peak point). The IML is significant in that this boundary between segments is physically within the material of the plate. The triangles showing open flow paths below the IML are not shown in this figure.

The sizes of the obstructions depend on the angle between the line of the peak and the plane of the obstruction for a flat obstruction such as that shown. For example, the obstruction M10-V11-M11-V12, which is at 90° to the peak line P1 is smaller than the obstruction M8-V9-M9-P9, at a smaller angle to the peak line. Similarly, the angle decreases as the obstruction area increases for M6-V7-M7-P7, M4-V5-M5-P5. The angle is smallest and the obstruction area largest for obstruction M2-V3-M3-P3.

Figure 11:
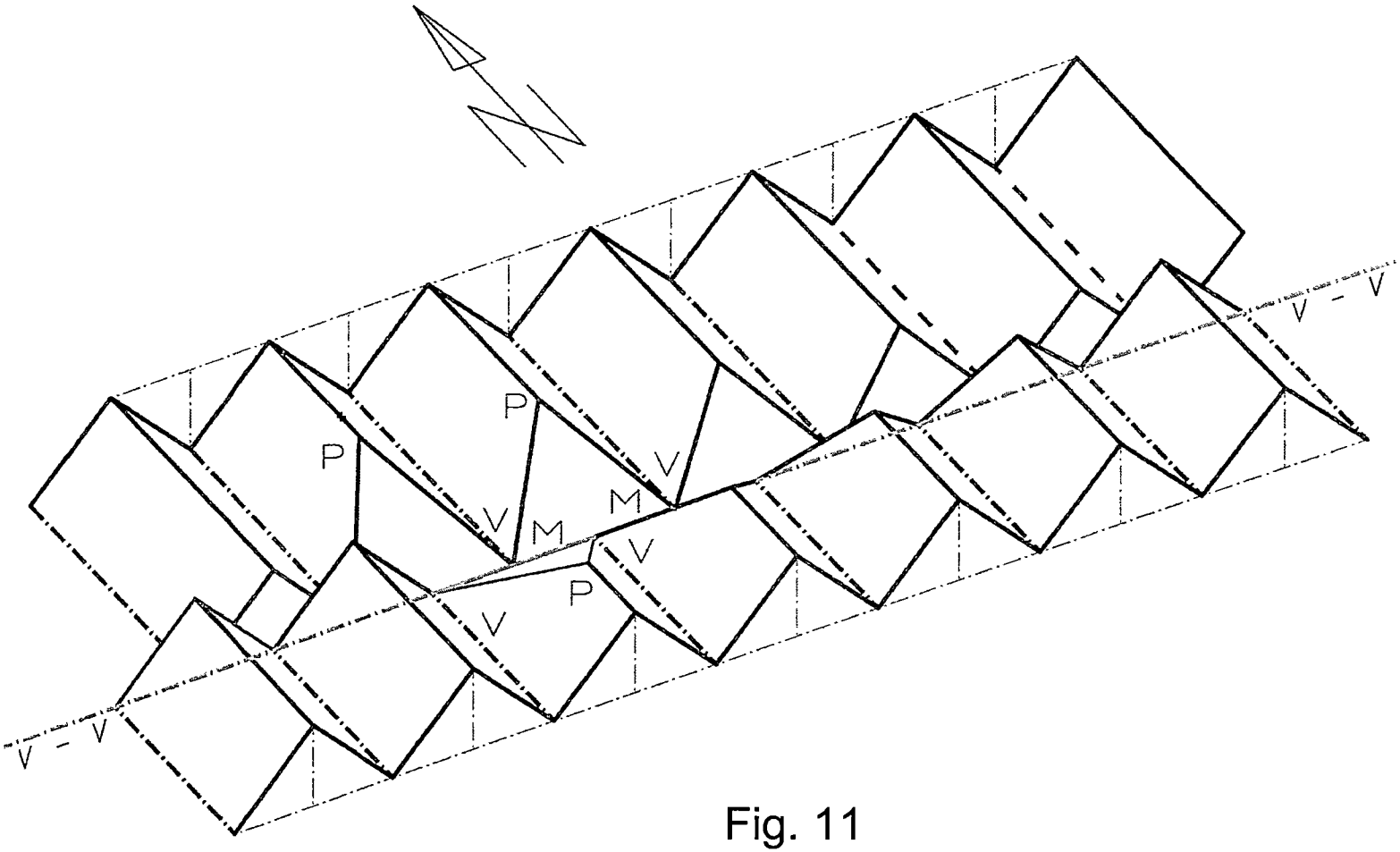

A base valley line (center line V-V) is noted in FIG. 11. The center line V-V passes through the ends of each of the valleys (dotted circle).

Figure 12:
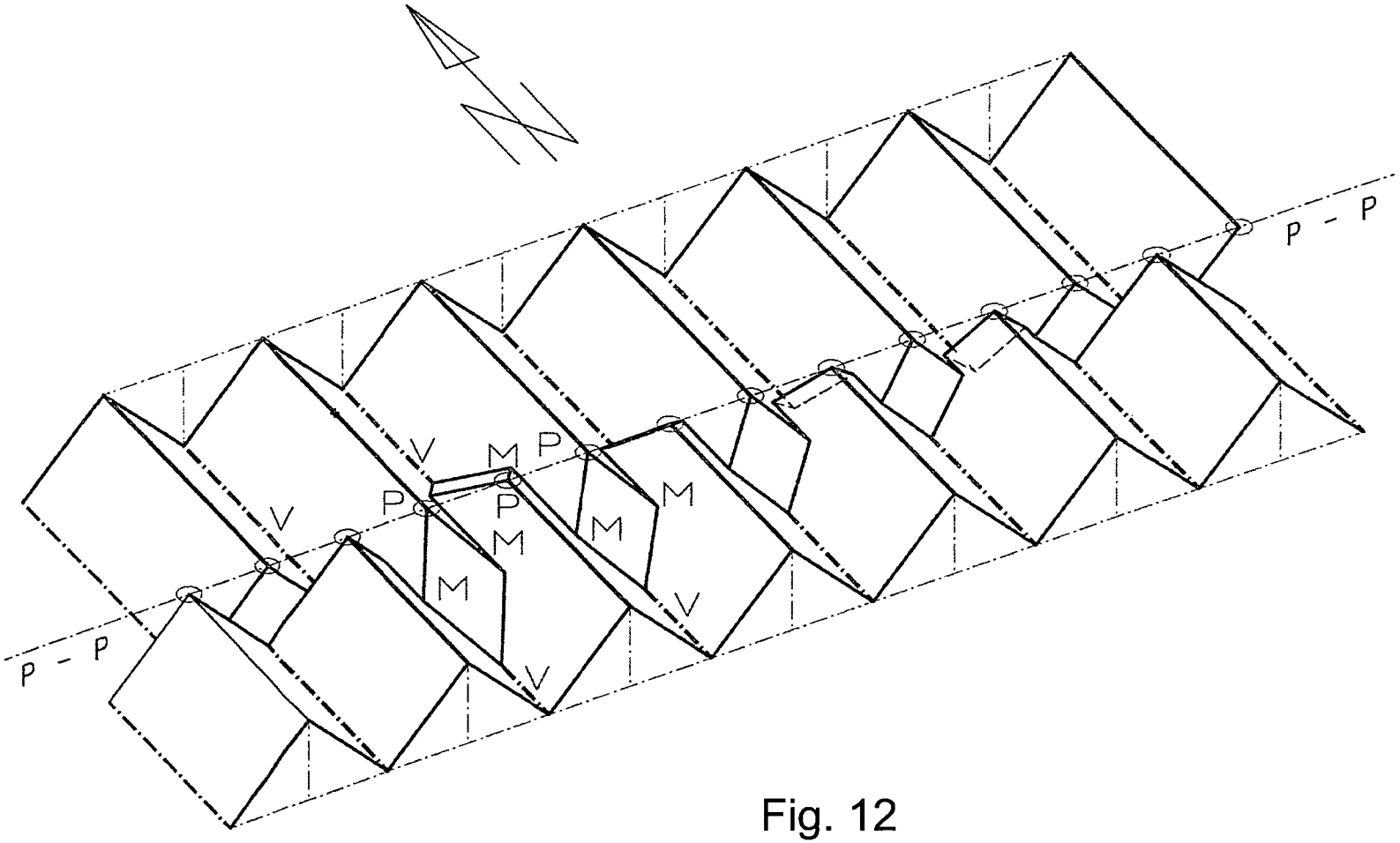
FIG. 12 schematically illustrates segments meeting at intermediate lines, showing the change in size and shape of obstructions as the angle between a peak and its associated obstruction changes according to several embodiments of the invention.

An upper peak line (center line P-P) is noted in FIG. 12. The center line P-P passes through the ends of each of the valleys (dotted circle).

Figure 13:
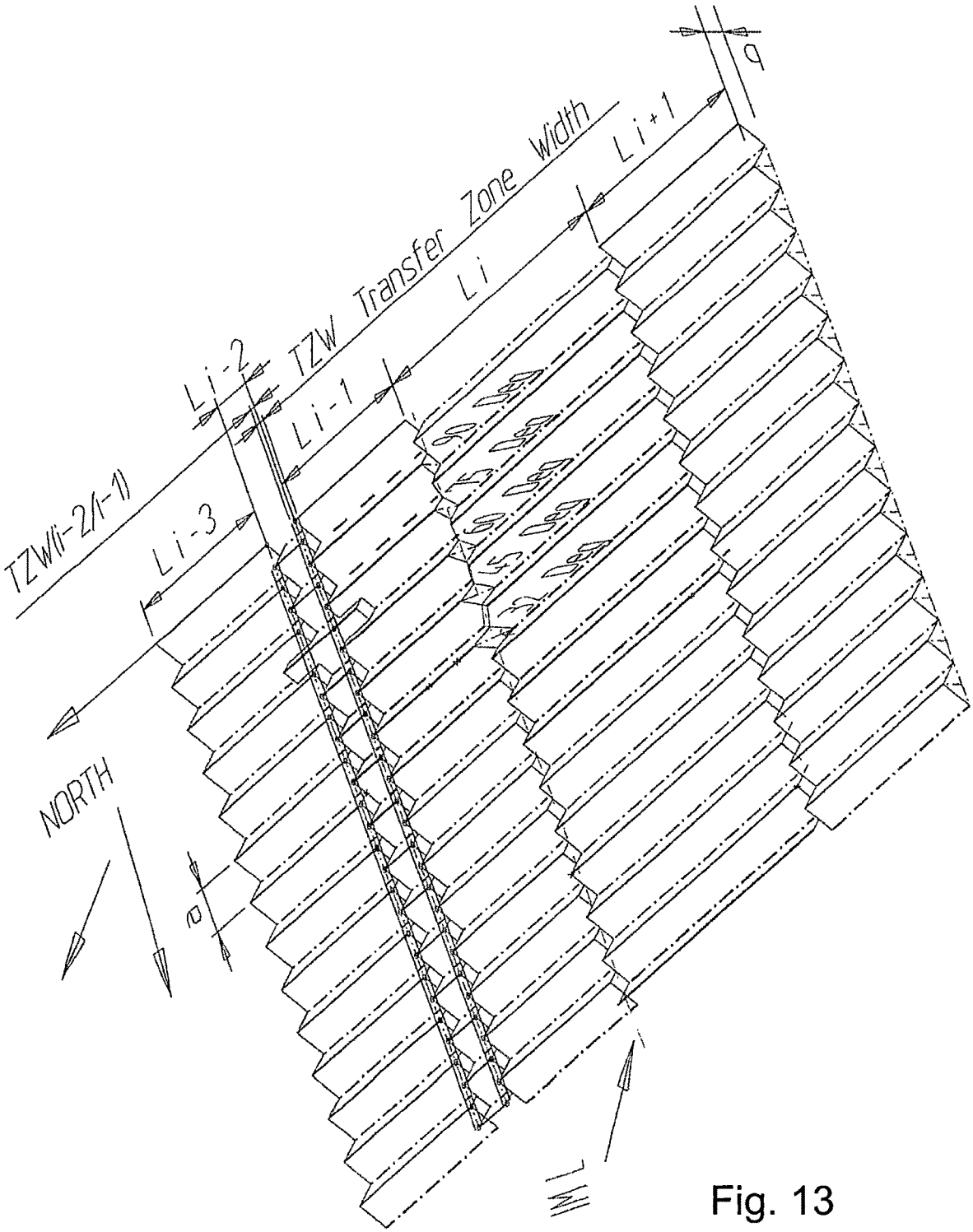
FIGS. 13 and 14 schematically illustrates the transition zones on both sides of IMLs between segment and fluid flow from a segment through the transition zone to an adjacent segment.
Figure 14:
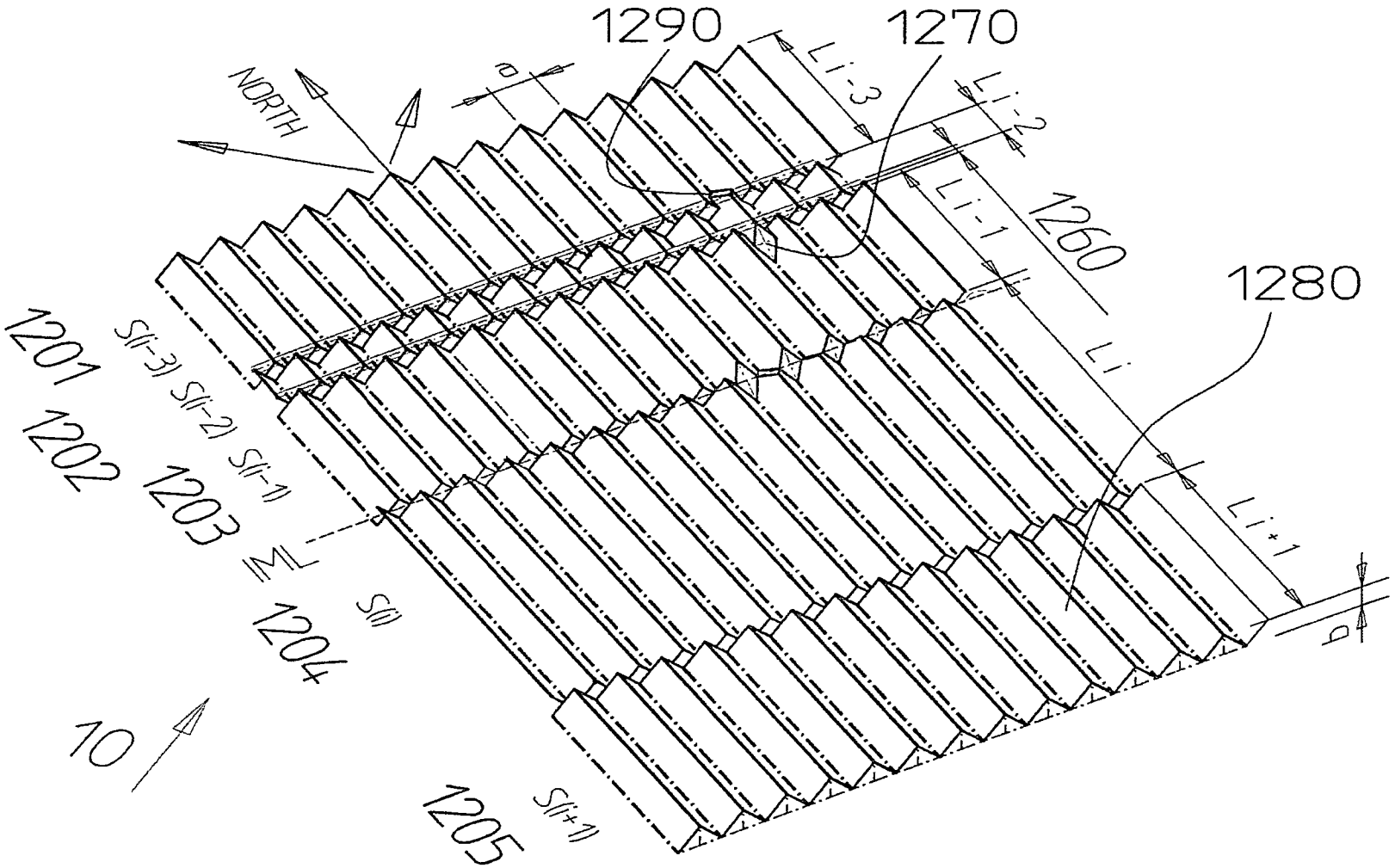

As discussed above, the high wavy zone is characterized by a relatively low flow resistance as well as a low heat transfer coefficient. Increasing the length of this region within the plate corrugation pattern will affect the segment length as well as the plate hydraulic and thermal performance. FIGS. 13 and 14 show segments of various lengths, long and short. The segment length, Li, the distance between segmentation lines, is one of the important plate design parameters. As the high wavy zone length, which is the segment length minus the transition zone lengths, increases, assuming a fixed length for the obstacle zone and a fixed length for the heat transfer zone, the hydraulic resistance decreases, while the heat transfer coefficient also decreases.

In FIG. 13, which is not to scale, the portion (10) shown of the plate has five segments (1, 2, 3, 4, 5), of lengths Li–3, Li–2, Li–1, Li and Li+1. Transition zones are shown between segments of length Li–3 and Li–2 and between segments of length Li–2 and Li–1. The obstacle zone between segments of length Li–2 and Li–1 has width b, the same as the thickness of the plate; each transition zone in the obstacle zone has a width of b/2. The terminations of peaks are shown (17', 17"). The heat transfer area of the plate (10) ensures complete separation of fluid above the plate from fluid below the plate. In some embodiments, at least one plate comprises apertures allowing fluid from one side of the plate to mix with fluid from the other side of the plate. In the embodiment of FIG. 11, fluid cannot flow over a peak from a valley to an adjoining valley or under a valley from one peak to an adjoining peak. In this embodiment, each flow path (11) for fluid flowing above the plate (10) has a uniform width between adjacent peaks (17); similarly, each flow path for fluid flowing under the plate has a uniform width between adjacent valleys. In the embodiment shown, each flow path (3, 4, 11) has a centerline (14); the centerlines (14) are oriented parallel to the main longitudinal axis of the plate. In other embodiments, centerlines (14) can be oriented at other angles, including lateral to the main longitudinal axis of the plate. The depth b of a flow path is determinable as the vertical (z-direction) distance between the summit (17) of a peak (12) to a centerline (14) of a valley (16).

A closed terminal portion (22) at a terminal end (27) of a peak or valley, which can at least partially block fluid flow entering or exiting a flow path, occurs between two adjacent protrusions that form a peak (17) therebetween. A closed terminal portion can have a planar or curved surface. Closed terminal portions or obstacles can have complex curved shapes.

An obstacle (22) can block flow exiting a flow path. In this embodiment, an obstacle (22) is bounded by the terminal edges of peaks in one segment (3) and the terminal edges of valleys in the adjacent segment (4).

A transition zone between the high wavy zone and the intermediate line can be used to tune the properties of the fluid flow through the plate. The transition zone shape, as well as any non-standard segments between one high wave zone and a subsequent high wavy zone can affect the fluid velocity, fluid turbulence and fluid vorticity, as well as affecting the mixing of fluid from different flow paths. All of these affect the heat transfer coefficient between the fluids.

In FIG. 14, which is not to scale, the portion (10) shown of the plate has five segments (1201, 1202, 1203, 1204, 1205), of lengths Li−3, Li−2, Li−1, Li and Li+1. Transition zones are shown between segments of length Li−3 (1201) and Li−2 (1202) and between segments of length Li−2 (1202) and Li−1 (1203).

The shortest segment (1202), can be (as shown) a standard segment, but is more typically a non-standard segment, one, for example, with a low wavy zone. All of the segments have the same wavelength, a, but the segments have different lengths. All of the segments have a phase shift of a/2 relative to an adjacent segment. so that, for each of these, a peak in one segment is collinear with a valley in the next segment. The plate thickness is b. IMLs IML(i−1/i) (1206) and IML (i/i+1) (1207) are shown.

An obstruction can extend into a neighboring peak or valley as a low peak (1290). It an end with a vertical chamfer, or with a chamfer of any desired shape, With the linear chamfer shown in FIG. 14, the width of the transition zone between segments can be varied. In this embodiment, the chamfer is flat, and its area depends on the angle between the peak (or valley) line and the plane of the chamfer. The smaller the angle between the peak (or valley) line and the plane of the chamfer, the larger the chamfer is and the further it extends toward (or into) the adjacent high wavy zone. The long chamfer (1270) extends down about ⅙ of the way from the end of the peak in Segment S(i−2) (1207) into the adjacent valley of the high wavy zone of Segment S(i−1) (1203).

Figure 15A:
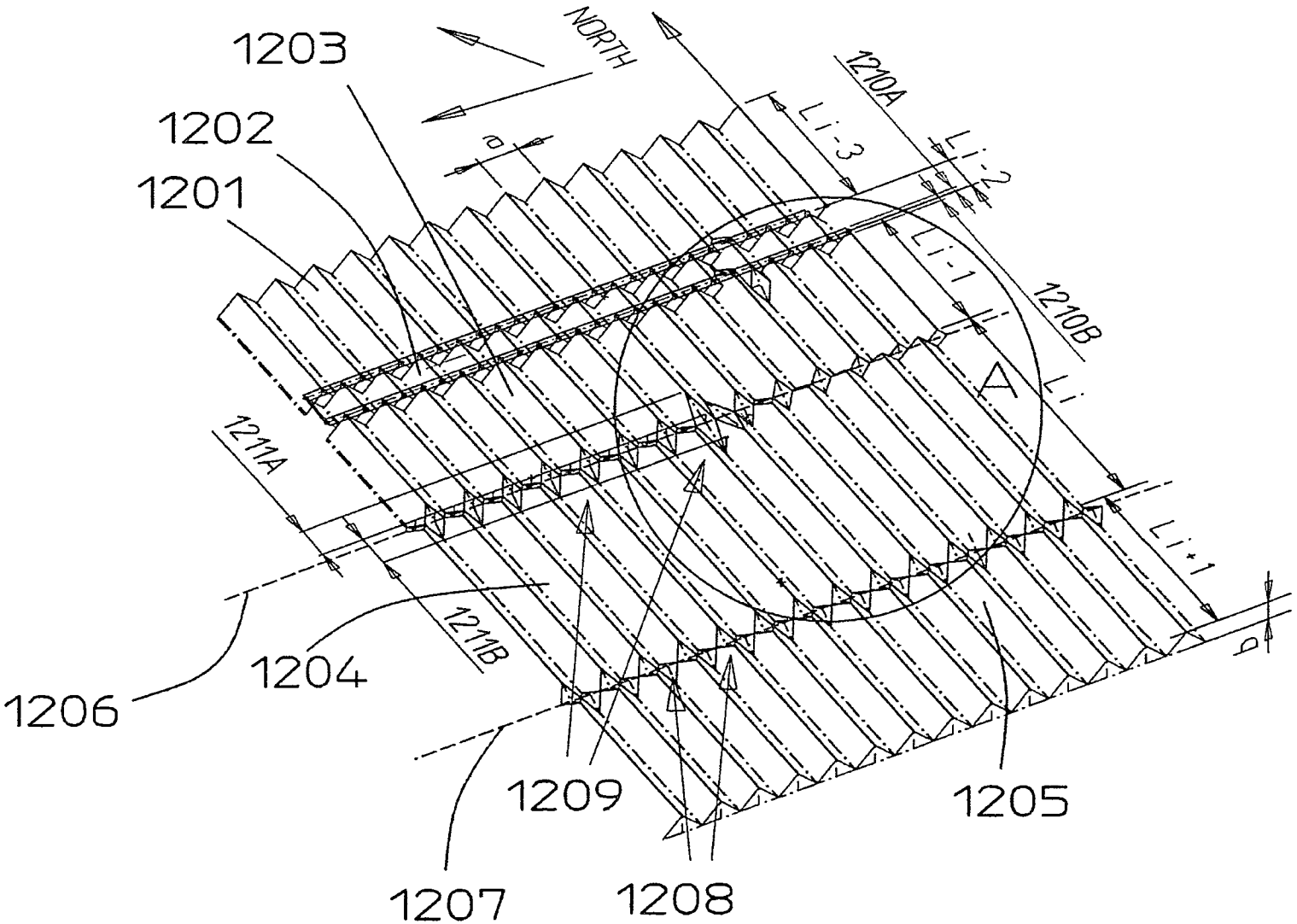
FIGS. 15A-D schematically illustrates a segment in which the high wavy zone comprises a plurality of peaks and valleys according to several embodiments of the invention.
Figure 15B:
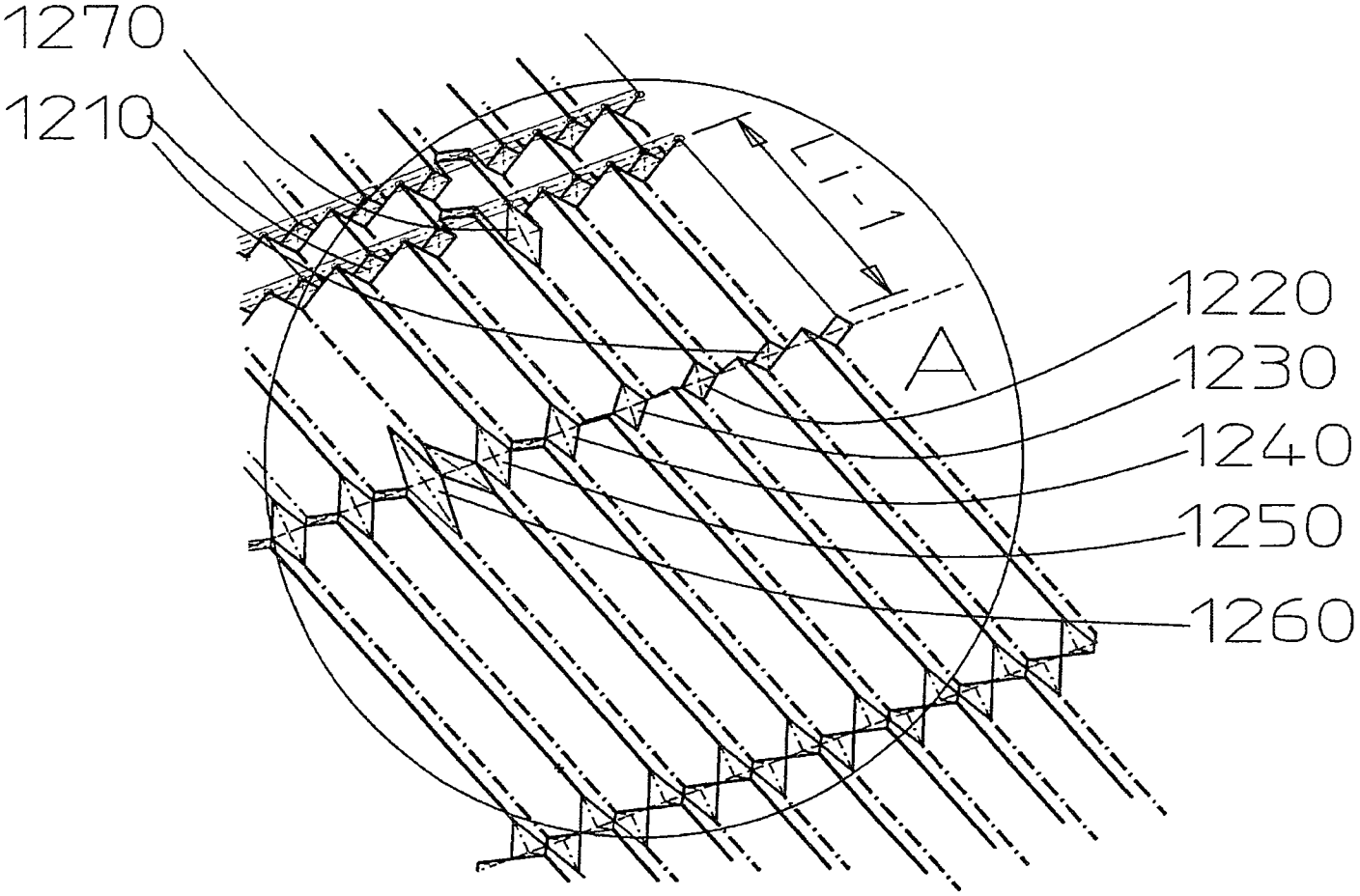

The segments shown in FIGS. 15A-B represent a corrugation design with transverse segments, although the same design could have longitudinal segments or segments at any other angle. Intermediate lines (IML) are shown in the beginning and end of each segment. The peaks and valleys in the high wavy support zone reach the segmentation surfaces in many parts of the figure. Peaks (P) are indicated by heavy solid lines and valleys (V) by heavy dot-dashed lines. In this exemplary embodiment, the IML is a straight line halfway between the plane of the peak tops and the valley bottoms. However, as described below, the IML can be can be of arbitrary shape and height.

FIG. 15A schematically illustrates five segments (1201, 1202, 1203, 1204, 1205) with different lengths (Li−3, Li−2, Li−1, Li, Li+I); FIG. 15B schematically illustrates an enlarged view of an upper central portion (circle A) of the segments of FIG. 15A. The shortest segment (1202), can be (as shown) a standard segment, but is more typically a non-standard segment, one, for example, with a low wavy zone. All of the segments have the same wavelength, a, but the segments have different lengths. There is no phase shift between the segment of length Li+1 (1205) and the segment of length Li (1204) (phase shift-0), while the phase shifts between the segment of length Li (1204) and the segment of length Li−1 (1203), between the segment of length Li−1 (1203) and the segment of length Li−2 (1202) and between the segment of length Li−2 (1202) and the segment of length Li−3 (1201) are a/2, so that, for each of these, a peak in one segment is collinear with a valley in the next segment. The plate thickness is b. IMLs IML(i−1/i) (1206) and IML (i/i+1) (1207) are shown.

With the linear chamfer shown in FIG. 15A-B, the width of the transition zones between segments can be calculated. For a chamfer angle α of 15° (1260), the transition zone width, including radiusing, will be approximately 2b; the obstacle zone width is then approximately 4b. For a chamfer angle α of 32° (1250), the transition zone width will be approximately b. For a chamfer angle α of 90° (1210), the transition zone width will be approximately b/2 The shapes of the obstacles are shown, for IML(i−1/i) (1206), for chamfer angles of 90° (1210), 75° (1220), 60° (1230), 45° (1240), 32° (120) and 15° (1260).

A chamfer (1270) making an angle of approximately 30° with a peak line and starting from a point almost directly above an IML, which extends a distance of about 2b into the neighboring valley, is also shown.

The corrugation structure which is detailed in this application comprises rows of peaks and valleys which act as support regions, as well as guiding fluid flow in a desired direction. In addition, a flow obstacle zone is created, from the end of the peak and valley array. Within the obstacle zone, the flow path is narrowed to a minimal width denoted as a 'window'. The window height, as well as the height of the obstacle above or beneath it, are parameters which are designed for plate specific performance.

If it is desired to achieve obstacles and window heights which are identical for both PHE fluids, which flow on both sides of the PHE plate, it is desirable to separate the plate cross section into 2 separate windows which are identical in size, one for each fluid. If the plate drawing depth is b' or b", or b after the plate thickness is neglected, the resulting window height at equal cross section is b'/2, b"/2 or approximately b/2.

Figure 15C:
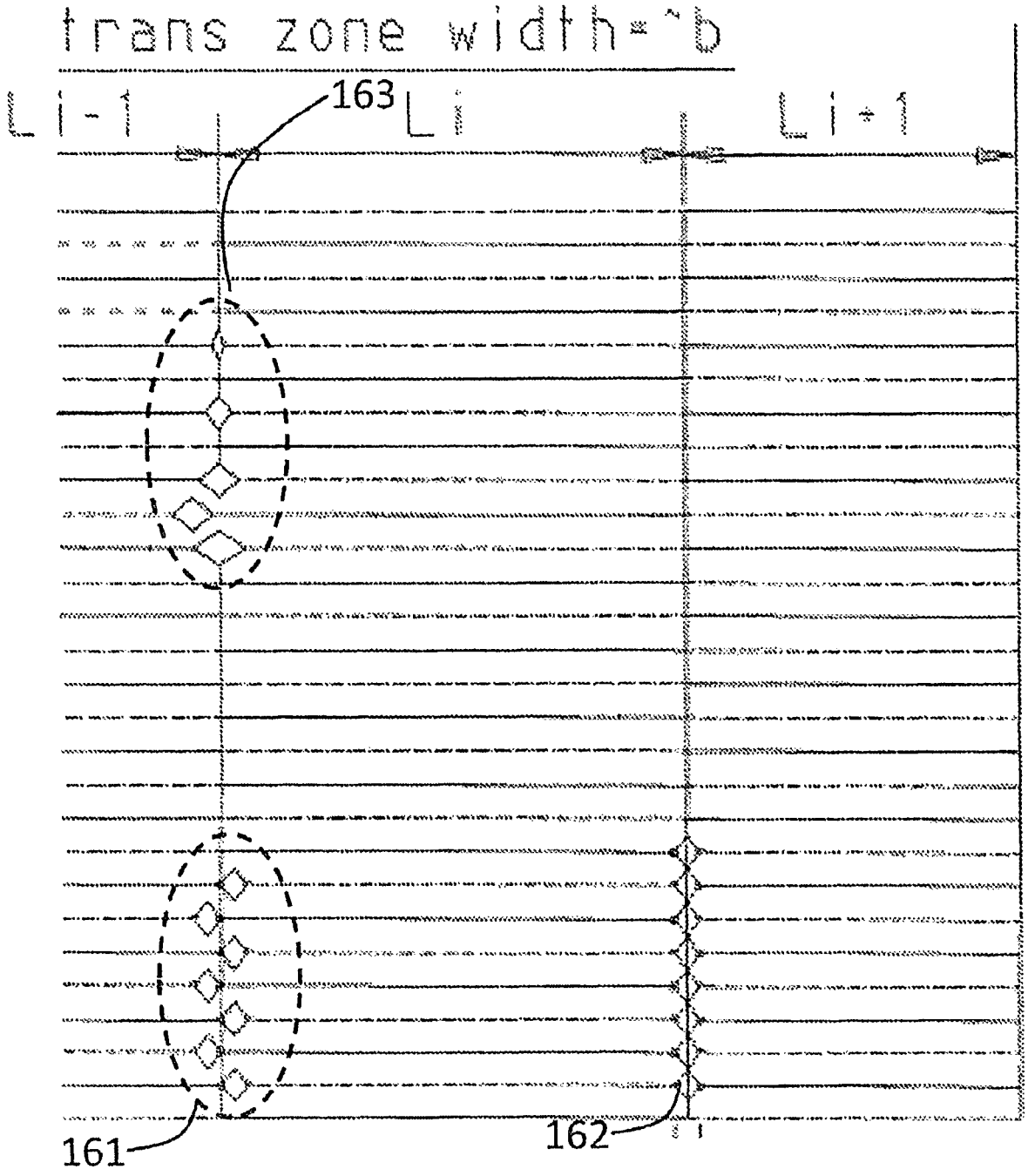

FIG. 15C schematically illustrates locations for obstructions near the ends of peaks or valleys. The obstructions can be staggered (161) so adjacent obstructions fall on opposite sides of an IML or another boundary. Obstructions can be aligned (162) so that their centers all lie on the Obstructions can be all the same size (161, 162) or different sizes ((163) and any combination thereof (164).

Figure 15D:
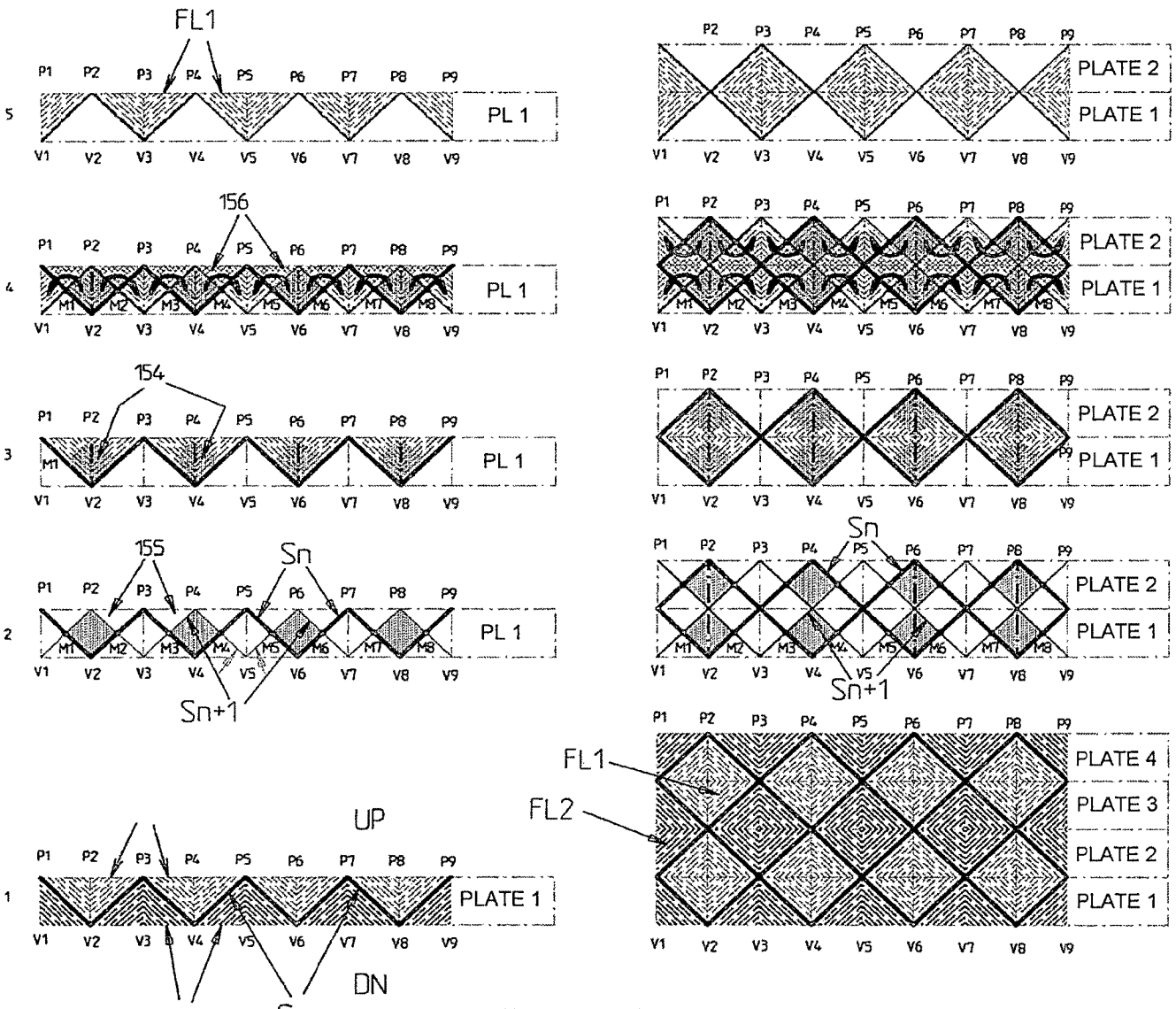

FIG. 15D illustrates plate stacks and fluid flow through different vertical cross-sections through plate stacks for flow along the plate stack. On the left is the flow through a single plate in a stack, while on the right is flow through four plates of the stack (lowest row) and two plates in a stack ($3^{rd}$ and $4^{th}$ rows). Row 2 shows the sides of the peaks and valleys in segment Sn (heavy lines), while the light lines show the sides of the peaks and valleys in segment Sn+1. The Vi (1501) are valleys, the Pi (1503), peaks and the Mi (1503) show areas of obstruction.

The lowest row shows, on the left, flow above and below one plate in a multi-plate stack. Fluid 1 flows above the plate and fluid 2 below it. The lowest row, right, shows flow above and below four plates in a multi-plate stack. Fluid 1 (light grey) flows above the first and third plates in the stack and below the second and fourth plates in the stack, while fluid 2 (dark grey) flows below the first and third plates and above the fourth plate. The fluids are flowing through a high wavy zone. All of the space is filled with fluid, with diamonds in the lowest and third rows of diamonds filled with fluid, and fluid 2 in the diamonds of the second row and the upper half diamonds below the first row of diamonds and in the lower half row of the uppermost row of half-diamonds.

The second row show the edges of the peaks and valleys (heavy diagonal lines) for the segment Sn and edges of the peaks and valleys (light diagonal lines) for the segment Sn+1. Peaks (Pi, 151) valleys (Vi, 152) and saddle points (Mi, 153) are shown. Obstructions in a transition zone (154) partially blocking the flow of fluid, and the third row shows fluids 1 and 2 flowing through the windows (155) in the first transition zone, while row 4 shows fluid flow through windows in the second half of the transition zone. Arrows in row 4 show the direction of motion across the cross section, being inward towards the peaks for fluid 1 and inward towards the valleys for fluid 2. The fifth row shows flow of fluid 1 only in a high wavy zone.

FIGS. 16A and B show portions of embodiments of structures in which segments with a high wavy zone (S(n−1), S(n+1), S(n+3)) in which the peak and valley lines are oriented longitudinally are separated by short (non-standard) segments (S(n), S(n+2) which are laterally flat and longitudinally tilted (higher at one end than the other). Peaks are indicated by heavy solid lines, valleys by heavy dot-dashed lines. FIG. 16D is an enlargement of a portion of FIG. 16C.

The embodiment of FIG. 16A has no phase shift between segments Sn−1, Sn, Sn+1 and Sn+2. The obstacle zones between segments comprise low peaks between adjacent peaks and high valleys between adjacent valleys. The intermediate lines that divide the obstacle zone into two transition zones are at different heights, with the IML between segment S(n−1) and segment Sn being at a height of 3b/4, the intermediate line between segment S(n) and S(n−1) being at a height of b/2 and the IML between segment S(n−1) and S(n−2) being at a height of b/4. All heights are exemplary; any intermediate line can be at any height between 0 and b and, as disclosed above, they need not be at a constant height and need not e straight lines.

Figure 16B:
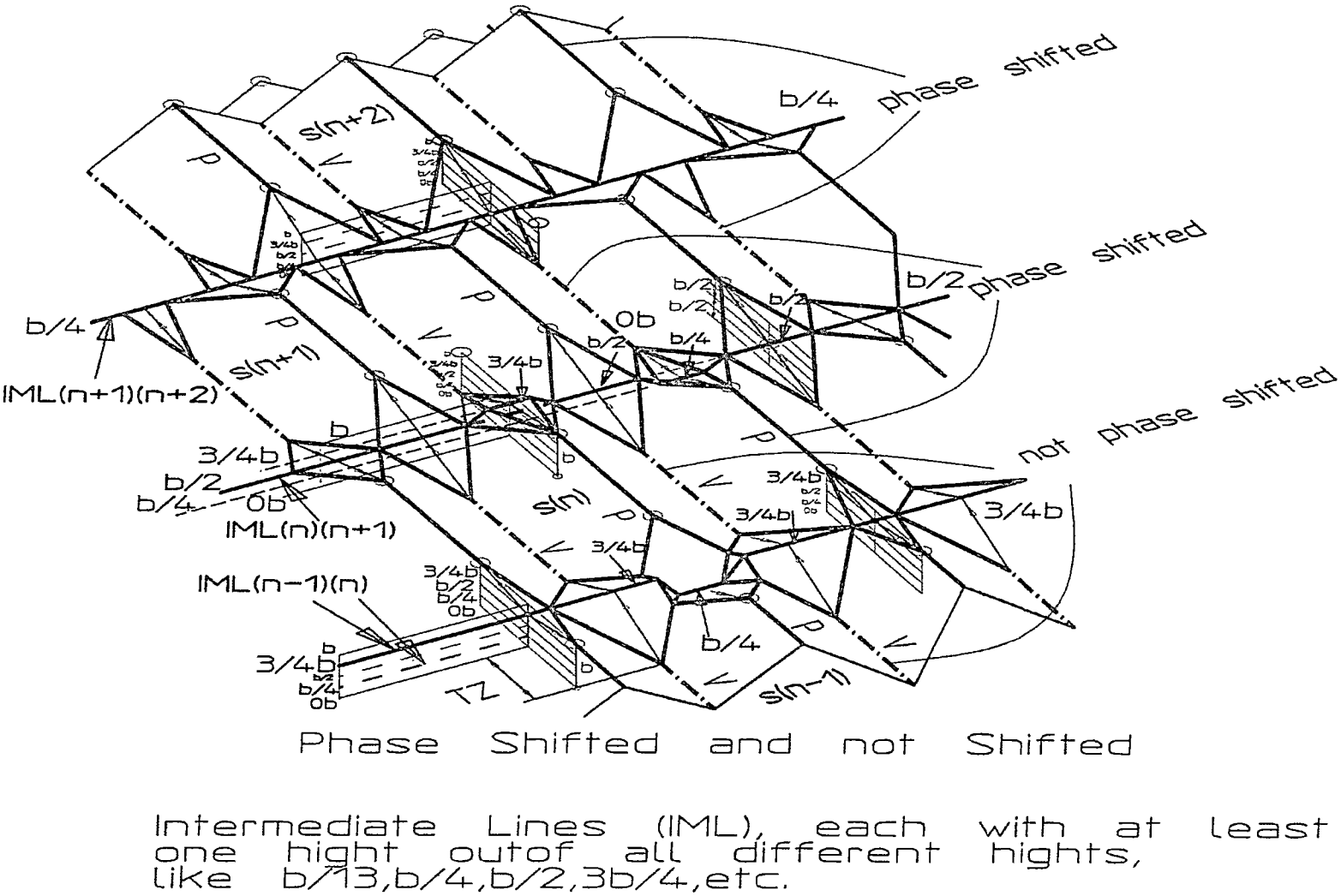

The embodiment of FIG. 16B has no phase shift between segments Sn−1, but has an exemplary phase shift of a/2 between Sn and Sn+1 and between Sn+1 and Sn+2. The obstacle zones between segments comprise low peaks between adjacent peaks and high valleys between adjacent valleys. The intermediate lines that divide the obstacle zone into two transition zones are at different heights, with the IML between segment S(n−1) and segment Sn being at a height of 3b/4, the intermediate line between segment S(n) and S(n−1) being at a height of b/2 and the IML between segment S(n−1) and S(n−2) being at a height of b/4. All heights are exemplary; any intermediate line can be at any height between 0 and b and, as disclosed above, they need not be at a constant height and need not be straight lines.

Behavior of the fluids on the upper and lower sides of a plate may or not be similar, even for identical fluids, as the characteristics of the flow will depend on the windows, where a window is the smallest free cross-sectional area through which a fluid can pass at an outlet of a flow channel, where the outlet is typically in an TZ. For non-limiting example, fluid in a flow path in segment s(n) flowing above a plate towards s(n+1) will divide and pass to the left and right of the peak partially blocking the outlet of the alley flow path. The window is bounded by the two (rising) sides of the valley on the first plate and the down going sides of the plate above. A half-window for flow of fluid 1 is between the valley and the depth of the plate, b; the window extends from the height of the base of the window, h(win1) to the thickness of the plate, b so that $0 \leq h(win1) \leq b$. Similarly, a window for fluid 2 is bounded by the two (falling) sides of a peak on the first plate and the rising sides of the plate below. A half-window for flow of fluid 1 is between the segmentation plane and the peak; the window extends from the segmentation plane to the height of the top of the window, h(win2) so that $0 \leq h(win2) \leq b$. However, the sum of the heights of the windows cannot be more than the thickness of the plate; furthermore, windows are vertically aligned since, for any are where a window exists for fluid 1, the bottom of the fluid 1 window will be the top of a fluid 2 window, so $h(win1)+h(win2)=b$.

FIG. 16B shows 3 IMLs, between segments s(n−1) and S(n), between segments S(n) and S(n+1) and between S(n+1) and S(n+2). The heights of the IMLs are respectively 3b/4, b/2 and b/4. The heights can be set independently by altering the characteristics of the TZs and the characteristics of any non-standard segments between the TZs.

Figure 16C:
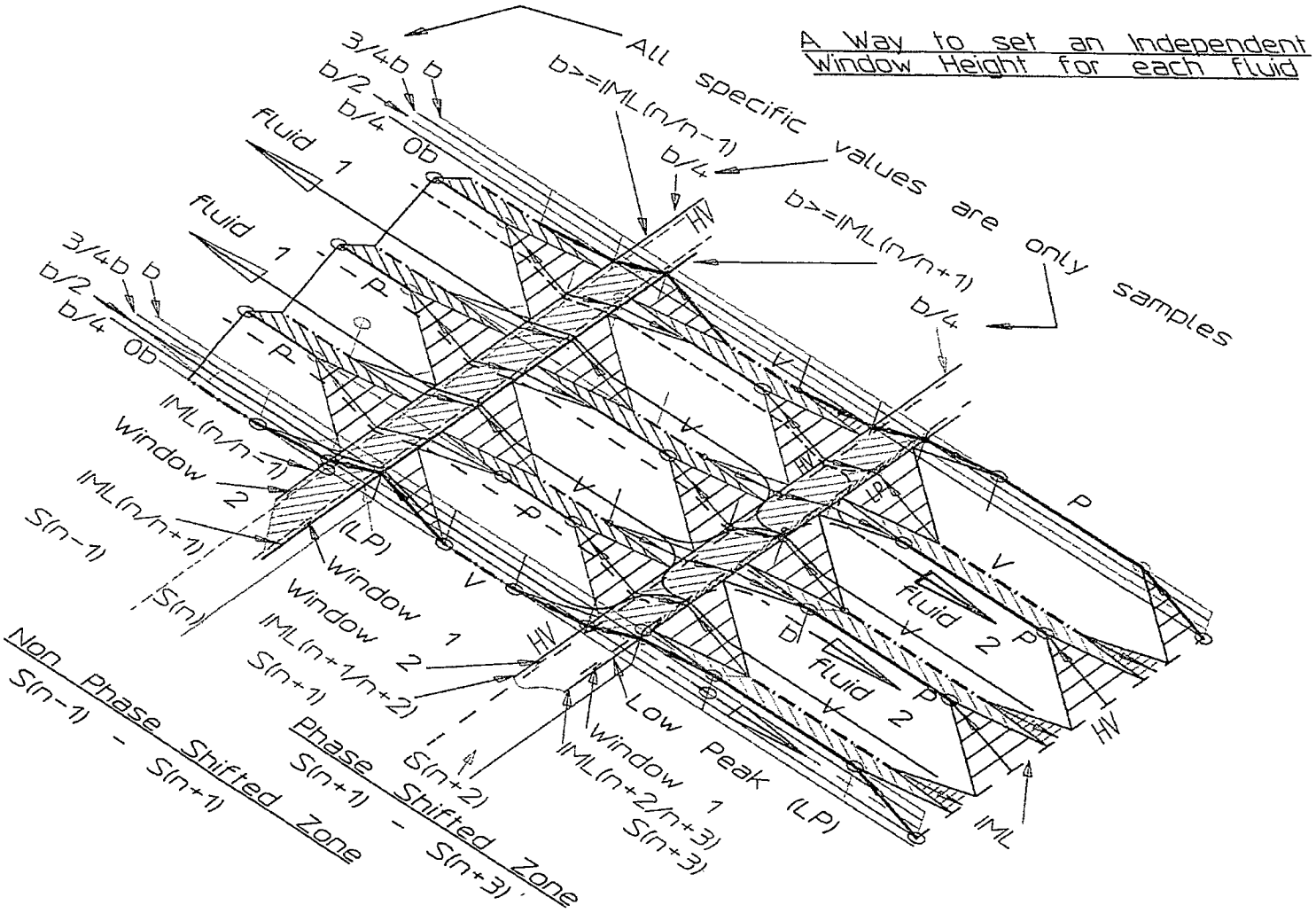
Figure 16D:
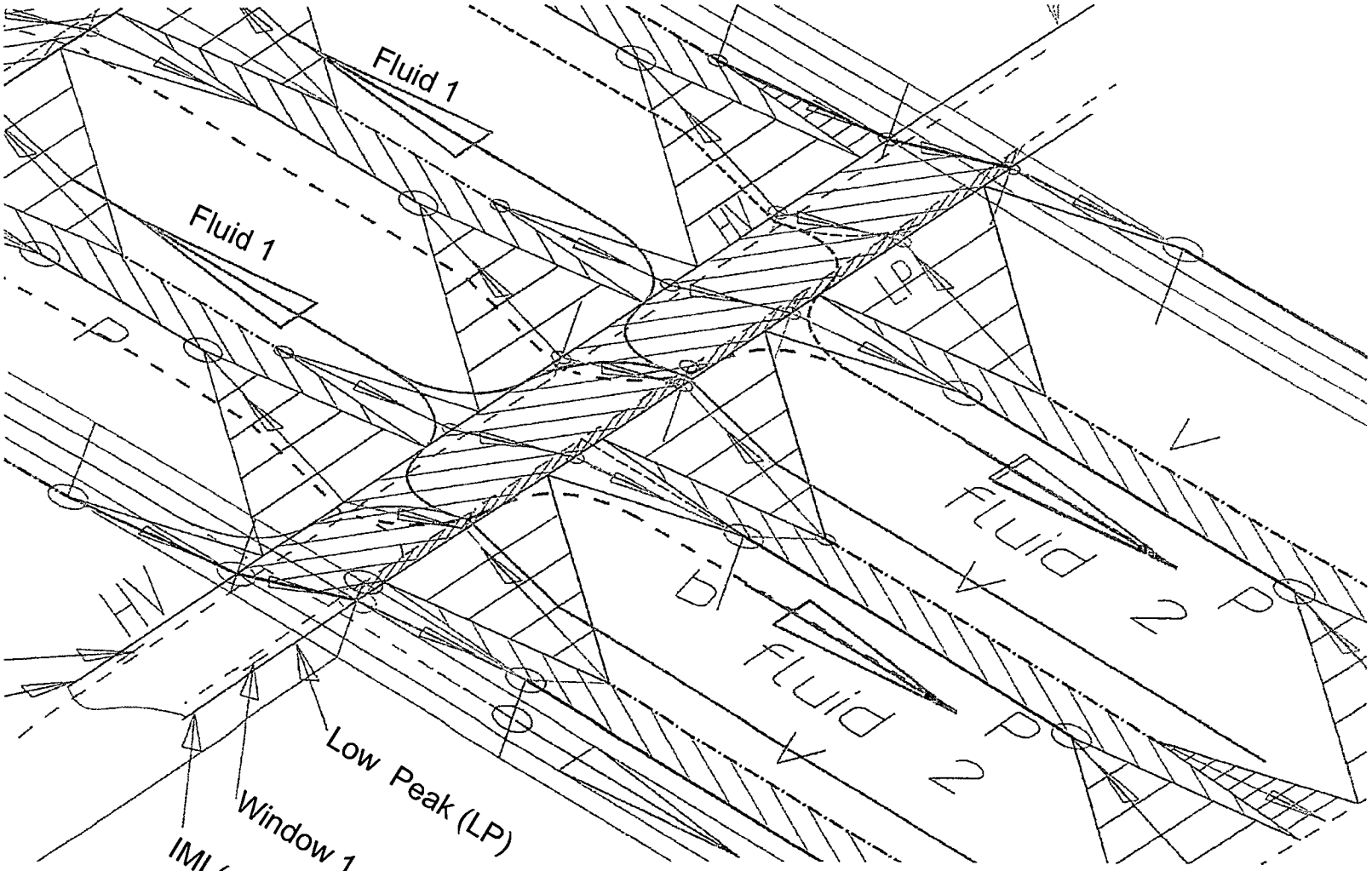

FIGS. 16C-D show a portion of an embodiment of a structure in which segments with a high wavy zone (S(n−1), S(n+1), S(n+3)) in which the peak and valley lines are oriented longitudinally are separated by short (non-standard) segments (S(n), S(n+2) which are laterally flat and longitudinally tilted (higher at one end than the other). Peaks are indicated by heavy solid lines, valleys by heavy dot-dashed lines. FIG. 16D is an enlargement of a portion of FIG. 16C.

There is no phase shift between segments S(n−1) and S(n+1), and there is a phase shift of a/2 between segments S(n+1) and S(n+3), if the non-standard segment S(n+2) is ignored.

In this exemplary embodiment, segment S(n+2) is at a height of 3b/4 above the low valleys at IML (n+2/n+3) and at a height of b/4 at IML (n+1/n+2); segment S(n+2) has a low peak at IML (n+2/n+3) and a high valley at IML (n+1/n+2). Similarly, segment S(n) is at a height of 3b/4 above the low valleys at IML (n/n+1) and at a height of b/4 at IML (n/n−1); segment S(n) has a low peak at IML (n/n+1) and a high valley at IML (n/n−1). In this exemplary embodiment, heights of b/4 and 3b/4, where b is the plate thickness, have been used for the low peaks and high valleys, although any values between 0 and b are possible and the low valley/high peak heights can be different for each segment.

Fluid 1 flows (solid arrows) above the plate. The uppermost edges of at least some valleys (the lines of the highest peaks) are in contact with similar high edges on the upper adjacent plate, which constitutes a full flow obstruction; fluid 1 will not pass laterally through the uppermost edges to an adjacent valley. This valley geometrical structure is closed off at its downstream edges by the phase-shifted peaks in the next segment, so that flow exiting a valley will be transversely deflected (arrows split to pass around the phase-shifted peak). The valley basic structure is repeated transversely throughout each of the segments. On the downward side of the plate, complementary peak structures are formed on both sides of the upward facing valley, through which fluid 2 flows (dashed arrows) below the plate.

FIGS. 16C-D also show the transition zones on both sides of the IML, for which the transition zone width is approximately at a value of b (plate drawing depth).

another embodiment of shows that segment S(n+1) and S(N+32) are separated by 2 IMLs, with a non-standard segment, S(n+2) between. This adds flexibility, in that the non-standard segment can both allow independent adjustment of window heights for segments S(n+1) and S(n+3) and can comprise wavy zones to further tune the flow characteristics of the fluids.

This embodiment allows the heights of the windows to be set independently for each fluid, since the heights of the high peaks and the low valleys can be different for each segment comprising a low peak or high valley at each end. The window size for FL1 is set by the height of the low peak, the window size for fluid 1 being the difference between the high peak height and the low peak height, while the window size for fluid 2 is set by the height of the high valley, the window size for FL1 being the difference between the height of the high valley and the height of the low valley.

It should be noted that at least one additional peak and/or valley can be inserted in a segment which ends in a low peak or high valley; if more than one is present, their heights can differ longitudinally, laterally or both. An embodiment can comprise any of the features disclosed above; for non-limiting example, any IML can be non-perpendicular to the flow direction, the flow direction need not be aligned with an edge of the plate, and peaks/valleys need not be evenly spaced.

In this application another PHE design is possible, in which in between two adjacent plates, which constitute an interspace for a particular fluid, one or more intermediate plates are inserted, perforated or not perforated, which are in contact with only one fluid on both sides, and are in contact with its adjacent plates at specific support points or lines. These intermediate plates are used for flow directing, pressure drop reduction as well as heat transfer enhancement, due to the increased heat transfer area and flow characteristics, resulting from the multiplicity of plates and the numerous and dense points of support which transfer heat from plate to plate via conduction.

For implementation of this corrugation structure at a gasketed PHE scenario, it is recommended that the added intermediate PHE plates will be on the side of the lower pressure fluid, as the support between the plates on this fluid side is stronger, due to the slight compression from the high pressure fluid, and therefore the heat transfer will be enhanced due to the conduction between adjacent plates at the support points or lines. In addition, brazed type PHEs are also suitable for the addition of intermediate corrugated plates for various applications.

FIG. 17A-G show a PHE for the application of a lower heat transfer coefficient fluid (fluid 1) which is typically a gas (or a condensing gas) and a higher heat transfer fluid (fluid 2) which can be a liquid, an evaporating liquid or a condensing liquid, in which fluid 1 (e.g. air) enters the PHE between the plate edges on a side and exits the plate on the opposite side, after transferring thermal energy with fluid 2, which enters and exits the gaps between the PHE plates via the ports at top and bottom and then travels transversely in the gaps between plates from the lower port to the upper port.

Figure 17A:
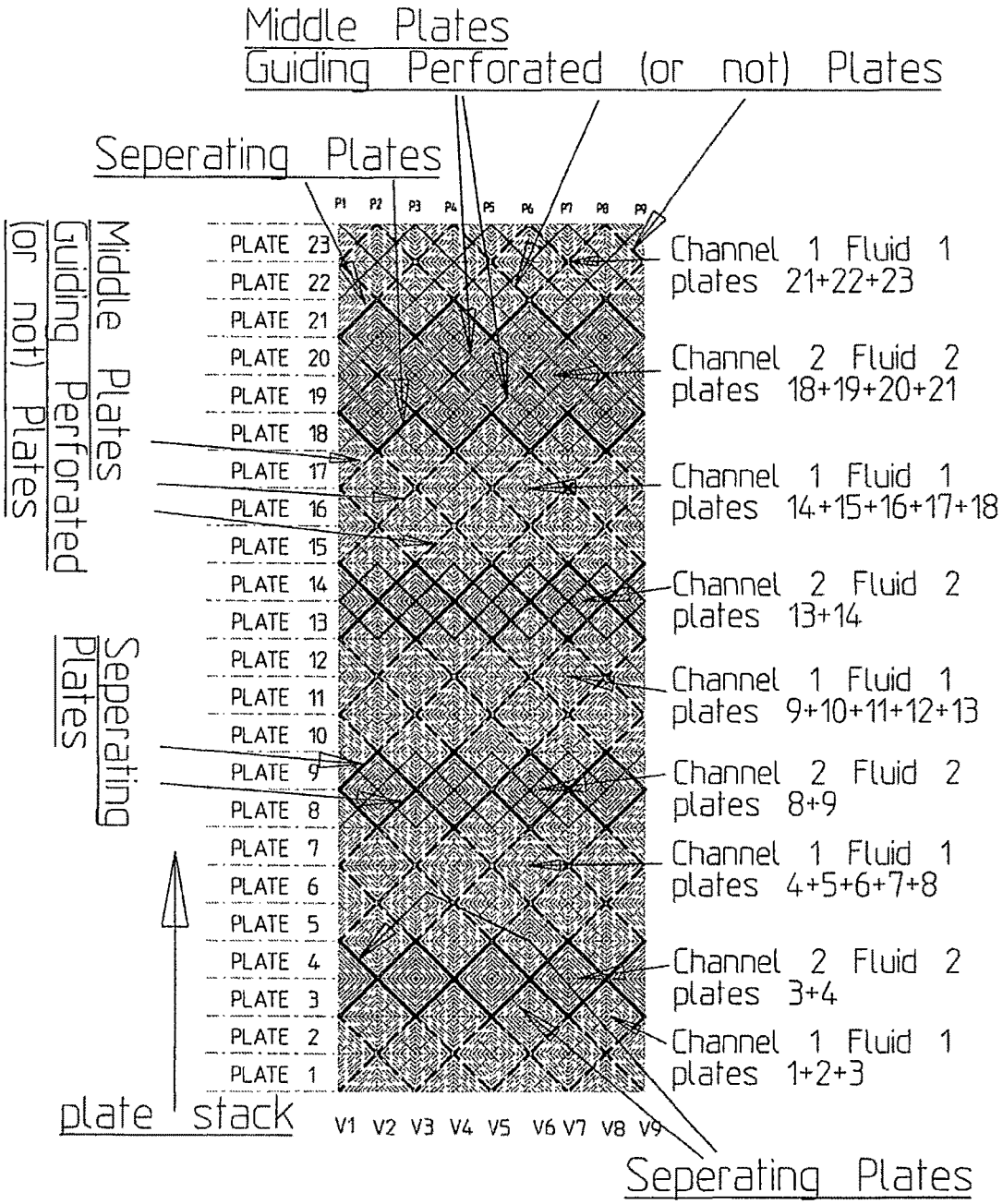
FIGS. 17A-B schematically illustrates a side views of plate stacks with separating plates and middle plates according to several embodiments of the invention.

Adjacent sets of gaps can be fluid 1/fluid 1, fluid 1/fluid 2 or fluid 2/fluid 2. In the embodiment of FIG. 17A, showing a cross-section through a plate stack, for example, fluid 1 flows above and below plate 22, fluid 1 flows above plate 21 with fluid 2 below it, and fluid 2 flows above and below plate 19.

This PHE type, as described above, is an alternative to the finned-tube heat exchanger, where pipes are surrounded by attached fins, which are slightly compressed by the pipes. This heat transfer technique is known as 'extended heat transfer area', where the fins, which constitute the extension of the heat transfer area, collect energy from the gas flowing through them and transfer it through the surface of the pipes (usually of copper material) to the other fluid, which flows through the pipes.

An advantage of the novel PHE design, as described in this application, with comparison to a finned-tube heat exchanger, is that the inter-plate contact at the support lines/points is relatively strong due to the compression of the tie rods and due to the higher pressure fluid, which compresses the primary and intermediate plates of the lower pressure fluid. Past studies have shown that the performance of plate-fin heat exchanges declines with time, due to the loosening of the fin-tube contact points over time. However, in this novel PHE plate design, a larger amount of heat transfer is possible, due to the large surface area and the density of support points and lines which allow thermal contact between adjacent plates, and heat transfer rates do not degrade over time, because of the PHE plate design, which guarantees constant contact compression over time.

Figure 17B:
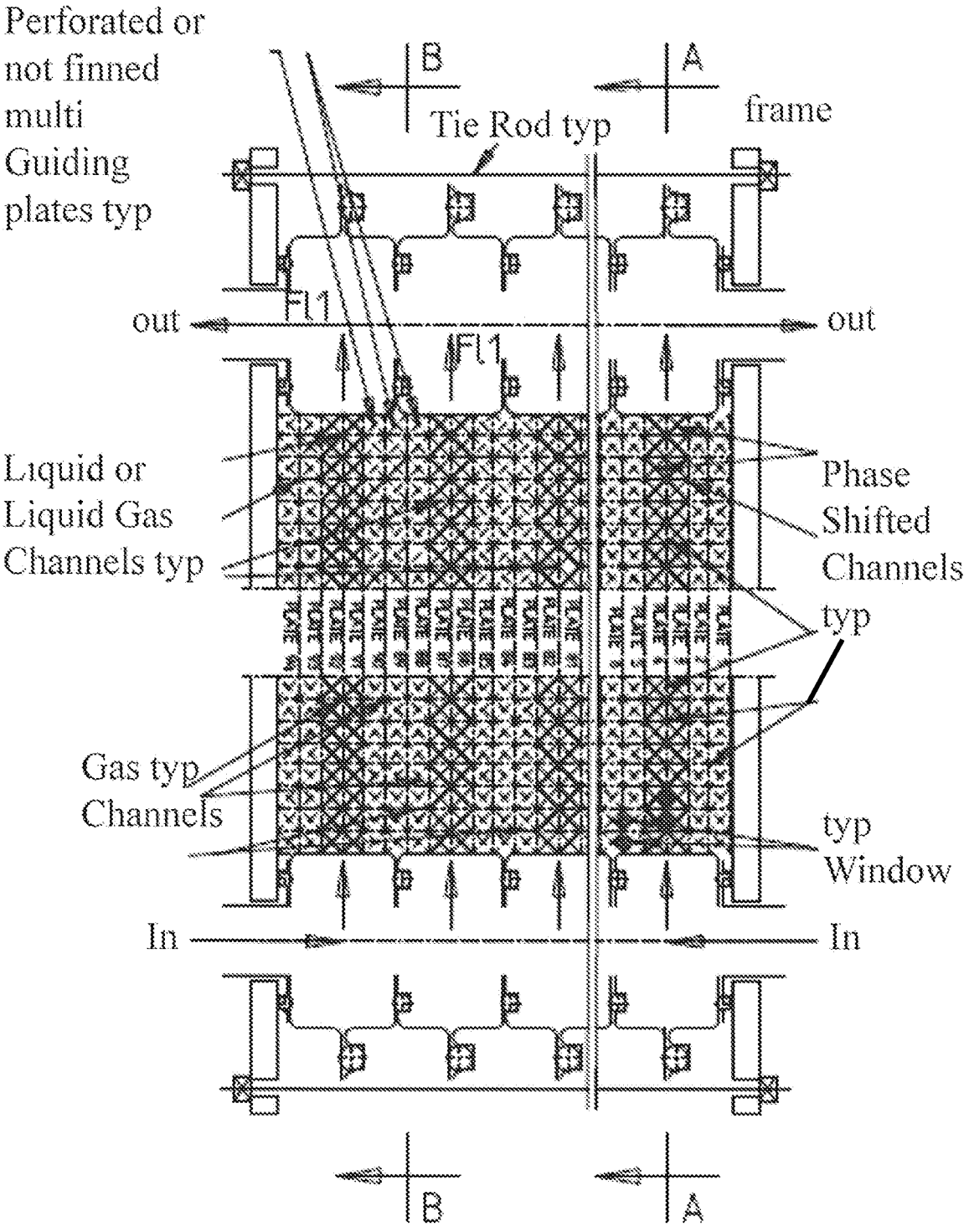
Figures 17C, 17D:
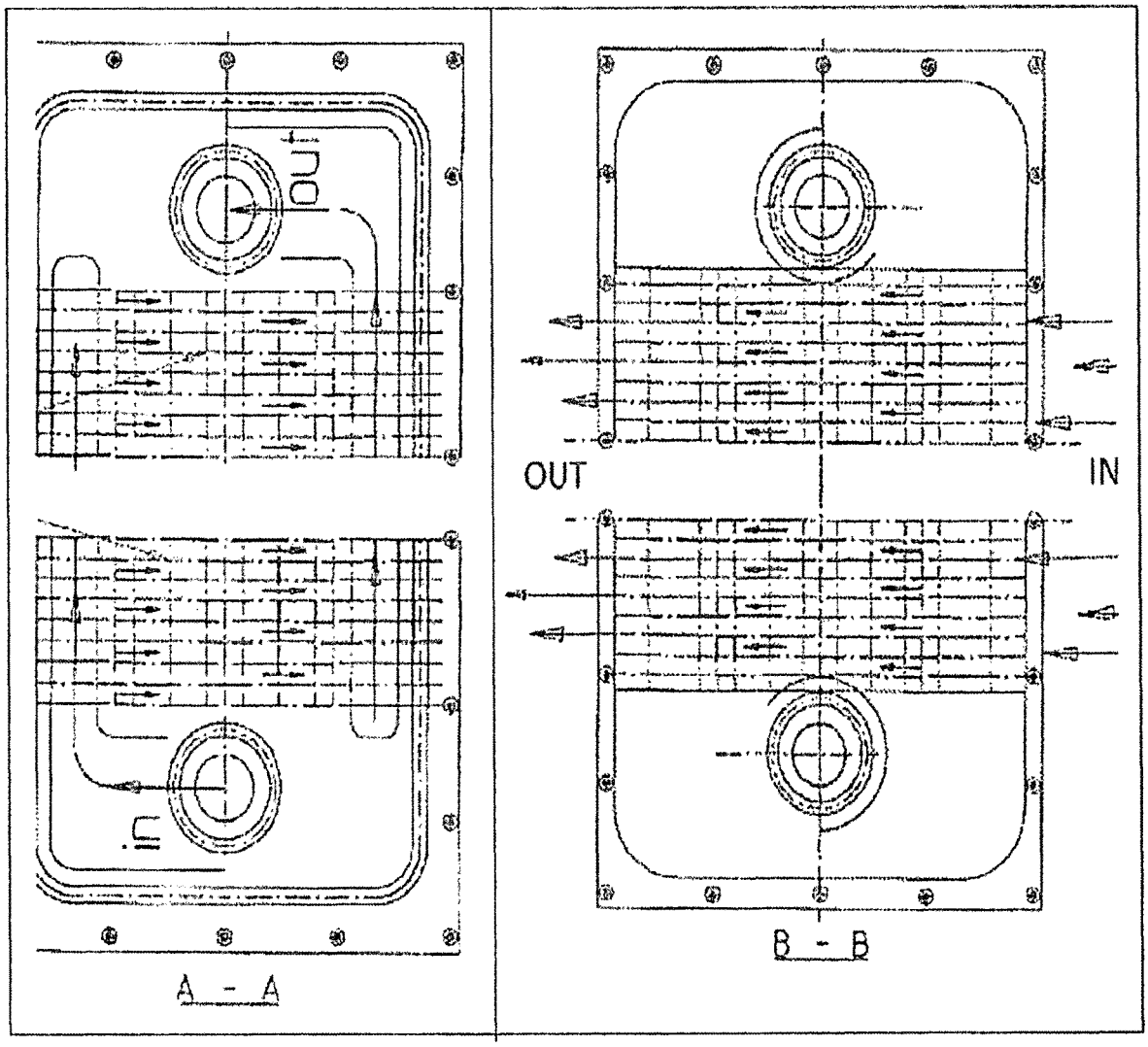
FIGS. 17C-D schematically illustrates a top view of the plate stack if FIG. 17B, showing the directions of flow between the plates for the two fluids according to several embodiments of the invention.

FIGS. 17B-D show another exemplary embodiment of the PHE for fluids with significantly different heat transfer coefficients where there is no phase shift in the flow paths. FIG. 17B schematically illustrates a side view, with flow of fluid 2 being shown in FIG. 17C, a side view along the line A-A of FIG. 17B and flow of fluid 1 being shown in FIG. 17D, a side view along the line B-B of FIG. 17B. As can be seen, the fluids flow horizontally across in the figure.

Figure 17E:
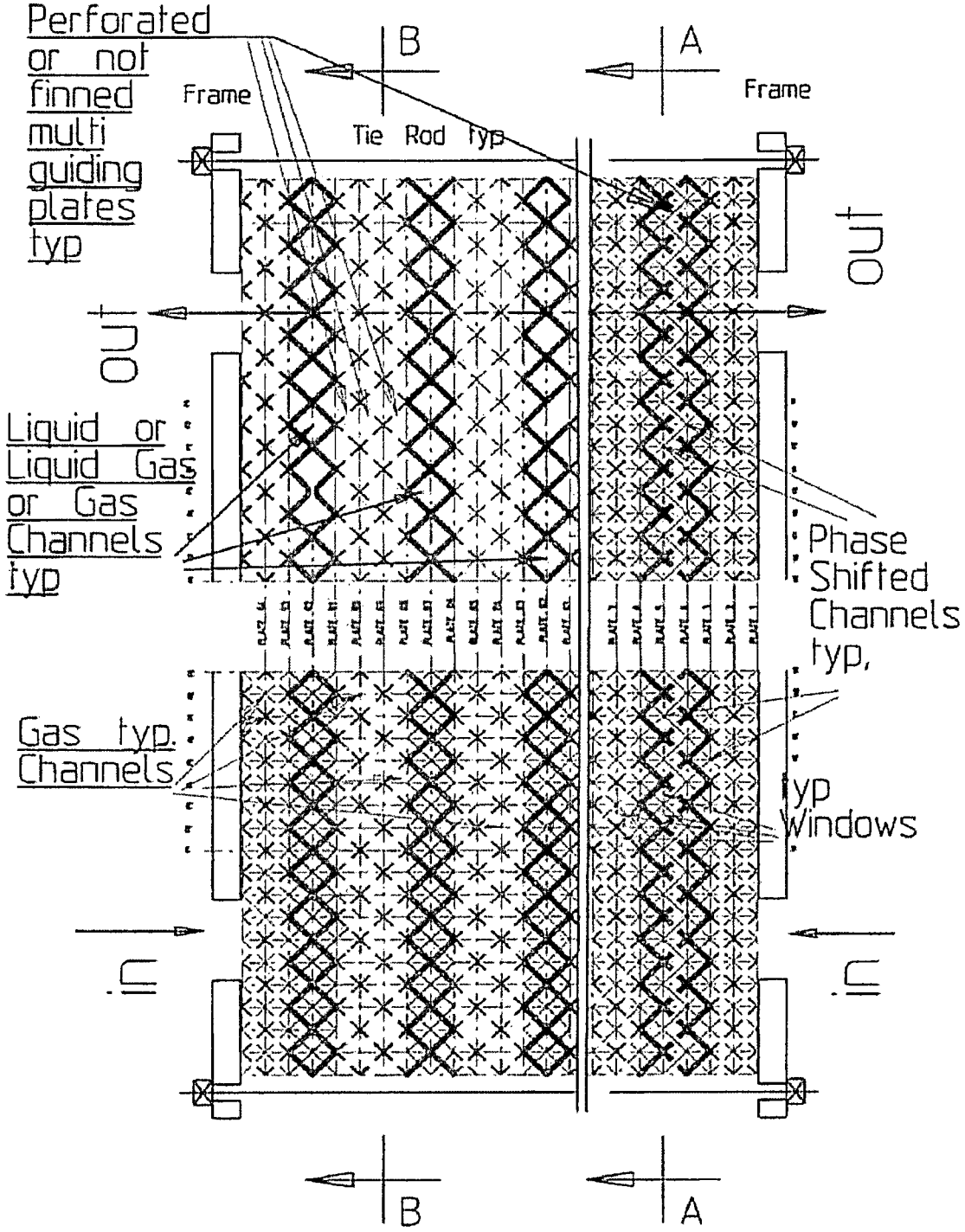
FIG. 17E schematically illustrates a side view of another embodiment of a plate stack with separating plates and middle plates according to several embodiments of the invention.
Figure 17F:
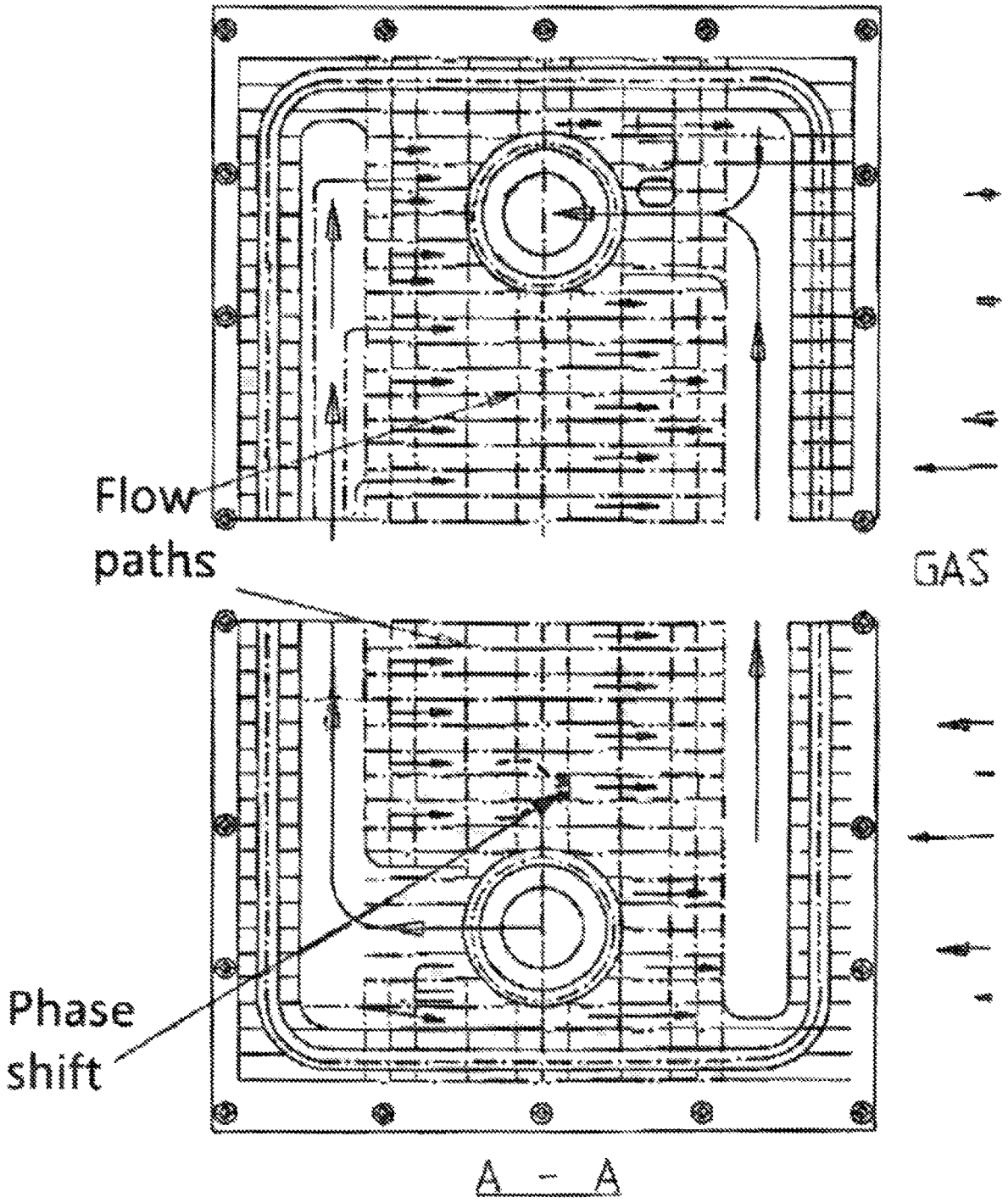
FIGS. 17F-G schematically illustrates a top view of the plate stack if FIG. 17B, showing the directions of flow between the plates for the two fluids according to several embodiments of the invention.
Figure 17G:
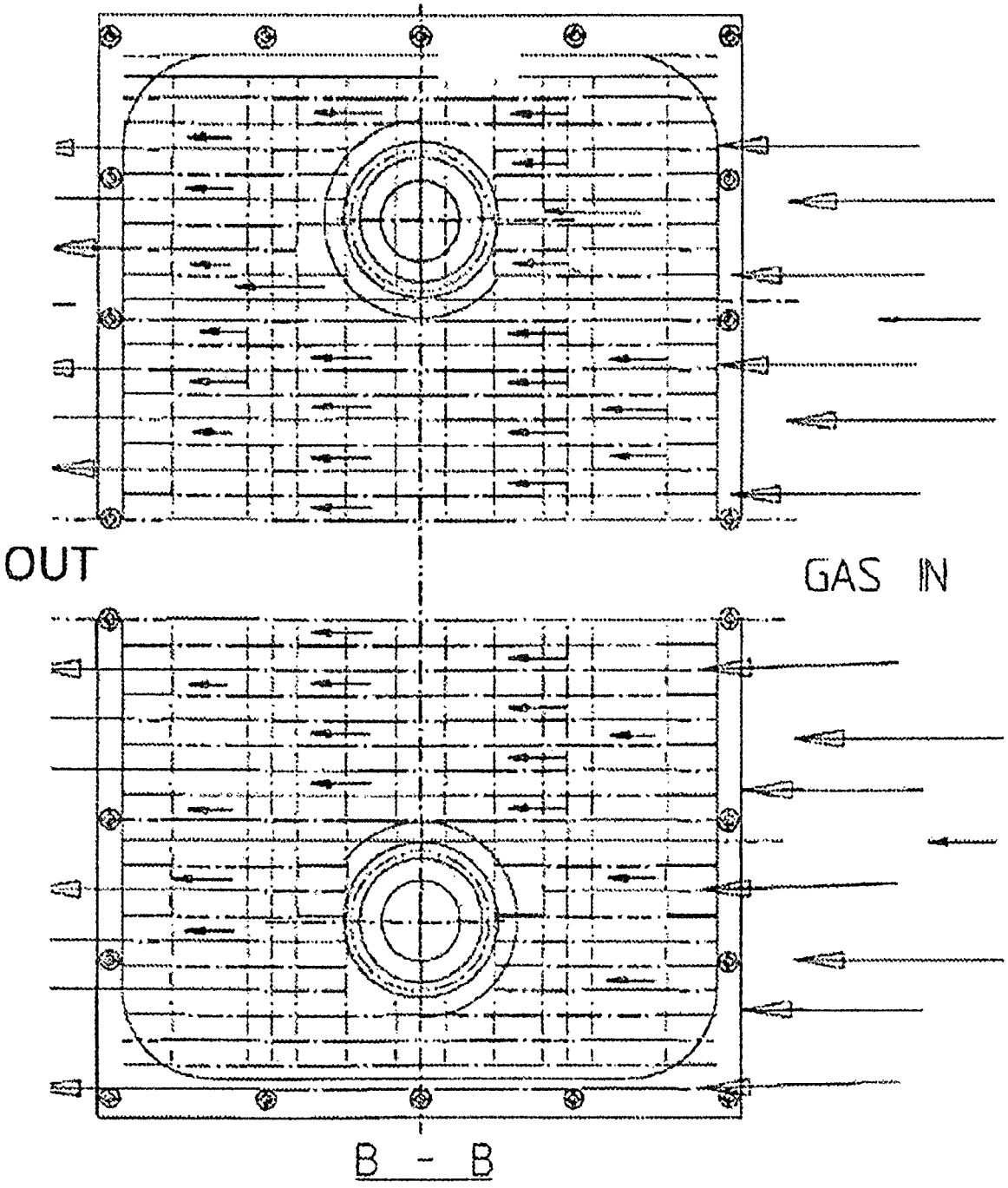

FIGS. 17E-G show another exemplary embodiment of the PHE for fluids with significantly different heat transfer coefficients, where the flow paths comprise a phase shift. FIG. 17E schematically illustrates a side view, with flow of fluid 2 being shown in FIG. 17F, a side view along the line A-A of FIG. 17E and flow of fluid 1 being shown in FIG. 17G, a side view along the line B-B of FIG. 17E. In this embodiment, in addition to the phase shift, flow paths extend beyond the inlet and outlet ports to increase the zone of heat transfer. The dashed arrows in FIG. 17F indicate fluid flow at the phase shift in between flow paths.

As noted above, the plates are strongly compressed together, either from tie rods or at the edges by welding or brazing. This strong compression between the plates decreases the thermal contact resistance at the support points or lines, and thus enhances the conduction heat transfer. The intermediate plates (e.g., plate 22 in FIG. 17A) act as an extended surface through which energy from the fluid flowing along them is collected and subsequently is transferred through the contact points/lines between the intermediate plates and the primary plates (with different fluids flowing on their two sides). The collected energy is ultimately transferred to the other fluid through the surface area of the primary plates.

In addition to or as an alternative to a phase shift, a low wave structure, such as the exemplary embodiments shown in FIGS. 18-23 can be placed at an obstructing angle with reference to the flow direction. Low waves are characterized by low peaks which are lower than the plate absolute height and high valleys which are higher than the plate lowest height. These mid-height intermediate regions are typically placed between the high wavy zones of adjacent segments and act as transitional surfaces between segments.

In a PHE, it is important to support the plates of the stack by means of those plates, and to transfer the pressure from the plates to the tie rods or other connecting means. As the plate is very thin (e.g., less than about 0.2 to about 0.8 mm), the supporting distance is very important, and structures that provides lower minimum distances between plates are preferred, because thin plates with better heat conductivity and lower cost can be used. Plate designers can thus use high valleys and low peaks and/or protrusions and depressions to provide support between adjacent plates.

Figure 18:
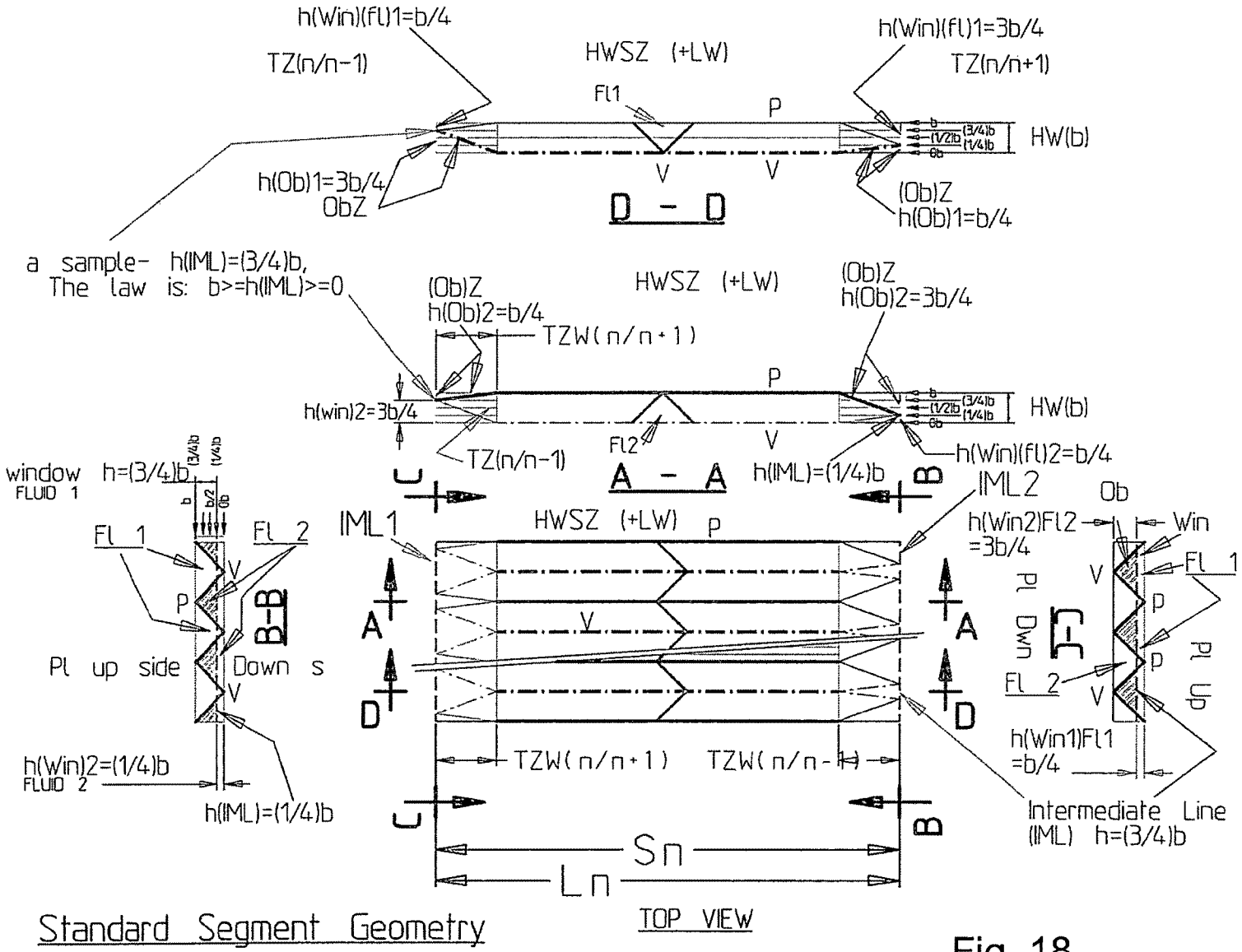
FIG. 18 schematically illustrates adjacent standard segments linked by intermediate regions of different shapes according to several embodiments of the invention.
Figure 21:
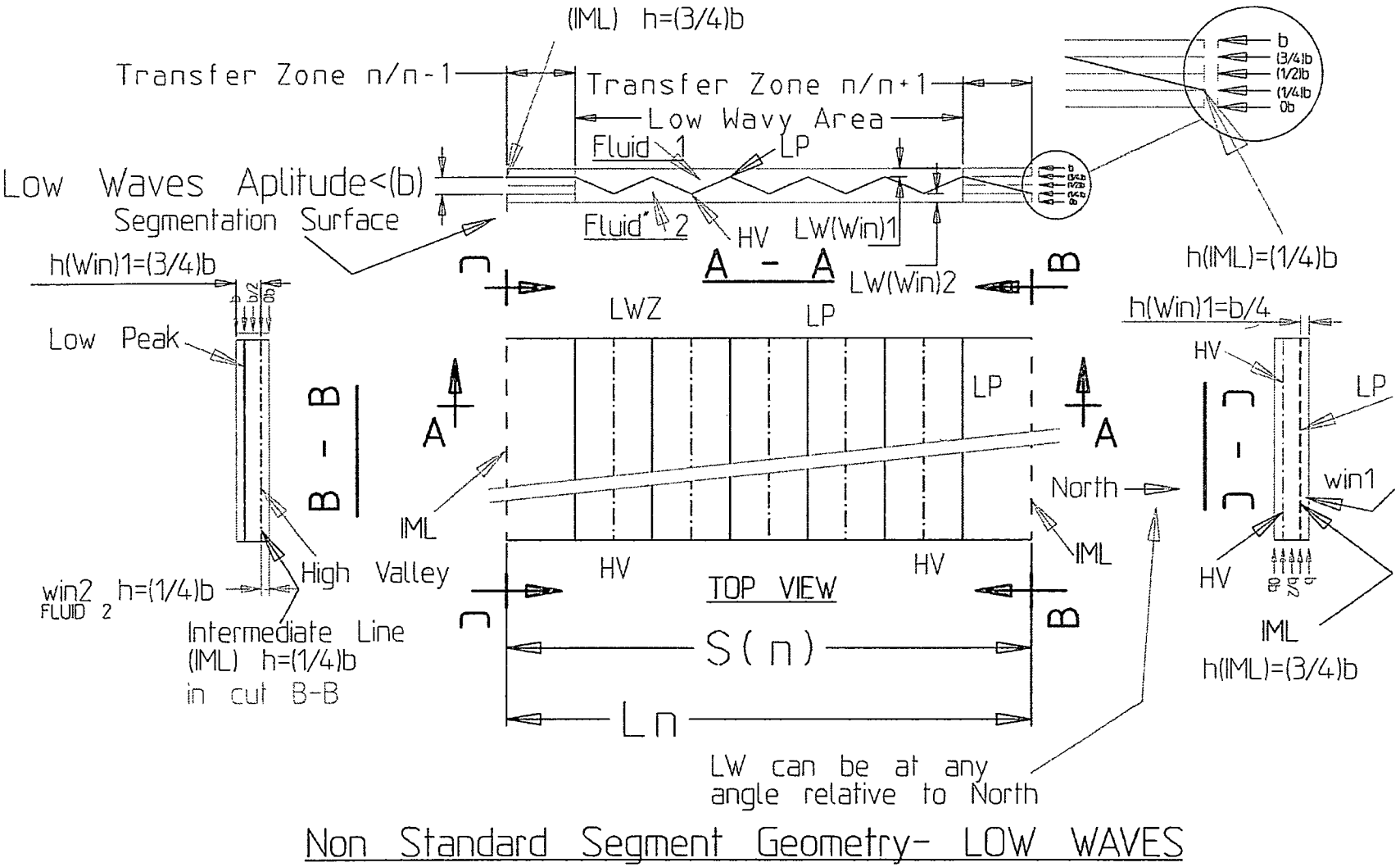
Figure 22:
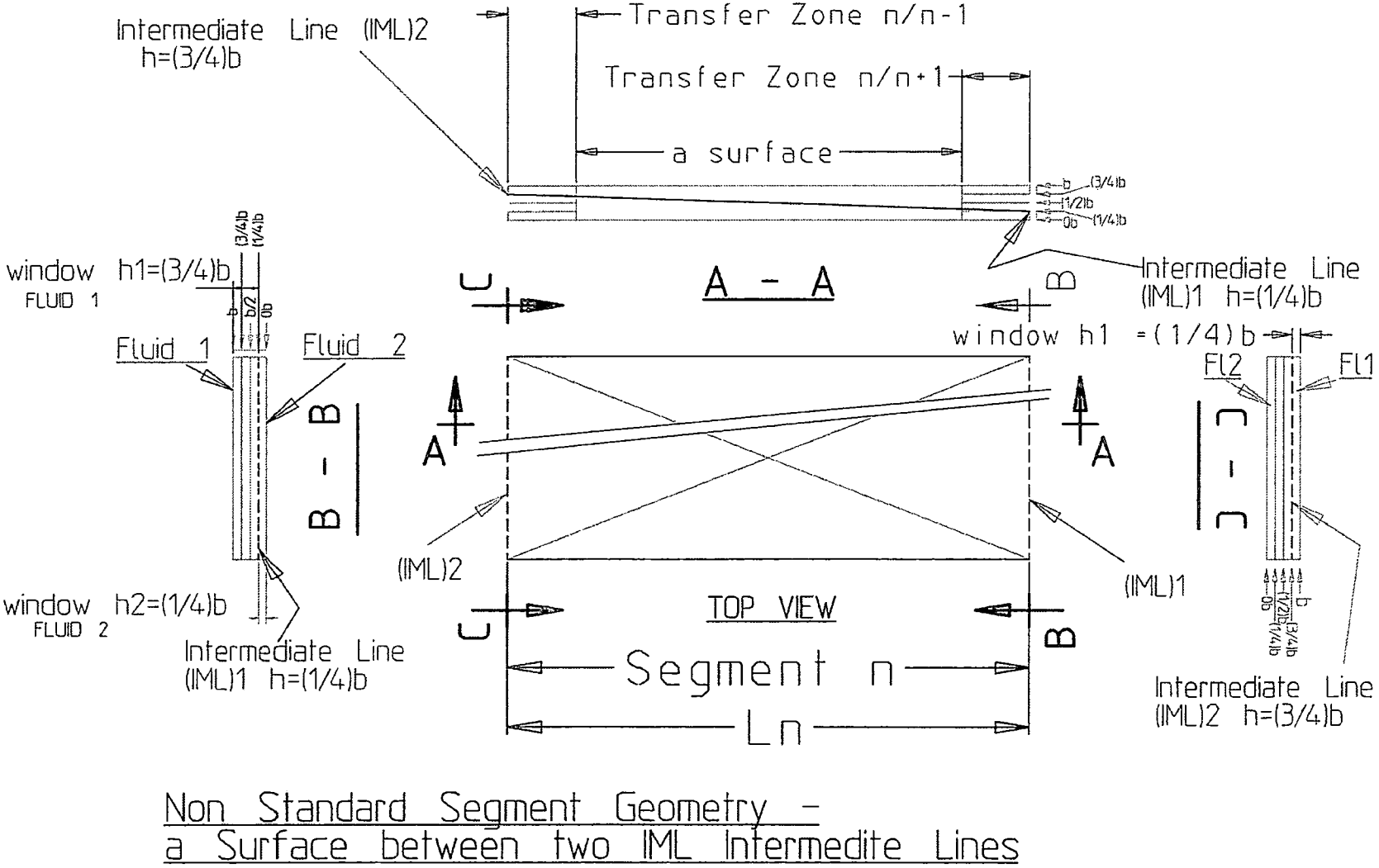

FIGS. 18, 21 and 22 provide overviews showing, for each of the three exemplary embodiments, several cross-sections at different location and in different planes.

In FIG. 18, the IMLs (IML1 and IML2) are straight lines of constant vertical height, where IML1 is of height 3b/4 and IML2 is of height b/4. The actual values given for heights at the IMLs or for low peaks and high valleys, the heights of the low peaks or high valleys are exemplary. Any height between 0 and b can be used in an embodiment.

Figure 19:
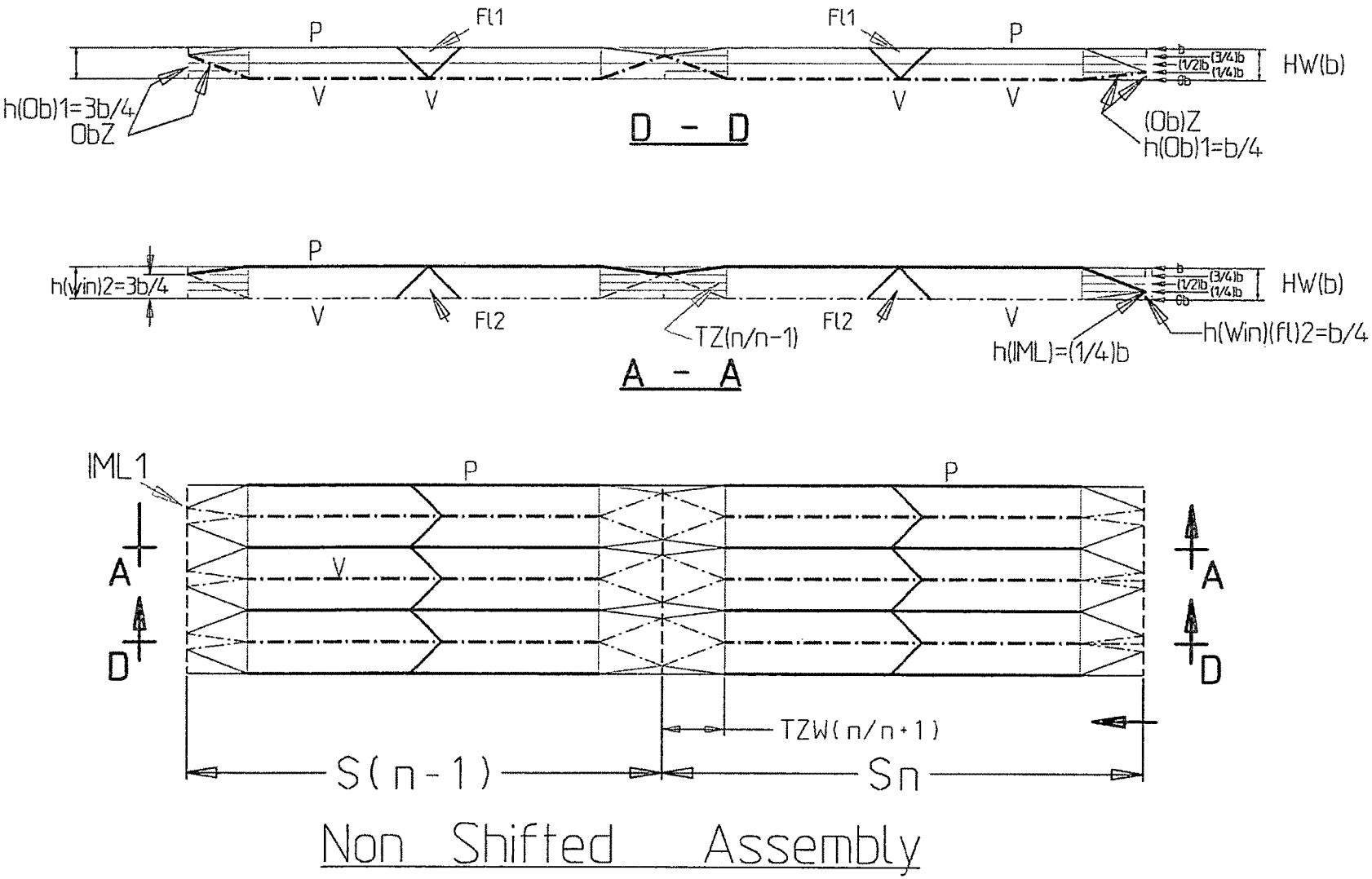
FIG. 19 schematically illustrates adjacent non-standard segments linked by intermediate regions of different shapes according to several embodiments of the invention.

FIG. 19 schematically illustrates two segments with chamfer-type TZs and no phase shift between segments. The IML zigzags vertically across the plate, being at a height of 3b/4 (section D-D) along the line of the peaks and at a height of b/4 (section D-D) along a line of the valleys. Therefore, fluid 1 (above the plate) will have much more obstruction to the flow and a greater pressure drop (as well as greater heat exchange) compared to fluid 2 (below the plate) with the larger windows.

Figure 20:
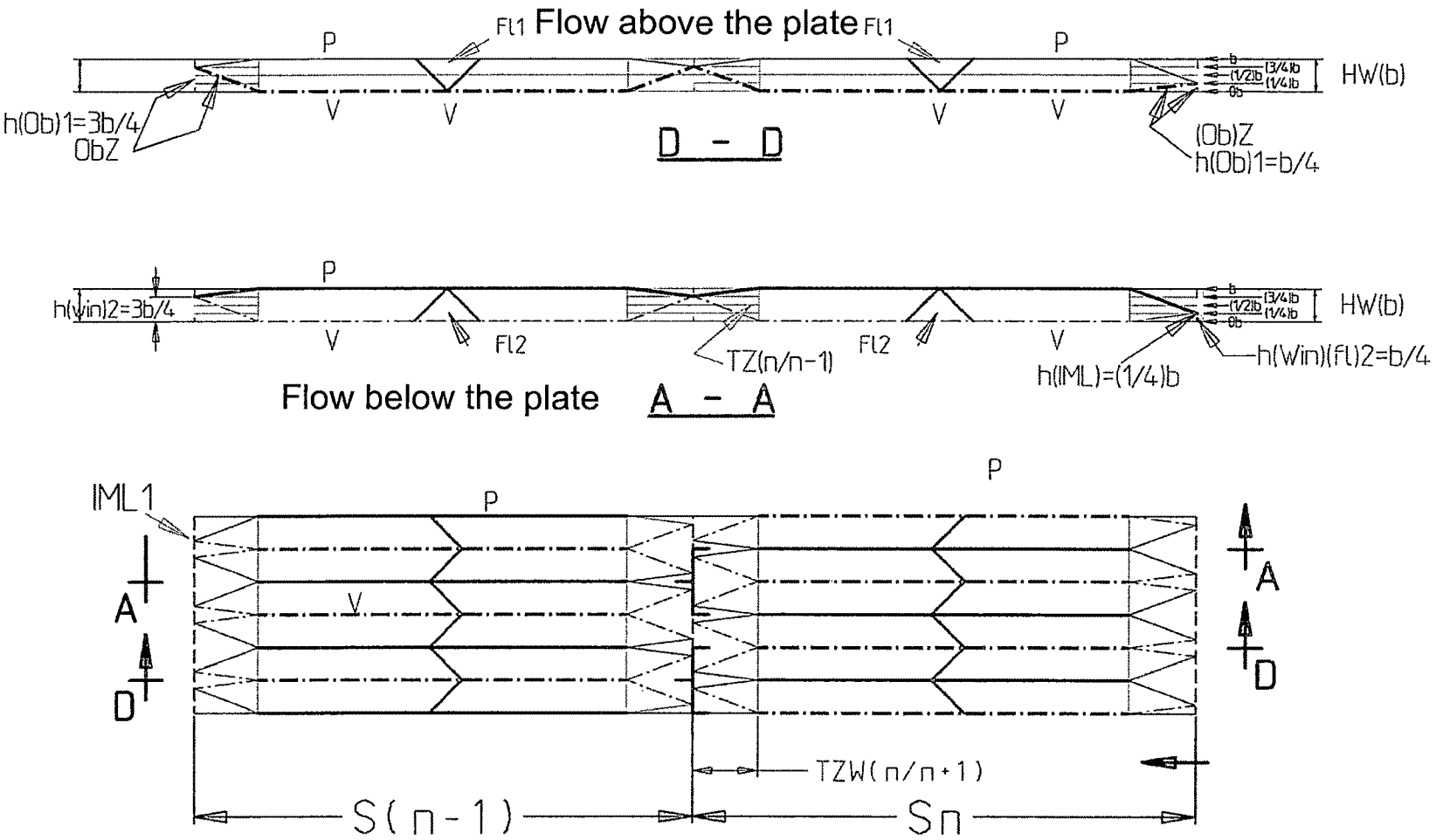
FIG. 20-22 schematically illustrates adjacent segments linked by intermediate regions according to several embodiments of the invention.

FIG. 20 schematically illustrates two segments with chamfer-type TZs and a phase shift of a/2 between segments. The IML zigzags vertically across the plate, being at a height of 3b/4 (section D-D) along the line of the peaks and at a height of b/4 (section D-D) along a line of the valleys. Therefore, fluid 1 (above the plate) will have much more obstruction to the flow and a greater pressure drop (as well as greater heat exchange) compared to fluid 2 (below the plate) with the larger windows. However, there will be more mixing across the plate for both fluid 1 and fluid 2 and more turbulence (and therefore a higher heat exchange) for both fluids.

FIG. 21 schematically illustrates views of a segment Sn in which the high wavy zone comprises a plurality of peaks and valleys. As shown in FIG. 15A, starting from IML1 at the left, the segment Sn comprises a transition zone, a high wavy region with V-shaped flow paths, and a second transition zone; the segment ends at IML2. The segment comprises a number of lateral peaks (thick solid lines) and valleys (thick dot-dashed lines).

FIG. 21 schematically illustrates views of a non-standard segment Sn which comprises two transition zones and a low wavy zone. As shown in FIG. 17A, starting from IML1 at the left, the segment Sn comprises a transition zone TZ1, a low wavy zone (LWZ) comprising low peaks (LP) and high valleys (HV), and a second transition zone (TZ2); the segment ends at IML2.

FIG. 22 schematically illustrates views of a non-standard segment Sn in which the high wavy zone comprises a plane which falls from ILM1 to IML2. The IMLs are straight lines at constant heights and segment Sn comprises the plane defined by IML1 and IML2. In other variants of this embodiment, at least one IML can have different heights at each end, at least one IML can be non-perpendicular to at least one segment side edge, at least one IML can be a curved, zigzag or otherwise non-straight line, and any combination thereof.

Figure 23A:
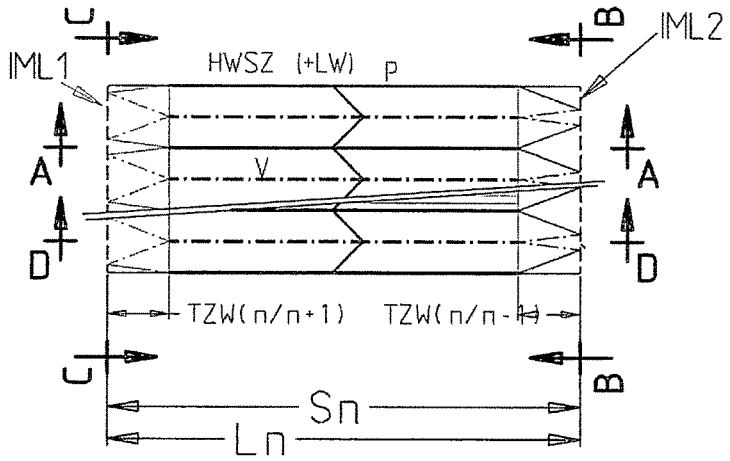
FIGS. 23A-E schematically illustrates turbulence in flow between plates according to several embodiments of the invention.

FIGS. 23A-E schematically illustrates views of a segment Sn in which the high wavy zone comprises a plurality of peaks and valleys. As shown in FIG. 23A, starting from IML1 at the left, the segment Sn comprises a transition zone, a high wavy region with V-shaped flow paths, and a second transition zone; the segment ends at IML2. The segment comprises a number of lateral peaks (thick solid lines) and valleys (thick dot-dashed lines). FIGS. 235B-E comprise cross-sections taken along the lines A-A, D-D, B-B and C-C, respectively, of FIG. 23A.

Figure 23B:
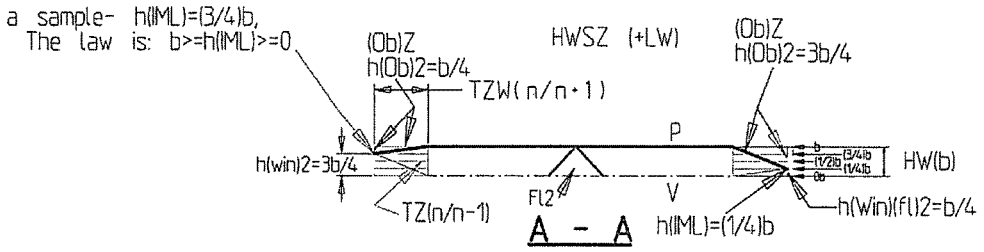

FIG. 23B schematically illustrates a lateral view of segment Sn taken along the line A-A, which passes along the line of a peak. The peaks of segment Sn start with a low peak, at height h=3b/4. They then rise across the TZ to the height b and remain there until the second TZ is reached. The peaks then fall to a low peak height of h=b/4.

Figure 23C:
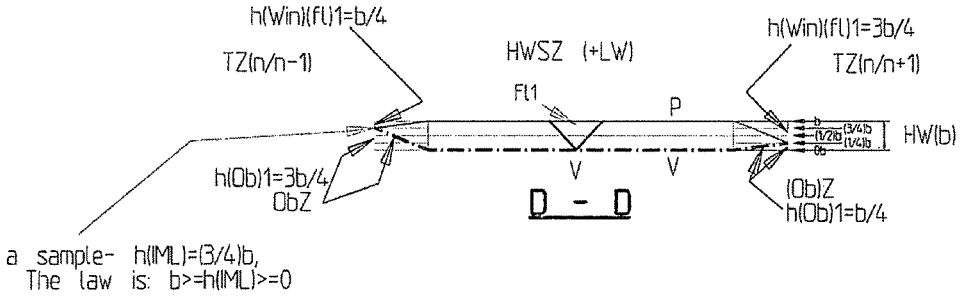

FIG. 23C schematically illustrates a lateral view of segment Sn taken along the line D-D, which passes along the line of a valley. The valleys of segment Sn start with a high valley, at height h=3b/4. They then fall across the TZ to the height 0 and remain there until the second TZ is reached. The valleys then rise to a high valley height of h=b/4.

Figure 23D:
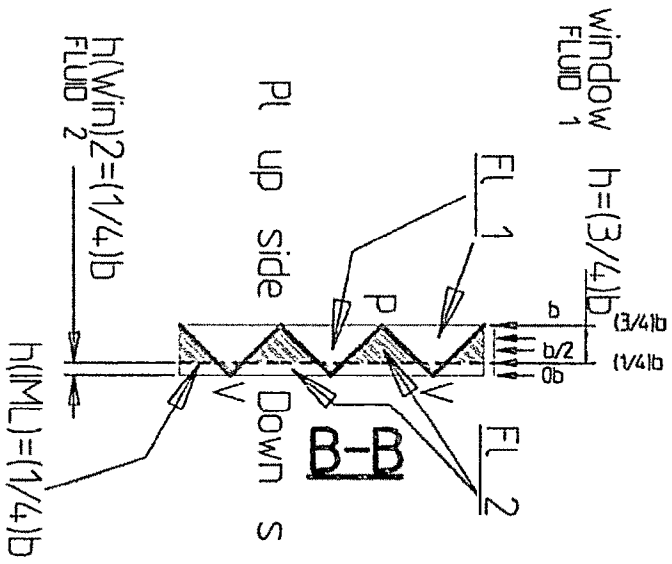

FIG. 23D schematically illustrates a lateral view of segment Sn taken along the line B-B, which passes along the line IML2. Fluid FL1 flows above the plate, perpendicular to the plane of the paper, in long, thin six-sided windows (the other 3 sides belong to the adjoining plate above) with a half-height from the IML line (height=3b/4) to the high peak plane (height=b). Fluid FL1 flows above the plate, in long, thin six-sided windows (the other 3 sides belong to the adjoining plate above) with a half-height from the high peak plane (height=b) to the IML line (height=3b/4). The flow paths are separated by small triangular segments of metal between height 3b/4 and b, where the low peaks valleys rise to the high peaks. Fluid FL2 flows under the plate, in large six-sided windows (the other 3 sides belong to the adjoining plate below) with top at 3b/4 and centerline at 0 (the base will be at 3b/4 from the low valley plane of the next lower plate).

Figure 23E:
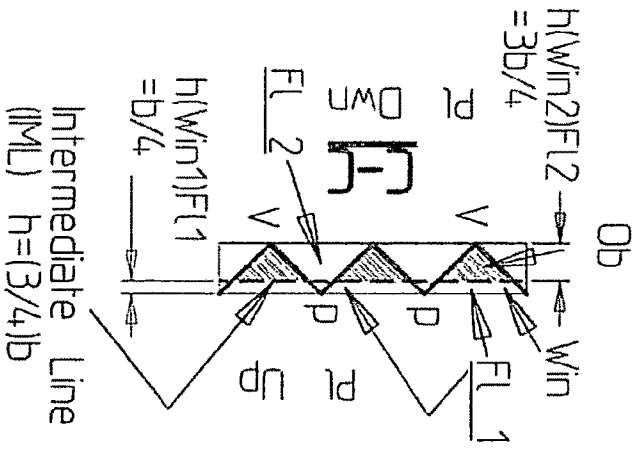

FIG. 23E schematically illustrates a lateral view of segment Sn taken along the line C-C which passes along the line IML1. Fluid FL1 flows above the plate, perpendicular to the plane of the paper, through large six-sided windows (the other 3 sides belong to the adjoining plate above) with base at b/4 and centerline at b (the top will be at b/4 from the low valley plane of the next upper plate). Fluid FL2 flows under the plate, in long, thin six-sided windows (the other 3 sides belong to the adjoining plate below) with a half-height from the low valley plane (height=0) to the IML line (height=b/4). The flow paths for fluid FL2 are separated by small triangular segments of metal between height b/4 and 0, where the high valleys fall to the low valleys.

Therefore, if this segment design is longitudinally repeated, each fluid flows alternately through large windows and small windows. Heat transfer (and pressure drop) are greater at the small windows, smaller at the large windows. Therefore, a plate design of this type can increase heat transfer for both fluids with only a small increase in pressure drop.

Figure 24A:
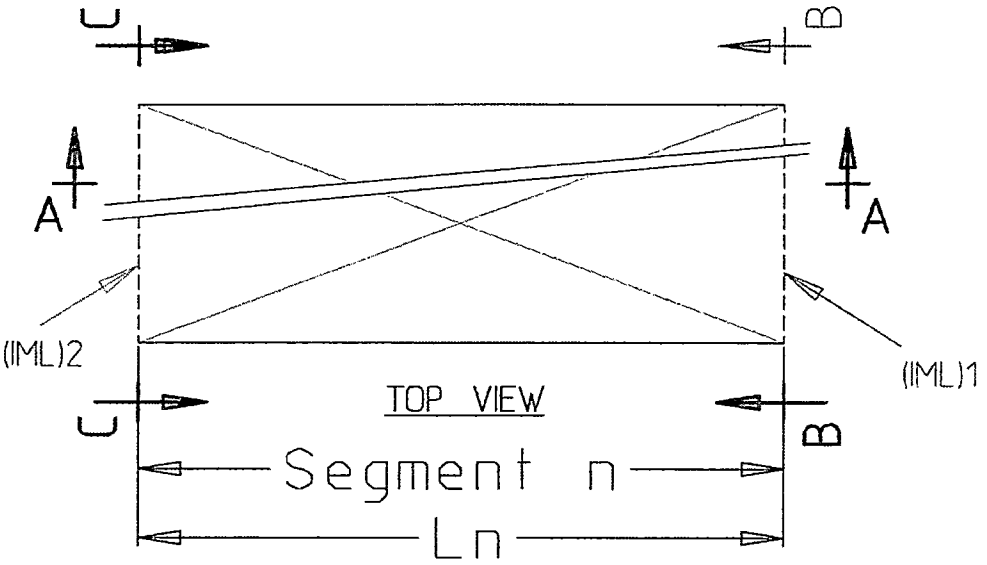
FIGS. 24A-D schematically illustrates adjacent non-standard segments linked by intermediate regions according to several embodiments of the invention.

FIGS. 24A-D schematically illustrate views of a non-standard segment Sn in which the high wavy zone comprises a single low peak (at IML2) and a single high valley (at IML1). As shown in FIG. 24A, the IMLs are straight lines at constant heights and segment Sn comprises the plane defined by IML1 and IML2. In other variants of this embodiment, at least one IML can have different heights at each end, at least one IML can be non-perpendicular to at least one segment side edge, at least one IML can be a curved, zigzag or otherwise non-straight line, and any combination thereof.

FIGS. 24B-E comprise cross-sections taken along the lines A-A, BB and CC, respectively, of FIG. 24A.

Figure 24B:
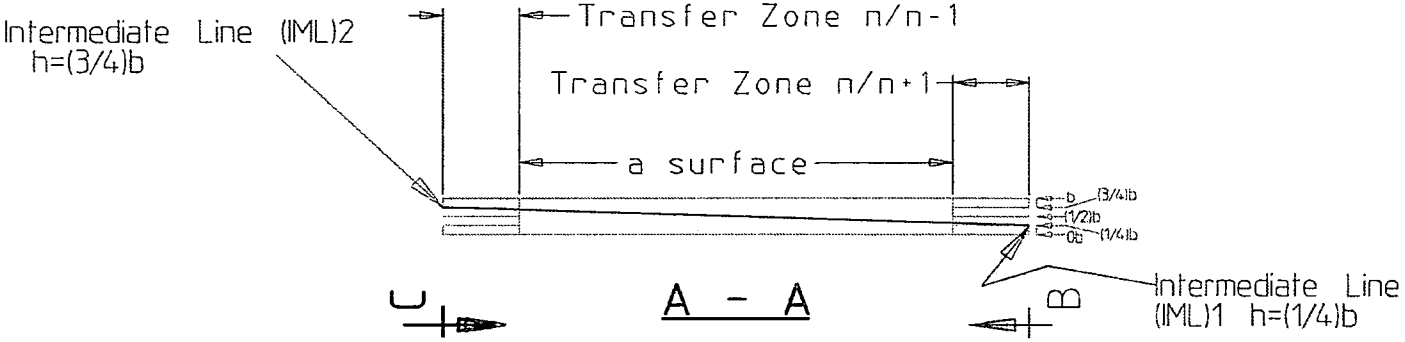

FIG. 24B schematically illustrates a lateral view of segment Sn taken along the line A-A, which passes along the line of a peak. Segment Sn starts at height h=3b/4. It then rise across the TZ to the height b and remain there until the second TZ is reached. The peaks then fall to a low peak height of h=b/4.

Figure 24C:
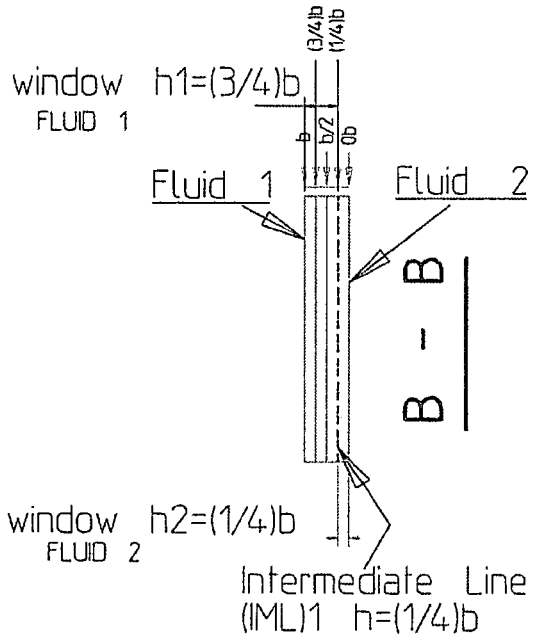

FIG. 24C schematically illustrates a lateral view of segment Sn taken along the line C-C which passes along the line IML1. Fluid FL1 flows above the plate, perpendicular to the plane of the paper, through large six-sided windows (the other 3 sides belong to the adjoining plate above) with base at b/4 and centerline at b (the top will be at b/4 from the low valley plane of the next upper plate). Fluid FL2 flows under the plate, in long, thin six-sided windows (the other 3 sides belong to the adjoining plate below) with a half-height from the low valley plane (height=0) to the IML line (height=b/4).

The flow paths for fluid FL2 are separated by small triangular segments of metal between height b/4 and 0, where the high valleys fall to the low valleys.

Figure 24D:
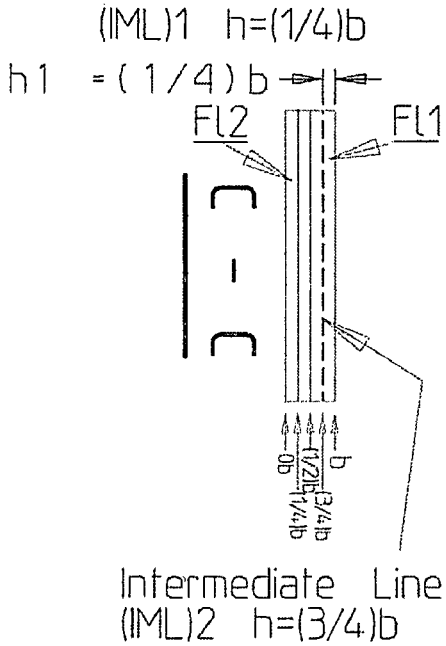

FIG. 24D schematically illustrates a lateral view of segment Sn taken along the line B-B, which passes along the line IML2. Fluid FL1 flows above the plate, perpendicular to the plane of the paper, in long, thin six-sided windows (the other 3 sides belong to the adjoining plate above) with a half-height from the IML line (height=3b/4) to the high peak plane (height=b). Fluid FL1 flows above the plate, in long, thin six-sided windows (the other 3 sides belong to the adjoining plate above) with a half-height from the high peak plane (height=b) to the IML line (height=3b/4). The flow paths are separated by small triangular segments of metal between height 3b/4 and b, where the low peaks valleys rise to the high peaks. Fluid FL2 flows under the plate, in large six-sided windows (the other 3 sides belong to the adjoining plate below) with top at 3b/4 and centerline at 0 (the base will be at 3b/4 from the low valley plane of the next lower plate).

Therefore, each fluid flows alternately through large windows and small windows. Heat transfer (and pressure drop) are greater at the small windows, smaller at the large windows. Therefore, a plate design of this type can increase heat transfer for both fluids with only a small increase in pressure drop.

In FIGS. 23 and 24, the interconnecting surface is a plane; in other embodiments, the interconnecting surface can be wavy or otherwise textured. Its dimensions can vary; it can be short or long. Its shape may be characterized or otherwise configured by the shape of the two neighboring intermediate lines to be connected.

In FIG. 25, the non-standard segment shown comprises low waves only—there is no contact between this exemplary embodiment and the adjacent plates on either side, but as shown above, a segment can also comprise high waves and/or supports. Segment Sn is interconnected with segment S(n+1) and, on the other side, with segment S(n−1). Different segments can have different shapes, dimensions and configurations. The segments are characterized by a plurality of i waves, i is any number (integer number or not), those waves may be selected from waves that are characterized by low peaks and high valleys, being lower than or equal to the peaks in the high-wave level and/or higher than or equal to the valleys in the low-wave level, respectively.

Figure 25A:
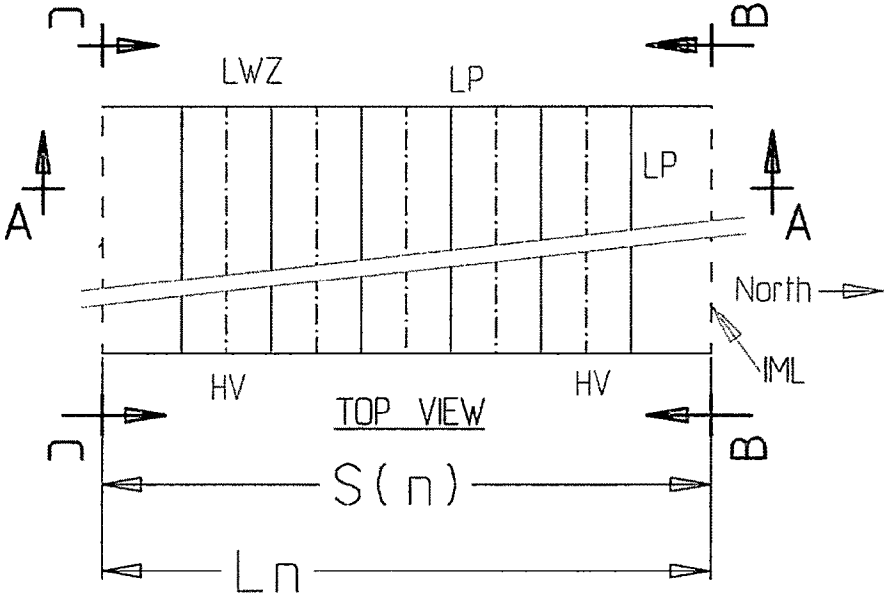
FIGS. 25-28 schematically illustrate a perspective view of segments meeting at intermediate lines, showing different size and shape obstructions according to several embodiments of the invention.
Figure 25B:
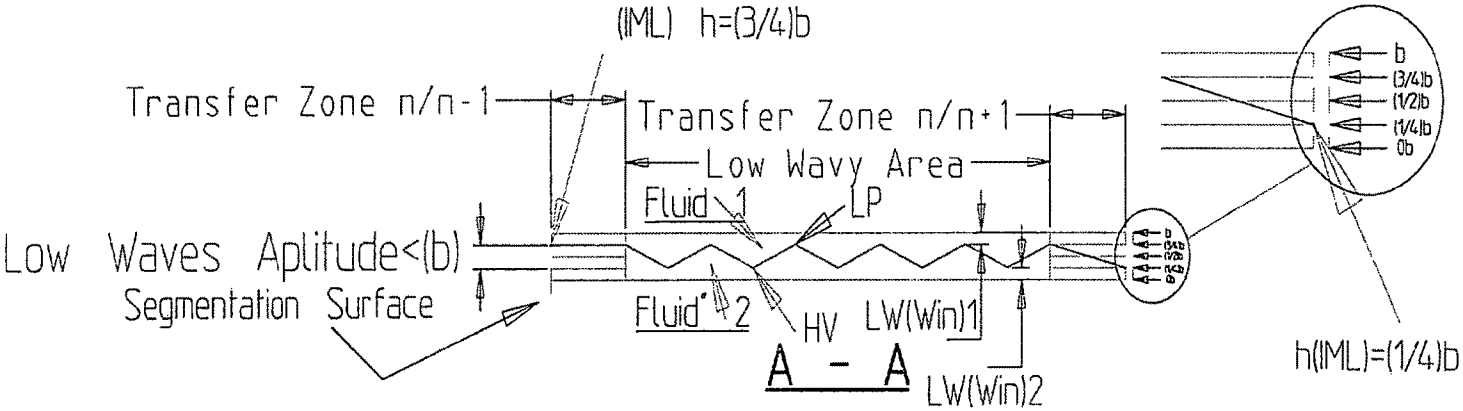
Figure 25C:
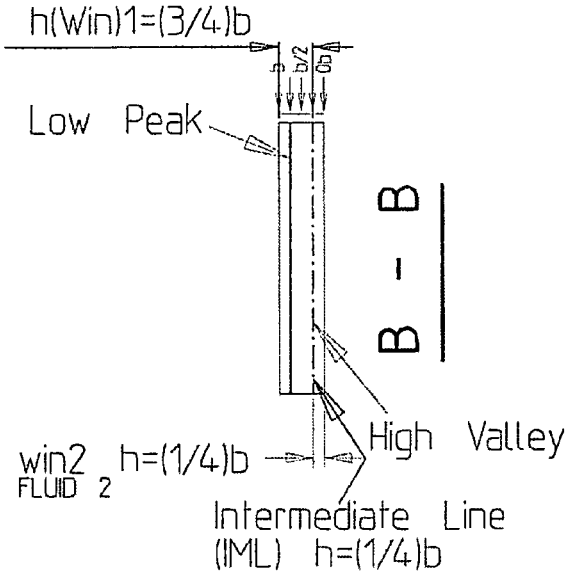
Figure 25D:
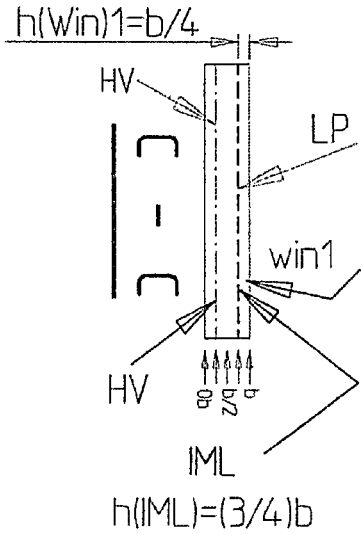

FIGS. 25A-D schematically illustrate views of a non-standard segment Sn which comprises two transition zones and a low wavy zone. As shown in FIG. 17A, starting from IML1 at the left, the segment Sn comprises a transition zone TZ1, a low wavy zone (LWZ) comprising low peaks (LP) and high valleys (HV), and a second transition zone (TZ2); the segment ends at IML2. FIGS. 25B-D comprise cross-sections taken along the lines A-A, B-B and C-C, respectively, of FIG. 25A. As there is a gap between the lowest high valley of the plate and the highest low valley of the next plate, fluid can flow laterally across the entire width of the plate.

FIG. 25B schematically illustrates a lateral view of segment Sn taken along the line A-A, across the low peaks and high valleys of Sn. In this exemplary embodiment, the low peaks are at height h=3b/4 and the high valleys at a height of b/4, although they can, in practice be at any height between h=0 and h=b. In this exemplary embodiment, the height is 3b/4 throughout TZ1 and drops from 3b/4 to b/4 in TZ2. It is obvious that the height can be either constant or varying in height and/or direction in any portion of either TZ. Fluid 1 flows above the plate and fluid 2 below it; since, unless h=0 for the high valleys or h=b for low peaks, the direction of flow will depend on the sizes of the windows and on the direction from which the fluids enter the segment Sn and the direction in which they leave it.

FIG. 25C schematically illustrates a lateral view of segment Sn taken along the line B-B which passes along the line IML2. Fluid FL1 flows above the plate, in long, thin four-sided windows (2 sides belong to the adjoining plate above) with a half-height from the IML line (height=3b/4) to the low peak plane (height=b). Fluid FL2 flows below the plate, in wide four-sided windows (the other 2 sides belong to the adjoining plate below) with a half-height from the low peak plane (height=3b/4) to the low valley line (b=0).

FIG. 25D schematically illustrates a lateral view of segment Sn taken along the line C-C, which passes along the line IML1. Fluid FL1 flows above the plate, in long, thin four-sided windows (two sides belong to the adjoining plate above) with a half-height from the IML line (height=3b/4) to the low peak plane (height=b). Fluid FL2 flows below the plate, in wide four-sided windows (the other 2 sides belong to the adjoining plate below) with a half-height from the low peak plane (height=3b/4) to the low valley line (b=0).

Therefore, fluid 1 flows through small windows and fluid 2 through large windows; the heat transfer coefficient being greater for fluid 1 than for fluid 2. This is useful if the two fluids have significantly different heat transfer coefficients, and also if their flow rates, viscosities or both differ significantly.

Wave peaks lower than the high peaks (low peaks) and wave valleys higher than the low valleys (high valleys) are supported (touch an adjacent plate) only if a support protrusion on one plate is deep enough to meet the depression on a subsequent plate or if support protrusions on adjacent plates are in contact. Low peaks and high valleys are used to improve turbulence in heat transfer at the cost of an increased pressure drop. Adjacent supports can be angled with respect to each other so that they touch along only part of their highest region.

Figure 26A:
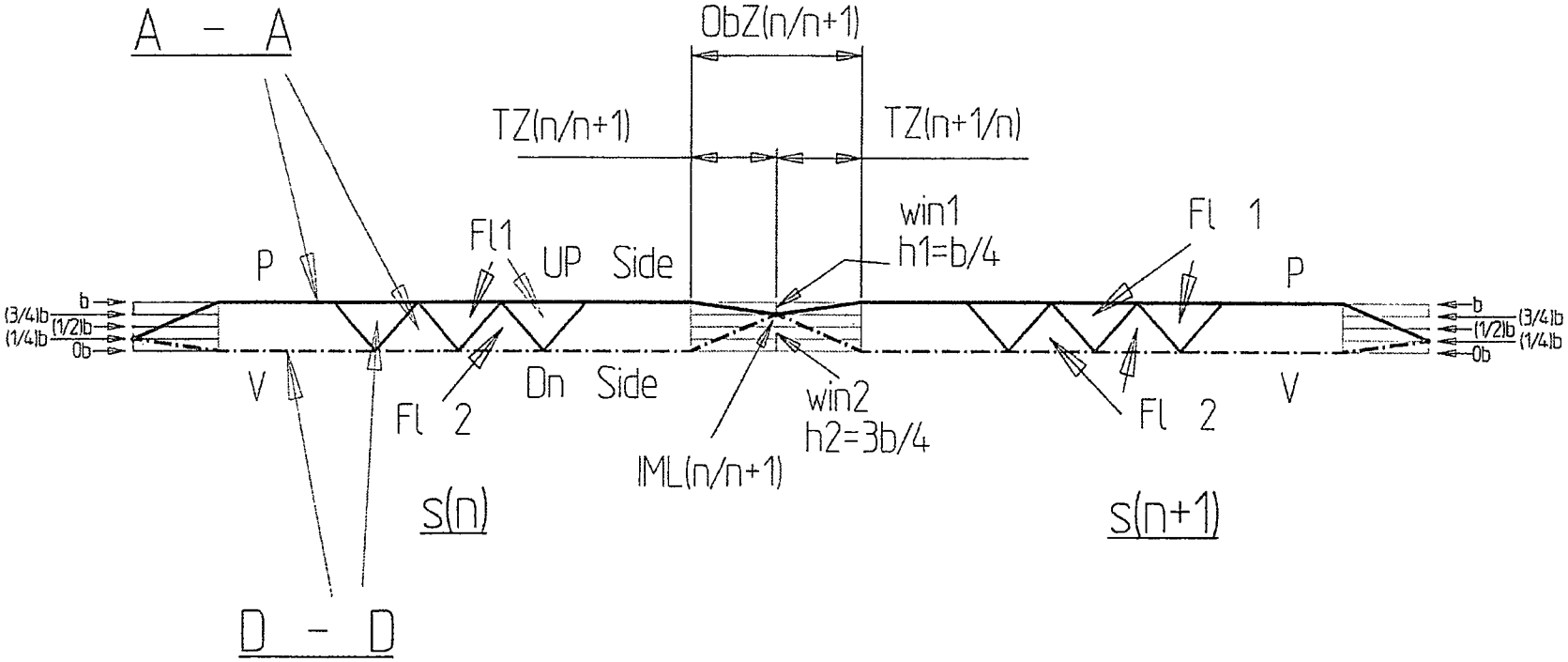

FIG. 26A schematically illustrates an embodiment with transition zones TZ(n) and TZ(n+1) without waves (i=0) between the two interconnected segments meeting at the intermediate line IML(n/n+1). The transition zones form symmetrical mirror images. When (not shown) an intermediate line has half the height of the high peak (h1=b/2), the obstacle to the flow of fluid 1 (FL1) in window 1, the cross-sectional area where fluid 1 can flow, is equal to the obstacle to fluid flow of fluid 2 (FL2) in window 2, the cross-sectional area where fluid 2 can flow. However, if the intermediate line is at a different height, for non-limiting example, h1=3b/4=b/2+x where x=b/4, the obstacle to flow of fluid 1 in window 1 is different from the obstacle to fluid flow of fluid 2 in window 2. The height of window 1 is b/4 whilst the height of window 2 is 3b/4, so that the obstacle of fluid 1 is higher (here, 3b/4) than obstacle of fluid 2 (b/4).

Since the height of the intermediate line is independent of the height of the peaks and valleys of the segments it interconnects, the obstacle of fluid 1 is independent of the obstacle of fluid 2 so that the flow parameters of fluid 1 are independent of the flow parameters of fluid 2.

Figure 26B:
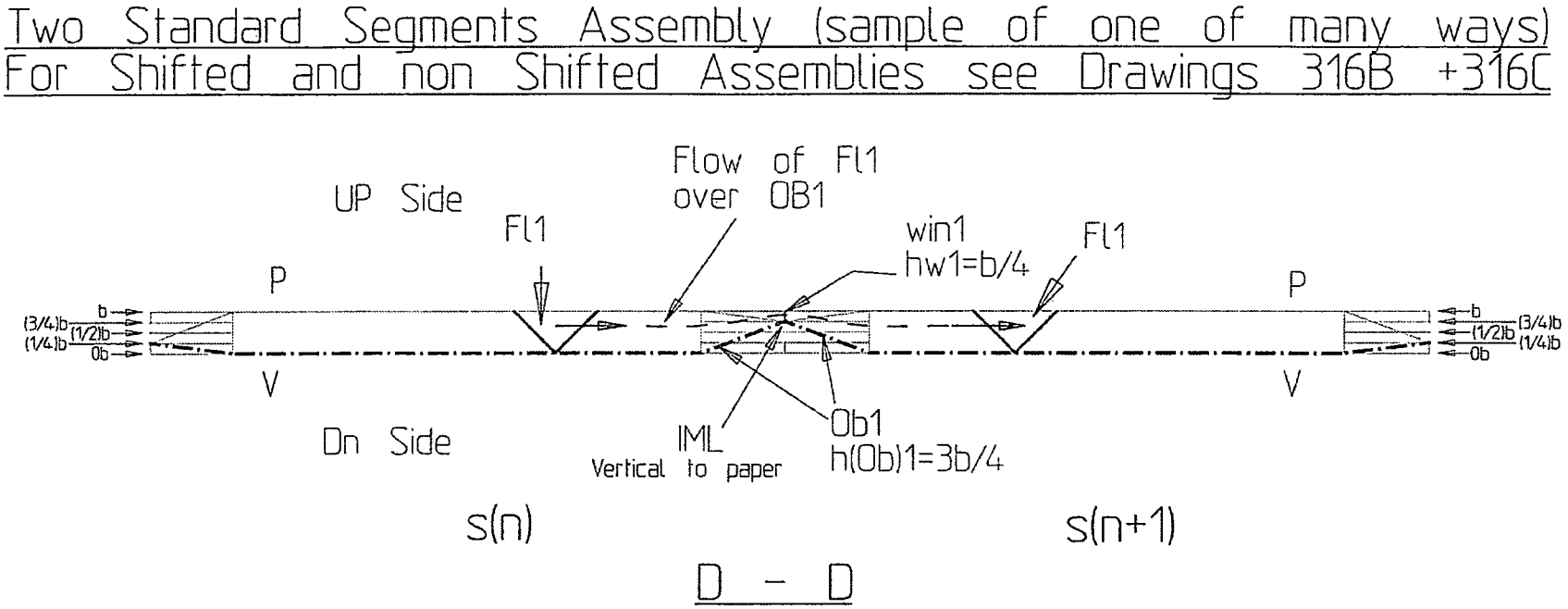
Figure 26C:
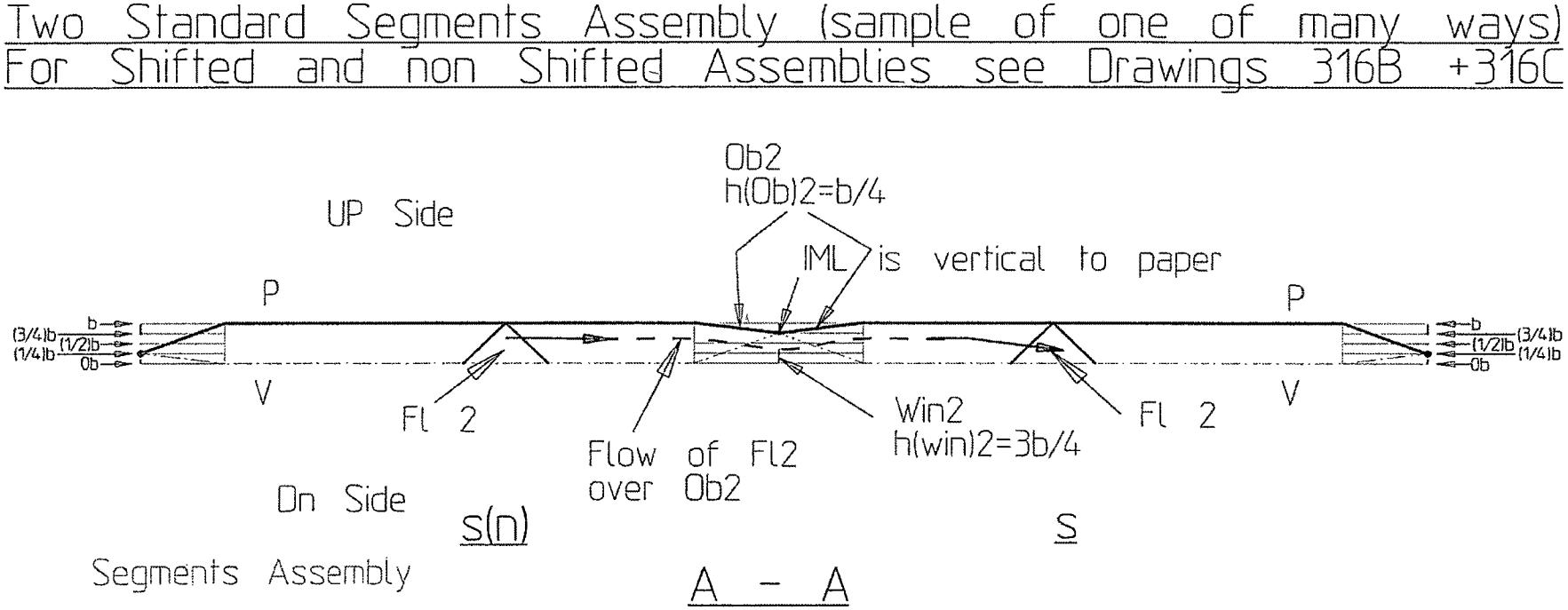

FIGS. 26B and C show the flow of FL1 over obstacle 1 and FL2 over obstacle 2, showing more clearly the flow areas 3b/4 for FL1 (FIG. 26B) and b/4 (FIG. 26C).

Figure 26D:
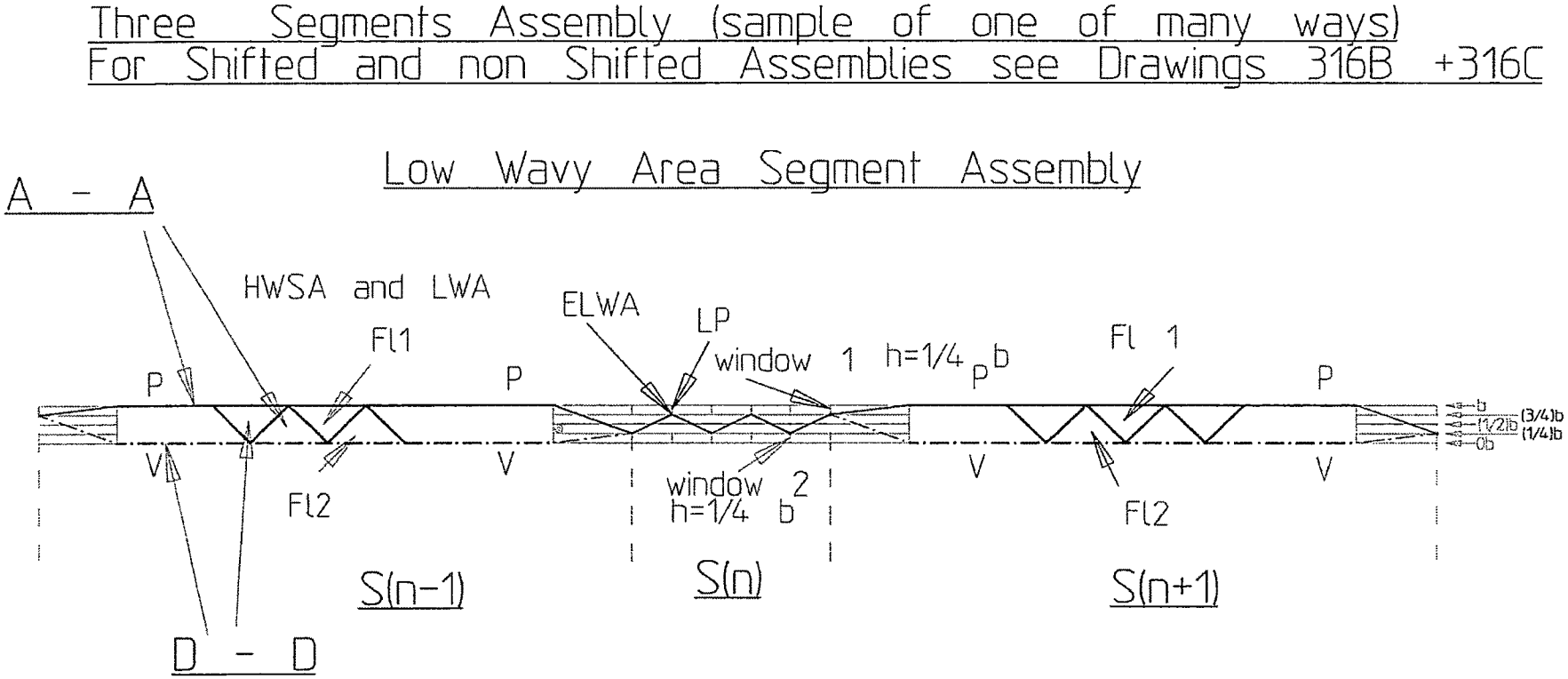
Figure 26F:
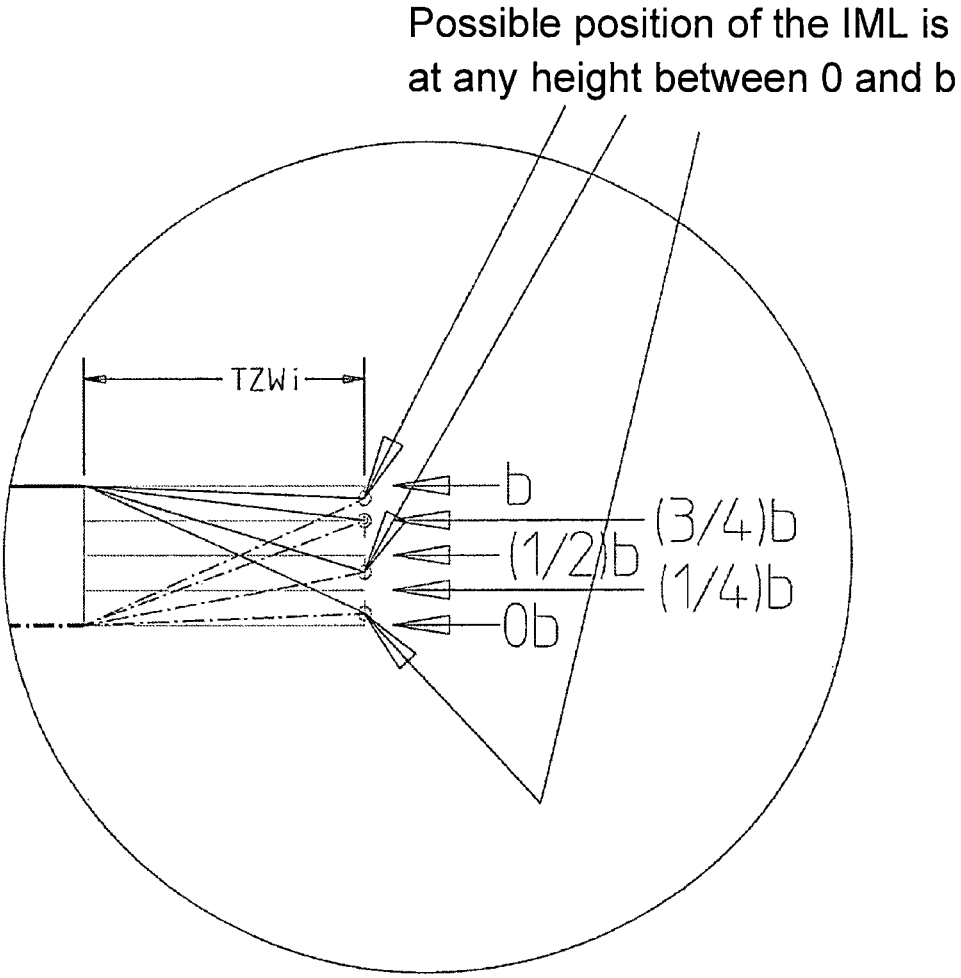
Figure 26G:
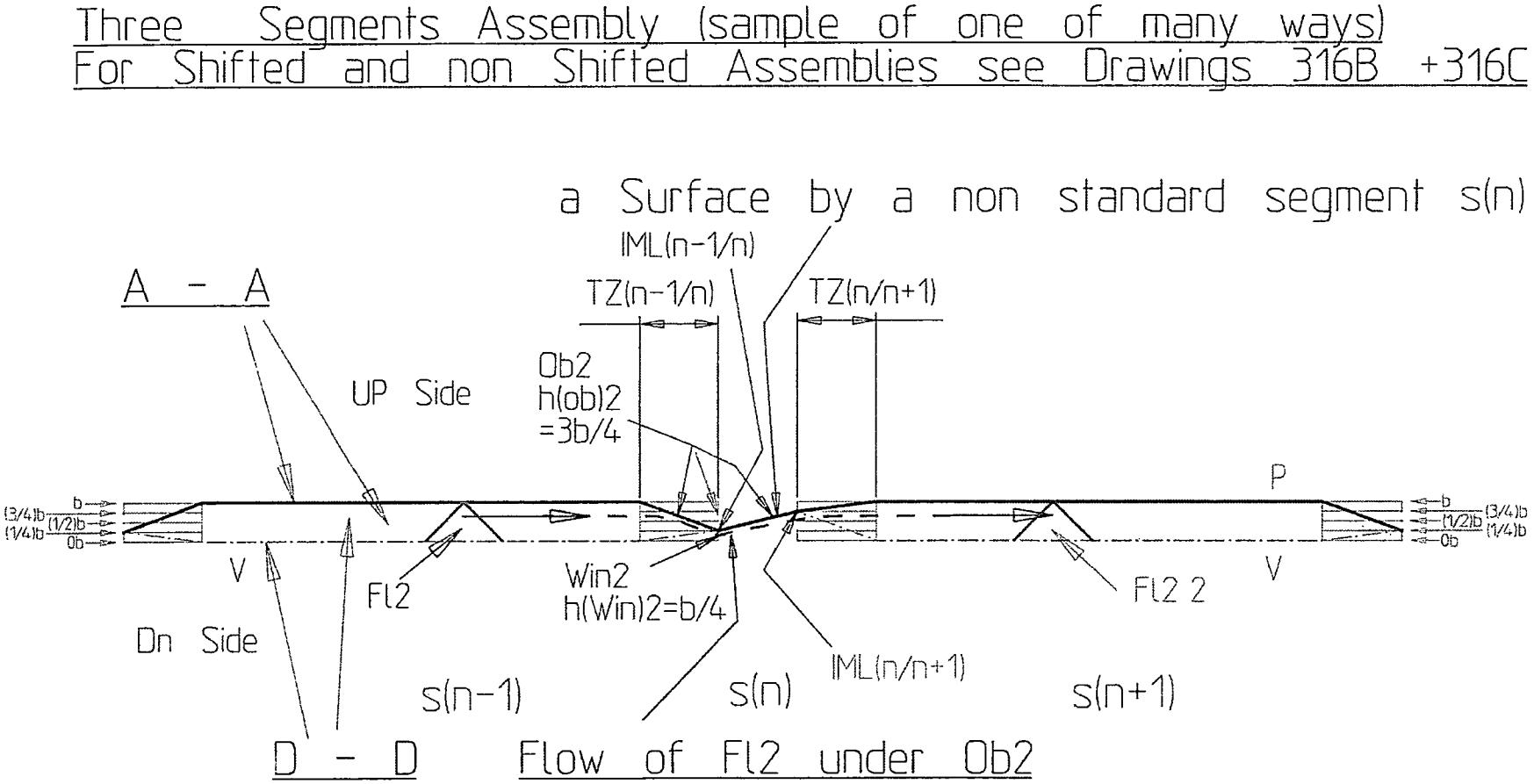
Figure 26H:
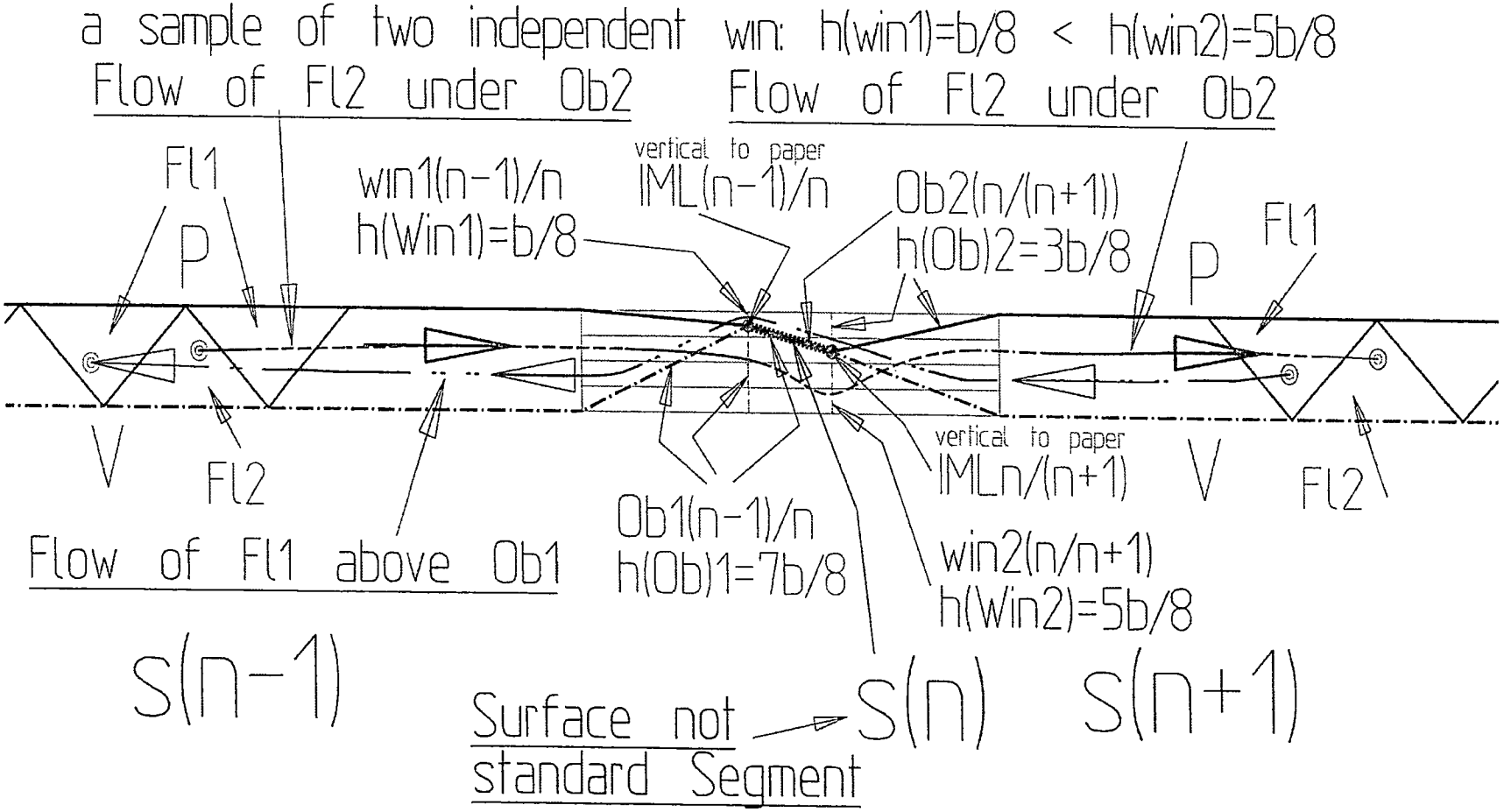
Figure 26I:
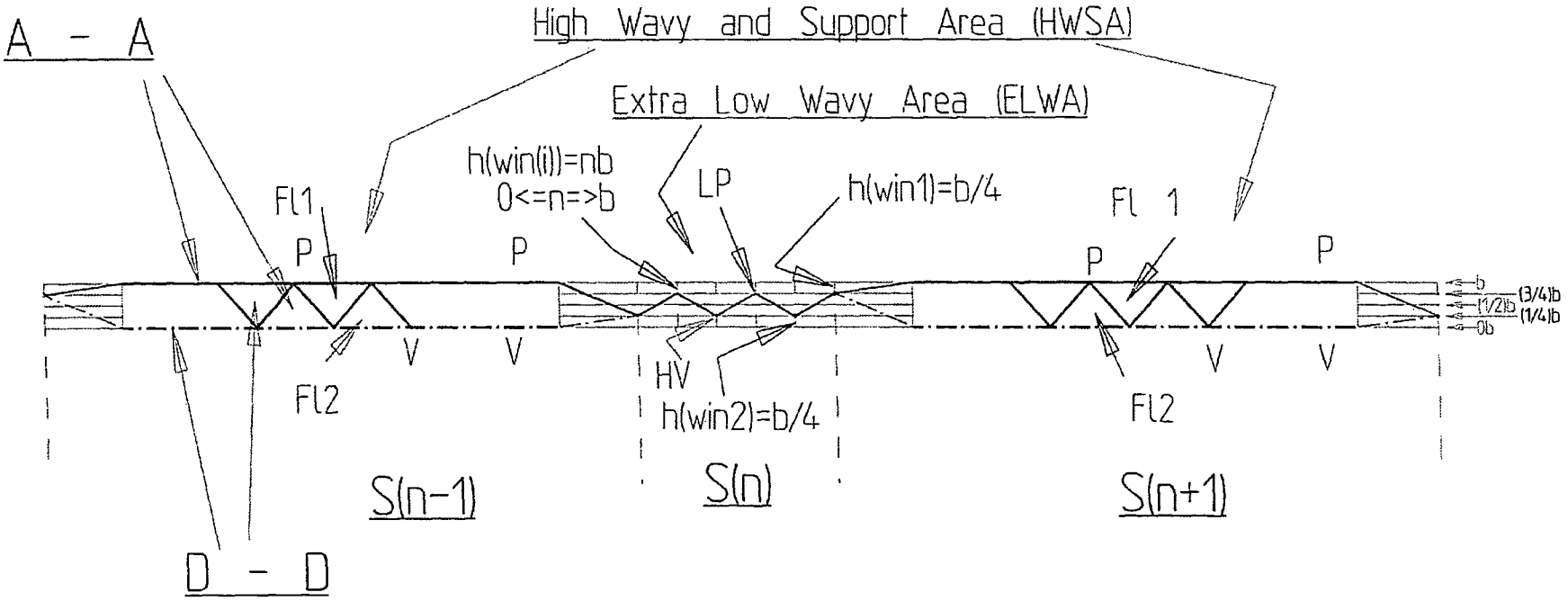
Figure 26J:
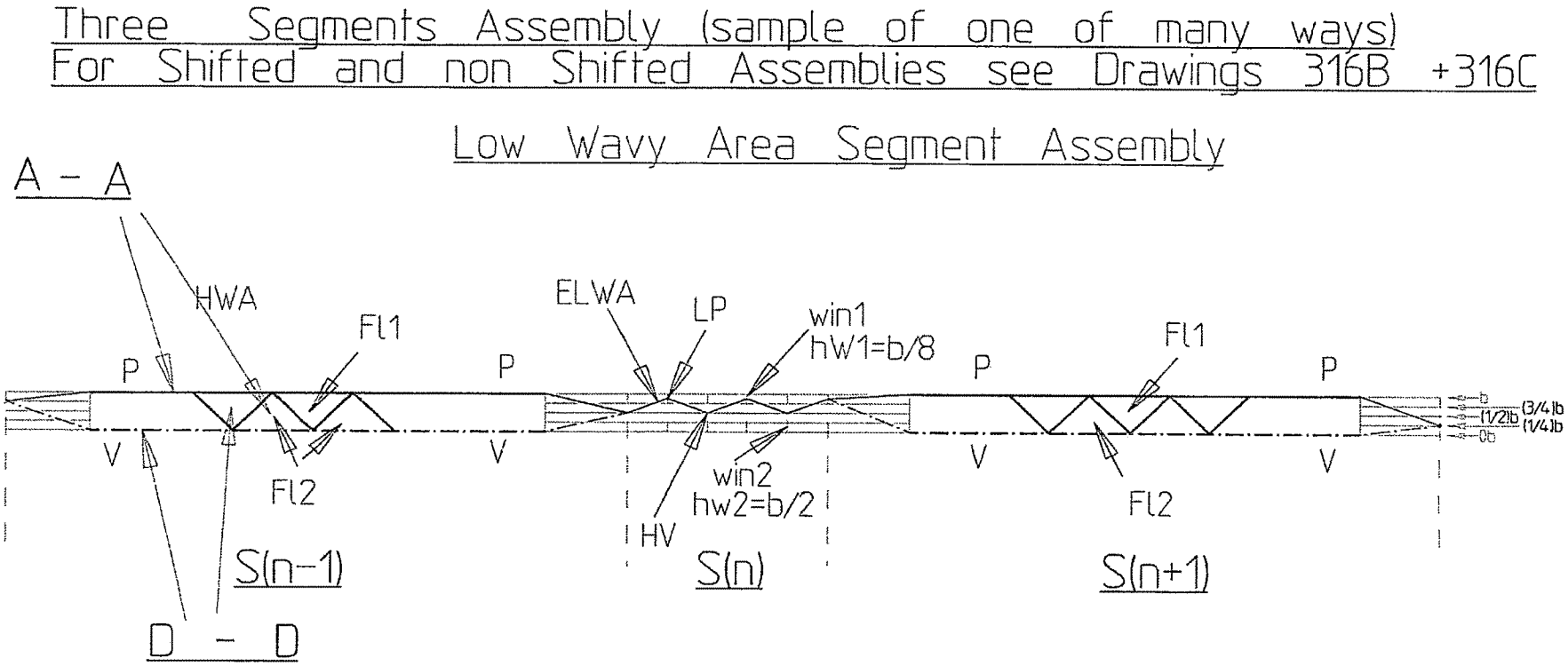
Figure 26K:
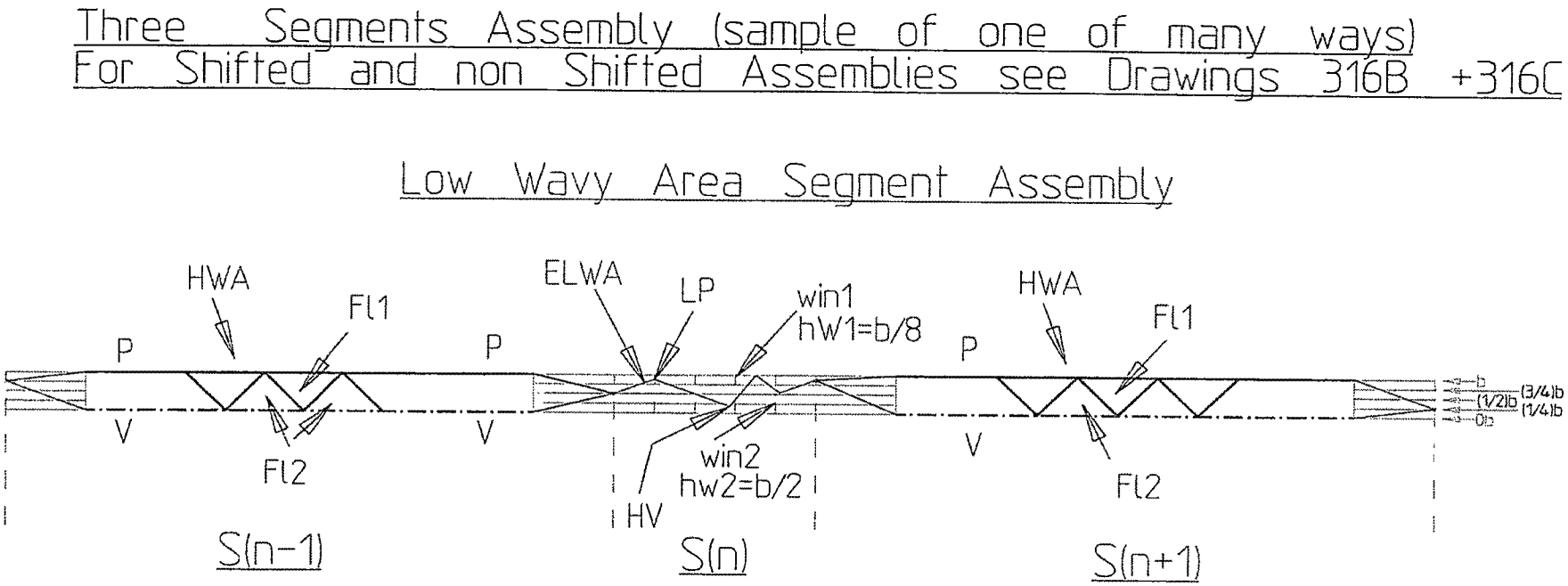
Figure 26L:
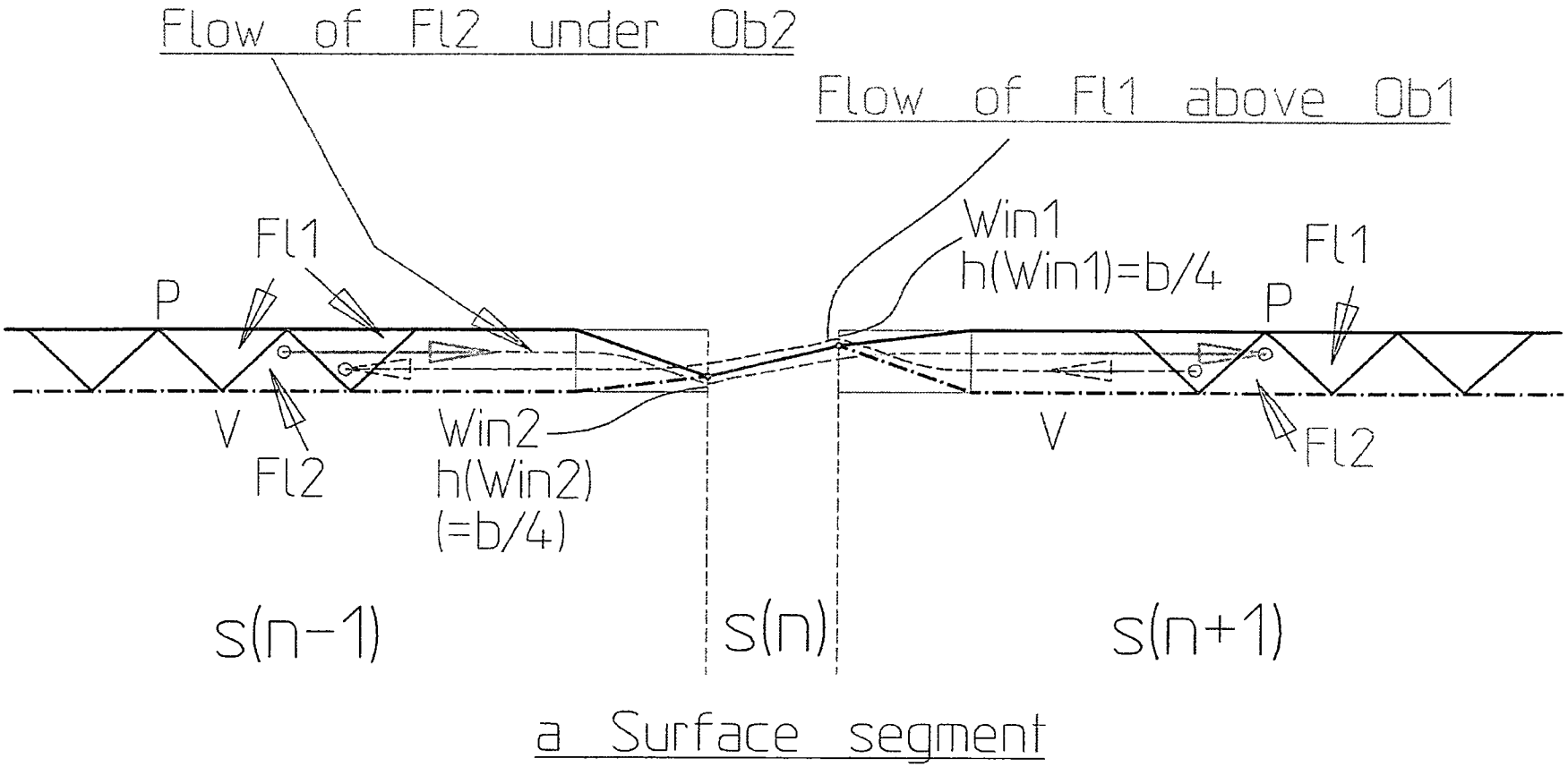

FIG. 26D shows three segments S(n−1), S(n) and S(n+1), where middle segment S(n) comprises extra low way area: Windows 1 and 2 are characterized by h=1/4. FIG. 26E shows a configuration where h(Win1)=h(Win2)=b/4. In the middle segment S(n) IML(n−1/n) is provided between TZ(n−1/n) and TZ(n/n+1). FIG. 26F shows enlargement view of right end of segment S(n). FIG. 26G shows a three segments configuration, where flow of Fluid 2 is under Ob2, a surface by non-standard segment S(n). IML(n−1/n) is located between TZ(n−1/n) and TZ(n/n+1), h(Win2)=b/4. FIG. 26H shows a three segments configuration, where flow of Fluid 2 is under Ob2. IML(n−1/n) is located between TZ(n−1/n) and TZ(n/n+1), h(Win1)=b/8, h(Ob1)=7b/8; and h(Win2)=5b/8, h(Ob2)=3b/8. FIG. 26I shows a three segments configuration which comprises HWSA and LWA. h(Win1)=h(Win2)=1/4. FIG. 26J shows a three segments configuration where h(Win1)=b/8 and h(Win2)=b/2. FIG. 26K shows a different configuration where h(Win1)=b/8 and h(Win2)=b/2. FIG. 26L shows a different configuration where h(Win1)=h(Win2)=1/4.

Figure 27:
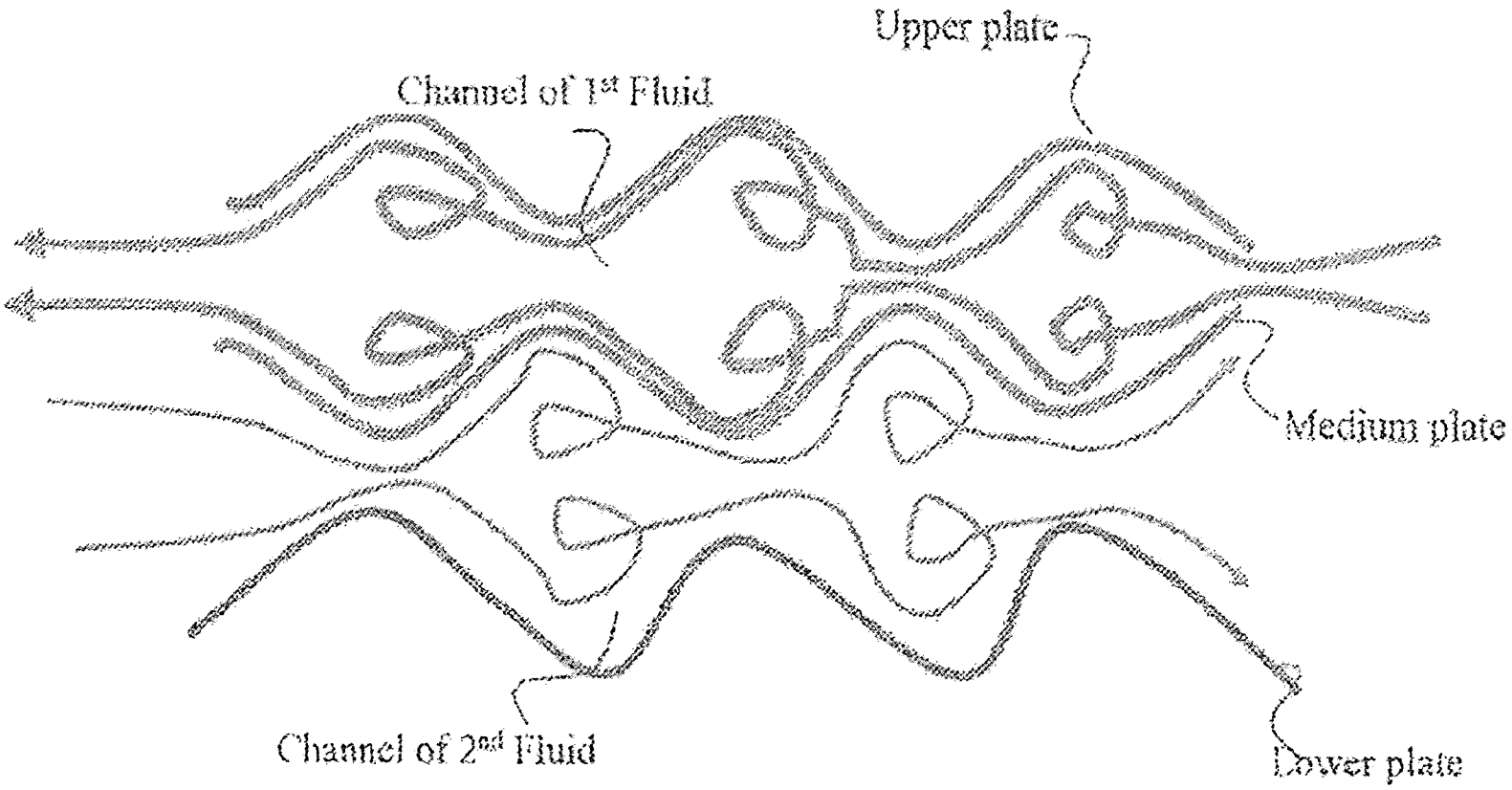

FIG. 27 schematically illustrates an embodiment where the low-wavy area of an upper plate forms a first flow path with the middle (median) plate, providing turbulent flow of fluid 1 from right to left, whilst the middle (median) plate forms with the lower plate a second parallel flow path, providing countercurrent turbulent flow of fluid 2 from left to right. In various embodiments, flow of fluids 1 and 2 can be concurrent or countercurrent.

Figure 28:
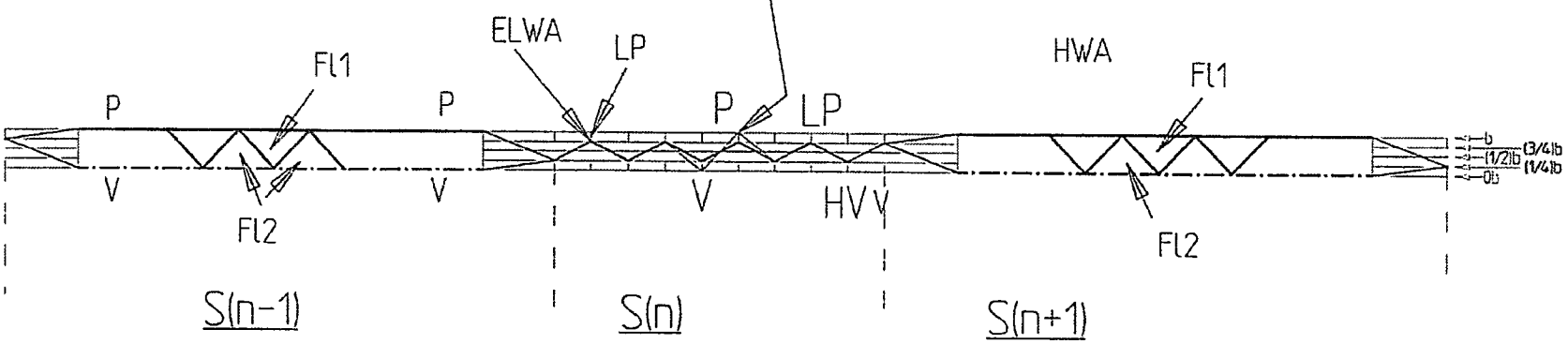

FIG. 28 schematically illustrates a Segment S(n) which comprises supports. In FIG. 28, at least part of the third valley, labelled V, is at a height of b/4, and at least part of the third valley is at a height of 0. At locations where the valley V is at a height of 0, it will contact the next lower adjacent plate, providing support for the plates. Similarly, at least part of the third peak (labelled P) is at a height of 3b/4 and at least part of the third peak is at a height of b. At locations where the peak P is at a height of b, it can contact the next upper adjacent plate, providing support for the plates. A support can occur on any part of low peak or high valley. Not all of the parts of a peak at a height b need contact an adjacent plate and, similarly, not all parts of a valley at a height 0 need contact an adjacent plate.

Figure 29:
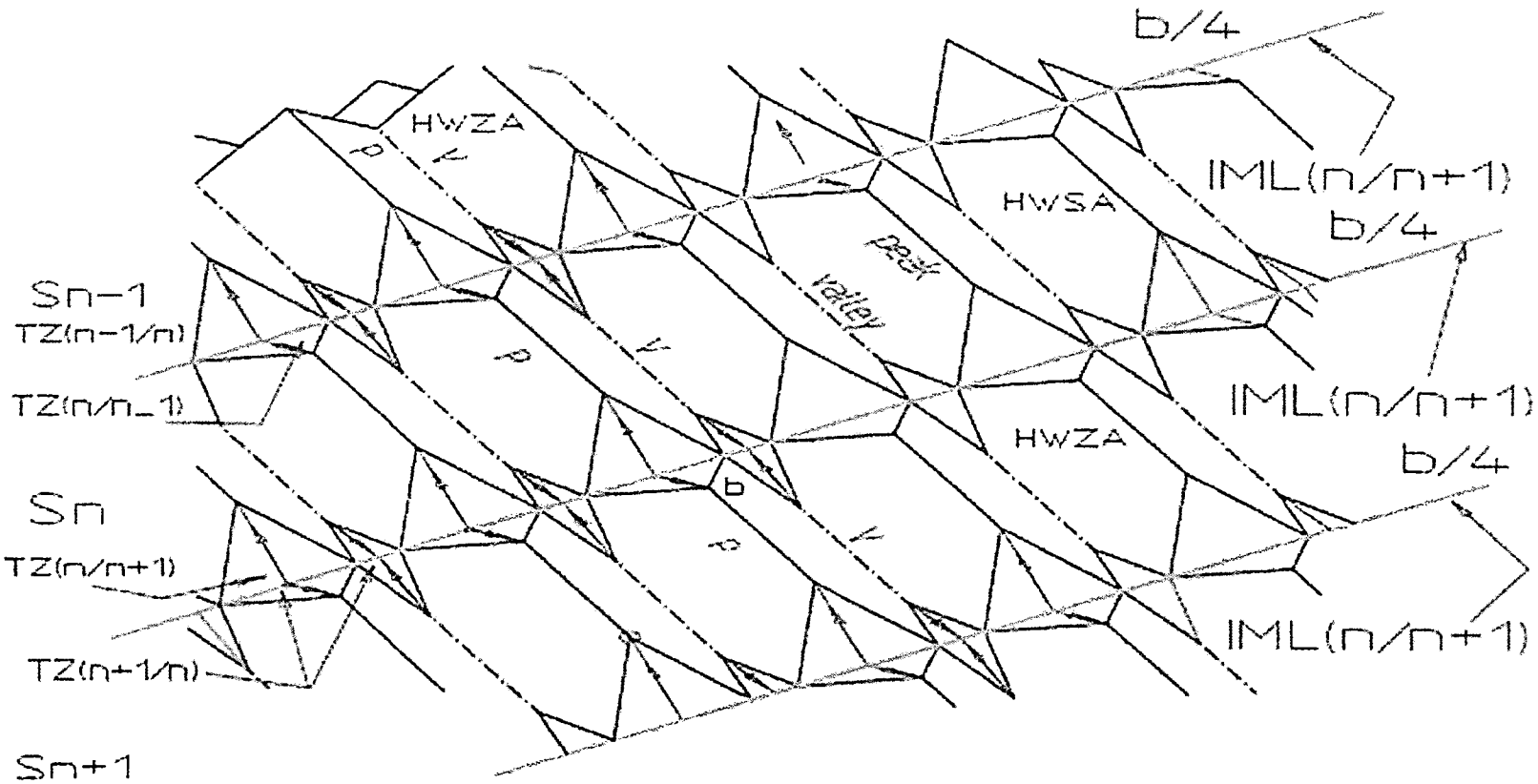
FIG. 29 schematically illustrates fluid flow around peaks and obstructions of the plate shown in FIG. 28 according to several embodiments of the invention.

The PHEs shown below additionally comprise a phase shift between segments. Typically, in the figures described below, Fluid 1 flows above the plate whilst Fluid 2 flows below the plate. In FIG. 29, Fluid 1 meets obstacles of height h=b/4, whereas Fluid 2 meets different obstacles of height h=3b/4b.

Figure 30:
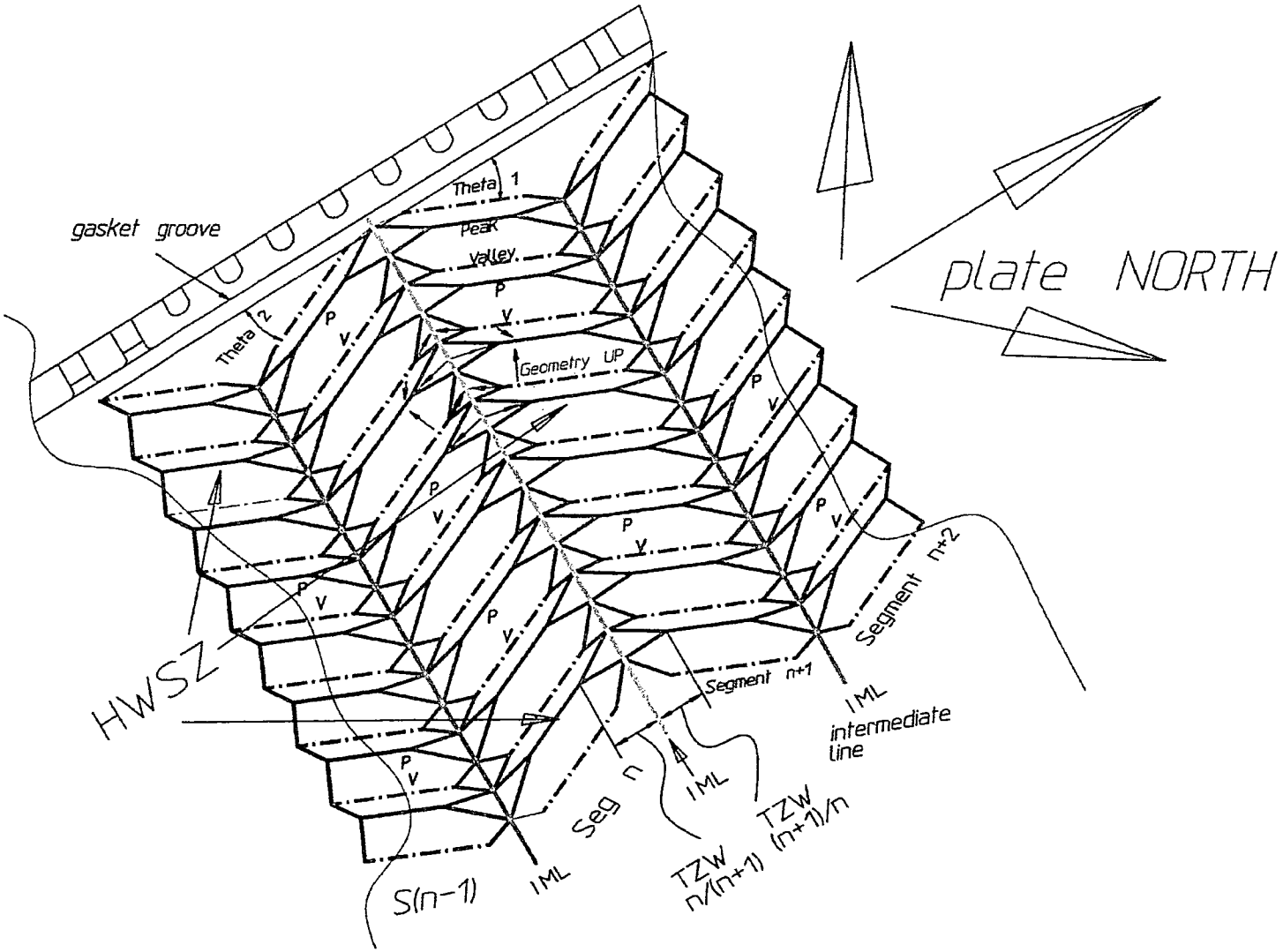
FIG. 30 schematically illustrates an enlarged perspective view of segments meeting at intermediate lines, showing the obstructions according to several embodiments of the invention.

FIG. 30 illustrates a plate with 4 segments, where the lines of the peaks comprise a curve, an extra wavy area, so that terminal ends of the peaks (and, similarly, the terminal ends of the valleys) are higher at one end of a segment than the other, so that the peak-valley distance remains the same across a segment but the cross-sectional area beneath the plate (and above it) changes across each segment. Segment n−1 is a falling segment; its rightmost terminal end is lower than its leftmost terminal end. Segment n is a rising segment, then segment n+1 is a falling segment, followed by another rising segment. Each TZ between segments displays obstructions, as well. In this embodiment, the lines of the peaks and valleys are parallel to the longitudinal edge of the plate; the curve also rises and falls along the x axis. However, other embodiments can have the lines of the peaks/valleys and the direction of the rise and fall of the curve that are not aligned with each other or the plate edges.

Figure 31:
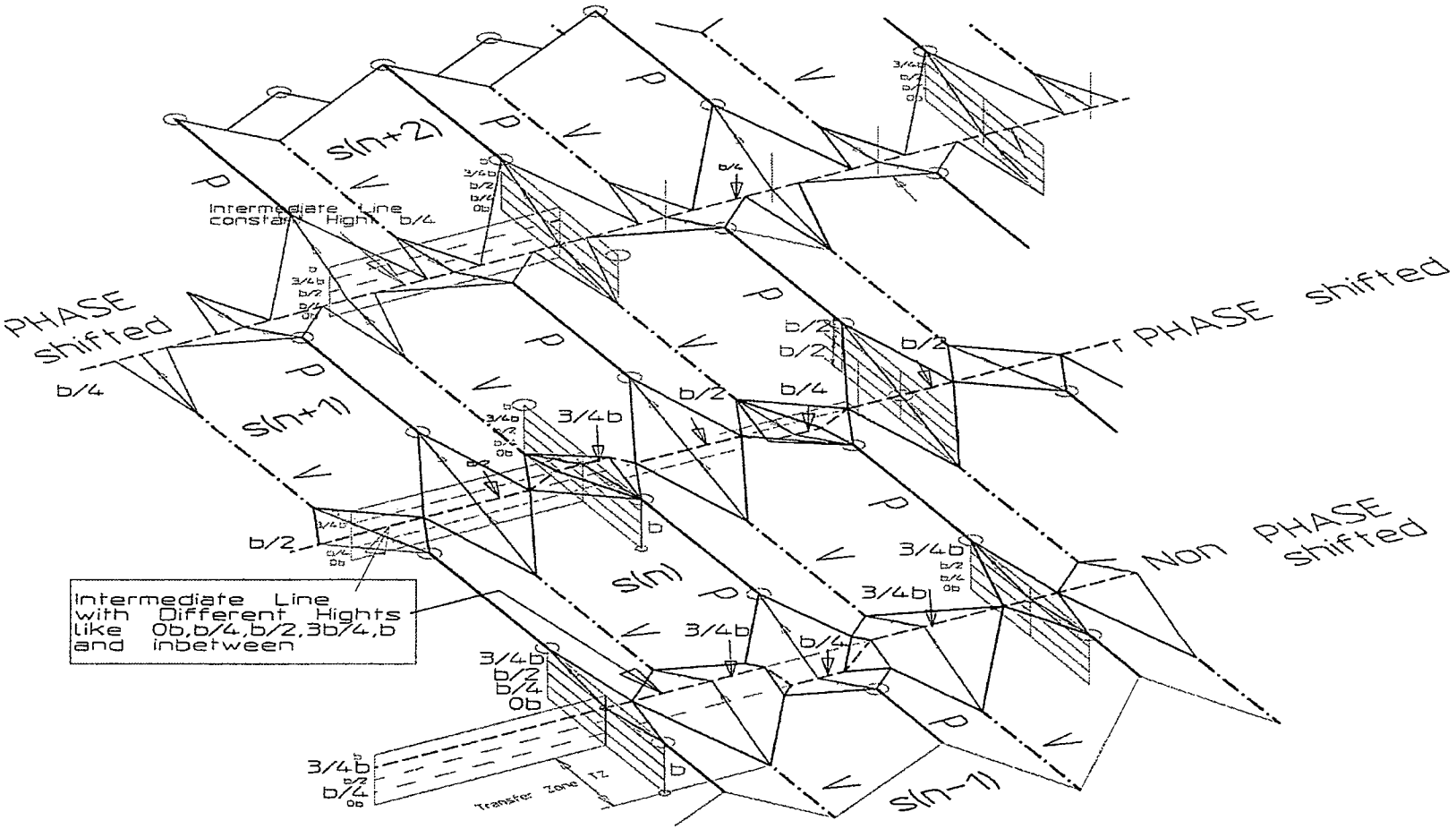
FIG. 31 schematically illustrates a perspective view of segments meeting at intermediate lines, where the segments are phase shifted with respect to each other, according to several embodiments of the invention.

FIG. 31 schematically illustrates a heterogeneous phase shift pattern. Segment S(n−1) is not phase shifted with respect to segment S(n), while segment S(n) has a n angular phase shift of 180 degrees, a phase shift of a/2 with respect to segment S(n+1). There are three intermediate lines, the first at height h=b/4, the second at height b/2 and the third at height 3b/4.

Figure 32:
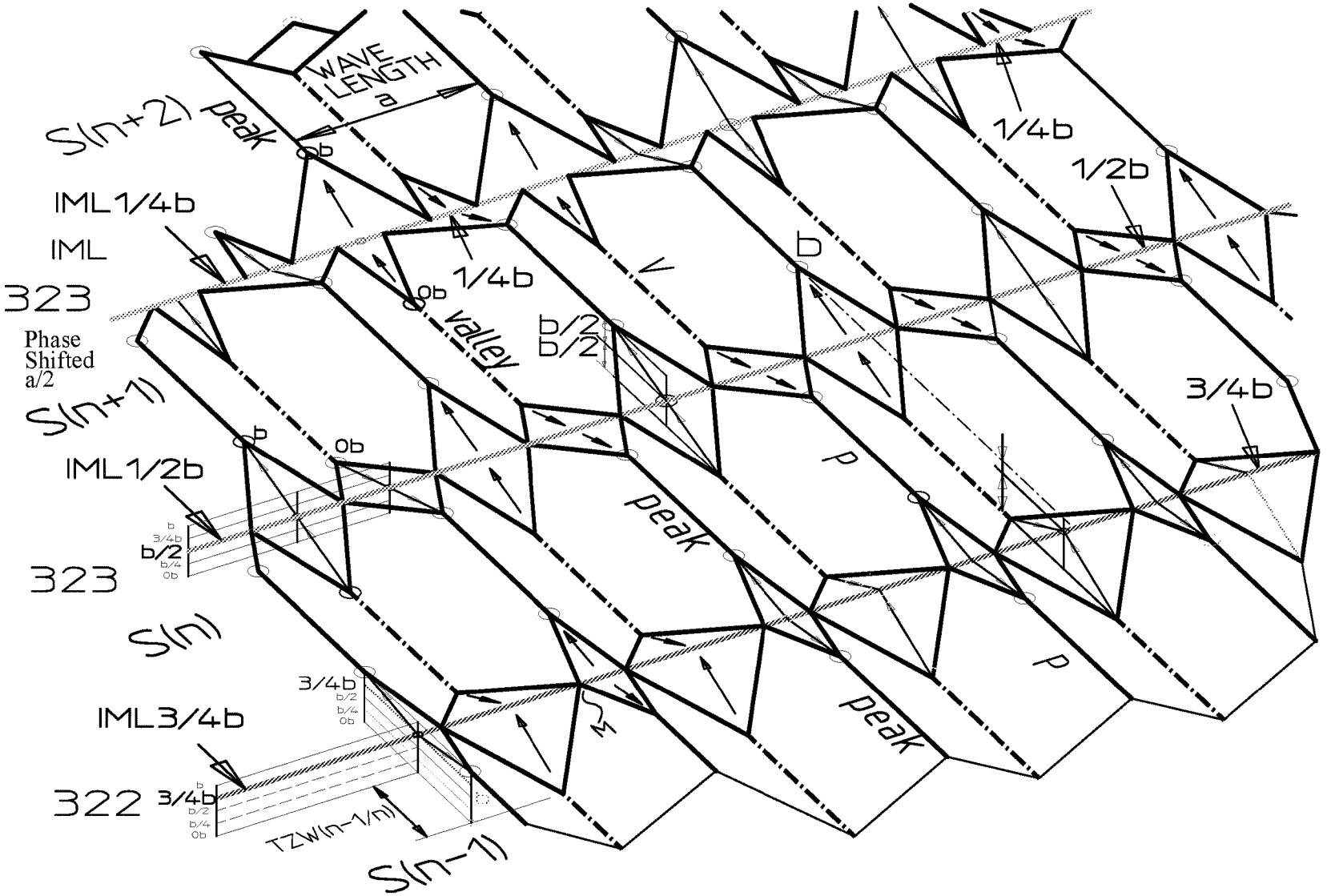
FIG. 32 and FIG. 33 schematically illustrates a perspective views of a low wavy area comprising support protrusions according to several embodiments of the invention.

FIG. 32 illustrates a heterogeneous TZ pattern. It the first intermediate line, the peak TZs have the same shape and the valley TZs have the same shape, but the peak TZ shapes differ from the valley TZ shapes. At the second intermediate line, the shapes and sizes of the peak and valley TZs are the same, but the peaks subtend a different angle with the TZs than the valleys. The angle is the same for all peaks and the angle is the same for all valleys. At the third IML, the TZs on one side of the IML have a different shape and size from the TZs on the other side of the IML. Different combinations of the above are also possible.

Figure 33:
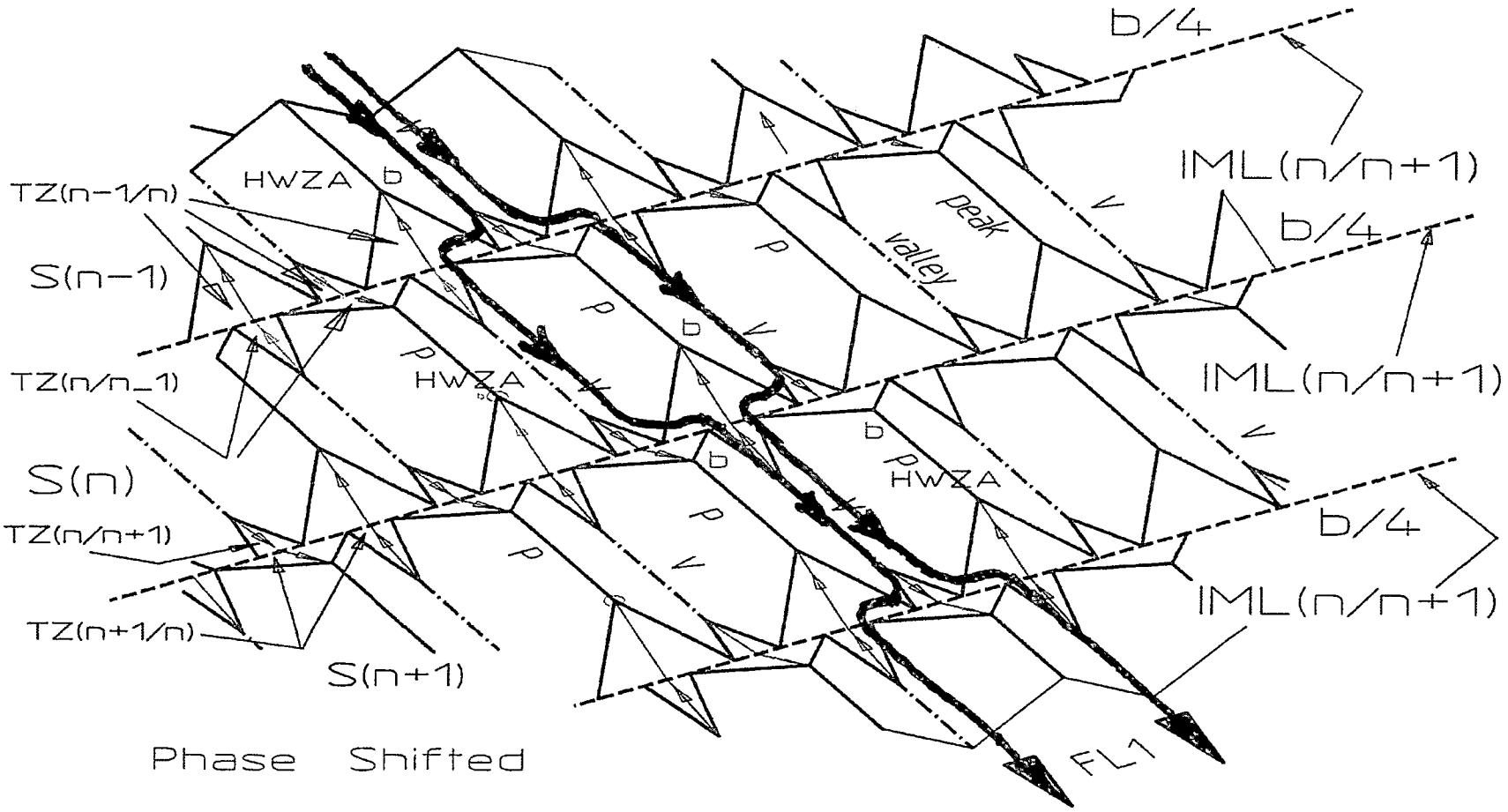

FIG. 33 schematically illustrates a similar plate with phase shifted segments. The phase shifting will induce further turbulence, and may also induce vorticity, compared to a non-phase shifted plate such as that shown in FIG. 26. The additional turbulence (and vorticity) will occur because the flowing fluid in a flow path in one segment will divide into two streams, flowing through adjacent flow paths, in order to pass around the obstacle caused by the phase-shifted peak in the next flow path. This is indicated in FIG. 29 by the lines, which separate to bypass the obstacle formed by the terminal ends and sides of the peaks, and rejoining in the flow path beyond the obstacle. It should be noted that there will be mixing of the separated streams with separated streams from adjacent flow paths, also increasing mixing of fluid across the plate and increasing flow turbulence.

This embodiment enhances turbulence, since streams from adjacent upstream flow paths will meet and be mixed in the downstream flow paths. The high-wave zone is characterized by multiple peaks, all aligned in same main direction (here, north-south).

In the embodiments shown above, a single IML separated adjacent segments. In FIG. 30, two parallel IMLs are shown. The height of each IML line is independent of the height of the other IML. This configuration can be used to reduce flow resistance when two sides of the plate comprise a high obstacle, with h>b/2.

Figure 34:
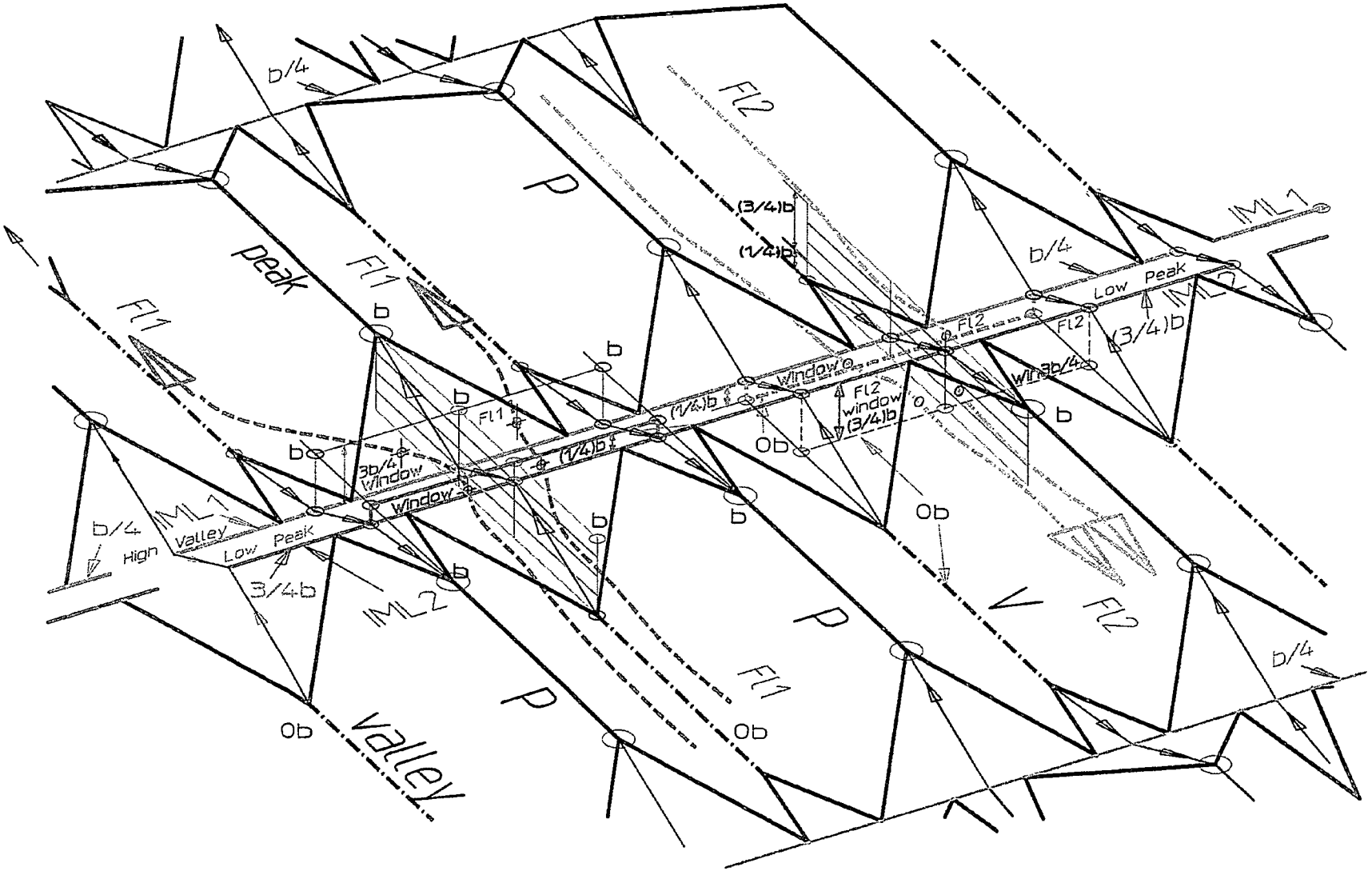
FIG. 34 schematically illustrates an embodiment without phase shift, according to several embodiments of the invention.

FIG. 34 schematically illustrates an embodiment without phase shift. Each intermediate line has a different height, where the southernmost intermediate line is the highest at a height of 3b/4, the middle intermediate line is at b/2 and the northernmost intermediate line is the lowest, at a height of b/4. Fluid 1 is flowing northward; the velocity will be greatest across the southernmost intermediate line and lowest across the northernmost intermediate line. For fluid 2, flowing concurrently below the plate, on the other hand the velocity will be least for the southernmost intermediate line and greatest for the northernmost intermediate line. Therefore, turbulence is most likely to develop for fluid 1 at the northernmost IML and, similarly, turbulence is most likely to develop at the southernmost IML for fluid 2.

Figure 35:
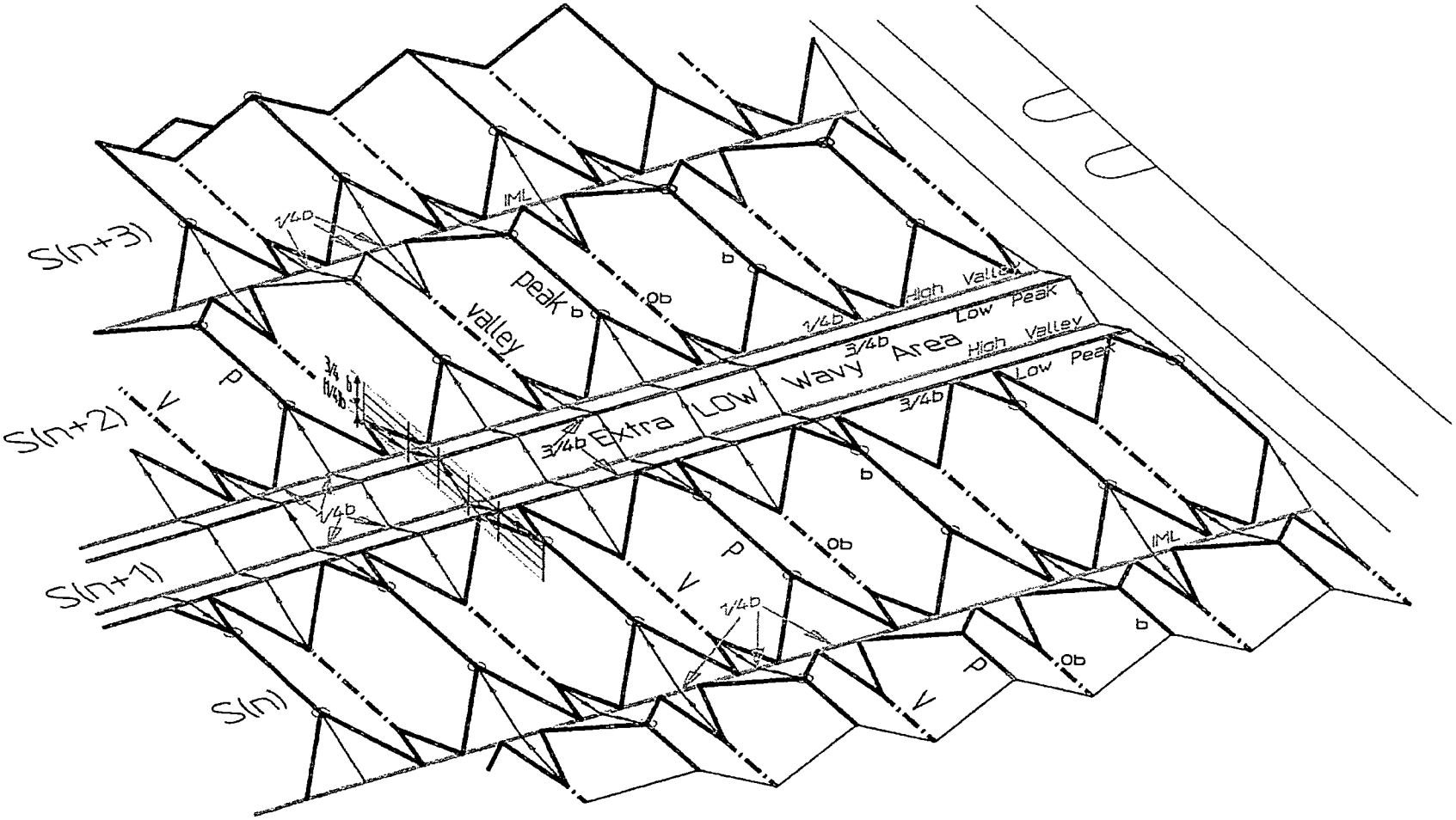
FIG. 35 schematically illustrates a section of a plate with several segments separated by TZs and intermediate lines, according to several embodiments of the invention.

FIG. 35 schematically illustrates a section of a plate with several segments separated by TZs and intermediate lines. In segment n, the peak/valley lines are parallel to the edge of the plate. In segment n+1, the peak-valley lines are perpendicular to the same edge of the plate. Segment n+1 also comprises high valleys, low peaks, an intermediate wavy area and peak supports. The segments n+2 and n+3 are phase shifted with respect to each other, but segments n+3 and n+4 are not phase shifted. Supports are found in segment n+2 at the ends of HWZ. The peaks and valleys of segments n+3 and n+4 have flat tops (bottoms. Supports are provided along the peak/valley lines of segments n and n+1.

The three illustrations 36A-C discussed below show again a phase-shifted plate. A non-shifted plate is also possible. The plate also comprises an extra low wavy area. Intermediate line n+1/n+2, is changing its height from west to east. It begins at h=b/4, then in the middle, h=b/2 and ends when h=3b/4. In segment n is characterized by three waves (i.e., three low peaks and three high valleys) exceeded perpendicular to the flow direction. Those non-supported zones provide lower flow rate with low pressure drops. Supporting points are provided: UP and DOWN adjacent neighboring plates. This configuration provides enhanced heat transfer and increased plates support.

The figure below 36C schematically illustrates a peak characterized as a truncated ridge (e.g., a recessed portion of sawed area in various shapes and dimensions). This structure enables increase number of streams, increased velocity. It improves heat transfer and increase pressure drop. The illustration further depicts up and down supporting points, e.g., a depression shaped protrusion shape members.

The illustration below schematically illustrates a zigzag line on which supporting points are located. Intermediate lines are zigzagged as well. The protrusion supporting line may be aligned exactly above the depressed supporting line. Those supports are possible but not necessary. A zigzag extra low wavy area is also disclosed. This zigzag conformation improves turbulence of the flow and heat exchange, yet it might increase pressure drop.

Figure 36A:
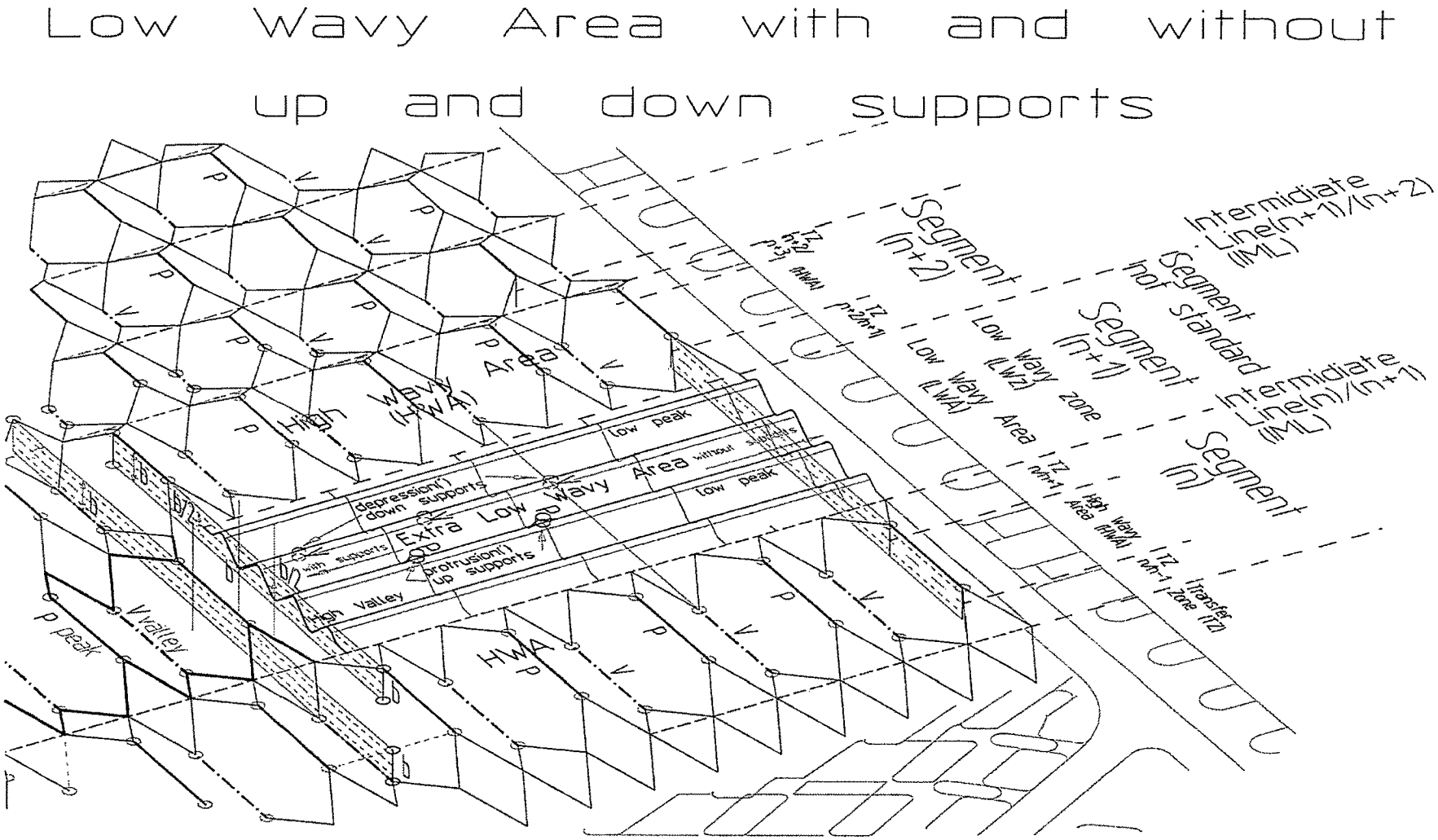
FIGS. 36A-F support area, according to several embodiments of the invention.
Figure 36B:
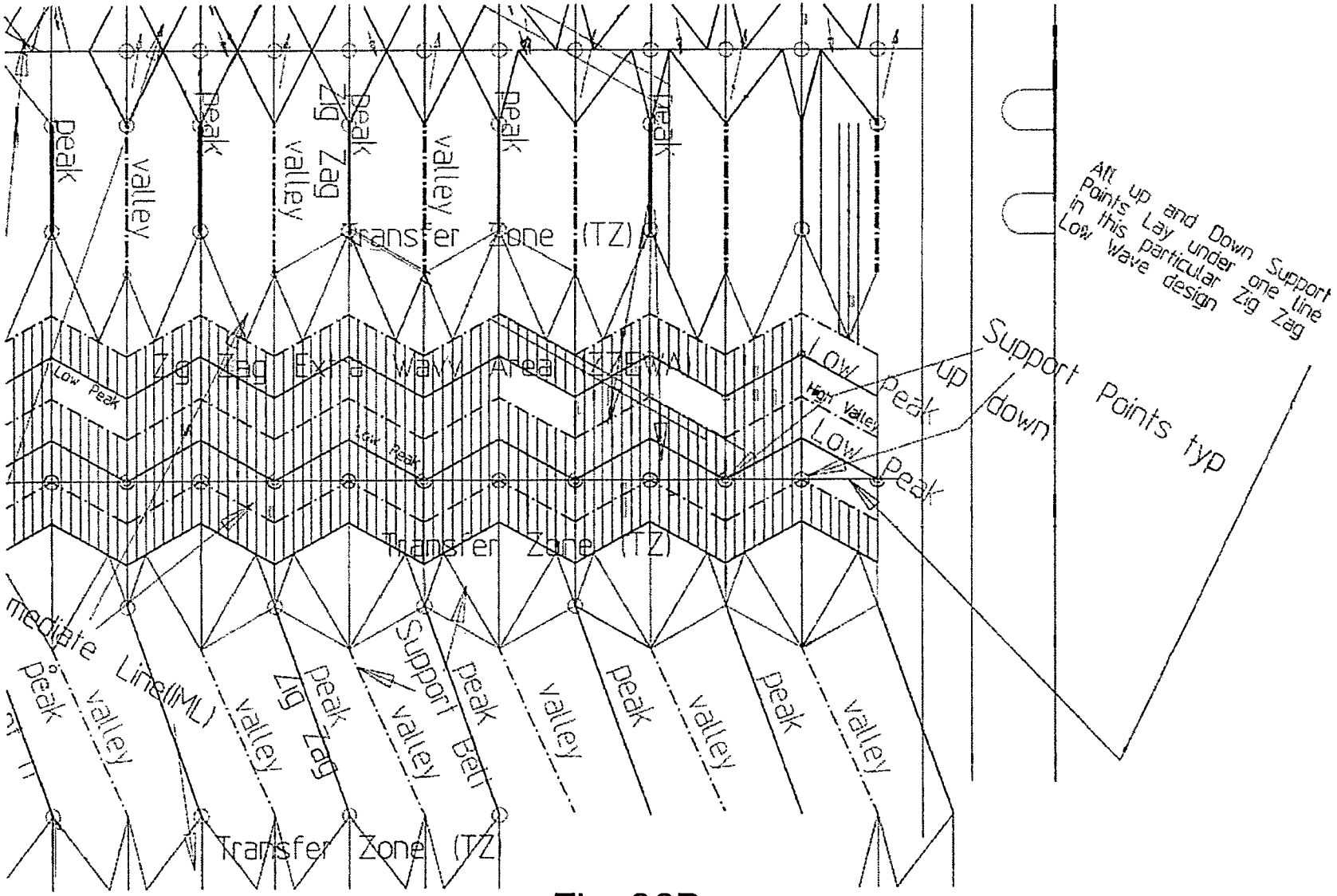
Figure 36C:
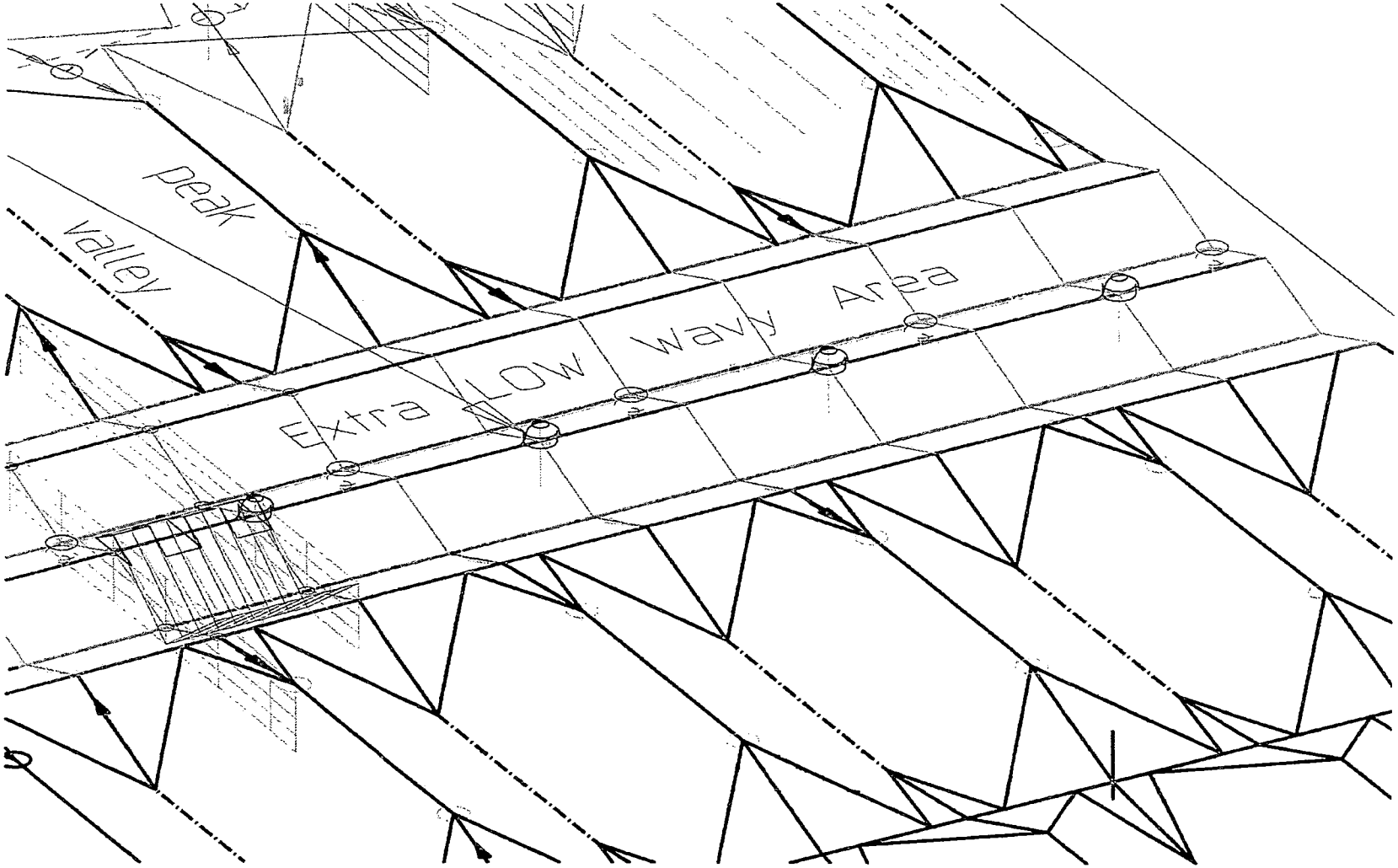
Figure 36D:
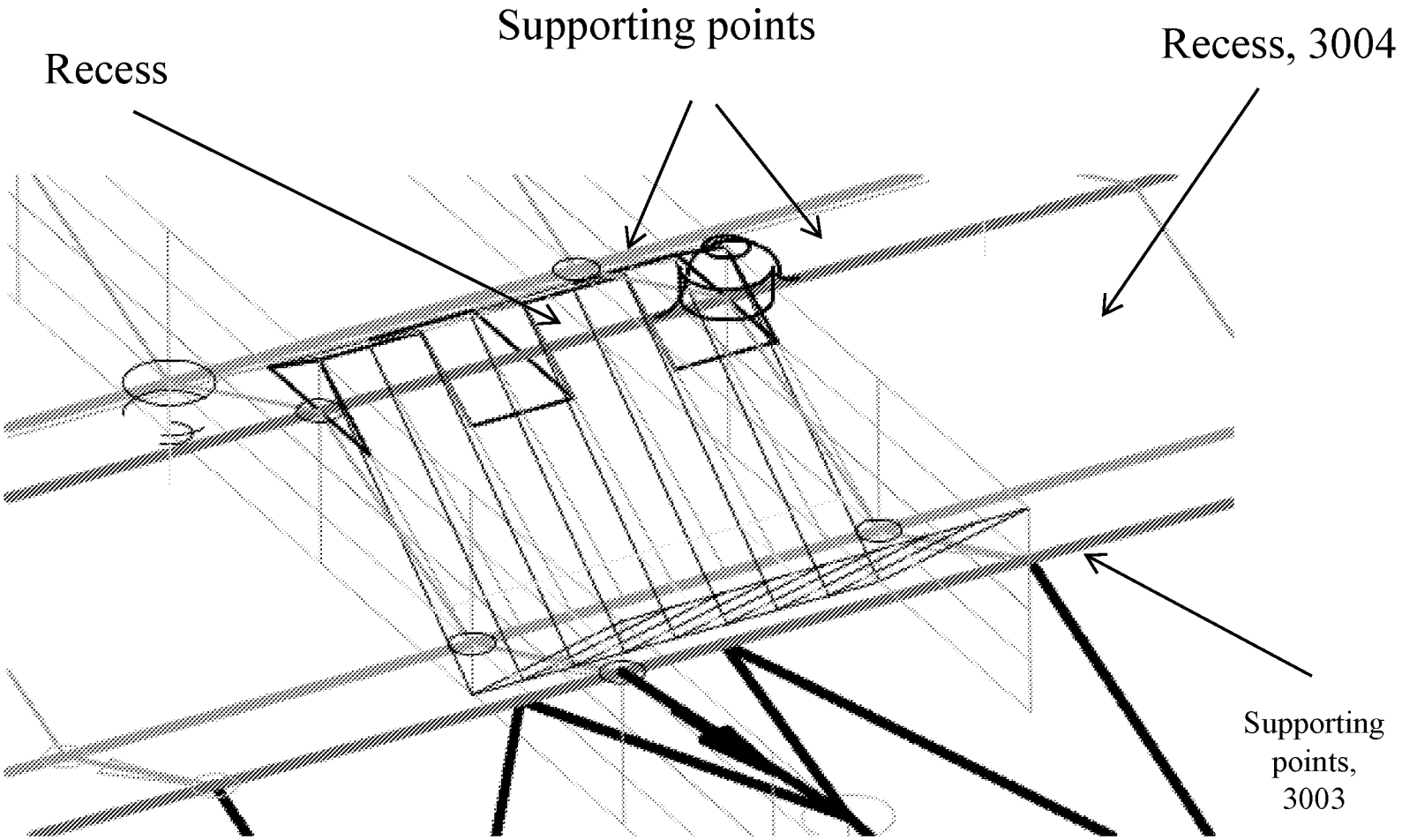
Figure 36E:
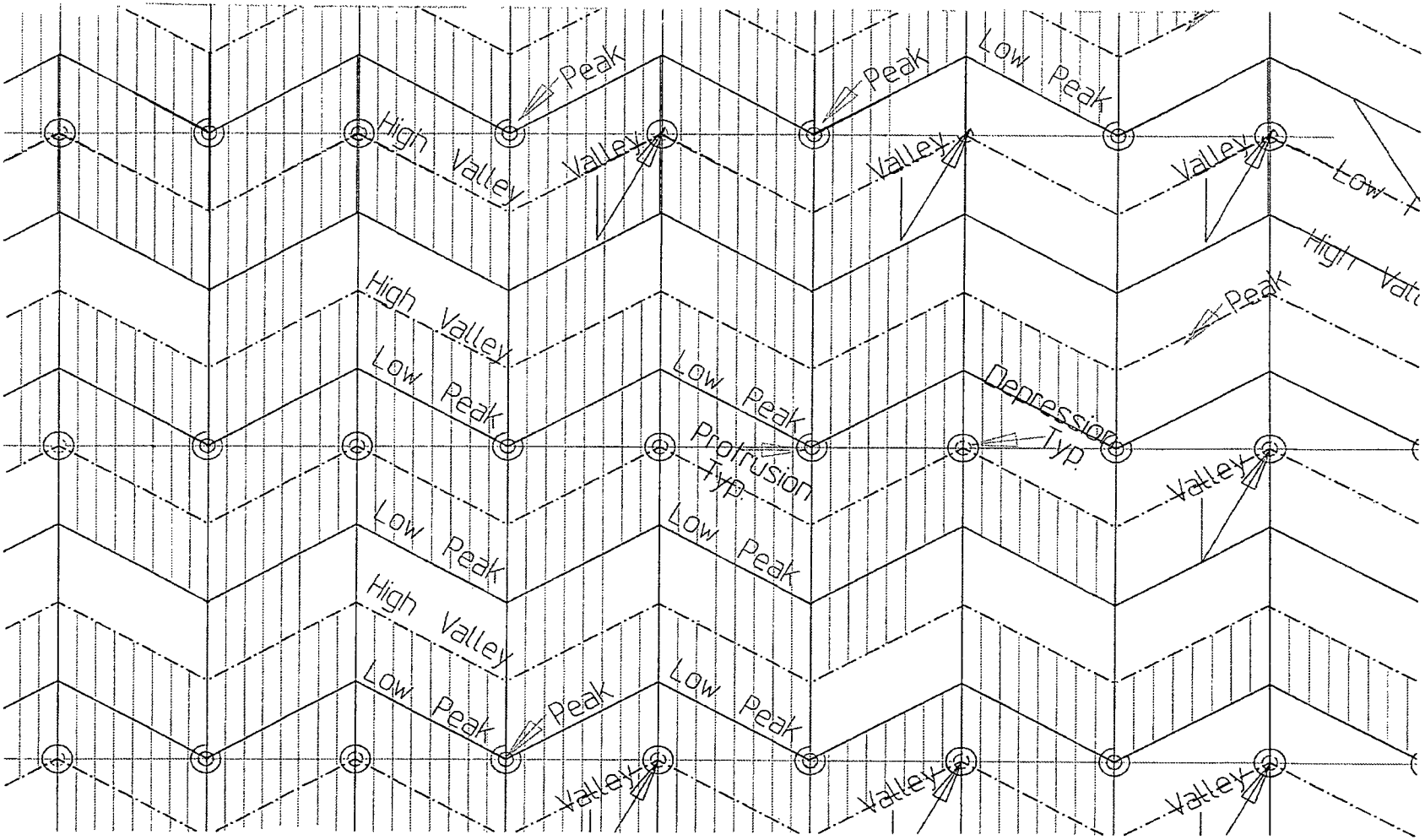
Figure 36F:
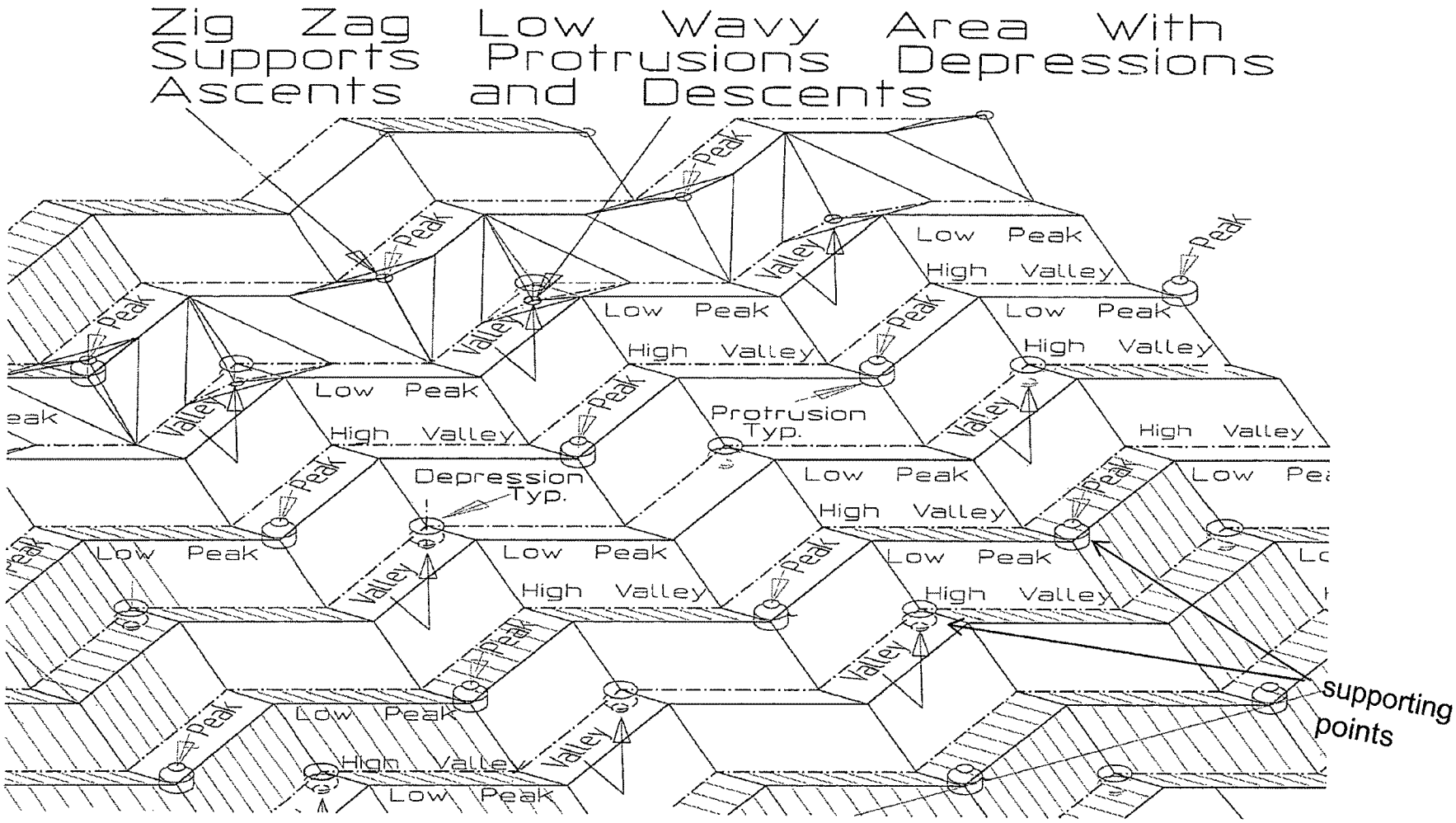

FIG. 36A-F support area; whereas FIG. 36D illustrates an enlargement of support area, and FIGS. 36E and 36F schematically shows long low wavy area with supports. The waves can be indefinitely long, e.g., can reach the entire length of heat transfer area.

FIG. 36E shows a zigzag structure which comprises abrupt obstacles, namely, increase of height, provides a continuous and uninterrupted helical, spiral, screw movement which combines rotation with translation which decrease pressure drop. Much similarly, FIG. 34 shows support which is provided by wave shape.

FIG. 36F schematically illustrates a plate with support protrusions (supporting points). Support protrusions are illustrated in a number of possible locations, for example, upward-pointinf support protrusions can be seen at the IML between 2 low peaks, at an IML in a high valley, at an IML on a low peak, and at an IML on a high peak. Downward support protrusions can be found at the IML between 2 high valleys, at an IML in a low peak, at an IML on a high valley, at an IML on a low valley. Along the line of a high peak or low peak, or along the line of a high valley or low valley, or on a flat-topped peak or valley are other possible positions for an upward supporting point or a downward supporting point. Supporting points can also be extended into supporting lines.

It should be noted that the embodiment of FIG. 36F comprises high peaks, as well as low peaks, high valleys as well as low valleys, low valleys adjacent to low peaks, low valleys adjacent to high peaks, and high valleys adjacent to high peaks.

Figure 37:
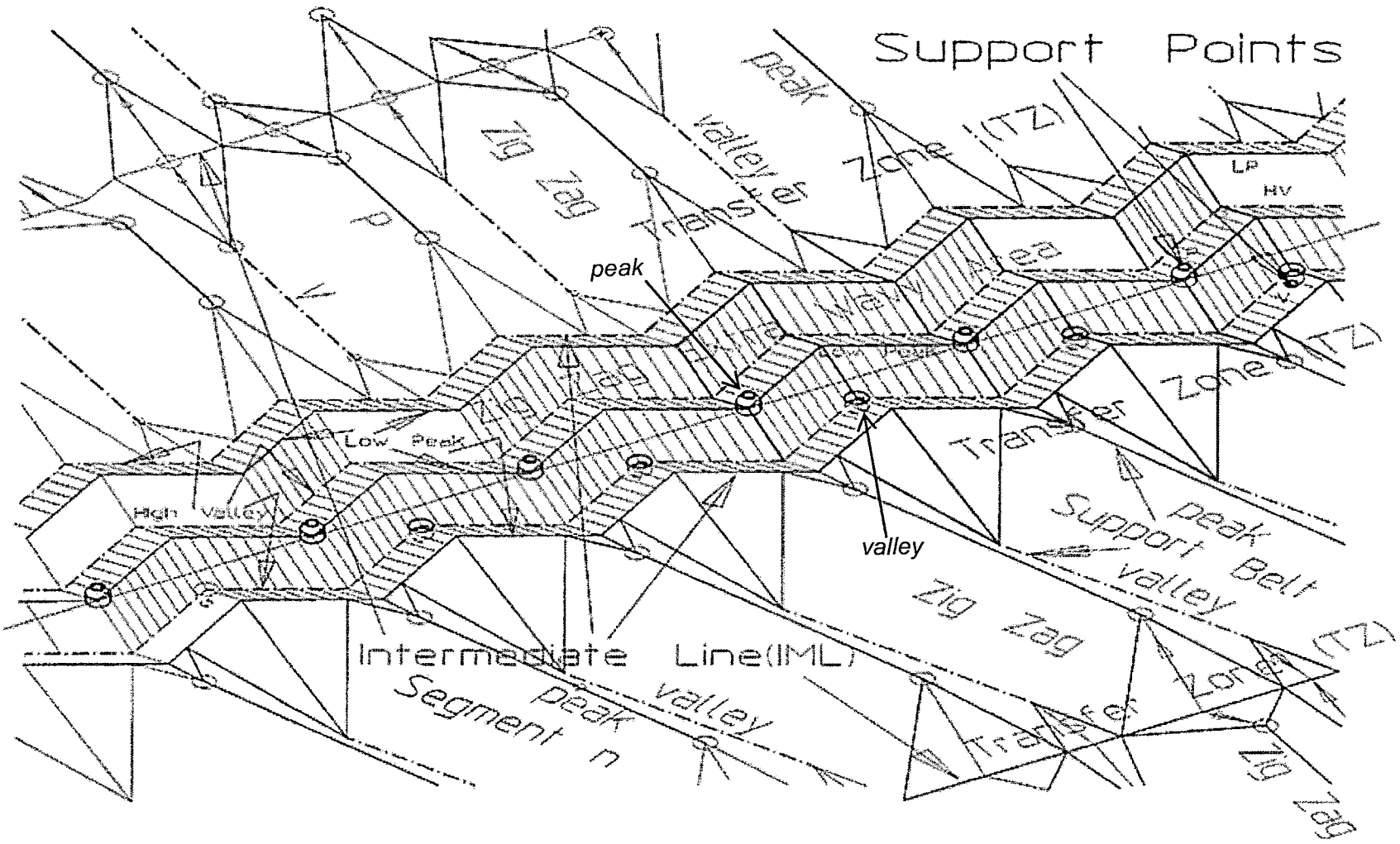
FIG. 37 schematically illustrates supporting points in an extra low wavy area, according to several embodiments of the invention.

FIG. 37 schematically illustrates supporting points in an extra low wavy area.

Figure 38:
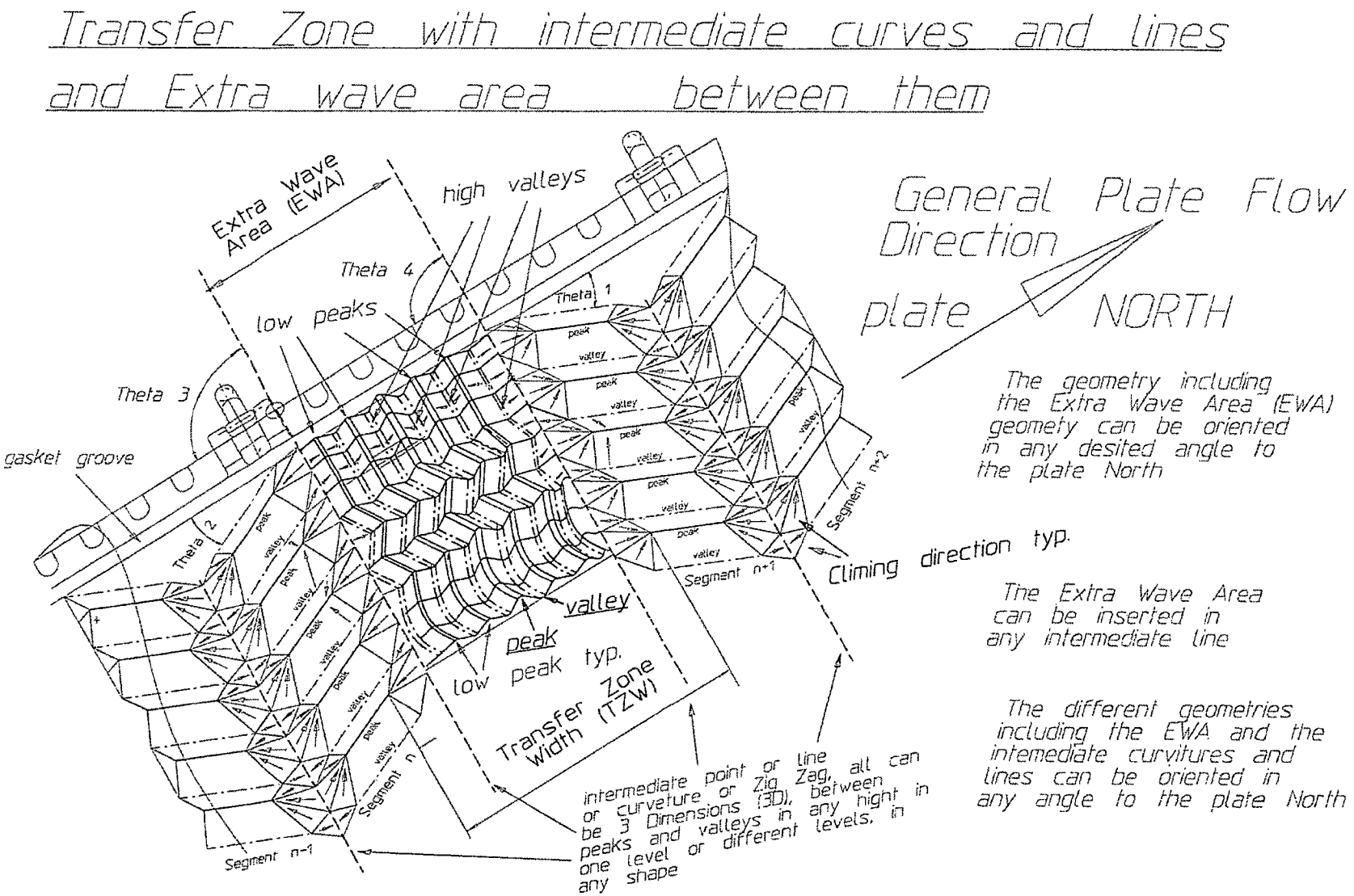
FIG. 38 illustrates a plate with 4 segments, according to several embodiments of the invention.

FIG. 38 illustrates a plate with 4 segments, where the lines of the peaks comprise a curve, an extra wavy area (EWA), so that terminal ends of the peaks (and, similarly, the terminal ends of the valleys) are higher at one end of a segment than the other, so that the peak-valley distance remains the same across a segment but the cross-sectional area beneath the plate (and above it) changes across each segment. Segment n−1 is a falling segment; its rightmost terminal end is lower than its leftmost terminal end. Segment n is a rising segment. Between segment n and segment n+1 is a transfer zone comprising waves perpendicular to the line of the waves in segments n−1, n, n+1 and n+2. Segment n+1 is a falling segment, followed by another rising segment. Each TZ between segments displays obstructions, as well. In this embodiment, the lines of the peaks and valleys in the segments are parallel to the longitudinal edge of the plate; the curve also rises and falls along the x axis.

The IMLs are shown perpendicular to the general line of the waves in segments n−1, n, n+1 and n+2. The TZ can be generally flat, have a generally convex curve, have a generally concave curve, have waves aligned with waves outside the TZ, have waves perpendicular to waves outside the TZ comprise a phase shift, be at another angle to waves outside the TZ, and any combination thereof. The orientation can be in any direction with respect to the plate axes. An IML can be at any angle theta with a plate axis, not just perpendicular. 2 exemplary angles, theta 3 and theta 4, are shown. The Tz can comprise high valleys, low valleys, high peaks, low peaks and any combination thereof.

Figure 39:
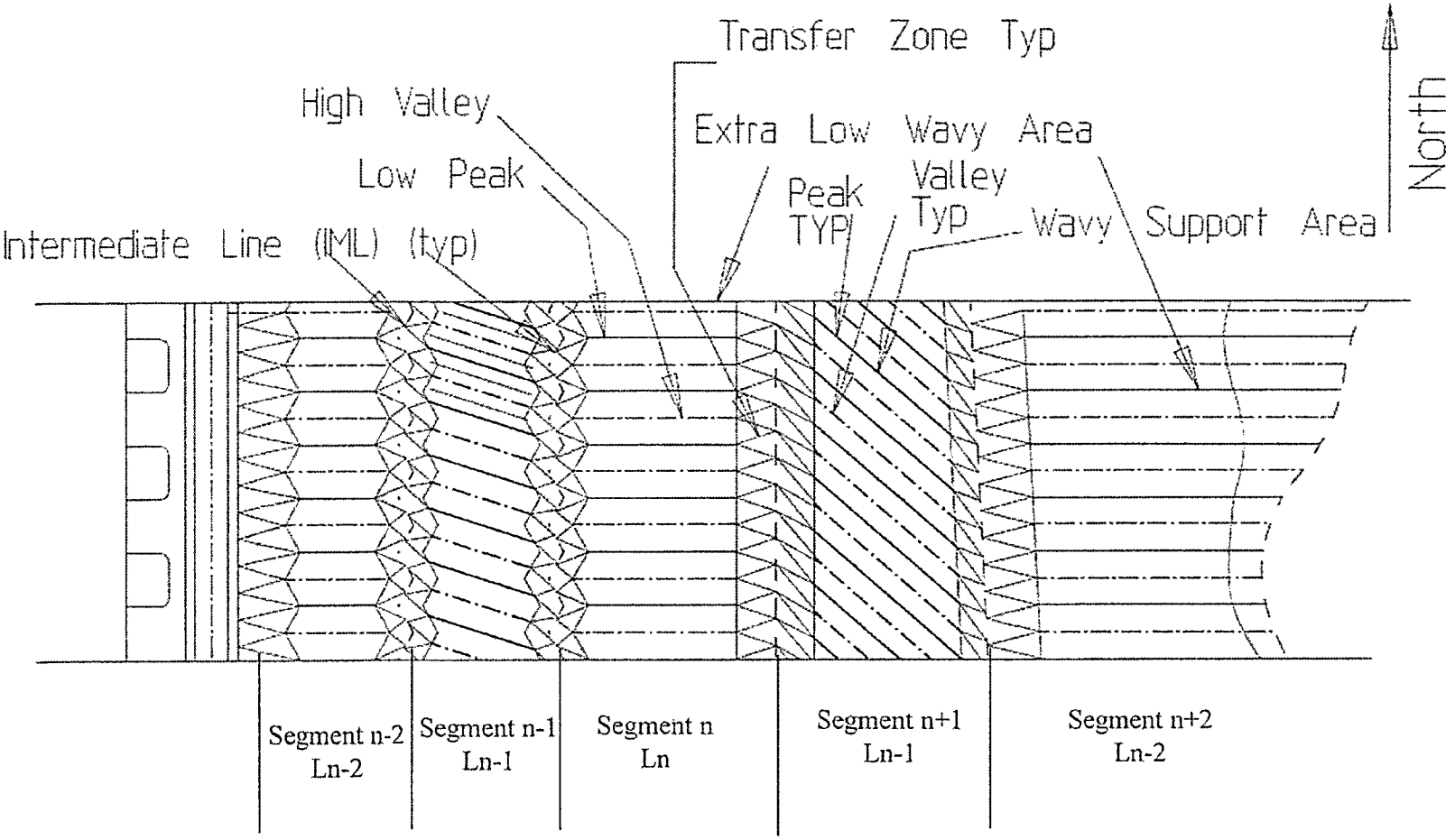
FIGS. 39 and 40 schematically illustrate a section of five segments, where adjacent rows of peaks and valleys in the wavy area are angled with respect to each other, according to several embodiments of the invention.
Figure 40:
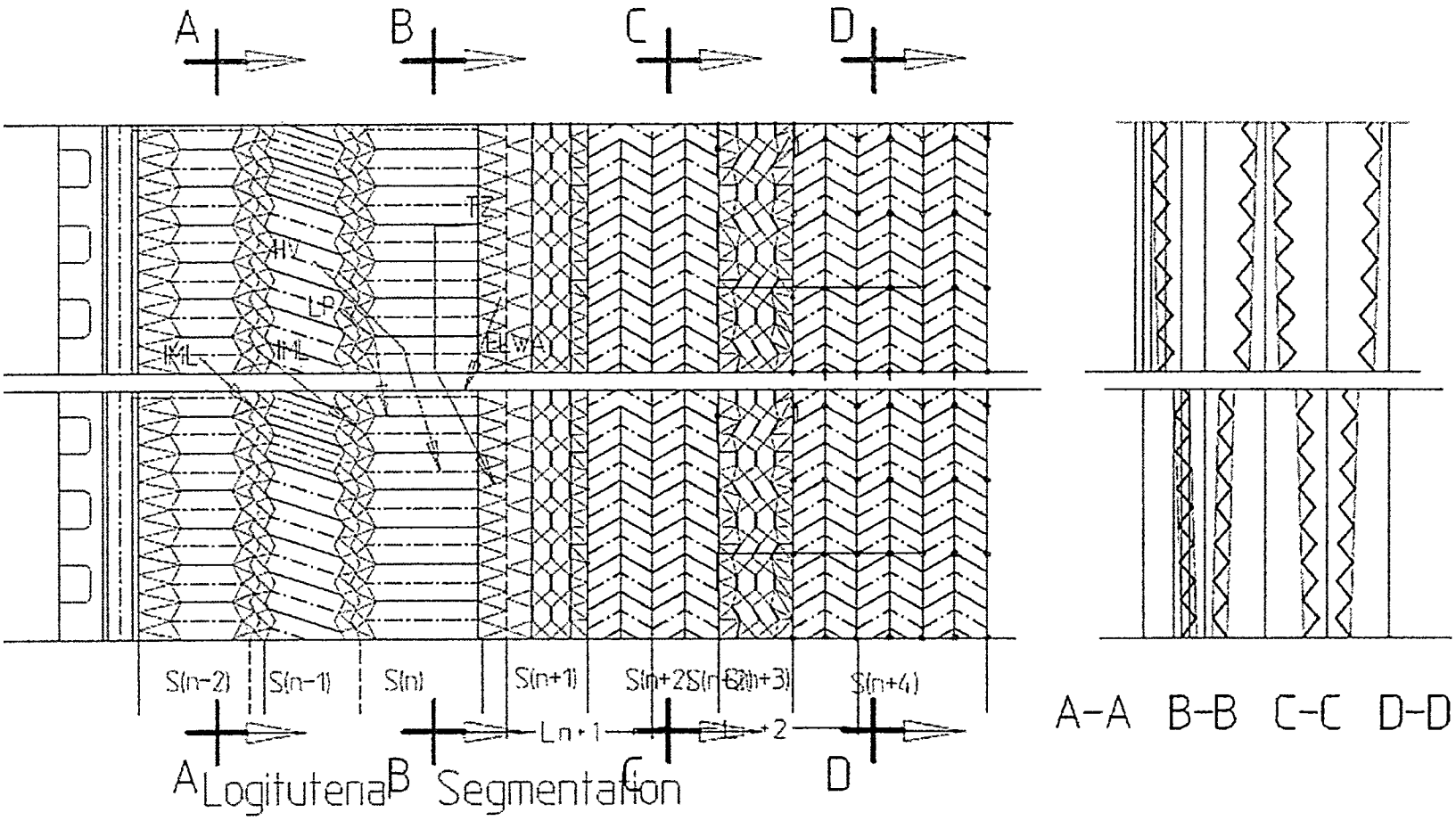

In addition to the types of segment shown in FIG. 39, FIG. 40 schematically illustrates segments (S(n+4), S(n+2) where adjacent rows of peaks and valleys in the wavy area are angled with respect to each other, a wavy area with waves providing flow channels almost perpendicular (S(n+3)) and perpendicular (S(n+1) to the flow channel, where alternate waves along a flow channel have different shape, Side views along lines A-A, B-B, C-C, and D-D show that a flow path can have a zigzag (or other non-straight) edge in the vertical direction as well as in the horizontal direction.

Figure 41:
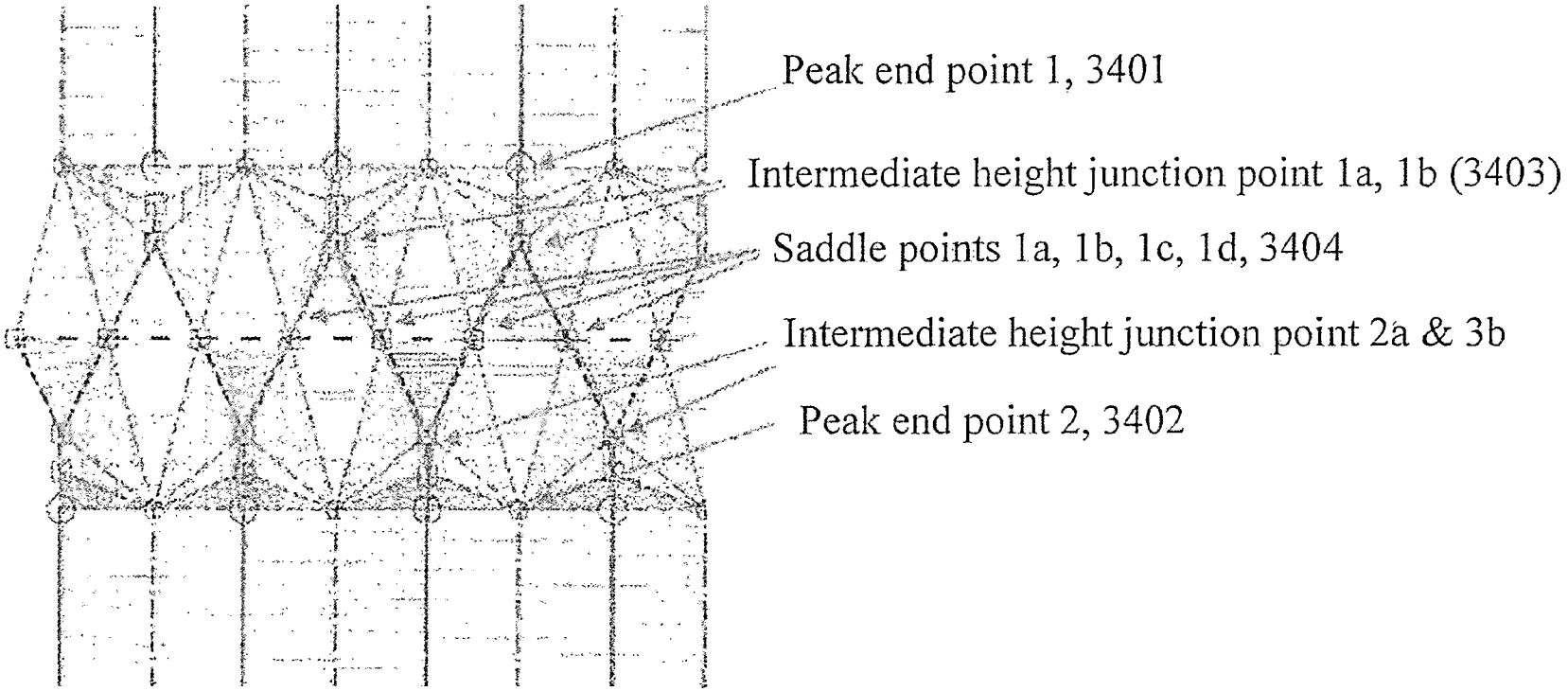
FIGS. 41 and 42 schematically illustrate an indirect & divergent connection with a plurality of junctions, according to several embodiments of the invention; and in FIGS. 43-56 illustrates other various embodiments of the invention.
Figure 42:
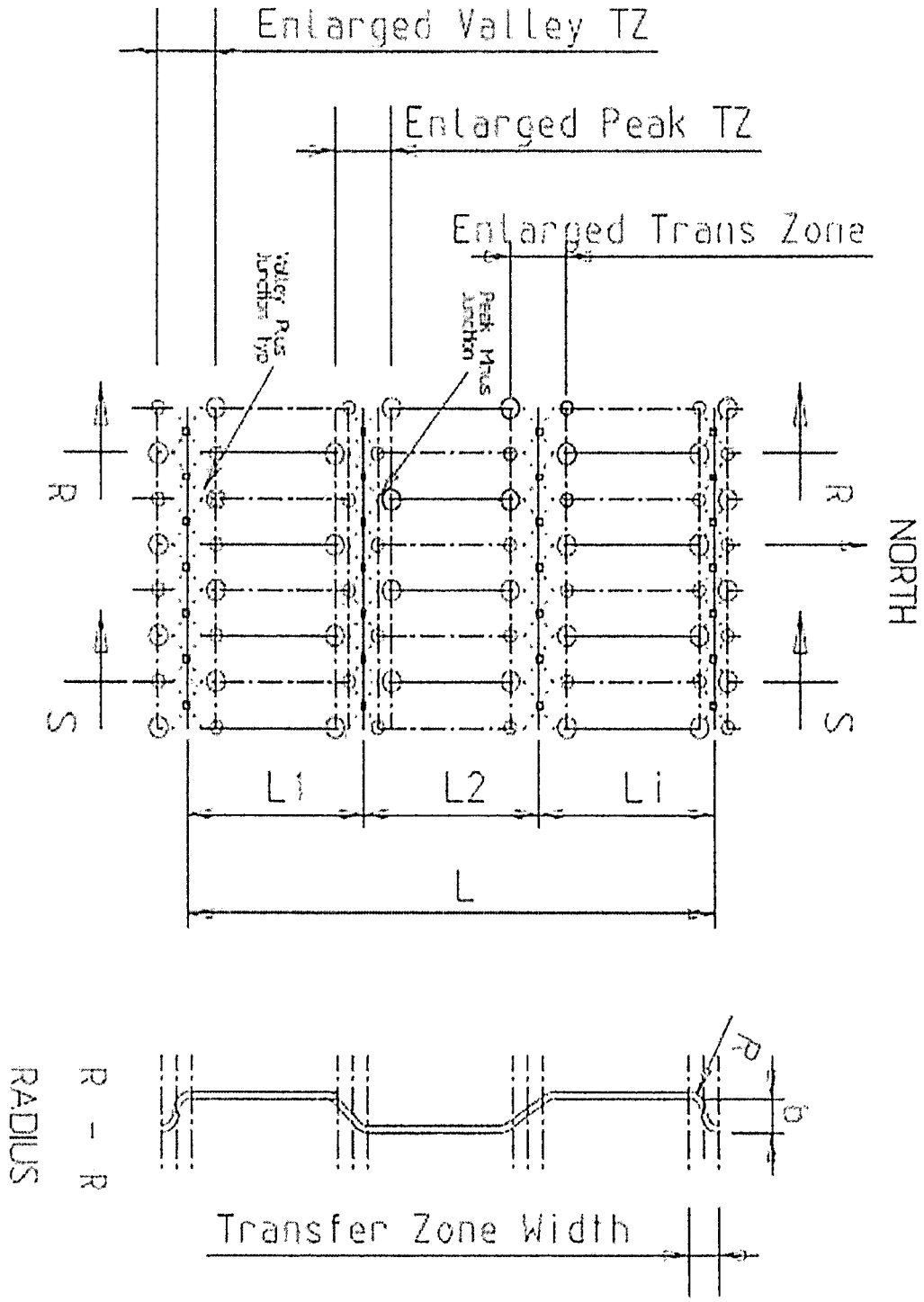
Figure 43A:
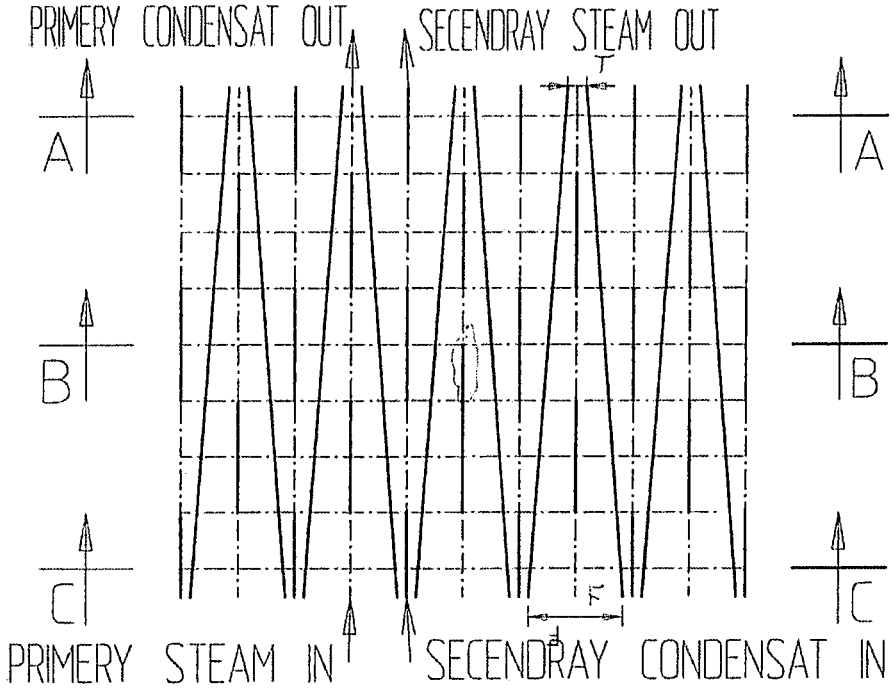
Figure 43B:
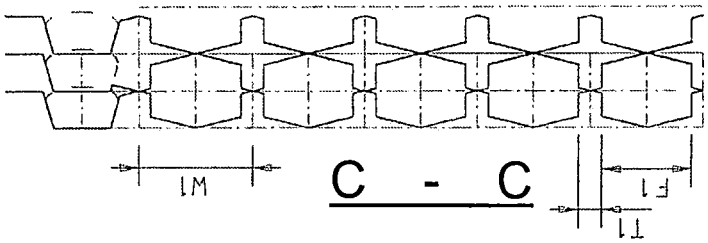
Figure 43C:
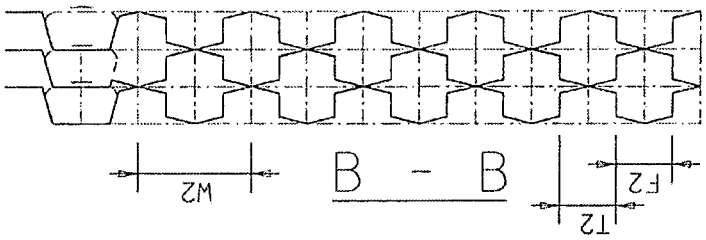
Figure 43D:
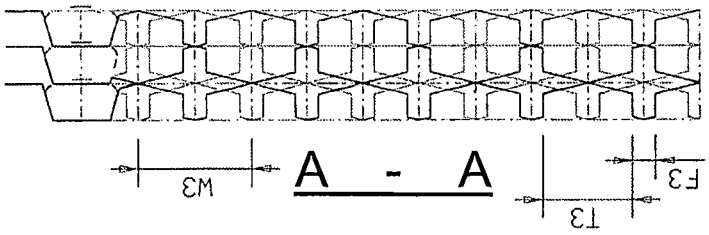

FIGS. 41 and 42 show an indirect & divergent connection with a plurality of junctions that connects between a first peak end-point 1 (3401), to a second peak end-point 2 (3402). From peak end point 1, downwards, to intermediate height junction point 1*a* (3403), then to Saddle points 1*a* and 1*b* (3404); then going up and similar manner.

Symmetric/Asymmetric Plate Corrugation Pattern

In some embodiments, the PHE corrugated plate pattern is 'asymmetric' with regard to its xy mid-height plane, so that the protrusion pattern seen from plate side U differs from the depression pattern seen from on plate side D; the corrugation pattern above the mid-height plane differs from the corrugation pattern below the mid-height plane. This is contrary to a symmetric wave corrugation, in which no differences in the geometrical pattern exist between opposite sides of the PHE plate except possibly at the edges of the heat exchange area of the plate.

An asymmetric corrugation pattern entails a difference in HWZ wave form nature between opposite sides, which can comprise a difference in the fundamental wave shape (sinusoidal, V-shape, square or other), curvature, inclination angle, shape irregularity, added features and any combination thereof. In addition, an asymmetric corrugation pattern can include differences in the transition zones and windows between U and D side of the plate. An asymmetric corrugation pattern may or may not include a phase shift between adjacent segments.

At least one of the embodiments in FIGS. 43-55 illustrate the following: Cross sections through one or more asymmetric plates (70), with one figure schematically illustrating two cross-sections through a single plate, and another showing the same cross-sections through a plurality of plates. Thick solid lines represent a first upstream cross section for at least one of the fluids, while thin solid lines represent a second cross section which is downstream of the previous cross section for that at least one fluid. In this embodiment, adjacent segments are phase shifted with respect to each other. Because of the phase shift, flow will shift laterally (e.g., below the plate, from P2 to P1 and P3 or, above the plate, from V2 to V1 and V3). The lateral flow will be through "windows", areas of reduced cross-section between the falling peaks and the rising valleys.

The upward peak (72) is of a different shape from the downward valley (73). In FIGS. 43A-D, the peaks are labelled P1 to P9, valleys are labelled V1 to V9, and M1 to M8 indicate saddle points in the obstacle zone, which are not in either of the cross-sections but falls between them. The topmost (or only) plate is labelled. For flow from the first cross-section to the second cross-section above the plate, the terminations of the peaks of the second cross-section (74) will form an obstacle to this downstream flow. By changing the shape of the curved sections above and below the mid-height plane and by changing the stacking orientation, the heights of the obstacles Mn are controllable.

At the bottom part of a window, flow above the plate, is shown by area P2-M2-P3. The top part of a window, for flow below the plate, is shown by area V2-M2-V3. An obstacle to flow above the plate is shown by M2-P3-M3-V3. An obstacle to flow below the plate is shown by M3-P4-M4-V4.

Schematically illustrated cross sections of two adjacent segments within an asymmetrical PHE plate corrugation pattern, including a phase shift between the adjacent segments. The HWZ corrugation wave, as shown in the cross section in FIG. 36A has different curvatures above and below the mid-height plane.

A stack of plates (75) with a corrugation pattern shown above, with the asymmetrically corrugated PHE plates stacked with alternate plates rotated in the xy plane (about the Z axis). No variations in HWZ flow paths will result between alternate channels within the plate stack. The cross-sectional shape of the channels (77, 177, hatched) is shown. All channels, except those at the edges of the heat exchange area, have the same cross-sectional shape. Windows (85, 185, cross-hatched) for flow above and below the plate are shown.

Another option for plate stacking of asymmetrically corrugated PHE plates (70) rotates the plates out of plane through the x-z plane or x-y plane, about an in-plane axis (x or y), so that the U side of the rotated plates faces downward. A figure showing the original orientation and a figure where plate 1 has been rotated. This produces a plate stack with flow paths which vary in shape and hydraulic diameter, alternating between a larger (82) and a smaller (81) hydraulic diameter.

A figure schematically illustrating two plates with the original corrugation pattern above, with the lower plate (plate 2) in the original orientation and the upper plate (plate 1) rotated about an in-plane axis.

A schematically illustrated resulting plate stack (80) for the plates (70) in the original orientation. One fluid will flow through a relatively large oval-shaped HWZ cross sectional shape (82, right hatched) with relatively large obstruction zone windows (107, vertical cross-hatching), while the other fluid flows through smaller star-shaped HWZ cross sectional shape (81, left hatched) with relatively small obstruction zone windows (103, diagonal cross-hatching) in adjacent channels. Abutments between the plates (96, 97, 102, 106, 108), separate the fluids. For plate 1, the curvature above the mid-height plane (78) schematically illustrates a lesser inclination than the curvature below the mid-height plane (91). The terminations of the peaks of the second cross-section (74) will form an obstacle to this downstream flow.

For the oval HWZ shape (82), the obstruction to flow will comprise the lower half of an upper downstream star shape and the upper half of a lower downstream star shape. Flow from the upper left quadrant will be rotated anticlockwise in passing through the window into the upper right quadrant of the downstream oval HWZ shape to the left. Flow from the lower left quadrant will be rotated clockwise in passing through the window into the lower right quadrant of the downstream oval HWZ shape to the left. Flow from the lower right quadrant will be rotated anticlockwise in passing through the window into the lower left quadrant downstream oval HWZ shape to the right. Flow from the upper right quadrant will be rotated clockwise in passing through the window into the upper left quadrant of downstream oval HWZ shape to the right. As discussed below, this secondary rotational motion will help increase the heat transfer coefficient for the system.

For the star HWZ shape (81), the windows (103) are much smaller relative to the star shape than the windows (107) of the oval shape are relative to the oval HWZ shape (82). In addition, the amount of deflection is much greater for fluid passing throw the windows (103) for the star shape than for the fluid passing through the windows (107) for the oval shape. Therefore, it is to be expected that the amount of secondary rotational motion induced in passing through windows is much greater for flow through the star-shaped HWZs (81) than for flow through the oval shaped HWZs (82).

As described above, when flowing around an obstacle to pass from one segment to the next, the flow from a channel will divide and pass through adjacent windows. The large windows (107) provide a small resistance to flow and a somewhat improved heat transfer coefficient, while the small windows provide a large resistance to flow and also a larger improvement in heat transfer coefficient. It is believed that the improvements in heat transfer coefficient result from the increased fluid velocity due to the reduced cross-sectional area of the windows, the change in direction of the fluid flow, leading to increased vorticity of the flow, all of which increase flow turbulence and reduction of the thickness of the wall boundary layer.

Therefore, the combination of an asymmetrical wave corrugation pattern and the rotation about an in-plane axis results in a heat exchanger in which each fluid passes through channels of significantly different shape. Each channel is characterized by HWZs and windows of a specific cross-sectional shape and hydraulic diameter, the cross-sectional shapes and hydraulic diameters differing between the channels. This results in a heat exchanger where a substantial difference exists between the two fluids in terms of pressure drop, heat transfer convection coefficient and any combination thereof. This is especially important for applications where large differences in flow rate and/or fluid physical properties exist between the heat transferring fluids in the heat exchanger.

It is within the scope of this invention for a heat exchanger plate wherein the asymmetric corrugation wave pattern undergoes alterations along the length of the plate. These alterations can be transverse to the plate length, such as but not limited to the width and shape of an HWZ or lengthwise, such as but not limited to the lengths of the segments, the distances between segments, shape of the IML and the shape of the obstacle zone. This may assist in situations where a lengthwise phase change is expected or where the flow widthwise distribution is lacking and must be assisted by creating cross sectional differences between alternating flow interspaces.

A schematically illustrated embodiment where the cross-sectional geometry of the HWZ changes during passage down a plate. In this embodiment, the widths of the interspaces remains constant, but the curvature and shape of the perimeter of the HWZ changes. For perimeter 1, at one end of the plate, the perimeter on the right side is approximately diamond-shaped; the shapes and sizes of the interspaces are the same for both fluid 1 and fluid 2. On the left side, the perimeter is curved, so that there are star-shaped interspaces in one row and oval-shaped interspaces in the rows above and below (where there are such neighboring plates), with the cross-sectional area much larger for the oval-shaped interspaces than for the star-shaped interspaces.

Perimeters 2 through 5 progress down the plate, with perimeter 5 at the other end of the plate. On the right side of perimeter 2, the indicated diamond is slightly narrowed, while the diamonds in the rows above (and below, whichever exist) being slightly widened. On the left side of perimeter 2, the indicated star is slightly widened, while the ovals in the rows above (and below, whichever exist) are slightly narrowed.

On the right side of perimeter 3, the indicated diamond is further narrowed, clearly showing a broad star shape, while the diamonds in the rows above (and below, whichever exist) are further widened, clearly showing a narrow oval. On the left side of perimeter 3, the indicated star is further widened, while the ovals in the rows above (and below, whichever exist) are further narrowed.

On the right side of perimeter 4, the indicated diamond is further narrowed from perimeter 3, showing a narrower star shape, while the diamonds in the rows above (and below, whichever exist) are further widened from perimeter 3, clearly showing a wider oval. On the left side of perimeter 4, the indicated star is further widened from perimeter 3, becoming a narrowed diamond, while the ovals in the rows above (and below, whichever exist) are further narrowed from perimeter 3, clearly showing a widened diamond.

At the other end of the plate, as shown by perimeter 5, on the right side, indicated diamond has become a narrow start shape while the indicated diamond has become a wide oval. On the left side, all of the interspaces are diamonds.

In a variant of this type of embodiment, one fluid flows through narrow star shaped interspaces at one end of the plate; these transition to diamonds near the center of the plate and the fluid flows through wide oval interspaces at the opposite end of the plate. In this variant of the type of embodiment, the other fluid will flow through wide oval interspaces at one end of the plate; these transition to diamonds near the center of the plate and the other fluid flows through narrow star shaped interspaces at the opposite end of the plate.

In some variants, the shape of the interspace cross-sections varies laterally across the plate (not shown) with, for non-limiting example, the right-most interspaces in one row for one fluid having a narrow star shape, the central interspaces in that row for that fluid being diamond shaped and the leftmost interspaces in that row, for that fluid, having a wide oval shape, with the shape of the interspaces changing gradually across the row. The interspaces in the row above, for the other fluid, will vary in the opposite direction, having a wide oval shape at the right and a narrow star shape at the left. It is also possible to combine both variants, with a narrow star shape at the left at one end being star-shaped and at the other end on the left being oval, while, on the right, an oval transition to a star.

An embodiment where the width of the interspace's changes during passage down a plate. The steam (or other condensable fluid) enters at the bottom via the wide interspaces, while the liquid condensate enters via the narrow interspaces. The steam interspaces narrow during passage downstream, while the liquid condensate interspaces widen. At the downstream end of the PHE, at the top of the figure, the (evaporated) condensate exits via wide interspaces, while the (condensed) condensable fluid exist via narrow interspaces.

A schematically illustrated a cross-section along the line C-C, near the entrance to the PHE. The steam interspaces, in the lower row, are wide, while the liquid condensate interspaces are narrow.

Near the center of the plate, a cross-section along the line B-B, the steam interspaces (lower row) and the liquid condensate interspaces (upper row) are about the same width.

Near the exit end of the plate, a cross-section along the line A-A, the steam interspaces (lower row) are narrow, while the liquid condensate interspaces, upper row, are wide.

These types of embodiment are useful where it is desired that the steam condense and the liquid condensate evaporate during passage through the PHE.

One method of estimating of the effect of the ratio of the HWZ cross sectional areas on the heat transfer rate and pressure drop can be found using the following derivation.

The dimensionless heat transfer Nusselt (Nu) number, is defined as:

$$\mathrm{Nu} \equiv (h \cdot D_H)/k \tag{1}$$

Where: $D_H$ is the hydraulic diameter, defined as 4 A/p, h is the fluid convection coefficient, k is the fluid heat conduction coefficient, A is cross sectional surface area, and p is the cross-sectional wetted perimeter.

The Nusselt number for plate heat exchanger flow can be written as the Sieder-Tate equation:

$$\mathrm{Nu} = C_1 \mathrm{Re}^a \mathrm{Pr}^b (\mu_w/\mu)^c \tag{2}$$

The Nusselt number in this equation is dependent on the following dimensionless numbers:

Reynolds number: $\mathrm{Re} \equiv (\rho u D_H)/\mu$ and Prandtl number: $\mathrm{Pr} \equiv \rho C_p/k$ Where: ρ is density, u is flow velocity, μ is the fluid bulk viscosity, $\mu_w$ is viscosity at wall boundary and $C_p$ is heat capacity. $C_1$, a, b, c are constants that were experimentally determined by Sieder and Tate and which are independent of hydraulic diameter and cross-sectional shape for a large range of cross-sectional shapes and hydraulic diameters.

Combining equations (1) and (2), the Nusselt number Nu can be eliminated, giving $$\frac{h \cdot D_H}{k} = C_1 Re^a Pr^b (\mu_w/\mu)^c$$

So that $$h = \frac{k}{D_H} C_1 Re^a Pr^b (\mu_w/\mu)^c \quad (3)$$

The Reynolds number Re for each fluid, i, can be written as:

$$Re \equiv \frac{\rho_i u_i D_{H_i}}{\mu_i} = \rho_i \frac{\dot{V}_i}{A_i} \frac{D_{H_i}}{\mu_i} = \rho_i \frac{\dot{V}_i}{A_i} \frac{4A_i}{p_i} \frac{1}{\mu_i} = \frac{4\dot{V}_i \rho_i}{p_i} \frac{1}{\mu_i} = \frac{4\dot{m}_i}{p_i \mu_i}$$

Where $\dot{V}_i$ is the volumetric flow rate, $\dot{m}_i$ is the mass flow rate for each fluid, and the flow velocity $u_i$ is inversely dependent on the interspace cross sectional area, $u_i = \dot{V}_i / A_i$.

Therefore, Reynolds number Re may be determined from the mass flow rate and the perimeter; it is not dependent on the cross sectional area. In this novel PHE plate design, where the two different interspaces for the two fluids share the same walls, the perimeters of the two interspace cross sections are the same, so that if the two fluids have the same mass flow rate and viscosity, the resulting Reynolds number Re will be the same, even though the cross-sectional areas and shapes of the interspaces may be very different.

For a typical PHE, the perimeters of the interspaces for the two fluids are identical since each section of a perimeter is a boundary between an interspace of one fluid and an interspace of the other fluid.

Therefore, for a typical PHE, if the viscosities and mass flow are the same for the two fluids, the Reynolds number will be the same for the two fluids.

From equation (3), the convection coefficient h is related to the Reynolds number and inversely related to the hydraulic diameter. It is also dependent on the fluid properties of the fluids.

In the case where the fluid properties of the two fluids are the same and the mass flows of the two fluids are the same, from eq. (3), the convection coefficient is dependent only on the hydraulic diameter; for a typical PHE, the fluid passing through the interspaces with the larger hydraulic diameter will have the smaller convection coefficient, independent of the shape of the interspaces.

For a given plate heat exchanger, the general heat transfer coefficient is a sum of the inverses of the convection coefficients of both fluids, the conduction coefficient at the wall separating between the two fluids, and the fouling factor:

$$\frac{1}{U} = \frac{1}{h_1} + \frac{1}{h_2} + \frac{t_w}{k_w} + \frac{1}{FF}$$

Where: U is the heat exchanger general heat transfer coefficient, $h_1$ is the heat transfer coefficient of the first fluid, $h_2$ is the heat transfer coefficient of the second fluid, $k_w$ is the wall conduction coefficient, $t_w$ is the wall thickness and FF is the fouling factor.

Therefore, a heat exchanger plate geometry may be selected with different interspace cross sectional area values for the two flowing fluids, for which the resulting heat exchanger general heat transfer coefficient will be as required.

One method of estimating the pressure drop within the plate heat exchanger for each flowing fluid uses the Darcy-Weisbach equation:

$$\Delta P = f_D \frac{L}{D_H} \cdot \rho_i \frac{u_i^2}{2g}$$

Where: ΔP is the fluid pressure drop, $f_D$ is the Darcy friction factor, L is plate flow length, and g is the gravitational constant.

The flow velocity $u_i$ is inversely dependent on the interspace cross sectional area, as quantified by the following relation: $u_i = \dot{V}_i / A_i$.

The Darcy-Weisbach equation may be converted to the following:

$$\Delta P = f_D L \frac{p}{4A_i} \cdot \frac{\rho_i}{2g} \frac{\dot{V}_i^2}{A_i^2} = f_D L \frac{p \rho_i}{8g} \frac{\dot{V}_i^2}{A_i^3}$$

Using this estimate, for example, due to the cubic relationship between area and pressure drop, doubling the interspace cross sectional area would result in an eightfold decrease in flow pressure drop.

FIG. 35 schematically illustrates longitudinal segmentation. A section of the plate gasket area (GA) is shown at the left in the figure. The plate longitudinal (x) axis is perpendicular to the longitudinal axis (parallel to the y axis) of the peaks (solid lines)/valleys (dot-dash lines) in segments S(n−2), S(n) ad S(n+2), while the peaks/valleys are at a NW/SE angle for segments S(n−1) and S(n+1). The intermediate lines (IML) are wavy at both the left and right edges of segments S(n−1) and S(n−2). The other IMLs (dashed lines) are straight.

Reference is still made to phase changing materials. Constant gas to liquid plate heat exchanger or evaporator (liquid phase changing to gas), or otherwise gas to liquid phase changing (condenser) are hereto disclosed. It comprises horizontal (or vertical) plates, in which each two adjacent plates, stacked together, form at least one flow path. In this flow path a fluid is flown and serves for either cooling or heating of the gas. The plates are sealed by means of gaskets, brazing, welding etc.

Figure 44:
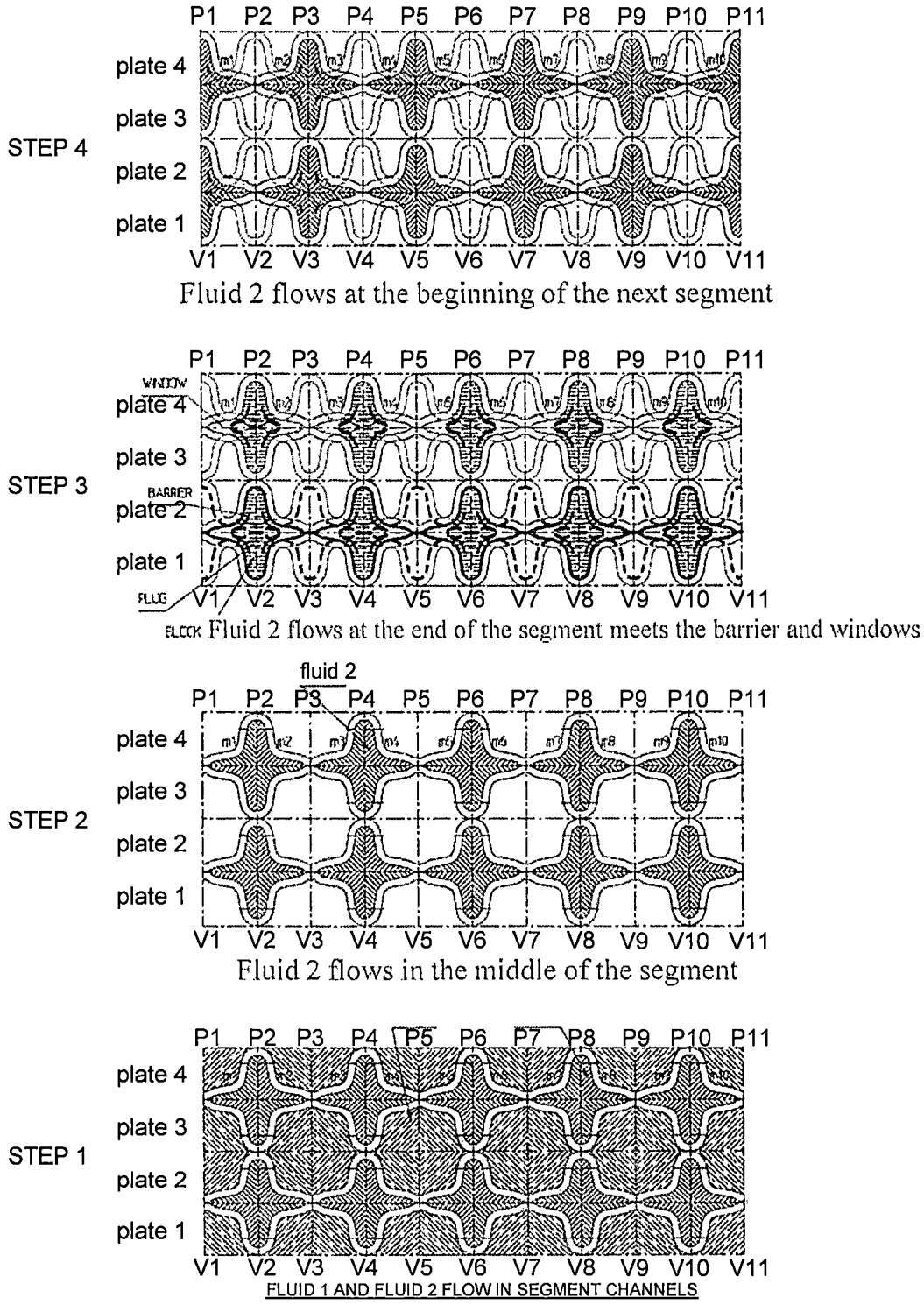
Figure 45D:
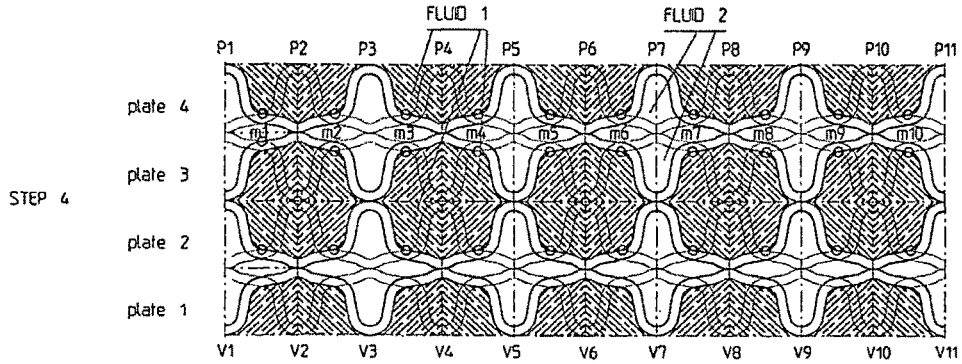
Figure 45C:
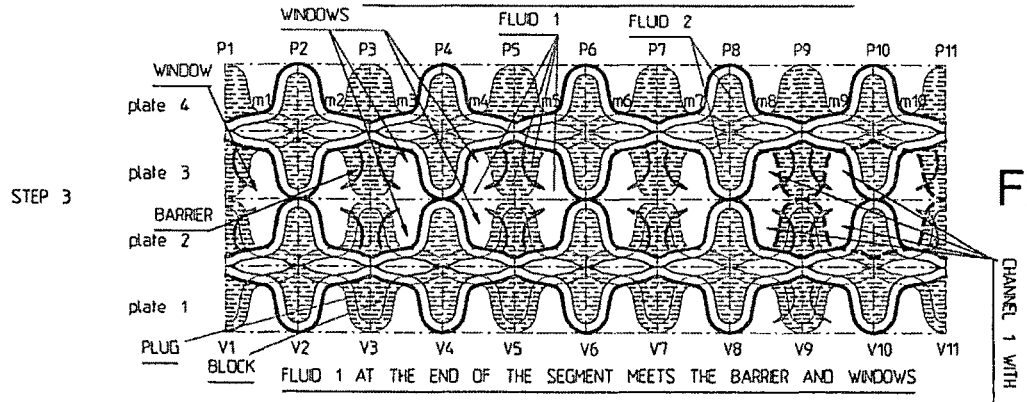
Figure 45B:
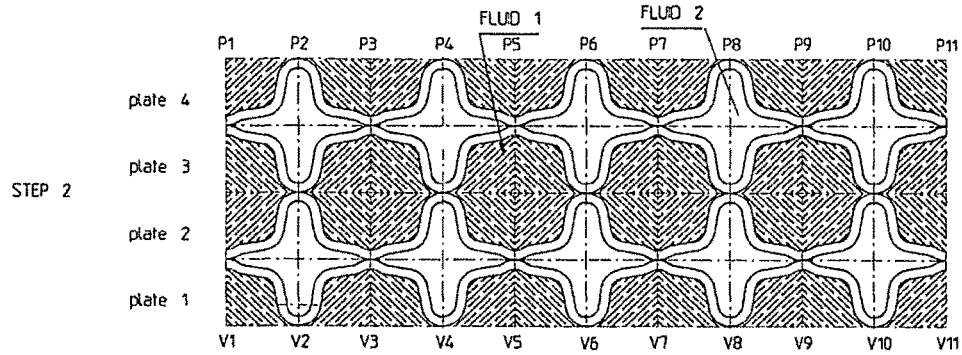
Figure 45A:
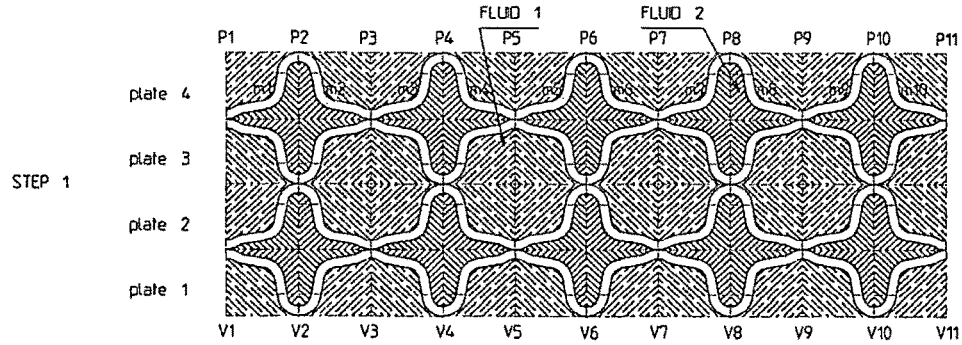
Figure 46:
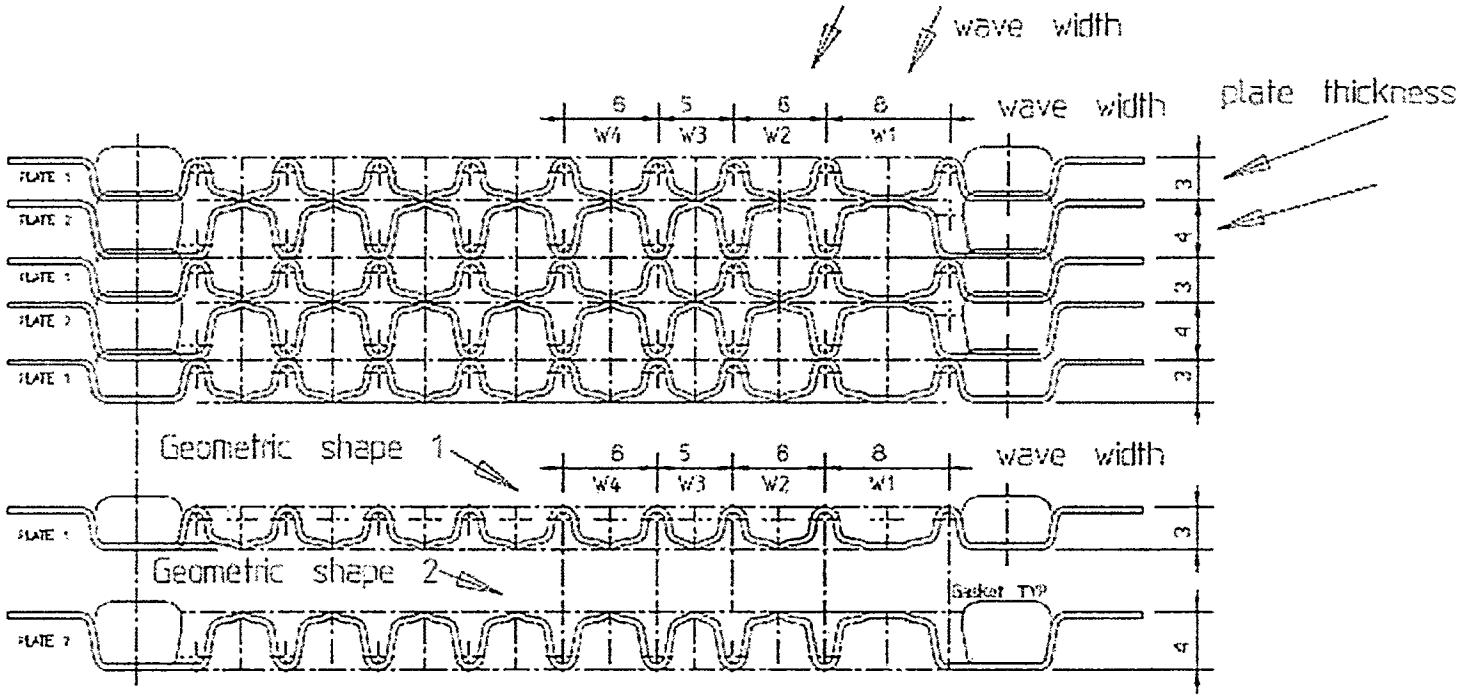
Figure 47:
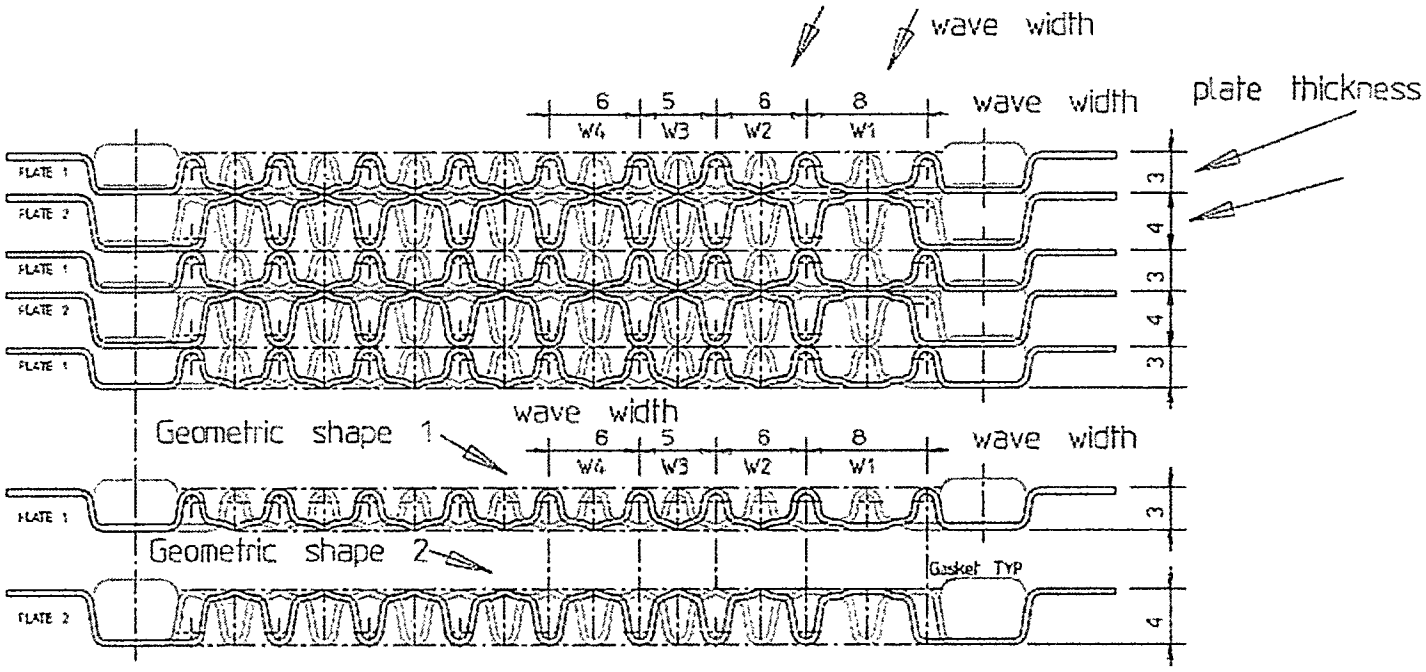
Figure 48:
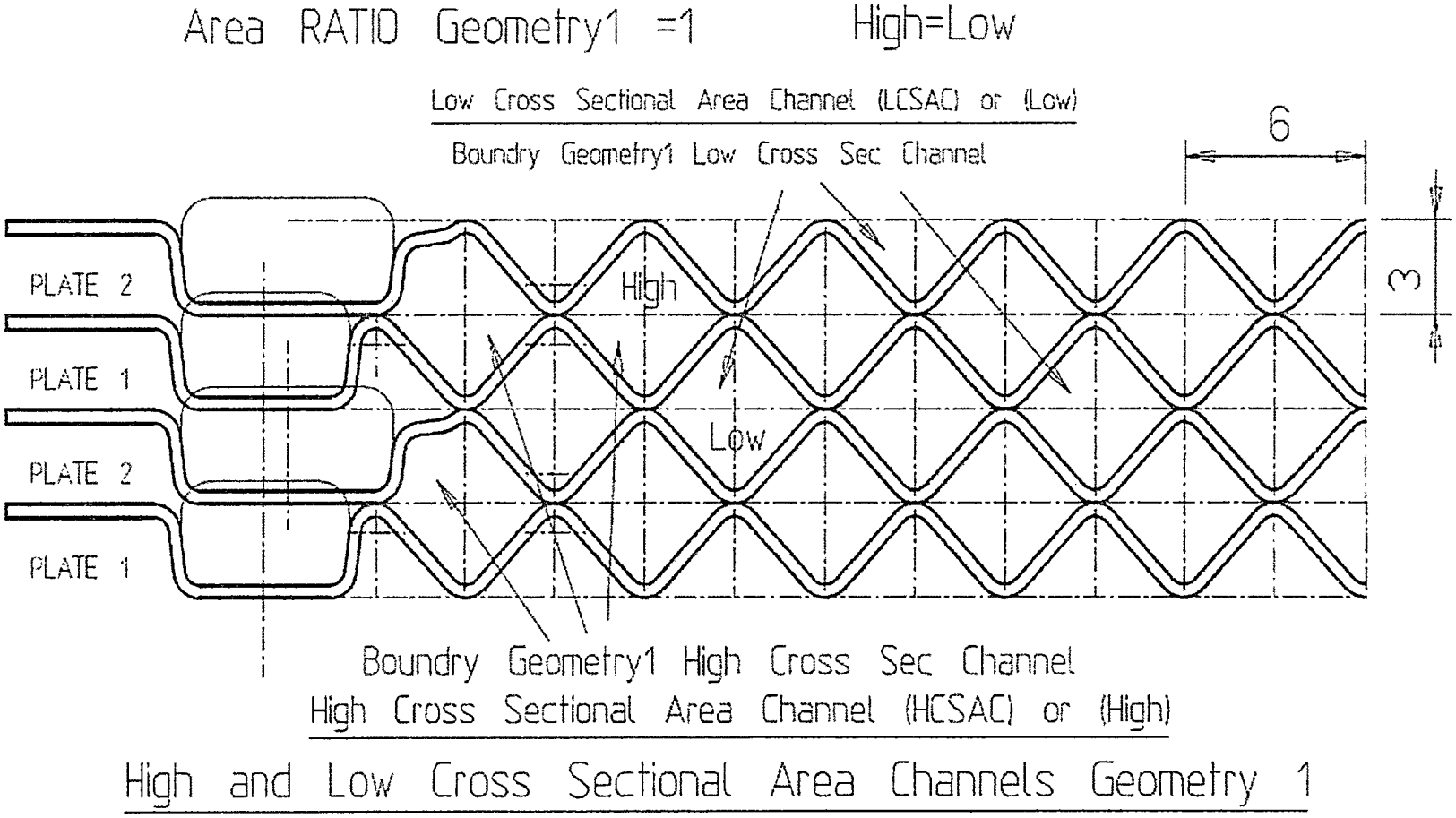
Figure 49:
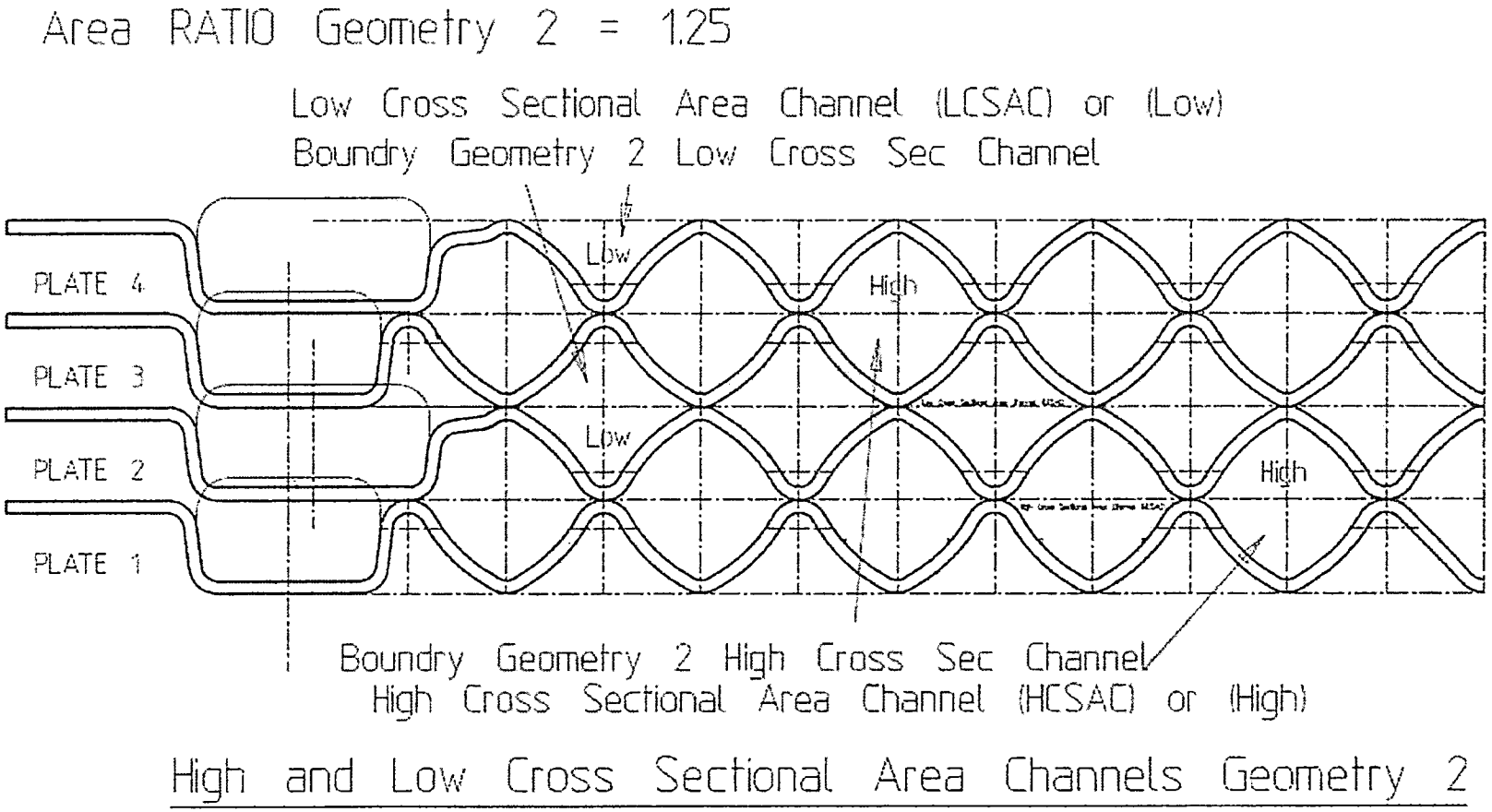
Figure 50:
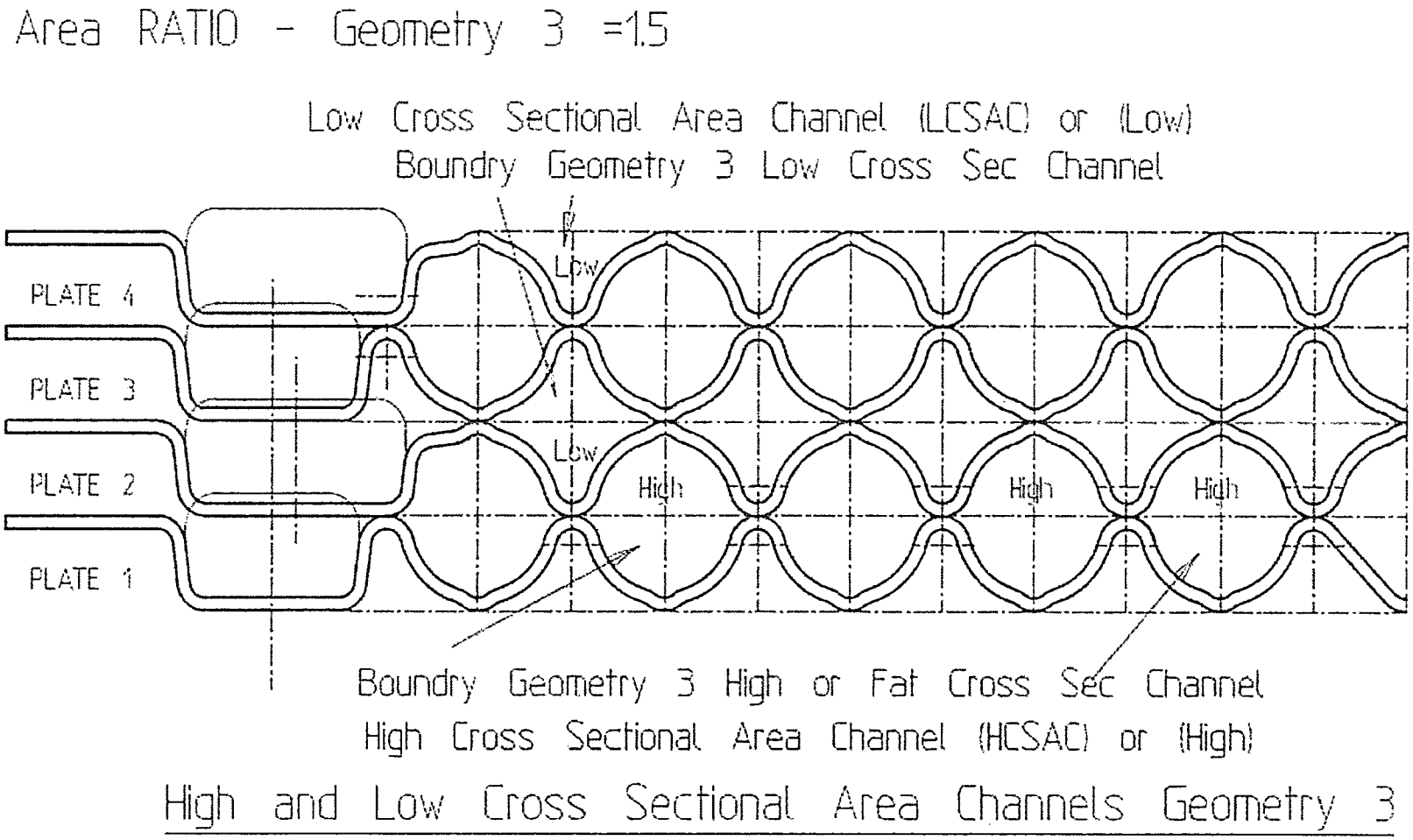
Figure 51:
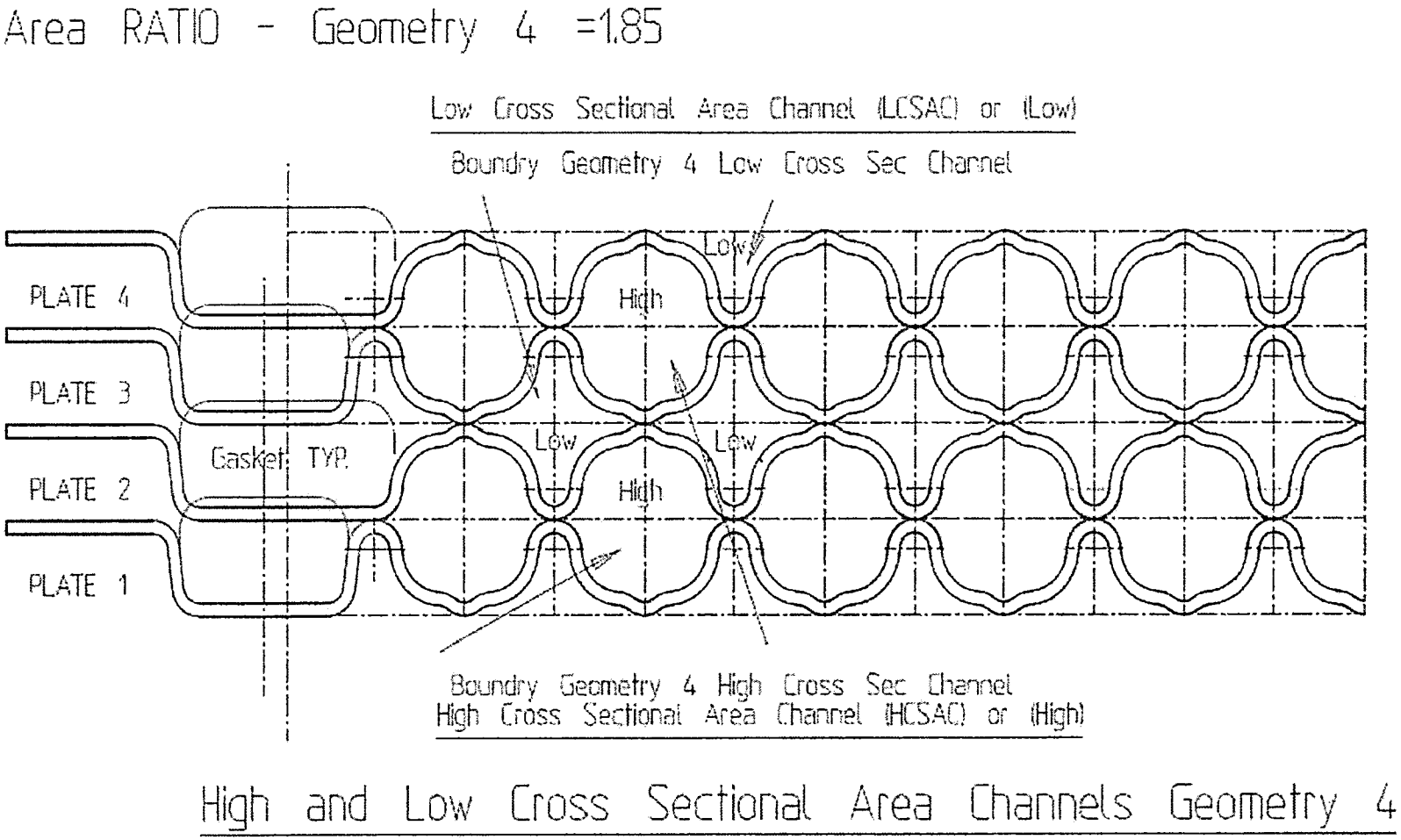
Figure 52:
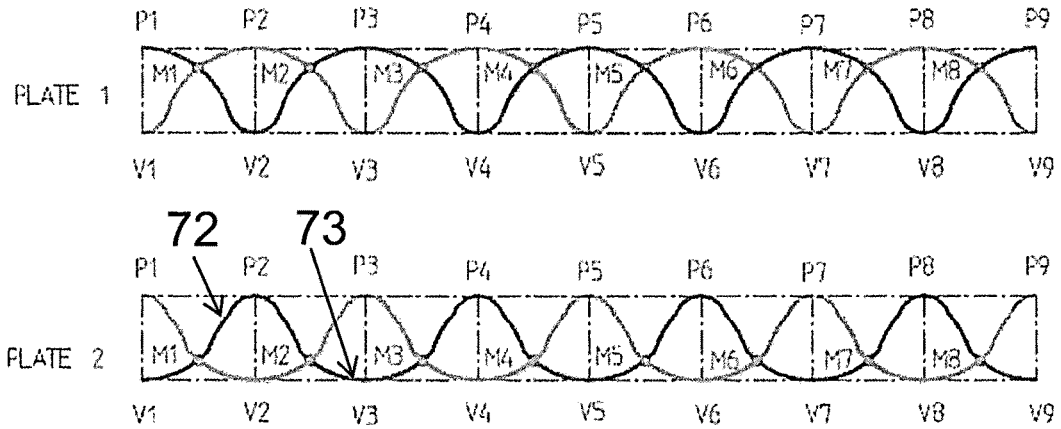
Figure 52:
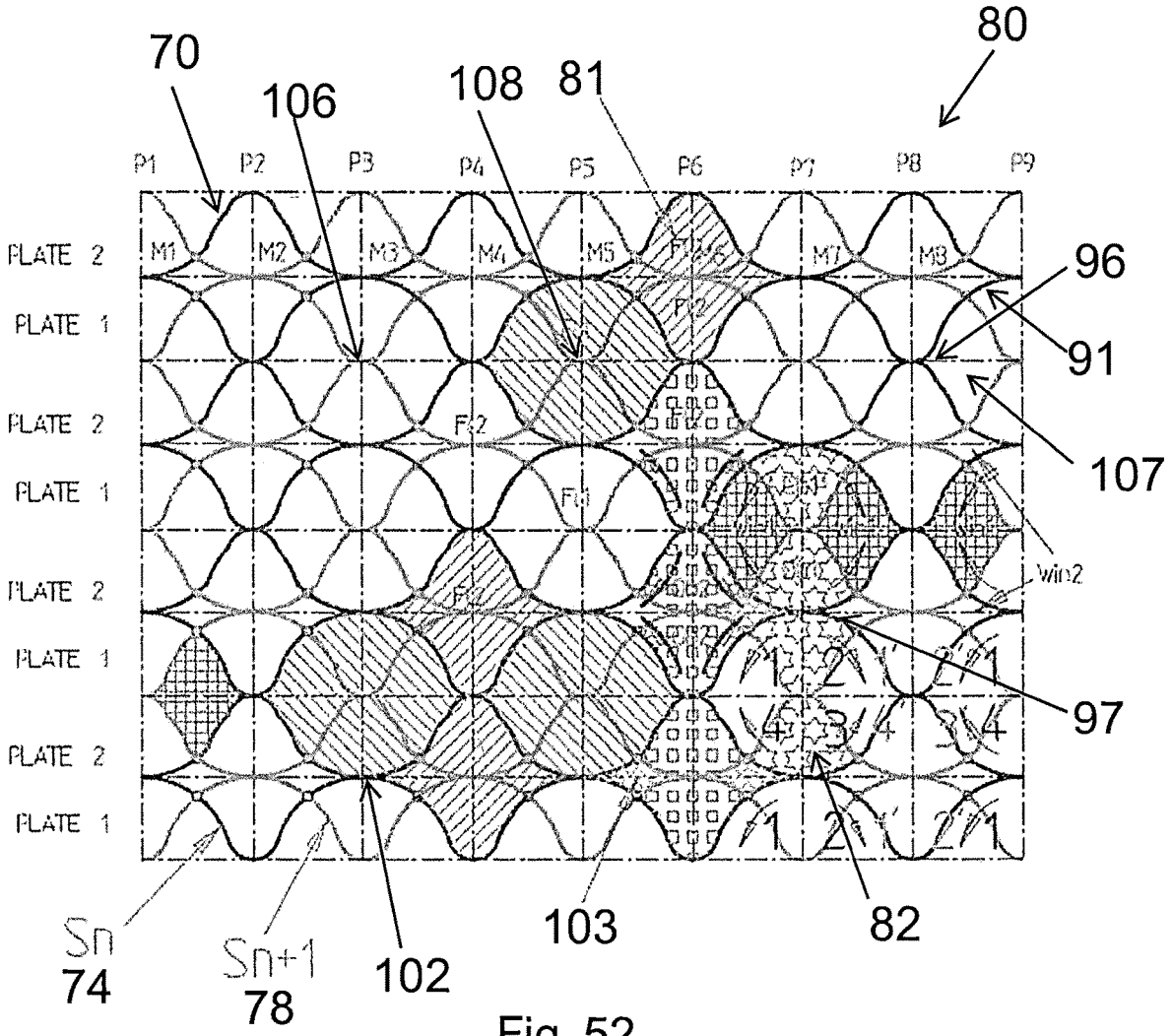
Figure 53:
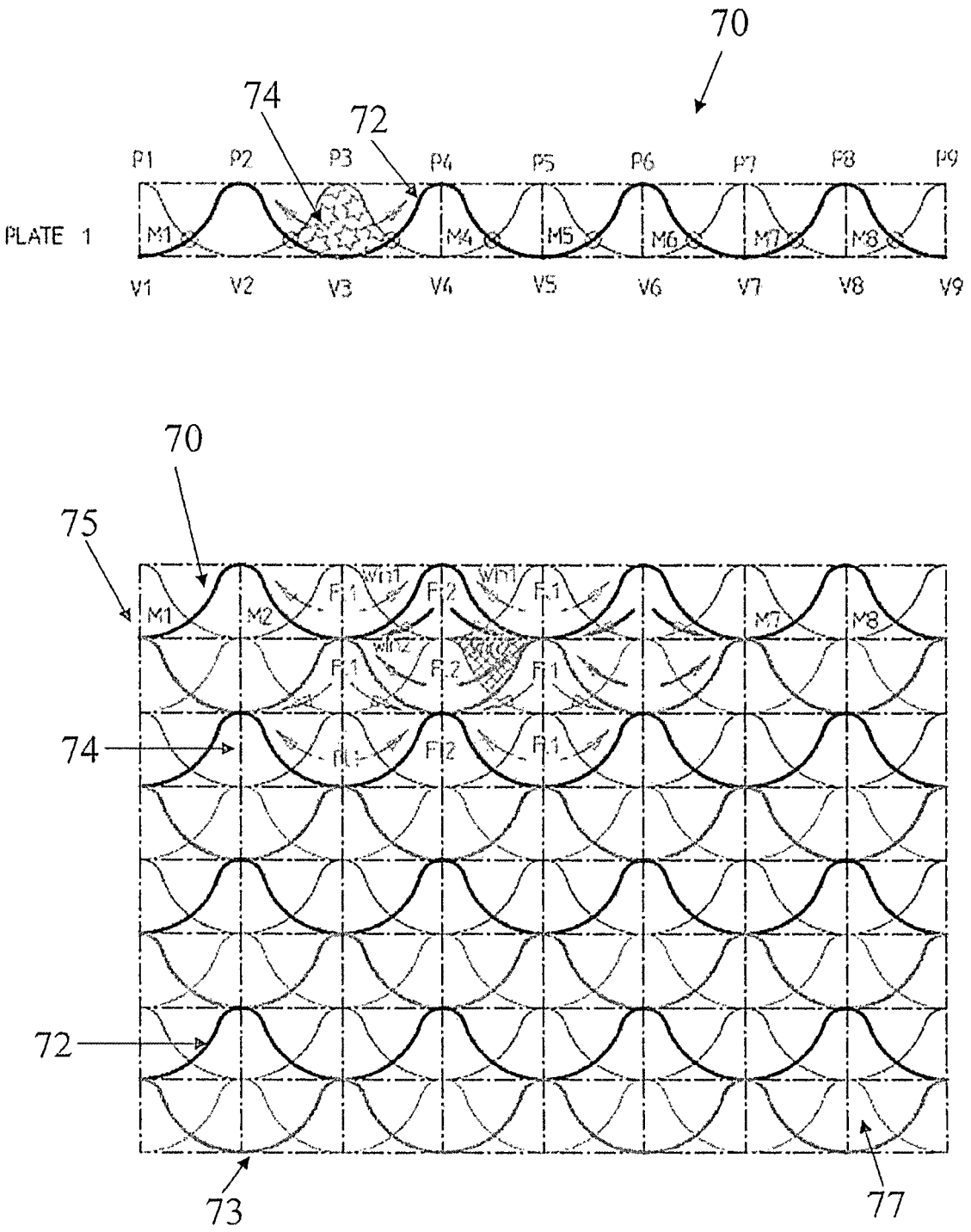
Figure 54:
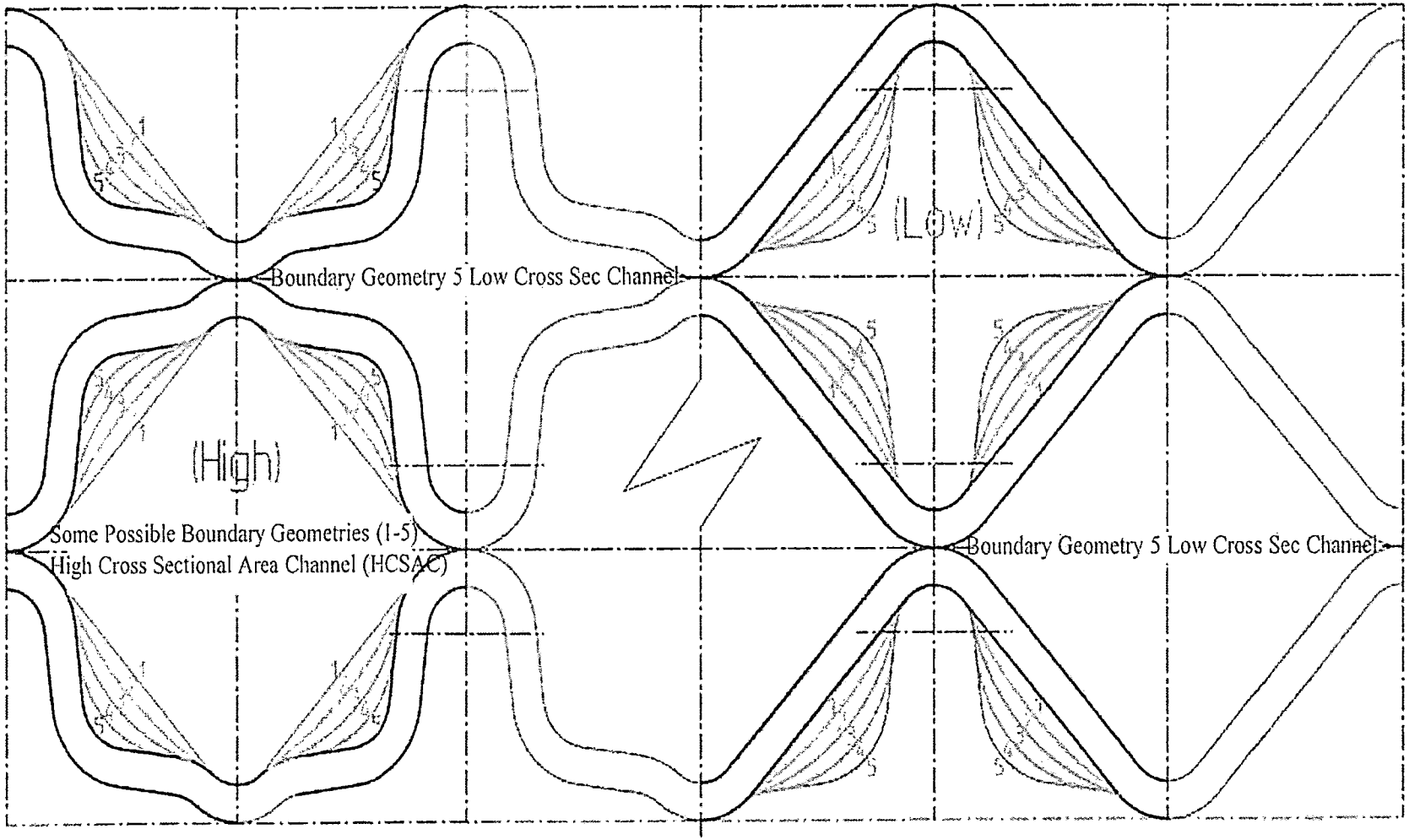
Figure 55:
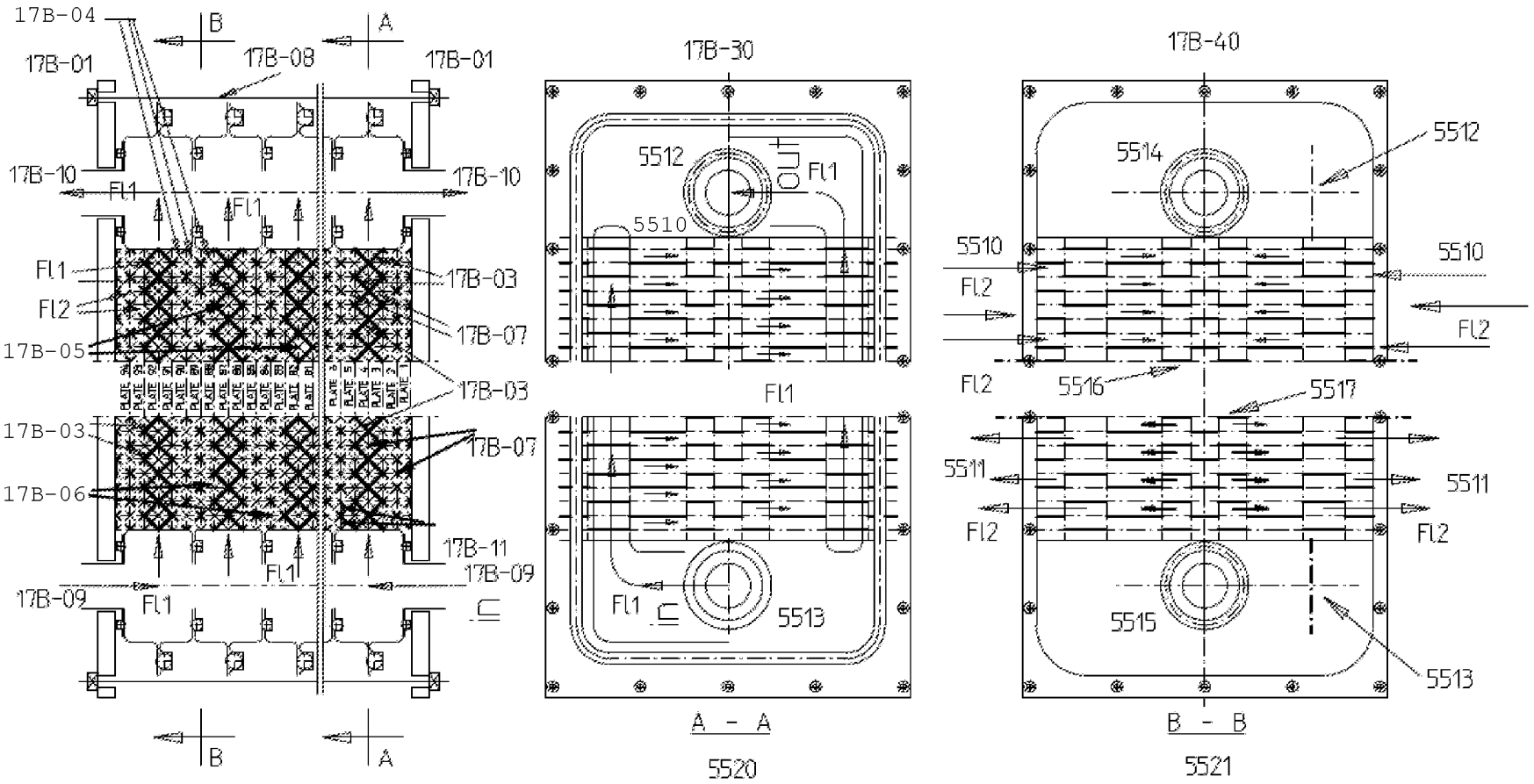

A schematically illustrated plate of a PHE where fluid is flowable across an area between adjacent obstructions. The size of the area can be altered along the length of the adjacent obstructions. A window (e.g. aperture, opening, cross section being open for fluid to flow throughout) is formed at the smallest area bounded by the adjacent obstructions. Fluid 1 is flowable through at least one first type of windows where fluid 2 is flowable through at least one second windows. In a segment, all windows of the first type of windows have similar shape and size. In an embodiment of the invention, all windows of the second type of windows have similar shape and/or size. In another embodiment of the invention, type 1 windows have a different shape from type 2 windows. In an embodiment of the invention, at least one of a group consisting of the type 1 windows and the type 2 windows change size with distance down the plate. By the plates schematically illustrated in the aforethe figures, various embodiments are provided useful: type 1 windows increase in size and type 2 windows decrease in size with distance down the plate. Alternatively, type 1 windows decrease in size and the type 2 windows increase in size with distance down the plate. Further alternatively, type 1 windows increase in size and the type 2 windows increase in size with distance down the plate. Still alternatively, type 1 windows decrease in size and the type 2 windows decrease in size with distance down the plate. Combination of those alternatives is also possible. In an example depicts in the figures (e.g., FIG. 44, wide window 41 and narrow opening 42) at least one of a group consisting of the type 1 windows and the type 2 windows are changing shape and/or size with distance down the plate. Shapes and sizes of the windows of FIG. 44 are illustrated at three different cross section marked A-C, along the 41-42 bore axis.

A stack 110 of four asymmetric plates 120, according to another embodiment, showing eight stages of flow, respectively. Each plate 120 is configured with non-identical protrusions and trenches. While each protrusion 112 is sinusoidal, each trench 113 continuously extending between adjacent protrusions 112 is hollow with a localized recess 116 at the trench centerline. Stack 110 is arranged with two types of interspaces 124 and 126, through which two different fluids, respectively, flow to promote increased heat transfer by virtue of the different interspace geometries. A second fluid flowing in interspace 124 undergoes a relatively high pressure drop and is afforded a relatively high heat transfer coefficient. A first fluid flowing in interspace 126 undergoes a low pressure drop relative to the first fluid and is afforded a relatively low heat transfer coefficient. Within stack 110, a plurality of interspaces 124 are aligned, and a plurality of interspaces 126 are aligned, while a pair of bank portions 118 and 119 is common to an adjoining pair of an interspace 124 and an interspace 126. A star-like interspace 124 is defined within the interior of a pair of oppositely oriented and aligned sinusoidal protrusions 112 and of a pair of oppositely oriented and aligned side protrusions 114, each of which is shaped similarly as a sinusoidal protrusion 112 but narrower and terminating with a slightly pointed end. Each bank of the sinusoidal protrusions 112 is configured with two continuous bank portions, a first adjacent-to-peak bank portion 118 and a second distant-to-peak bank portion 119 defining a portion of a side protrusion 114 and extending to a corresponding recess 116. The centerline of each side protrusion 114 is angularly spaced approximately 90 degrees from the centerline of a protrusion 112. With this arrangement, a first inter-trench abutment region 127 is formed at the abutting peak of a pair of protrusions 112, and a second inter-trench abutment region 128 is formed at the abutment of two side protrusions 114 of adjacent interspaces 124, respectively, converging at a recess 116. A hexagonal interspace 126 is defined within the interior of four pairs of bank portions 118 and 119, which are arranged to form two first inter-trench abutment regions 127 and two second inter-trench abutment regions 128. As can be seen, star-like interspace 124 has a relatively small hydraulic diameter and hexagonal interspace 126 has a relatively large hydraulic diameter. Further on, most upper scheme, the first and second fluids flow in separate channels. Second scheme illustrates the second fluid as it flows through an interspace 124 at the middle of a first segment. Third scheme illustrates the second fluid as it exits the first segment and impinges upon an obstacle 129, after which it is deflected and flows through a window 123. Fourth scheme below illustrates the second fluid as it flows through an interspace 124 at the middle of a second segment which is downstream to the first segment, showing that the trenches of the second segment are transversally offset relative to those of the first segment.

Some possible boundary geometry to high and low cross sections. The two plates can be different from each other in drawing thickness. Geometry, shape, wave width, cross sectional area, sheet thickness etc. A similar plate arrangement, where two plates with different cross-sectional areas and with a shifted phase section. High and low cross-sectional area flow paths provided by two plates, and other geometries with four adjacent plates.

Plate 70 is configured with non-identical protrusions and trenches. While each protrusion 72 is sinusoidal, each trench 73 continuously extending between adjacent protrusions 72 is semicircular. The more extreme upstream segment is shown in bold lines, and the downstream segment is shown with thin lines. An obstruction 74 is bounded from above by a sinusoidal line and from below by a semicircular line, for example an obstruction is delimited by the points M2-P3-M3-V3. The flow is diverted by obstruction 74 to two transversally spaced windows, for example windows P2-M2-P3 and P3-M3-P4.

A stack 75 of eight plates 70 which are arranged such that each interspace 77 is defined by the abutment of an oppositely oriented sinusoidal protrusion 72 and semicircular trench 73. The semicircular trench of a first interspace abuts the peak of the sinusoidal projection of a second interspace. Two similarly oriented obstructions 74 are in mutual abutment while being projected within each interspace 77. All interspaces, obstructions and windows are identical.

An arrangement of two oppositely oriented plates 70 is provided in such a way that each pair of sinusoidal protrusions 72 are in abutting alignment with each other and each pair of semicircular trenches 73 are in abutting alignment with each other.

Stack 80 of eight plates 70 which are arranged with two types of interspaces 81 and 82. An interspace 81 is defined by the abutment of a pair of oppositely oriented sinusoidal trenches, and an interspace 82 is defined by the abutment of a pair of oppositely oriented semicircular trenches. Within stack 80, a plurality of interspaces 81 are aligned, and a plurality of interspaces 82 are aligned, while a portion 91 of a curved peripheral surface is common to an adjoining pair of an interspace 81 and an interspace 82. With this arrangement, oppositely oriented and aligned trenches are in abutment at an inter-trench abutment region 96 or 97, from which extends a plurality of curved peripheral portions 91.

Since oppositely oriented plates 70 are in abutting alignment with each other, a pair of obstructions that are projected into each of interspaces 81 and 82 are also in opposite orientation. Accordingly, the semicircular line 78 of each of a pair of oppositely oriented obstructions 74 projected into an interspace 81 is in abutment with each other at an inter-obstruction abutment region 102. Two small sized rhombic windows 103, i.e. each having an area of approximately 10% the area of an interspace 81, are defined by the remaining area of interspace 81 onto which an obstruction 74 is not projected. Each window 103 occupies the space between inter-obstruction abutment region 102 and an adjacent inter-trench abutment region 97.

Also, the narrow ending line 108 of a sinusoidal line of each of a pair of oppositely oriented obstructions 74 projected into an interspace 82 is in abutment with each other at an inter-obstruction abutment region 106. Two relatively large sized windows 107, i.e. each having an area of approximately 25% the area of an interspace 82, are defined by the remaining area of interspace 82 onto which an obstruction 74 is not projected. Each window 107 occupies the space between inter-obstruction abutment region 106 and an adjacent inter-trench abutment region 96.

This arrangement is conducive to customizing the size of a window through which a fluid is diverted to a downstream transversally offset trench by carefully selecting the configuration of each trench defining the interspace and of the obstruction projected into the corresponding trench. The size of a window is customized according to the given flow characteristics, desired degree of turbulence and temperature of the fluid flowing through the given interspace. The flow characteristics are influenced by the flow rate of the pump delivering the fluid and by the length and width of the trench through which the fluid flows before impinging upon the obstruction.

In one or more plates provided adjacent to the flow path, gas flows.

Wet plates are surrounded an array of flow paths, or alternatively, at least one flow path, which configured to direct flow of gas from one long side (rim) of the plate to the opposite side. Here, from west side of the plate to its east.

Such a stack of plates (fins) is characterized by an increased surface area of the gas side, and transfer the energy (heating or cooling) to the liquid by conduction via the supporting points from plate to plate in the gas plate stack to the wet plate located at the end.

An arrangement that allows for high gas flow and high rate of heat exchange, with respectively low pressure drop.

Wet plates comprise in their perimeter a sealing gasket, which block leakages of the fluids. Every flow path comprises at least one inlet and at last one outlet. Those inlets or outlets may exceed to other flow paths or plates. In between those plates, at least one gas-plates are provided. Those plates may comprise at least one sealed aperture in which liquid is flowing to or from openings in the wet plates.

Gas (dry) plates may be selected from a group consisting of pierced plates, texturized plates, plates comprising guiding members and a combination thereof.

The stack is enforced by various means, e.g., structured plates, configured to transfer the pressure to the tie rods. Tie rods are, e.g., elongated rods configured to both secure the stack and help in heat exchange.

The plate comprises at least two liquid openings (inlets/outlets). Alternatively, plate comprises at least three openings, at least one is liquid opening for liquid for supplying liquid for an evaporator or exciting condensate from a condenser.

Alternatively, gas plates are inserted in between liquid plates. Wet plates are drawn in such a manner that wet plate is supporting adjacent wet plate, and gas plates are located in between the wet plates. In such an arrangement that the dry plates are not located in the area of the openings of the wet plate. One benefit of this arrangement is that the stack is respectively strong, heat exchange is high and constant along time, as compared to known fin-containing heat exchangers.

Figure 56:
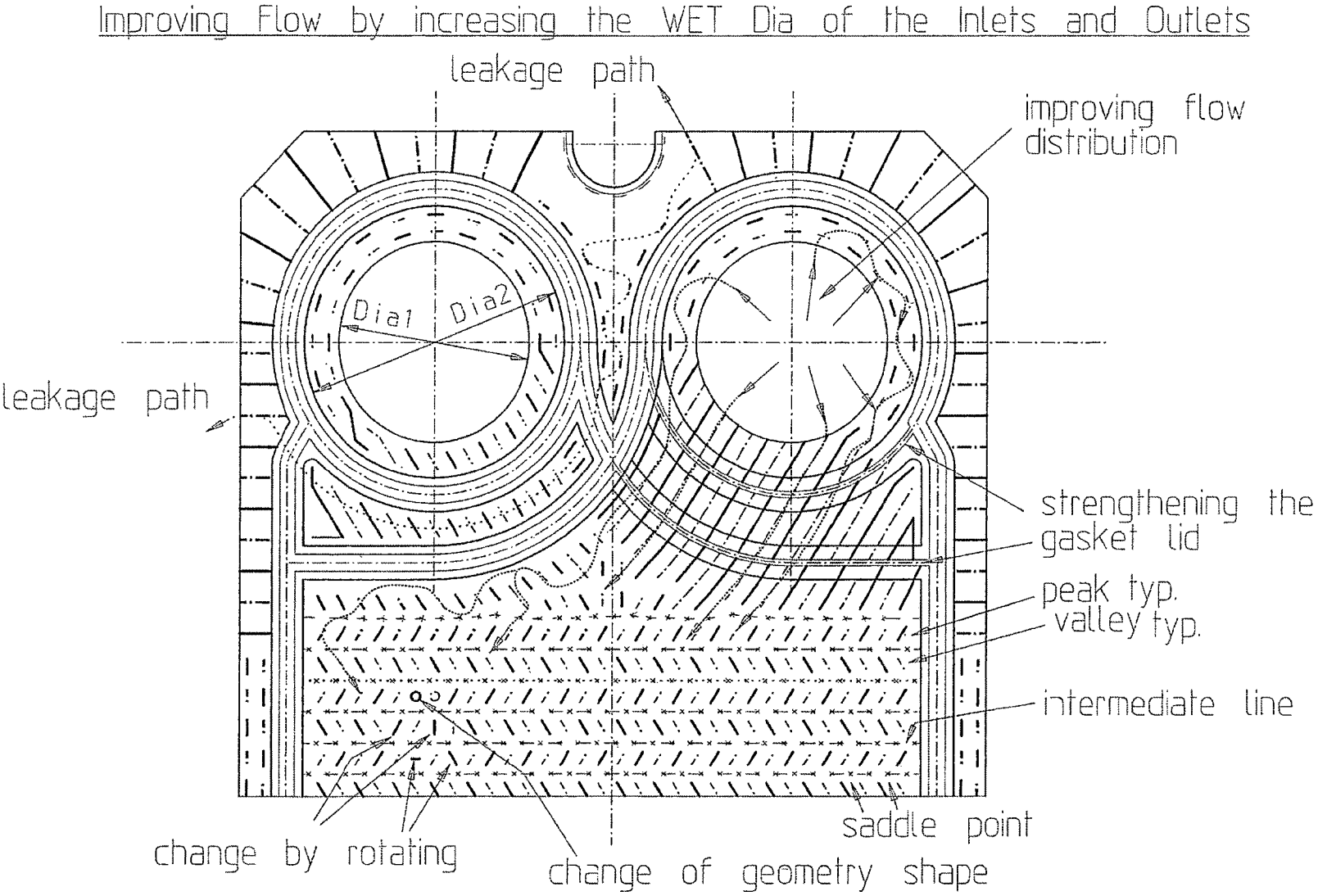

An embodiment of a port is schematically illustrated in FIG. 56. In this novel embodiment of a port, the peaks and valleys around the port that help retain a gasket in position in use, are oriented in an angular direction, head-to-tail around the perimeter of the port. Preferably, adjacent peaks will at least partially overlap so that a high peak-low peak arrangement will encircle the at least a portion of the perimeter of the port. Preferably, the angularly arranged high peak-low peak portion is on the edge side of the port; preferably, the peaks on the plate side of the port are arranged at an angle to the perimeter that is greater than about 10° and less than 90°. The angled arrangement on the plate side allows fluid to seep around the gasket into the interpolate space, while the angular arrangement on the edge side and preferably between the ports minimizes leakage outward but allows slight leakage over the low peaks and toward the center of the plate. The abutment of the high peaks and low peaks strengthens the gasket lid, minimizing bending of the plate in the region of the port and gasket, thereby enabling either higher pressure with the same plate thickness or thinner plates with the same pressures. The stronger support enabled by the high peak-low peak and angled high peaks on the plate side also enable larger ports to be used, thereby increasing throughput of the fluids and/or reducing pressure drop across the system. The diagonal peaks on the plate side also help direct fluid flow, so that the fluid spreads further across the plate in a shorter distance, thereby making more efficient use of the p[late heat exchanger area.

The novel port arrangement can be used with either a conventional arrangement of fluid channels or with any of the novel arrangements of fluid channels disclosed hereinabove. In the exemplary embodiment of FIG. 56, the segments are angled with respect to each other, with obstacles in the TZ at the intermediate lines between the segments.

It is in the scope of the invention wherein a plate heat exchanger comprising at least first, second and third identical stacked plates are disclosed. The configuration of the heat exchanger is customizable to a first fluid flowing across a first flow path defined between the first and second plates and to a second fluid flowing across a second flow path defined between the second and third plates so as to be in heat exchanger relation with the first fluid. Each of the at least first, second and third plates having a first side and a second side and comprising a heat transition zone which is formed with at least one of the following:

I. An asymmetrical wave pattern: an asymmetrical wave pattern comprising cyclically formed crests and troughs arranged such that at least some of the crests is characterized by a different shape than at least some of the troughs which is adjacent thereto; and/or II. A crest-trough abutment region at a peak of each protrusion delimiting one of the crests and troughs. The crest-trough abutment region is positioned in abutting relation with a corresponding crest-trough abutment region of an adjacent plate of the plate heat exchanger to provide an interspace delimited by one of the crests and by one of the troughs of the adjacent plate, and through which the fluid is flowable across one of the flow paths.

In an embodiment of the invention, the second plate is of an opposite orientation than the orientation of the first and third plates such that the second side of the second plate is adjacent to the second side of the first plate, and the first side of the second plate is adjacent to the first side of the third plate.

In an embodiment of the invention, a plurality of first interspaces delimited by a crest of the first plate and a trough of the second plate has a different hydraulic diameter than each of a plurality of second interspaces delimited by a crest of the second plate and a trough of the third plate by virtue of the opposite orientation of the second plate than the orientation of the first and third plates.

It is also in the scope of the invention wherein the heat transition zone is additionally formed with one or more of the following:

i. A plurality of separate segments of transversally contiguous discontinuous trenches. At least some of the discontinuous trenches is longitudinally extending and have a length less than the length of the heat transition zone and is defined by one or more surfaces bounded transversally by two separate protrusions between which the one or more surfaces are interposed. A plurality of segments is arranged in a staggered formation such that all of the trenches of a first segment are transversally offset from all of the trenches of a second segment which is longitudinally adjacent and immediately downstream to the first segment.

ii. A transitional zone between the first and second segments that includes a plurality of transversally adjacent single-surface obstructions arranged such that each of the obstructions is positioned in a fluid path of the fluid exiting the corresponding trench of the first segment, causing the flowing fluid to be deflected by the obstruction into two paths that are directed to two different discontinuous trenches, respectively, included within said second segment; and/or iii. At least some of the obstructions, which are in abutting relation with one of the obstructions of the adjacent plate at an inter-obstruction abutment region which is projected into a corresponding interspace, a window along which the deflected fluid flows being defined by a space projected into the corresponding interspace that is unoccupied by a projected obstruction between the projected inter-obstruction abutment region and an adjacent inter-trench abutment region.

It is also in the scope of the invention wherein size and/or shape of the window defined by corresponding interspace of the first flow path is different than the size and/or shape of the window defined by the corresponding interspace of the second flow path, and is customized in accordance with characteristics of the first fluid.

It is also in the scope of the invention wherein ratio of window area to projected area of the corresponding interspace is different with respect to the first flow path than with respect to the second flow path.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

Example 1

Industrial Cooling of Viscous Petroleum During the Distillation Process

The oil being distilled typically is cooled from a temperature of appx. 100° C. to a temperature of appx. 35° C. utilizing a cooling tower operating at appx. 30° C., followed by further cooling by chilled water. It is advantageous to achieve as low a temperature as possible from the cooling tower stage (as close as possible to the cooling tower water temperature), so that the secondary stage, using chilled water, which requires the operation of chillers resulting in large electricity consumption, will be as small as possible. Petroleum has an exceptionally high viscosity, especially at low temperature, so that laminar flow can be difficult to avoid, resulting in a low oil heat transfer coefficient h and a very high flow resistance.

Using a PHE with plates with asymmetric interspace cross-sectional areas, as described above, can increase heat transfer and lower the pressure drops. The relative flow rate of the oil within the heat exchanger is appx. 30 times lower than that of the water used for its cooling, so that a PHE configuration where the petroleum flows in the small interspaced PHE channels may ensure that the petroleum flow within the PHE will be turbulent, causing a substantial improvement in heat transfer, while retaining an acceptable pressure drop. The cooling water, characterized by a large flow rate, will flow within the large interspace PHE channels, minimizing its pressure drop. In this way, the overall heat transfer rate is improved, relative to a conventional plate heat exchanger of the same size, while the pressure drop is reduced. This implies that the required heat transfer area of a PHE with this novel plate design can be reduced, along with its cost.

Example 2

Thermally Induced Gravity Flow (Thermosiphoning)

In thermosiphoning, one of the fluids flows due to thermally induced gravity flow without the necessity of a pump. For this application type, a PHE with minimal flow resistance is required, as well as a satisfactory heat transfer rate.

Using a PHE with plates with asymmetric interspace cross-sectional areas, as described above, will provide a PHE with minimal flow resistance for the fluid flowing under thermally induced gravity flow (the thermosiphoning side of the PHE).

The invention claimed is:

1. A plate of a plate heat exchanger that comprises a Heat Transition Zone (HTZ), said HTZ comprises at least one area of Extra Low Wavy Zone (ELWZ) with one or more waves and supports, wherein each one of said one or more waves comprises: low peaks (LP') equal to or lower along (Z) axis than peaks (P'); low peaks (LP") equal to or lower along (Z) axis than peaks (P"); high valleys (HV'), equal to or higher along (Z) axis than valleys (V'); and high valleys (HV"), equal to or higher along (Z) axis than valleys (V"), wherein:

said one or more waves generally oscillate to a north of the plate;

said ELWZ is characterized by waves which take any shape, wavelength, direction and amplitude while lying between a peak plane and a valley plane, ELWZ waves are either evenly spaced or irregularly spaced, leaving any vertical space, also denoted by window, between the ELWZ low peaks and the peak plane, or between the ELWZ high valleys and valley plane; waves in the ELWZ are either identical in direction and/or amplitude or different from one another in direction and/or amplitude;

said ELWZ comprises protrusions rising to peak plane height b and depressions falling to valley plane height 0 taking any shape, said protrusions and depressions provide extra said supports;

when ELWZ waves have low peaks (LP) lines and high valleys (HV) lines taking a zigzag form, such points of support are found where the lines zigzag, i.e., in every second change of angle, such that peak points in one peak line and valley points in an adjacent valley line lay on the same line when projected onto the valley plane, and approximately straight lines connecting said peak point of support and an adjacent valley point of support proved extra support for said ELWZ; and said LP lines and HV lines taking a zigzag form generally transversally.

2. The plate of claim 1, wherein an x-y center of oscillation plane around which said waves oscillate, is either constant in height or varying in any direction, wherein:

when said center of oscillation decreases or increases along a segment S(n), a change in cross-section is provided along said segment; in areas where said center of oscillation is lower along z axis, fluid flowing above said plate has a larger cross-section and fluid flowing below said plate has a smaller cross-section; and in areas where said center of oscillation is higher along z axis, fluid flowing above said plate has a lower cross-section and fluid flowing below said plate has a larger cross-section.

3. The plate of claim 1, wherein each portion of said ELWZ is in any angle relative to north.

4. The plate of claim 1, wherein all of said points of support laying under the same line are the points of support of adjacent low peak and high valley in the particular zigzag form.

5. The plate of claim 1, wherein along a line of high peaks or low peaks, or along a line of low valleys are positions for a downward supporting point, or along a line of low peaks, or along a line of high valleys are positions for an upward supporting point.

6. The plate of claim 1, wherein said zigzag form comprises abrupt obstacles, i.e., increase of height, which provide a continuous and uninterrupted helical, spiral, screw movement which combines rotation with translation which decrease pressure drop.

7. The plate of claim 1, wherein said ELWZ is characterized by having lower-most portions denoted as 'valleys' (V), as well as higher-most portions denoted as 'peaks' (P), and mid-height intermediate portions, which include low peaks (LP) that are lower than the higher-most peaks of the pattern and high valleys (HV) that are higher than the lower-most valleys of the pattern, wherein:

said low peaks (LP) and high valleys (HV) have a shape comprising a circle, line, triangle, dot, or any other geometrical form;

said peaks (P), low peaks (LP), valleys (V), and high valleys (HV) refer to an initial orientation of the plate;

said plate's upper side, above the plate material, is denoted by (') or (U), while the plate's lower side, below the plate material, is denoted in this application by (") or (D), wherein the plate's lower side is hidden from view in a perspective of a top view, and for clarity, for any orientation of the plate, an excursion pointing upward (+Z direction) is called a "protrusion" and an excursion facing downward (−Z direction) is called a "depression".

8. The plate of claim 1, wherein said supports are extended into said points of support.

9. The plate of claim 1, wherein said supports are angled with respect to each other so that they touch along only part of their highest region.

10. A plate heat exchanger comprising 3 or more symmetric plates according to claim 1, wherein a symmetric plate is defined by having flow paths and/or windows, with a shape, size, direction and cross-section area (A1) above the plate, being the same from flow paths and/or windows, with a shape, size, direction and cross-section area (A1) below the plate, wherein:

when three symmetric plates are stacked together for use in a heat exchanger, with a middle plate shape rotated 180 degrees about the Z axes of the plate plane (relatively to the plates above and below), forms a flow channel between a below first symmetric plate and the middle symmetric plate provides an equal shape, size and cross-section area (A1+A1), as a flow channel between the middle symmetric plate and the third plate (A1+A1), and creating an equal geometrical form to the channels of Fluid 1 and of Fluid 2.

11. A plate heat exchanger comprising 3 or more asymmetric plates according to claim 1, wherein an asymmetric plate is defined by having flow paths and/or windows, with a shape, size, direction and cross-section area (A1) above the plate, being different from flow paths and/or windows, with a shape, size, direction and cross-section area (A2) below the plate, wherein:

when three asymmetric plates are stacked together for use in a heat exchanger, with a middle plate shape rotated 180 degrees about the Y axes of the plate plane, forms a mirror shape plate (relatively to the plates above and below), a flow channel between a below first asymmetric plate and the middle asymmetric plate provides a different shape, size and cross-section area (A1+A1), than a flow channel between the middle asymmetric plate and the third plate (A2+A2), and creating an unequal geometrical form to the channels of Fluid 1 and Fluid 2.

12. The plate heat exchanger of claim 10, further comprising sealings as gaskets, welding or brazing, between two adjacent plates.

13. The plate of claim 1, wherein said one or more waves reach the entire length of the heat transition zone (HTZ).

* * * * *